US012390011B2

(12) United States Patent
Junge

(10) Patent No.: US 12,390,011 B2
(45) Date of Patent: Aug. 19, 2025

(54) MODULAR COMPONENT ASSEMBLY

(71) Applicant: fiVO Design, Inc., Andover, MA (US)

(72) Inventor: Stewart Junge, Boxford, MA (US)

( * ) Notice: Subject to any disclaimer, the term of this patent is extended or adjusted under 35 U.S.C. 154(b) by 51 days.

(21) Appl. No.: 18/200,902

(22) Filed: May 23, 2023

(65) Prior Publication Data

US 2023/0301431 A1 Sep. 28, 2023

Related U.S. Application Data

(63) Continuation-in-part of application No. 17/218,062, filed on Mar. 30, 2021, now Pat. No. 11,653,756.

(51) Int. Cl.
*A47B 96/20* (2006.01)

(52) U.S. Cl.
CPC ..... *A47B 96/20* (2013.01)

(58) Field of Classification Search
CPC ... A47B 96/20; A47B 47/042; A47B 47/0025; F16B 12/08
USPC ..... 108/180, 158.12, 159, 60, 61; 220/4.28, 220/615, 682, 690; 297/440.13, 440.1; 312/257.1, 265.5, 107, 108, 263
See application file for complete search history.

(56) References Cited

U.S. PATENT DOCUMENTS 4,155,131 A * 5/1979 Harris ..... A47C 19/005 312/263
5,011,228 A * 4/1991 Marcantel ..... A47B 85/00 297/440.13
10,575,649 B2 * 3/2020 Pelletier ..... A47C 4/021
11,653,756 B2 * 5/2023 Junge ..... E04B 2/7405 108/180
2012/0279428 A1 * 11/2012 Brandenberg ..... A47B 3/06 108/158.12
2019/0059594 A1 * 2/2019 Davis ..... F16B 12/125
2022/0007856 A1 * 1/2022 Rose ..... E05G 7/004

FOREIGN PATENT DOCUMENTS

FR 2974604 A1 * 11/2012 ..... A47B 47/042
GB 2353080 A * 2/2001 ..... A47B 13/04
WO WO-2014198991 A1 * 12/2014 ..... A47B 47/0066
WO WO-2021215997 A1 * 10/2021 ..... A47B 47/0075

OTHER PUBLICATIONS

WO2013198991 with English translation (Year: 2014).*
Hoek wb page, https://hoekhome.com/collections/home-office/products/home-office-desk, retrieved Sep. 29, 2023, "created_at":"2022-07-20T10:02:41-04:00".

(Continued)

*Primary Examiner* — Janet M Wilkens

(57) ABSTRACT

A modular frame assembly, comprising a first lateral frame member including a first end, the first end including a flange portion extending from a longitudinal axis of the first lateral frame member; a first side frame member including one or more receiving members; and wherein the one or more receiving members being sized and aligned to receive the flange portion to cooperatively secure the first lateral frame member and first side frame member together; and where the flange non-deformably cooperatively connects with the one or more receiving members.

17 Claims, 69 Drawing Sheets

(56) References Cited

OTHER PUBLICATIONS

Thuma web page, https://www.thuma.co/products/the-bed?variant=7550696456220, retrieved Sep. 29, 2023, createdAt:"2023-08-02T17:15:31.530Z".
Work From Home Desks, https://workfromhomedesks.com/collections/wooden-standing-and-home-office-desks, retrieved Sep. 29, 2023, published_at":" 2022-08-31T20:32:45-07:00.

* cited by examiner

MODULAR COMPONENT ASSEMBLY

STATEMENT REGARDING FEDERALLY SPONSORED RESEARCH OR DEVELOPMENT (Not Applicable)

BACKGROUND

Panel assemblies have been used for a number of years. Panel assemblies have been constructed through the use of magnetic frames, brackets and other fastening members. Panels may be joined together to form barriers, walls, enclosed spaces and furniture.

Such panel joining methods are often complicated, time-consuming, and burdensome for an end user to assemble or disassemble and require a variety of tools to connect or disconnect the panels, thereby creating an unwieldy and cumbersome environment. Such joining methods also create sequencing problems thereby delaying proper assemblage as well as alignment problems which result in the inadvertent disengagement, breakage of the panels, and opportunities for error. As a result, panel assemblies may be difficult to assemble and, if possible, disassemble. Additionally, such assembling difficulties may prevent reassembly of the panel assemblies once disassembled. Still further, such panel assemblies may not be able to be varied or adapted for different configurations and for different sized users.

In a similar situation, modular furniture may be difficult to assemble and disassemble due to complicated connection devices or fixtures. Modular furniture such as desks, beds, storage containers, tables and the like suffer from this difficulty to assemble and disassemble the modular structures. It is also difficult, if not impossible, to add additional components to the modular furniture so as to have multiple desks, beds, storage containers, tables and the like cooperatively connected to form a further extension of the modular furniture.

SUMMARY

Accordingly, there has been an unmet need to provide a system and method for assembling, disassembling and reconfiguring modular panel assemblies and modular furniture in a swift, efficient, and tool-free manner. Discussed herein are various examples of modular interlocking panels and modular furniture components which enable various and adaptable panel configurations and modular furniture to be cooperatively secured and fixed in place. The disclosed assembly and method provides improved modularity and configuration advantages. The panels and furniture of the modular assembly may be easily assembled, reassembled and reconfigured without the use of any tools or connecting devices, and without requiring any skilled labor to do so. Still further, the panels and furniture of the disclosed assembly may be easily reconfigured for transient use by end users of all ages. The panel assemblies and furniture may be quickly, and single handedly, disassembled and reconfigured for use by a toddler, adolescent, or adult, individually or together, or stored for purposes of space optimization or future use.

Accordingly, there is a need for a modular frame assembly that can be easily assembled, disassembled and reconfigured by a single user in numerous different arrangements for use in all commercial and residential settings.

In some examples, the frame assembly is configured as a modular barrier assembly. In particular, the modular barrier assembly may be used to respond to various health and safety codes regulating the display of food or to various environmental safeguards attempting to minimize the spread of airborne particles in the environment.

In some examples, the frame assembly is configured as various pieces of furniture of the type described herein that would be light in weight, easily handled, very durable, and cooperatively secured together without the need for screws, bolts, or other connectors. Such furniture could be assembled and disassembled, stowed for storage or transport, and easily cooperatively secured together to form numerous different configurations.

Examples of the lightweight modular assemblies include beds, utility tables, inclined tables, modular storage units, and other modular constructions. These modular constructions may be extended in an X, Y, or Z direction through cooperative connections between other modular assemblies utilizing the flanges of one modular component fitting into the connecting slots of another modular component. The connecting slots are configured to be cut completely through the modular component from one side to another side and are configured to be completely enclosed or partially enclosed.

In the example of the modular assembly that forms a bed, there is a proximal end of the bed and a distal end of the bed. The proximal end of the bed and the distal end of the bed may be utilized differently. For instance, a stacked frame assembly may be constructed at the proximal end of the bed and an modular outrigger component or table may be constructed at the distal end of the bed. The proximal end of the bed may also be called the head of the bed and the distal end may also be called the foot of the bed.

In the example of a modular assembly that forms a table, the table may be comprised of multiple horizontal planes that are cooperatively connected to the modular assembly. The horizontal planes may also be fitted to the top of the modular assembly and held in place at the edges of the horizontal plane by modular components configured to accept the horizontal plane. The horizontal plane may also be fixedly attached to the modular assembly through the use of attachment devices such as locking cams that form an interference fit between the horizontal plane and the modular assembly. The locking cam or locking cams may have a curved surface that form a tighter interference fit as they are rotated into a connecting slot.

According to one embodiment of the invention, a modular frame assembly has a first lateral frame member including a first end including a flange portion extending from a longitudinal axis of the first lateral frame member. The assembly further includes a first side frame member including a longitudinal column defining one or more receiving members. The one or more receiving members are sized and aligned to receive the flange portions to cooperatively secure the first lateral frame member and first side frame member together.

According to another embodiment of the invention, a modular frame assembly has a first and second lateral frame member each having a first end, a second end, and a transverse portion extending therebetween. The first end and second end include a flange portion extending downward from a longitudinal axis of the first and second ends. The transverse portion includes an upper edge. A first and second side frame member each comprises a first end, a second end, and a cross panel extending therebetween. The first and second end include a lateral column defining one or more receiving members to receive the flange portions of the first and second lateral frame members. A top planar member has an upper surface and lower surface. The lower surface of the top planar member includes two elongated chambers to receive the upper edges of the transverse portion of the first and second lateral frame members. The top planar member also includes at least two parallel edges where the at least two parallel edges are within the confines of the modular frame assembly. As an example, the top planar member may be a desk top or a table top with a square or rectangular shape where the square or rectangular shape has at least two of the parallel sides confined within the modular frame assembly and the other two parallel edges are not confined within the modular frame assembly. Alternatively, in another configuration, all four sides of the square or rectangle are confined within the confines of the modular frame assembly. In one example, the top planar member is confined by modular components configured to have a tab at the end of the linear surface such that the tab confines the edge of the top planar member.

In some embodiments, methods of forming a modular frame assembly are provided. In one embodiment, a method of forming a modular frame assembly is provided comprising the steps of providing a first lateral frame member, wherein the first lateral frame member includes a first end having a flange portion extending from a longitudinal axis of the first end operable to be cooperatively secured. A first side frame member is provided including one or more longitudinal columns defining one or more receiving members sized to receive the flange portion of the first lateral frame member. The flange portion of the first lateral frame member is aligned with the one or more receiving members of the first side frame member. The flange portion of the first lateral frame member is inserted into the one or more receiving members of the first side frame member to cooperatively secure the first lateral frame member to the first side frame member.

In another embodiment, a method of forming a modular frame assembly is provided comprising the steps of providing a first and second lateral frame member, wherein the first and second lateral frame members include a first end, a second end, and a transverse portion extending therebetween. The first end and second end of the first and second lateral frame members include a flange portion extending downward from a longitudinal axis of the first and second ends. The transverse portion includes an upper edge. A first and second side frame member are provided each including a first end, a second end, and a cross panel extending therebetween. The cross panel or panels may form a wall or walls. Multiple walls may form an enclosure. The cross panel or panels may also form partitions. These partitions may be utilized to segment working areas or commercial exposition areas such as in an office or trade show. The modular frame assembly may also be utilized to form room dividers where a single or multiple dividers be utilized to create smaller sections of a room area. The first and second end of the first and second side frame members include a lateral column defining one or more receiving members sized to receive the flange portions of the first and second lateral frame members. A top planar member having an upper surface and a lower surface is provided. The lower surface of the top planar member includes two elongated chambers to receive the upper edges of the transverse portion of the first and second lateral frame members. The flange portion of the first end of the first lateral frame member is aligned with and inserted into the one or more receiving members of the first end of the first side frame member to cooperatively secure the first lateral frame member to the first side frame member. The flange portion of the second end of the second lateral frame member is aligned with and inserted into the one or more receiving members of the second end of the first side frame member to cooperatively secure the second lateral frame member to the first side frame member. The flange portion of the second end of the first lateral frame member is aligned with and inserted into the one or more receiving members of the first end of the second side frame member to cooperatively secure the first lateral frame member to the second side frame member. The flange portion of the first end of the second lateral frame member is aligned with and inserted into the one or more receiving members of the second end of the second side frame member to cooperatively secure the second lateral frame member to the second side frame member. The elongated chambers on the lower surface of the top planar member are aligned with and positioned into the upper edges of the transverse portions of the first and second lateral frame members to secure the top planar member onto the first and second lateral frame member.

In other embodiments, modular frame assemblies are provided, and methods of forming other modular frame assemblies, wherein multiple lateral frame members are adapted to be cooperatively secured to a plurality of lateral frame members and/or side frame members. In preferred embodiments, the modular frame assemblies are provided in an assembled state to form a barrier guard. In other preferred embodiments, the modular frame assemblies are provided in an assembled state to form furniture, such as desks, desks with shelf assemblies, chairs, and other pieces of furniture.

The modular frame assembly may be composed of any useful and durable material, including wood, plastic, glass, metal, textile or other suitable materials. Plastics that may be used include polycarbonate, polyethylene, impact resistant nylon and glass filled nylon. The material may be configured to be weather resistant, and may be provided in a number of colors.

BRIEF DESCRIPTION OF THE SEVERAL VIEWS OF THE DRAWINGS

The subject matter is described in greater detail below, with reference to the accompanying drawings, in which:

FIG. 8*i* is a perspective view of an alternate modular frame assembly in the configuration of a plurality of desks;

DETAILED DESCRIPTION

Figure 1A:
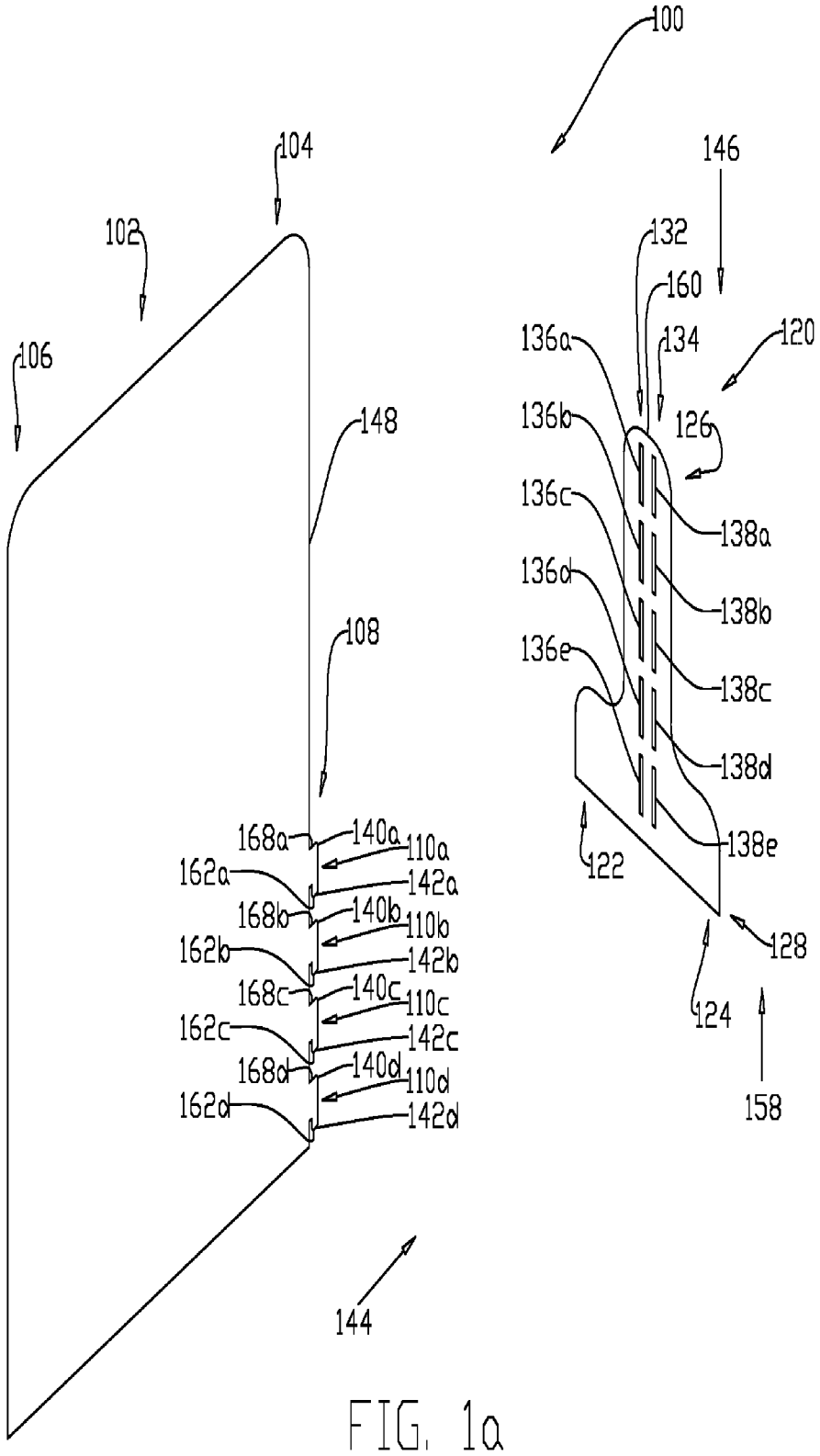
FIG. 1*a* is a perspective view of an example implementation according to the present disclosure.

Referring to the drawings, FIGS. 1 through 36*b*, in which like elements are provided having like reference designations throughout the several views, an example implementation of a modular frame assembly is illustrated.

The modular frame assembly as used herein is constructed in whole or in part from any suitable material including, but not limited to a wood, glass, plastic, acrylic, metal, composite, or other durable material, sufficiently rigid and having sufficient strength, while being light weight, shatterproof, with suitable waterproofing as appropriate for the intended use. In one embodiment, the device comprises a frame assembly constructed from a plastic material, such as polycarbonate. The polycarbonate comprising the frame assembly provides for transparency, enabling a virtually invisible barrier. It is contemplated that the frame assembly may be easily assembled and reconfigured by a single user as needed. It is also contemplated that the frame assembly may be easily disassembled for replacement in the event of a scratch or damage to any of the members.

In another embodiment, the frame assembly is constructed from a durable material, such as wood. The wood comprising the frame assembly can be of various densities, including but not limited to balsam fir, spruce and white pine. In another embodiment, the frame assembly is constructed from plywood, engineered material, or engineered substrate. The frame assembly provided has structural characteristics such that the frame assembly has the capability of being light weight, (e.g., from about approximately 2 pounds to about approximately 15 pounds, typically from about approximately 5 pounds to about 11 pounds) thereby enabling a single user to easily lift, configure, assemble, disassemble and reconfigure, the frame assembly as desired.

The modular frame assembly may be used for barrier guards and methods for their construction and use. In particular, the modular frame assembly may be used to respond to various health and safety codes regulating the display of food or to various environmental safeguards attempting to minimize the spread of airborne particles in the environment. The use of a barrier guard placed between an individual and food, or between two individuals, serves to respond to such regulations and other safety concerns regarding airborne particle transmission. The barrier guards may be used in any environment, including schools, doctor's offices, point of sale counters in retail stores, bars and restaurants, etc. They also may be used in settings having a taller transaction top such as a banks, open concept office spaces and on conference tables. The transparent material of the frame assembly provides a virtually invisible in which a circulation of air is impeded.

Advantageously, some of the features of the frame assembly may be used to adjust the height and/or configuration of the barrier guard. For example, the position of the frame members may be adjusted by being cooperatively secured to side members having various sizes and configurations. Additionally, an unlimited number of frame members may be cooperatively secured together to create a near seamless barrier for expanded barriers and transaction tops. Still further, the frame members may be assembled and reassembled into numerous different configurations depending on the use of such barriers in a commercial setting where people interact with each other. Advantageously, the frame assembly as disclosed is light weight and may be easily and swiftly assembled in any configuration as needed, and disassembled as frequently as desired.

In still further embodiments, the frame assembly may be used for furniture of the type described herein that would be light in weight, easily handled, durable, and interlocked together, resisting disengagement, without the need for screws, bolts, or other connectors. Further, such furniture could be assembled and disassembled, stowed for storage or transport, and easily interlocked together by a single user to form numerous different configurations. Similar to the benefits of the frame assembly when used as a barrier guard, the frame assembly configured as furniture, such as desks, shelves, chairs, etc., enables a user to adjust the height of the desktop or seat portion of a chair by the selective repositioning of side members between a series of longitudinally selected positions. Additionally, an unlimited number of frame members may be engaged and interlockingly or cooperatively connected or fixed together for a seamless and expanded row of desks, chairs, etc.

The frame members may also be manufactured in any dimensional size, as well as in custom sized combinations, with custom selected variable positions, as desired by an end user. Thus, for example and without limitation, such frame members can have heights of about approximately 12" to about approximately 96". The illustrated configuration and dimensions are shown to provide one embodiment of the present disclosure. For use as a child's toy, such frame members can have heights of about approximately 1" to 24". It is recognized that various modifications to the configuration and dimensions are contemplated by the present disclosure.

Still further, the modularity of the frame assembly is illustrated by utilizing the same limited number of similar or identical frame members to assemble and reassemble a variety of different configurations depending on the desired use of such furniture. For example, the frame assembly used as a desk for an adult may be quickly, and single handedly, disassembled and reconfigured for use as a desk by a toddler or adolescent. Utilizing additional frame members similar or identical to those used to form a first desk, a toddler desk may be assembled alongside an adult sized desk, thereby optimizing the ease of assembly, the use of frame members, as well as the space required for such configurations.

In a first family of embodiments, referring to FIG. 1*a*, a modular interlocking frame assembly 100 is illustrated including at least one lateral frame member 102 including a first end 104 and a second end 106 opposite to the first end 104. The first end 104 includes at least one flange portion 108 having a downwardly extending L-bend connector 110*a-d* along the longitudinal axis of the first end 104 of lateral frame member 102.

The modular assembly components may have the same number of L-bend connectors or may have odd and even number of L-bend connectors. The odd or even number of L-bend connectors facilitates the connection of multiple modular components to a single column of slots where the odd and even L-bend connectors are configured to connect to opposite sides of a column of slots by utilizing alternating slots that connectively match the odd or even L-bend connector configurations. This alternating connectivity allows for expansion of the modular frame assembly in an X, Y, and/or Z plane. The L-bend connectors may be non-deformably connected with the connecting slots. A non-deformable connection means that the L-bend connectors are configured to pass freely through connecting slots without any compression or dimensional change of the L-bend connector when passing through the connecting slot in a horizontal direction or when locking into place in a vertical direction.

Figure 1B:
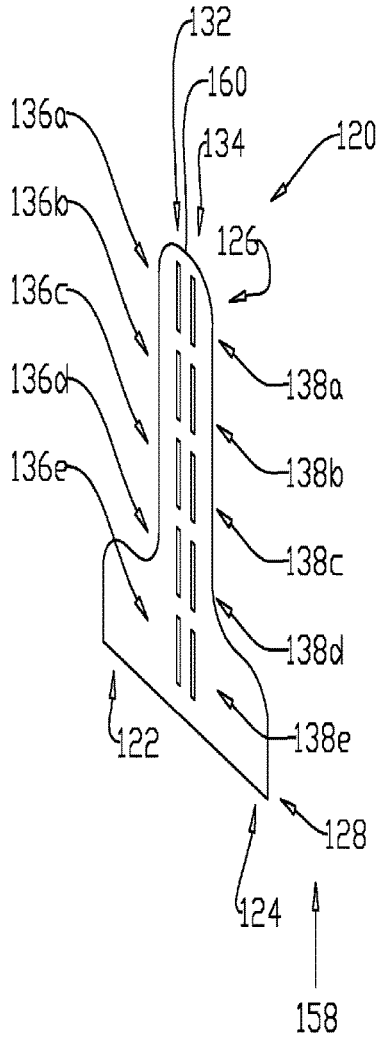
FIG. 1*b* is a perspective view of a side frame member according to the present disclosure.
Figure 1C:
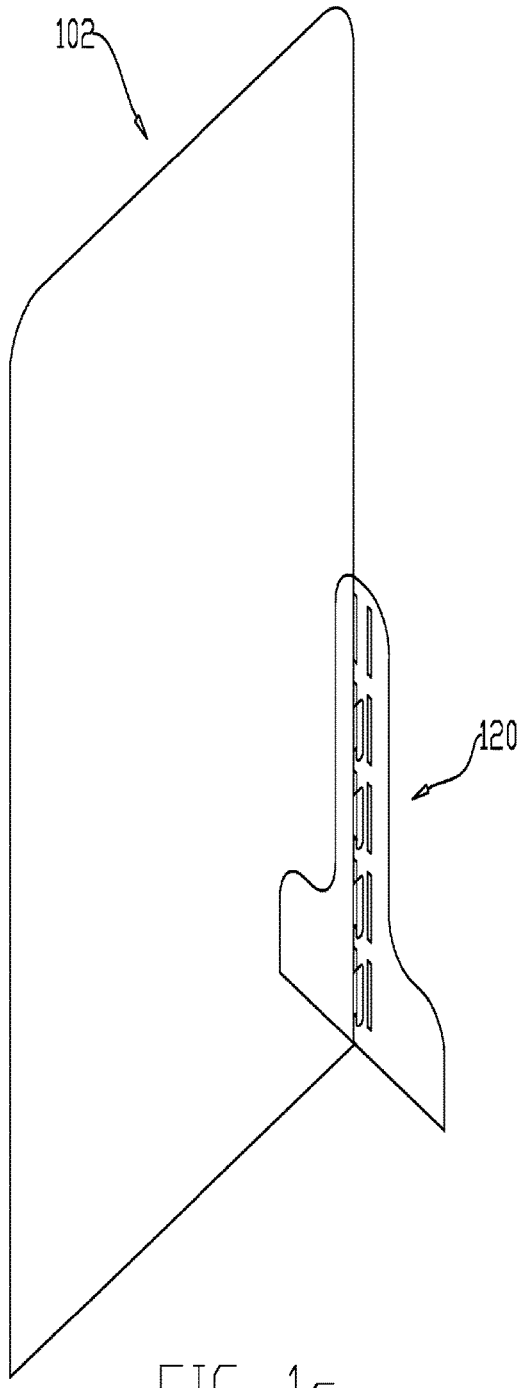
FIG. 1*c* is a perspective view of an example implementation according to the present disclosure.
Figure 1D:
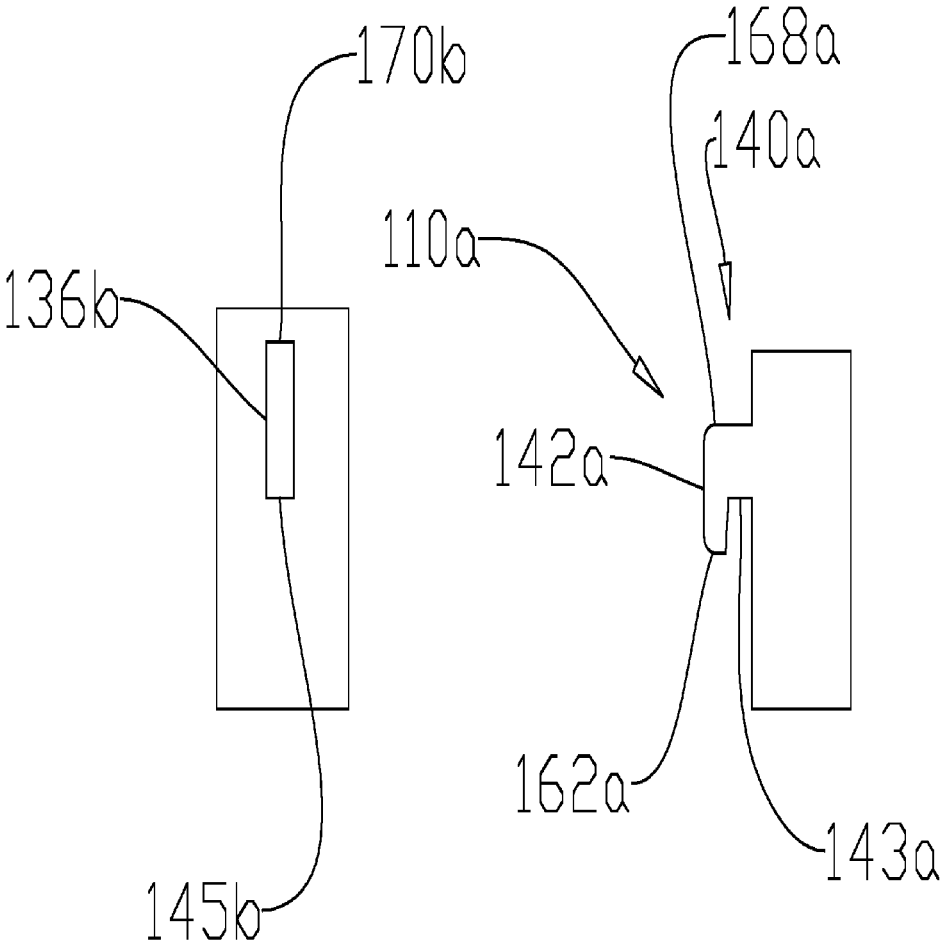
FIG. 1*d* is a perspective view of a locking mechanism according to the present disclosure.

The frame assembly 100 further includes at least one side frame member 120, as illustrated in FIG. 1*a*, including a first end 122 and a second end 124 opposite to the first end 122. The side frame member 120 further includes an outer surface 126 and a thickness 128. The side frame member 120 includes one or a plurality of receiving members, or slots. Receiving members may be configured in an arrangement such that the receiving members are aligned in one or more columns or offset from each other, parallel or skewed, in close or distant proximity, equal or different distance apart, or symmetrical or asymmetrical from each other. In an embodiment, as illustrated in FIGS. 1*a* and 1*b*, the receiving members are centrally disposed in columns 132, 134, each having five rectangular receiving members, or slots, 136*a-e*, 138*a-e*, respectively, however any number of slots can be provided. It is contemplated that the slots 136*a-e*, 138*a-e* may have any geometrical configuration, including but not limited to square, trapezoid, triangular, circular or oval. As illustrated in FIGS. 1*a*-1*c*, the slots 136*a-e*, 138*a-e* are aligned to receive the L-bend connectors 110*a-f* of flange portion 108 of first end 104 of lateral frame member 102 to secure the lateral frame member 102 to the side frame member 120 so as to form the barrier frame assembly such as shown in FIG. 1*c*.

Referring to FIG. 1*a*, the flange portion 108 includes a column of a plurality, e.g., four adjacent L-bend connectors 110*a-d*, however, any number of L-bend connectors can be provided. In alternative embodiments, the flange portion may include L-bend connectors configured in an arrangement such that the L-bend connectors are aligned in one or more columns or offset from each other, parallel or skewed, in close or distant proximity, equal or different distance apart, or symmetrical or asymmetrical from each other. In an embodiment, as illustrated in FIGS. 1*a*-1*f*, each of four L-bend connectors 110*a-d* includes a longitudinal protrusion 140*a*-140*d* and a substantially perpendicular downward extending locking tab 142*a-d*. As shown in FIG. 1*a*, the locking tab 142*a-d* may be angled at approximately between 90 to 95 degrees from the bottom of a horizontal portion 143*a* of the longitudinal protrusion 140*a*. In use, the lateral frame member 102 is cooperatively secured with the side frame member 120 by positioning the lateral frame member 102 such that its flange portion 108 is aligned with a longitudinal column 132, 134 of the side frame member 120. Either longitudinal column 132 or 134 may be utilized as desired. Accordingly, each of the four L-bend connectors 110*a-d* may be aligned with the slots 136*a-e* or 138*a-e* of column 132 or 134, respectively.

The L-bend connectors on the flange of a first modular assembly component are cooperatively connected or coupled with the slots in a second modular assembly component. The first and second modular frame components are cooperatively connected or coupled by moving at least one of the L-bend connectors of the first modular assembly component horizontally through the slots in the second modular assembly component such that the locking tab of the at least one L-bend connector protrudes beyond the opposite side of the slot and then moving the at least one L-bend connector vertically such that the locking tab of the at least one L-bend connector forms an interference fit with the second modular frame component.

In an embodiment as shown in FIG. 1*a*-1*e*, with the alignment of the longitudinal protrusions 140*a*-140*d* with slots 136*b* through 136*e*, the bottom portion 150 of lateral frame member 102 remains abutting the horizontal mounting surface 156. In use, as illustrated in FIGS. 1*a*-1*e*, to secure the lateral frame member 102 to the side frame member 120, the longitudinal protrusions 140*a*-140*d* are aligned with slots 136*b*-136*e*, and the longitudinal protrusions 140*a*-140*d* are inserted into the respective slots 136*b*-136*e* in direction 144 until the locking tabs 142*a*-142*d* and longitudinal protrusions 140*a*-140*d* pass through the thickness 128 of the side frame member 120 and protrude through the respective slots 136*b*-136*e* such that the horizontal portion 143*a* engages onto the bottom portion 145*b* of slot 136*b*. The L-bend connectors 110*a-d* are then pressed downwardly by a user pressing the lateral frame member 102 in the direction of gravity as indicated by arrow 146. Alternatively, the side frame member 120 may be pulled upward in the opposite to the direction of gravity as indicated by arrow 158. These actions cause the downwardly extending locking tabs 142*a*-142*d* of L-bend connectors 110*a-d* to be mechanically captured by the outer surface 126 of side frame member 120 directly beneath the slots 136*b*-136*e* while engaging the longitudinal protrusions 140*a*-140*d* in slots 136*b*-136*e*. The forward edge 148 of the first end 104 of lateral frame member 102 thus becomes releasably and securely mechanically interlocked with the side frame member 120. In use, each of the L-bend connectors 110*a-d* may be secured and released from the slots 136*b*-136*e* singularly or simultaneously.

Figure 1E:
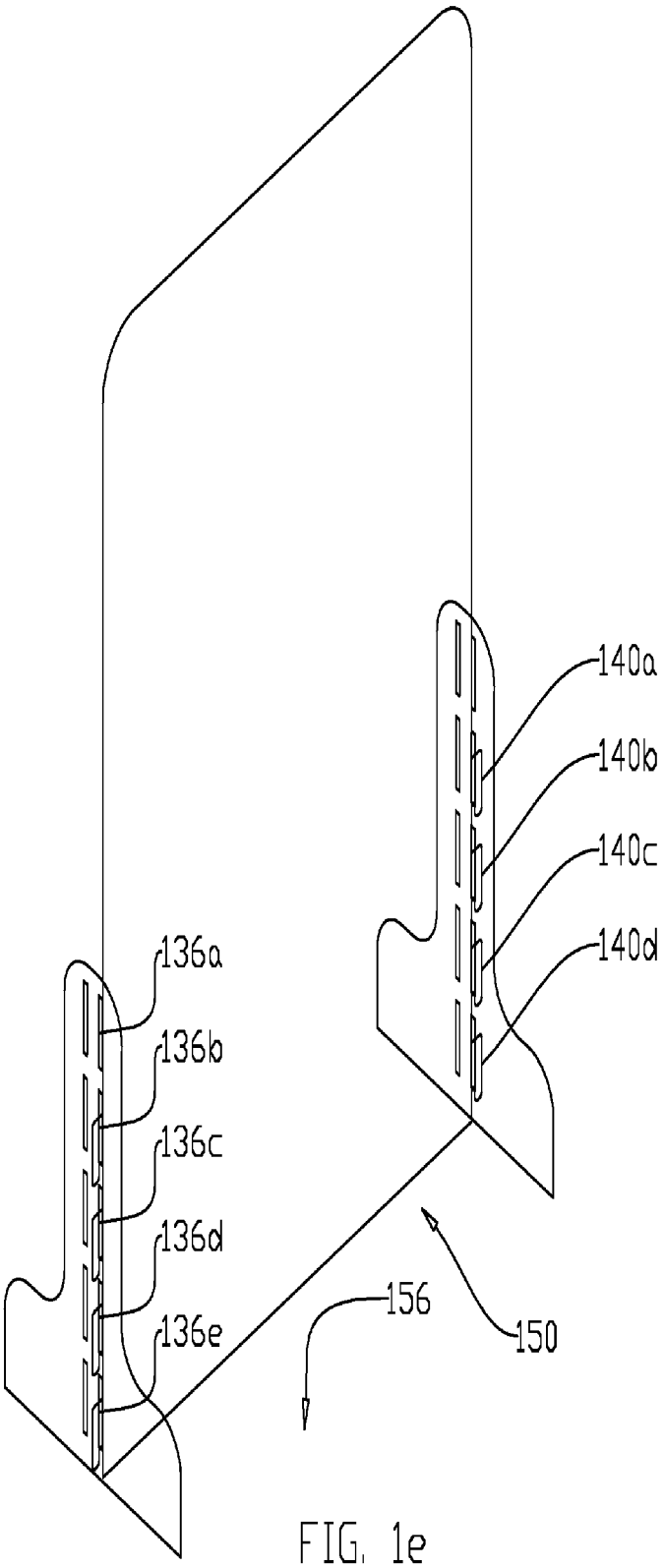
FIG. 1*e* is a perspective view of an example implementation according to the present disclosure.
Figures 1F, 1G:
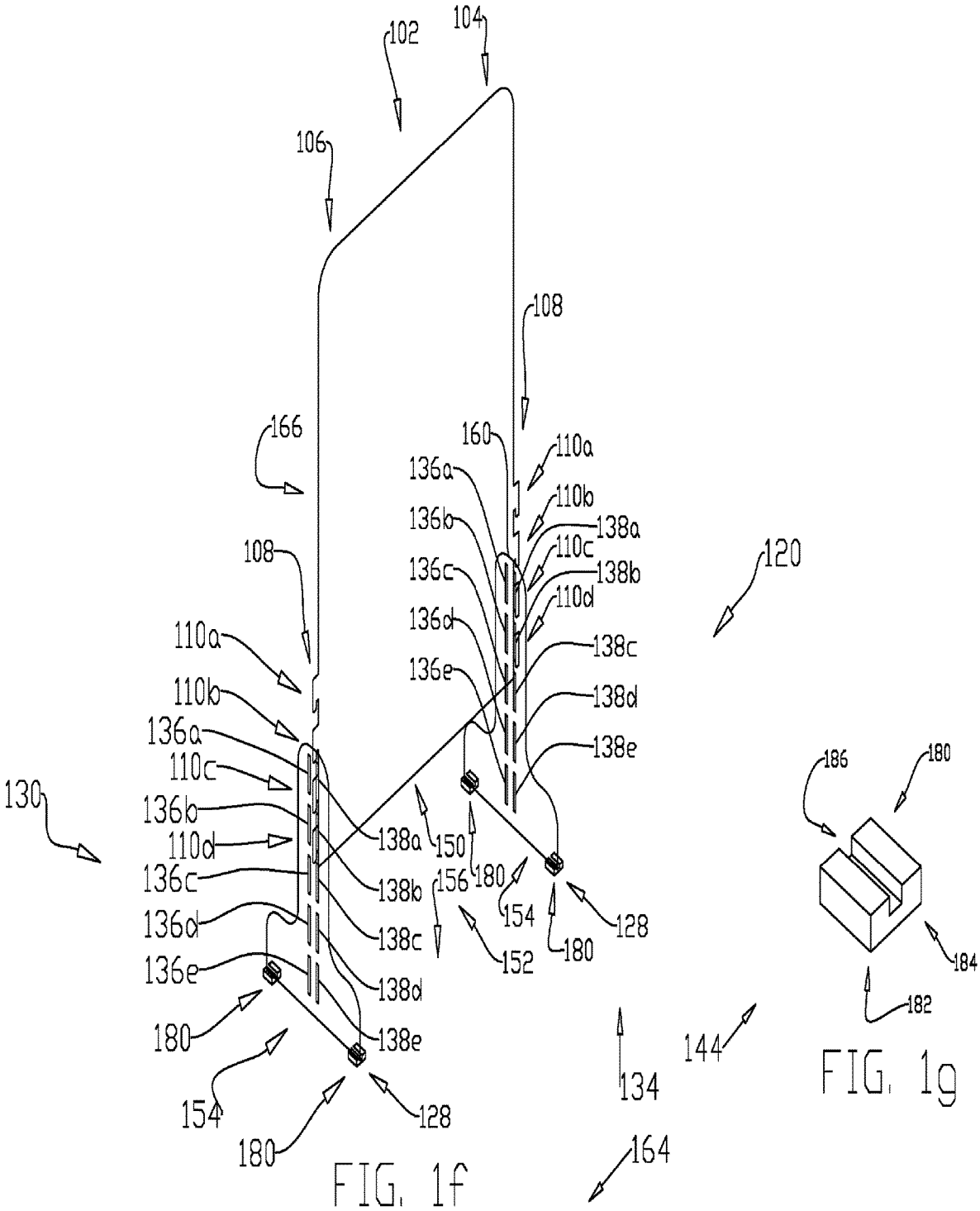
FIG. 1*f* is a perspective view of an example implementation according to the present disclosure.
FIG. 1*g* is a perspective view of a base member according to the present disclosure.

In another embodiment as illustrated in FIGS. 1*f*, the assembly includes a lateral frame member 102 and a first and second side frame members 120, 130, respectively. As shown, the lateral frame member 102 includes a first and second end 104, 106. The first and second ends 104, 106 each includes a flange portion 108 having a downwardly extending L-bend connectors 110*a-d* along the longitudinal axis of the first and second ends 104, 106 of lateral frame member 102. The first and second side frame members 120, 130, respectively, each have one or a plurality of receiving members 136*a-e*, 138*a-e* to allow for the alignment and insertion of L-bend connectors 110*a-d* on both the first and second ends 104, 106, respectively, of the lateral frame member 102. The L-bend connectors 110*a-d* of the first and second end 104, 106 enable the lateral frame member 102 to be selectively repositioned in a direction relative to the longitudinal axis of the lateral frame member 102 and interlockingly secured to a first side frame member 120 between a series of longitudinal positioned receiving members 136*a-e*, 138*a-e* and to a second side frame member 130.

In an embodiment, as illustrated in FIG. 1*f*, lateral frame member 102 is movable along a height of first side frame member 120 and second side frame member 130 within a longitudinal range as shown by the series of locations of the plurality of slots 136*a-e*, 138*a-e*, respectively, representing the two columns of slots 132, 134 on the first and second side frame member 120, 130, respectively. As shown in FIG. 1*e*, by aligning the four L-bend connectors 110*a-d* of the first and second ends 104, 106, respectively, of the lateral frame member 102, such that L-bend connectors 110*c* and 110*d* of the first and second ends 104, 106, respectively, align with and are inserted within the slots 138*a* and 138*b* of column 134 in each of the first and second side frame members 120, 130, respectively, the height of the lateral frame member 102 may be increased, as desired by a user, in a direction relative to the longitudinal axis of the lateral frame member 102. As shown in FIG. 1*e*, in such configuration, the bottom portion 150 of lateral frame member 102 is no longer flush with its mounting surface 156.

As shown in FIG. 1*f*, a desired vertical space 152 is created beneath the bottom portion 150 of lateral frame member 102 and the mounting surface 156 at an increased height above the mounting surface 156 approximately equal to the distance between slots 138*c* of the first and second side members 120, 130, respectively, and the bottom portion 154 of the first and second side members 120, 130, respectively. Such positioning creates the desired vertical space 152, or transaction space, beneath the lateral frame member 102 and the mounting surface 156. Depending on the desired height of the lateral frame member 102, the lateral frame member 102 may be moved further upward or downward relative to the longitudinal axis of the lateral frame member 102, as desired, by aligning the L-bend connectors 110*a-d* with and into any one or more of the one or a plurality of receiving members 136*a-e* in column 132 or one or a plurality of receiving members 138*a-e* in column 134. Alternatively, the L-bend connectors 110*a-d* of the first end 104 of the lateral frame member 102 may be aligned with and inserted into the receiving members of column 132 and the second end 106 of the lateral frame member 102 may be aligned with and inserted into the receiving members of column 134.

In use, the transaction space 152 may be created and increased by selectively repositioning the lateral frame member 102 such that the longitudinal protrusions 140*c-d* and extending locking tabs 142*c-d* are aligned with and inserted into slots 138*a-b*, bringing the top portions 168*c-d* of longitudinal protrusions 140*c-d* into contact with the top portion 170*a-b* of the slots 138*a-b*, thereby positioning the longitudinal protrusions 140*a* and 140*b* and extending locking tabs 142*a* and 142*b* disengaged from and above the first side frame member 120, as shown in FIG. 1*f*. In such configuration, as shown in FIG. 1*f*, the bottom portion 162 of the locking tab 142*b* is aligned with the upper edge 160 of the side frame member 120 and the longitudinal protrusion 140*b* is passed through the thickness 128 of the side frame member 120 in direction 144 with respect to a first side frame member 120, and in direction 164 with respect to a second side frame member 130 until the locking tab 142*b* engages with the upper edge 160 of the side frame members 120, 130, respectively.

In another alternative embodiment, the transaction space 152 may be still further increased by selectively repositioning the lateral frame member 102 such that only the longitudinal protrusions 140*d* and extending locking tabs 142*d* are aligned with slots 136*a* or 138*a* in the first and second side frame members 120, 130 (not shown). Accordingly, a user may reconfigure the assembly to provide for various height transaction spaces 152 to enable the user an opportunity to transact business, exchange goods, money, documents, food, or the like to an individual on the outer surface 166 of the lateral frame member 102.

Disengagement and removal of the lateral frame member 102 from the side frame member 120 is easily accomplished by lifting the lateral frame member 102 upwardly from its supported interlocked position with the side frame member 120 bringing the top portions 168*a-d* of longitudinal protrusions 140*a-d* of L-bend connectors 110*a-d* into contact with the top portion 170*b-e* of the slots 136*b-e* such that the L-bend connectors 110*a-d* are in a substantially parallel relationship to the slots 136*b-e* whereupon the L-bend connectors 110*a-d* can be withdrawn through the slots 136*b-e*, thereby separating and removing the lateral frame member 102 from the side frame member 120. The same method of disengagement may be performed for removing the second side frame member 130 from the lateral frame member 102.

In an embodiment, as illustrated in FIGS. 1*f* and 1*g*, the bottom portions 154 of the side frame members 120, 130, respectively, may be mounted onto base members 180 to avoid damage to a mounting surface as well as to provide additional stability to the configured assembly. Base members 180 include a first rib 182 and a second rib 184 opposite to the first rib 182. The first and second ribs 182, 184, respectively, have a rigid construction and define a longitudinal channel 186 disposed between the first and second ribs 182, 184, respectively. The longitudinal channel 186, extending in the longitudinal direction of the ribs 182, 184, has a width of a sufficient size, e.g., approximately 1.1 times greater, than the size of the bottom portion 154 of a side frame member which may be inserted. In an alternative embodiment, a bottom portion of a lateral frame member may be inserted into the base members. The placement of the bottom portion 154 of the side frame member into the base members enables the bottom portion 154 of the side frame member to resist linear and angular movement on the mounting surface. In use, upon constructing a frame assembly, the first and second bottom portions 154 of each of the side frame members are inserted into base members 180, as illustrated in FIG. 1*e*. In a constructed frame assembly, the base member of each side frame member each have a common elevation on a horizontal mounting surface, such as a top of a table, counter, floor, or other transaction area. The horizontal mounting surface for a table or desk or other modular component assembly falls within the confines of at least two parallel sides of the modular component assembly.

Figure 2A:
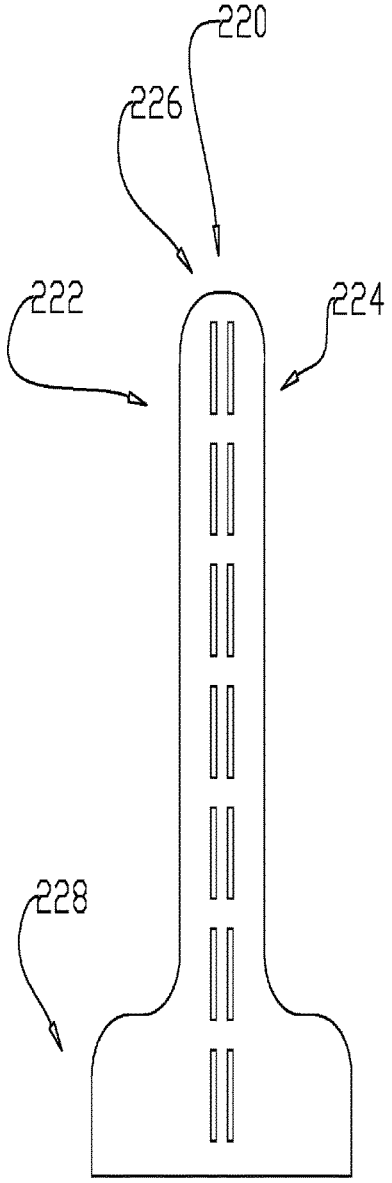
FIG. 2*a* is a side view of an example side frame member according to the present disclosure.
Figure 2B:
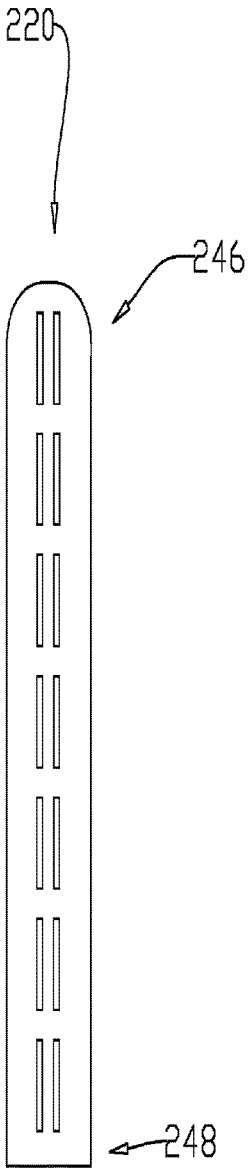
FIG. 2*b* is a side view of an example side frame member according to the present disclosure.
Figure 2C:
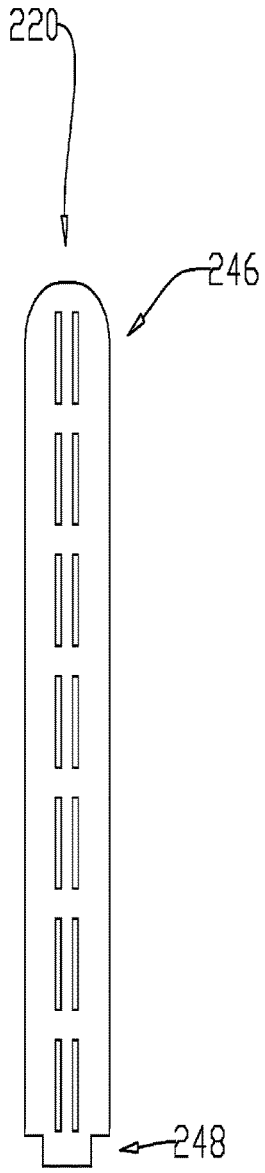
FIG. 2*c* is a side view of an example side frame member according to the present disclosure.

As shown in FIG. 2*a*, a side frame member 220 has a first end 222, a second end 224 opposite to the first end 222, a top portion, 226, and a bottom portion 228. Referring to FIG. 2*a*, the bottom portion 228 may be configured having a widening bottom portion extending outward from the top portion 226. In an alternative embodiment, as shown in FIGS. 2*b* and 2*c*, respectively, the side frame member 220 may be configured having bottom portions 248 of equal or narrower dimensions than the top portions 246. Additionally, in an alternative embodiment, it is contemplated that the first side frame member 220 may be configured with equal or different dimensions than the second side frame member 222 (not shown).

Figure 3A:
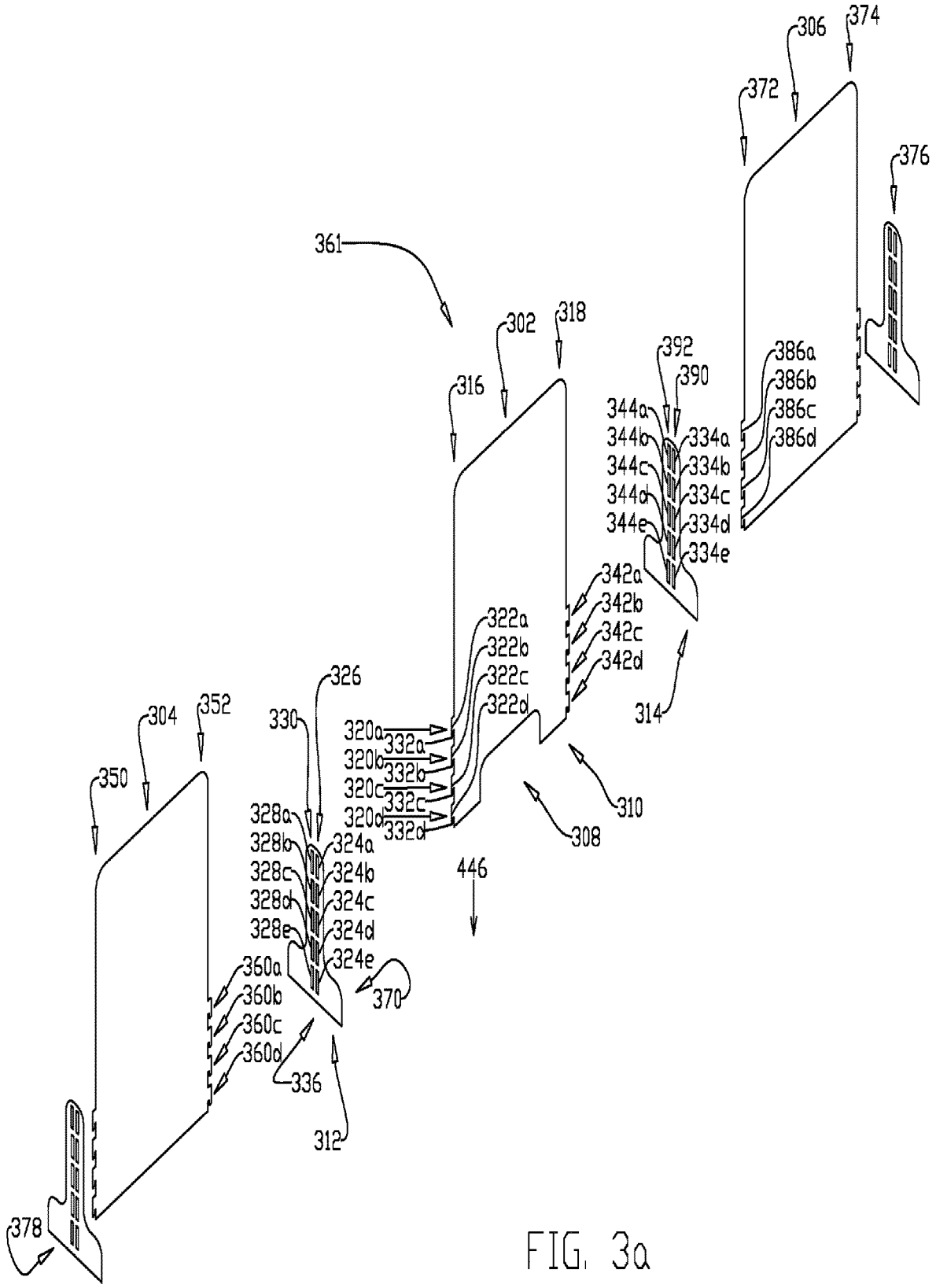
FIG. 3*a* is an exploded perspective view of an example implementation according to the present disclosure.

Although the lateral frame member is shown to be generally rectangular in geometry, it will be appreciated that essentially any shape or size of lateral frame member may be employed. As illustrated in FIG. 3*a*, in another embodiment, lateral frame member 302 is generally rectangular in geometry and is provided with a further modification which is suitable for enabling a transaction space without raising the entirety of the lateral frame member as described above with respect to FIG. 1*f*. The lateral frame member 302 is provided with a U-shaped cut out opening 308 in the bottom portion 310 of the lateral frame member 302. The cut out opening 308, which may be of any shape or size as desired by a user, enables a user the opportunity to transact business, exchange goods, money, documents, food, or the like to an individual on the outer surface 361 of the lateral frame member 302.

In an embodiment, as shown in FIG. 3*a*, a lateral frame member 302 may be interlocked together with one or more additional lateral frame members, 304, 306, respectively, to form an extended barrier of lateral frame members. Similarly, additional lateral frame members (not shown) may be added to the lateral frame members 304, 306, respectively, to form a further extended barrier of lateral frame members. As shown in FIG. 3*a*, the lateral frame member 302 may be interlocked with first and second side frame members 312, 314 by positioning the first side frame member 312 adjacent to a first side 316 of lateral frame member 302 such that L-bend connectors 320*a-d* of the first side 316 of lateral frame member 302 are aligned with a selective number of slots 324*a-e* from a first column of slots 326 or a selective number of slots 328*a-e* from a second column of slots 330 in the side frame member 312. The L-bend connectors 320*a-d* of the first side 316 are then inserted into the selectively aligned slots 324*b-e*, and the lateral frame member 302 is then pressed down in the direction of gravity, as indicated by arrow 446, and the downwardly extending locking tabs 332*a-d* of L-bend connectors 320*a-d* are mechanically captured by the outer surface 336 of side frame member 312 directly beneath the slots 324*b-e* while engaging the longitudinal protrusions 322*a-d* in slots 324*b-e*.

To interlock an additional second lateral frame member 304 onto the first lateral frame member 302, an additional second lateral frame member 304, having a first end 350 and a second end 352 is aligned adjacent to corresponding receiving members, or slots, of the first side frame member 312. In the event the first column 326 of slots 328*a-e* received the L-bend connectors 320*a-d* of the first side 316 of the first lateral frame member 302, then the second column 330 of slots 328*a-e* in the first side frame member 312 remain available to receive L-bend connectors 360*a-d* of the second end 352 of the second lateral frame member 304. The L-bend connectors 360*a-d* can be aligned and slid into the slots 328*b-e* of column 330 of side frame member 312 in the same manner as the L-bend connectors 320*a-d* are inserted into the selectively aligned slots 324*b-e*. The lateral frame member 304 is then pressed down in the direction of gravity, as indicated by arrow 446, and the downwardly extending locking tabs of L-bend connectors 360*a-d* are mechanically captured by the inner surface 370 of side frame member 312 directly beneath the slots 328*b-e* while engaging the longitudinal protrusions in slots 328*b-e*.

Figure 3B:
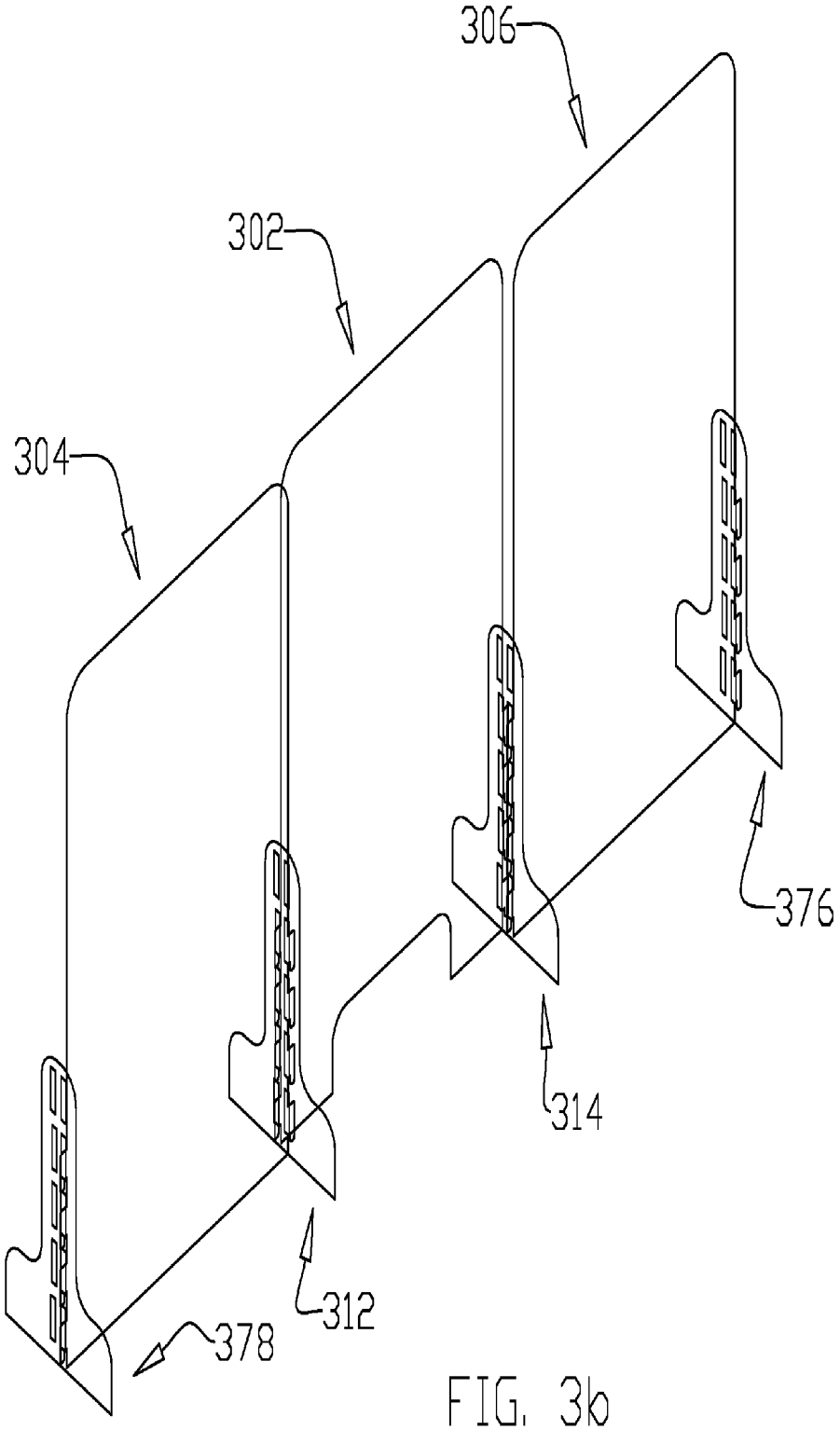
FIG. 3*b* is a perspective view of a modular barrier frame assembly according to the present disclosure.

With the addition of a third lateral frame member 306, having a first end 372 and a second end 374, the third lateral frame member may be added to the second side frame member 314 in the manner described with respect to the addition of the second lateral frame member 304 being interlockingly secured to the first side frame member 312. The slots on the side frame members may be configured such that at least one of the slots in a first set of slots 390 are offset from at least one of the slots in a second set of slots 392, such slots being in any configuration. Accordingly, one lateral frame member uses one set of slots 390, and another lateral frame member uses another set of slots 392 offset from the first set of slots. As shown in FIG. 3*a*, the first column 390 of slots 334*a-e* in the second side frame member 314 are occupied with the L-bend connectors 342*a-d* of the second side 318 of the first lateral frame member 302. The L-bend connectors 386*a-d* of the first end 372 of the third lateral frame member 306 are then aligned with and inserted into the corresponding second column 392 of slots 344*a-e* in the second side frame member 314. In this manner, a third side frame member 376 may be secured to the second side 374 of the third lateral frame member 306 and a fourth side frame member 378 may be secured to the first side 350 of the second lateral frame member 304 so as to form the barrier frame assembly such as shown in FIG. 3*b*. An unlimited number of lateral frame members and side frame members may be secured to assemble any length of barrier as desired. In an embodiment, any of the lateral frame members may have a different geometry based upon the desired use by an end user. In a further embodiment, any of the lateral frame members may have U-shaped cut out openings 308 as shown in FIG. 3*a*.

Figure 4A:
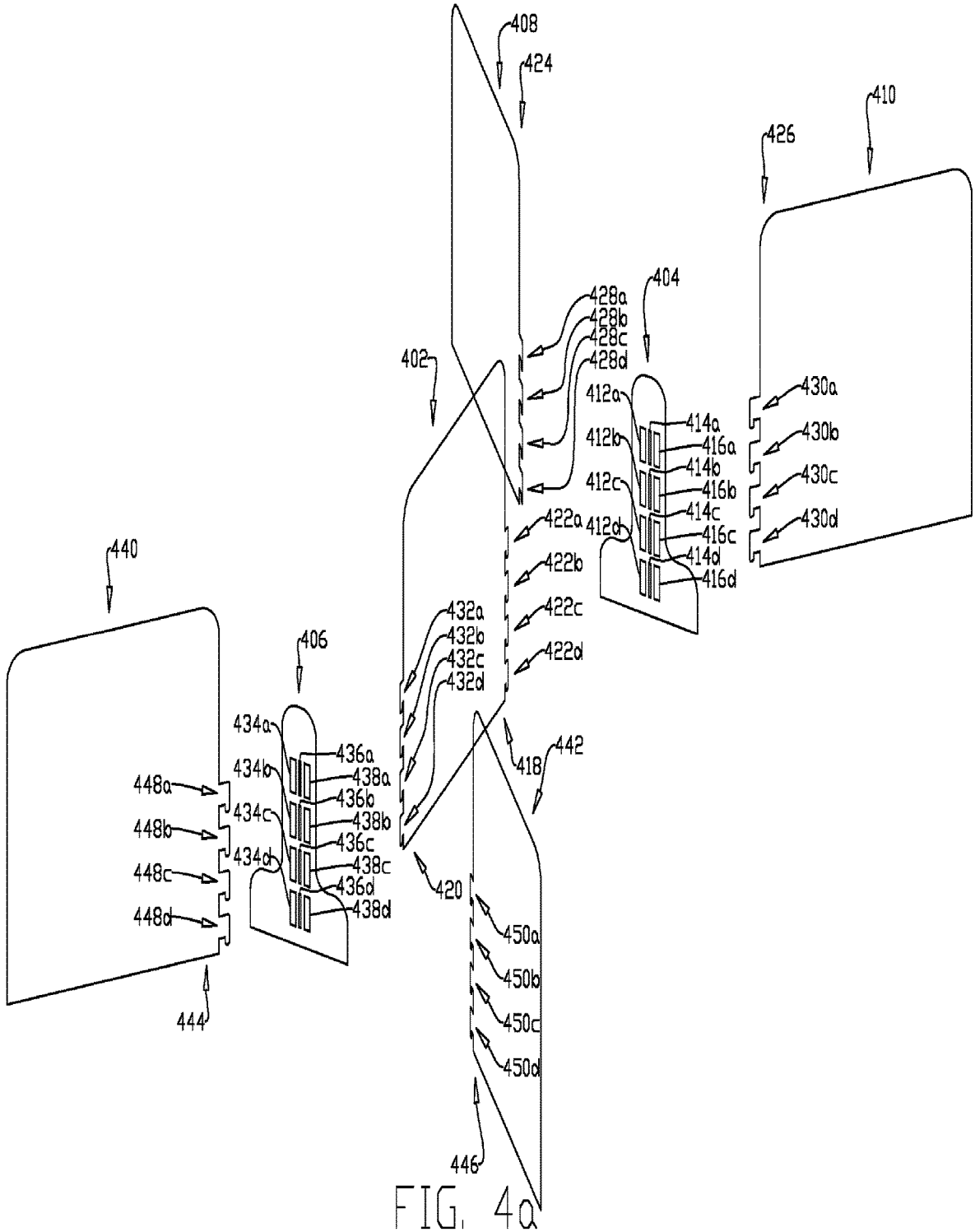
FIG. 4*a* is an exploded perspective view of an example implementation according to the present disclosure.
Figure 4C:
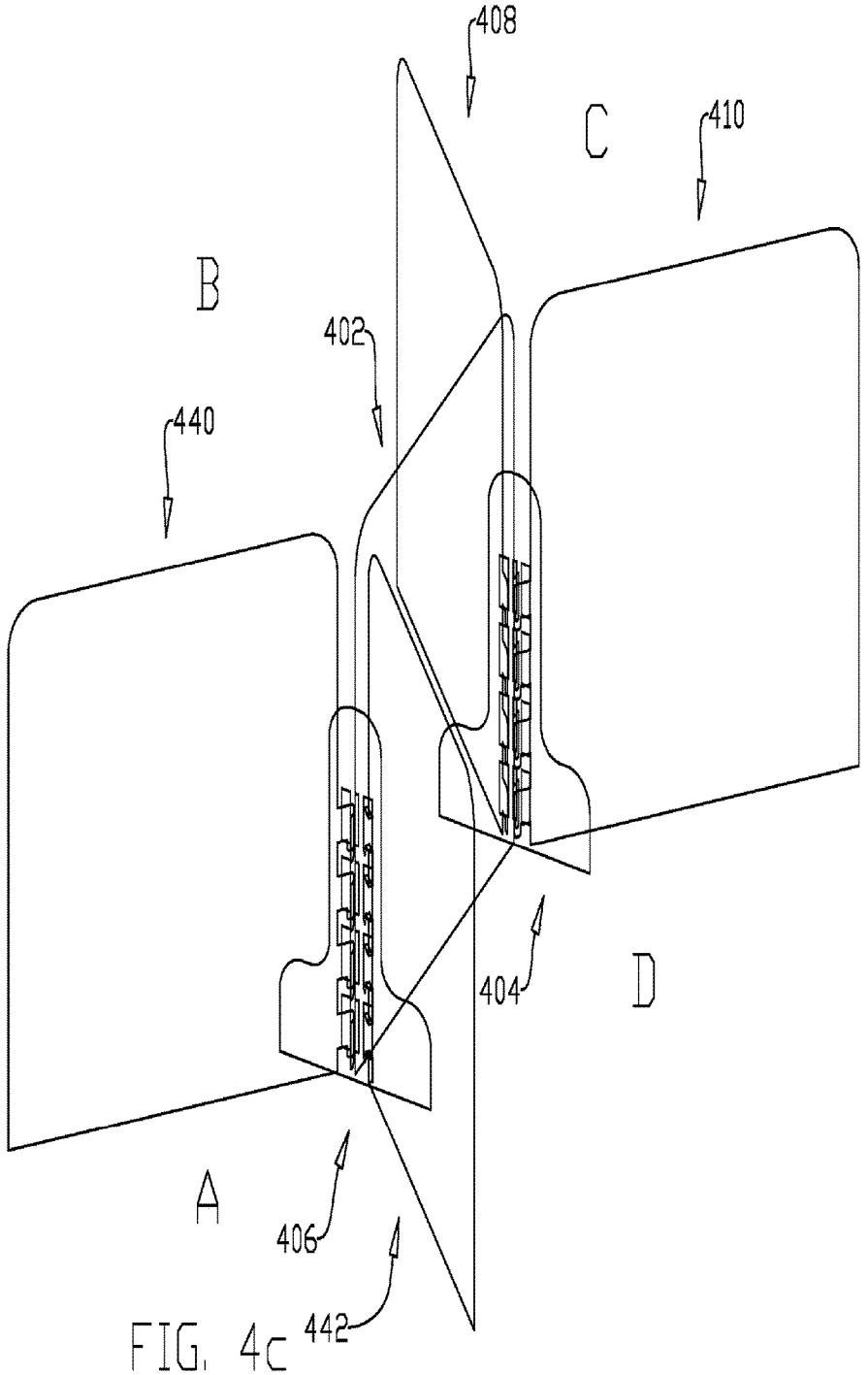
FIG. 4*c* is a perspective view of a modular barrier frame assembly according to the present disclosure.
Figure 4B:
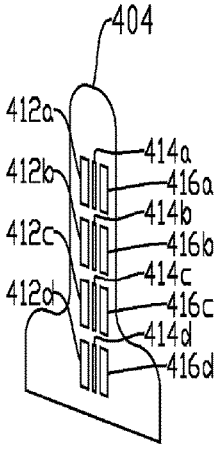
FIG. 4*b* is a side view of a side frame member according to the present disclosure.

In further embodiments, side frame members may have additional configurations of receiving members, or slots. As shown in FIGS. 4*a* and 4*b*, a rectangular first side frame member 404, includes three parallel columns of four vertically disposed rectangular slots 412*a-d*, 414*a-d*, and 416*a-d*, respectively. In other embodiments, the slots on the side frame members may be configured such that at least one of the slots in a first set of slots are offset from at least one of the slots in a second set of slots, such slots being in any configuration. As shown in FIG. 4*b*, first side frame member 404 includes three parallel columns of four vertically disposed different sized rectangular slots 412*a-d*, 414*a-d*, and 416*a-d*. As shown in FIG. 4*b*, the left and right columns of slots 412*a-d*, 416*a-d* may be configured with a wider width than the center column of slots 414*a-d*. Alternatively, it is contemplated that the columns of slots may be of differing shapes and sizes, i.e., the center column of slots may have a wider width than the left and right columns of slots (not shown). In an alternative embodiment, the center column of slots may have an increased number of slots than the slots on the left and right columns of slots (not shown). An increased number of slots in a center column of slots enables a center frame member to be higher than one or a plurality of a frame members on its first and/or second sides.

Referring to FIGS. 4*a* and 4*b*, a first lateral frame member 402 is disposed between first and second side frame members 404, 406, respectively. First lateral frame member 402 includes a first end 418 and second end 420 opposite the first end 418. First end 418 of first lateral frame member 402 includes L-bend connectors 422*a-d*. Center slots 414*a-d* on the first side member 404 are selectively aligned to receive the corresponding L-bend connectors 422*a-d* of the first end 418 of lateral frame member 402 to secure the first lateral frame member 402 to the side frame member 404.

Referring to FIG. 4*a*, there is shown a second lateral frame member 408 having a first end 424, and a third lateral frame member 410 having a first end 426. Each of the first ends 424, 426 of second and third lateral frame members 408, 410, respectively, include L-bend connectors 428*a-d*, 430*a-d*. The left and right columns of slots 412*a-d*, 416*a-d* of the first side frame member 404 are selectively aligned to slide the corresponding L-bend connectors 428*a-d* of the second lateral frame member 408 and L-bend connectors 430*a-d* of the third lateral frame member 410 into the slots 412*a-d* and 416*a-d*, respectively, to secure the second lateral frame member 408 and the third lateral frame member 410 to the first side frame member 404.

Referring to FIG. 4*a*, there is shown a second rectangular side frame member 406 including three parallel columns of four vertically disposed rectangular slots 434*a-d*, 436*a-d*, and 438*a-d*, respectively. As shown in FIG. 4*b*, the left and right columns of slots 434*a-d*, 438*a-d* may be configured with a wider width than the center column of slots 436*a-d*. Alternatively, it is contemplated that the columns of slots may be of differing shapes and sizes, i.e., the center column of slots may have a wider width and a different number of slots than the left and right columns of slots (not shown).

Referring to FIG. 4*a*, there is shown a fourth lateral frame member 440 and fifth lateral frame member 442, each having a first end 444, 446. The first ends 444, 446 of the fourth and fifth lateral frame members 440, 442 each have L-bend connectors 448*a-d*, 450*a-d*. The center slots 436*a-d* of the second side frame member 406 are selectively aligned to receive the corresponding L-bend connectors 432*a-d* of the second end 420 of the first lateral frame member 402 to secure the first lateral frame member 402 to the second side frame member 406. The left and right columns of slots 434*a-d*, 438*a-d* of the second side frame member 406 are selectively aligned to slide the corresponding L-bend connectors 448*a-d* of the fourth lateral frame member 440 and L-bend connectors 450*a-d* of the fifth lateral frame member 442 into the slots 434*a-d* and 438*a-d*, respectively, to secure the fourth lateral frame member 440 and the fifth lateral frame member 442 to the second side frame member 406, so as to form the barrier frame assembly such as shown in FIG. 4*c*.

Upon placement of the L-bend connectors 428*a-d* of the second lateral frame member 408 into wider slots 412*a-d*, L-bend connectors 430*a-d* of the third lateral frame member 410 into the wider slots 416*a-d*, L-bend connectors 448*a-d* of the fourth lateral frame member 440 into the wider slots 434*a-d*, and L-bend connectors 450*a-d* of the fifth lateral frame member 442 into the wider slots 438*a-d*, additional space is provided within the slots, 412*a-d*, 416*a-d*, 434*a-d* and 438*a-d*, respectively, for low friction independent pivotal and rotatable movement of the second, third, fourth and fifth lateral frame members 408, 410, 440, 442, respectively, to enable the second, third, fourth, and fifth lateral frame members 408, 410, 440, 442 to be rotatable to approximately 90 degrees from the adjacent frame member and approximately 45 degrees from the longitudinal axis of the adjacent side frame member. Accordingly, the second and third lateral frame members 408, 410, respectively, are rotatable to approximately 90 degrees with respect to each other, and approximately 45 degrees from the longitudinal axis of the first side frame member 404; the fourth and fifth lateral frame members 440, 442, respectively, are rotatable to approximately 90 degrees with respect to each other, and approximately 45 degrees from the longitudinal axis of the second lateral frame member 406.

As shown in FIG. 4*a*, as the second, third, fourth and fifth lateral frame members, 408, 410, 440, 442, respectively, are pivoted or rotated, they may be positioned at a wide variety of orientations, from approximately parallel to the first lateral frame member 402, when the second, third, fourth and fifth lateral frame members 408, 410, 440, 442, respectively, are not rotated from their initial position upon securement to the first lateral frame member 402, to approximately perpendicular to the first lateral frame member 402, when the second and third lateral frame members 408, 410, respectively, are each rotated approximately 90 degrees, in opposite directions, from their initial positions upon securement to the first lateral frame member 402, and the fourth and fifth lateral frame members 440, 442, respectively are each rotated approximately 90 degrees, in opposite directions, from their initial positions upon securement to the first lateral frame member 402. The pivotal movement of the second, third, fourth and fifth lateral frame members 408, 410, 440, 442 enable each of the four lateral frame members 408, 410, 440, 442, respectively, to be selectively positioned at a plurality of different angular orientations to accommodate various transaction or work areas, thereby accommodating four distinct transaction or work areas, A, B, C, and D, as shown in FIG. 4*c*. In similar manner, in a further embodiment, additional side frame members may be interlockingly coupled to one or more of the second ends of the second, third, fourth, or fifth lateral frame members 408, 410, 440, 442, respectively, to add additional distinct transaction or work areas to the assembly.

In an embodiment, upon selectively positioning one or more of the second, third, fourth or fifth lateral frame members, 408, 410, 440, 452, respectively, to a desired location, the lateral frame members may be stabilized in such desired position with the application of a removable adhesive attached to the bottom surface of the second, third, fourth, or fifth lateral frame members 408, 410, 440, 452, respectively, to adhere to the top of a mounting surface (not shown).

Figure 5A:
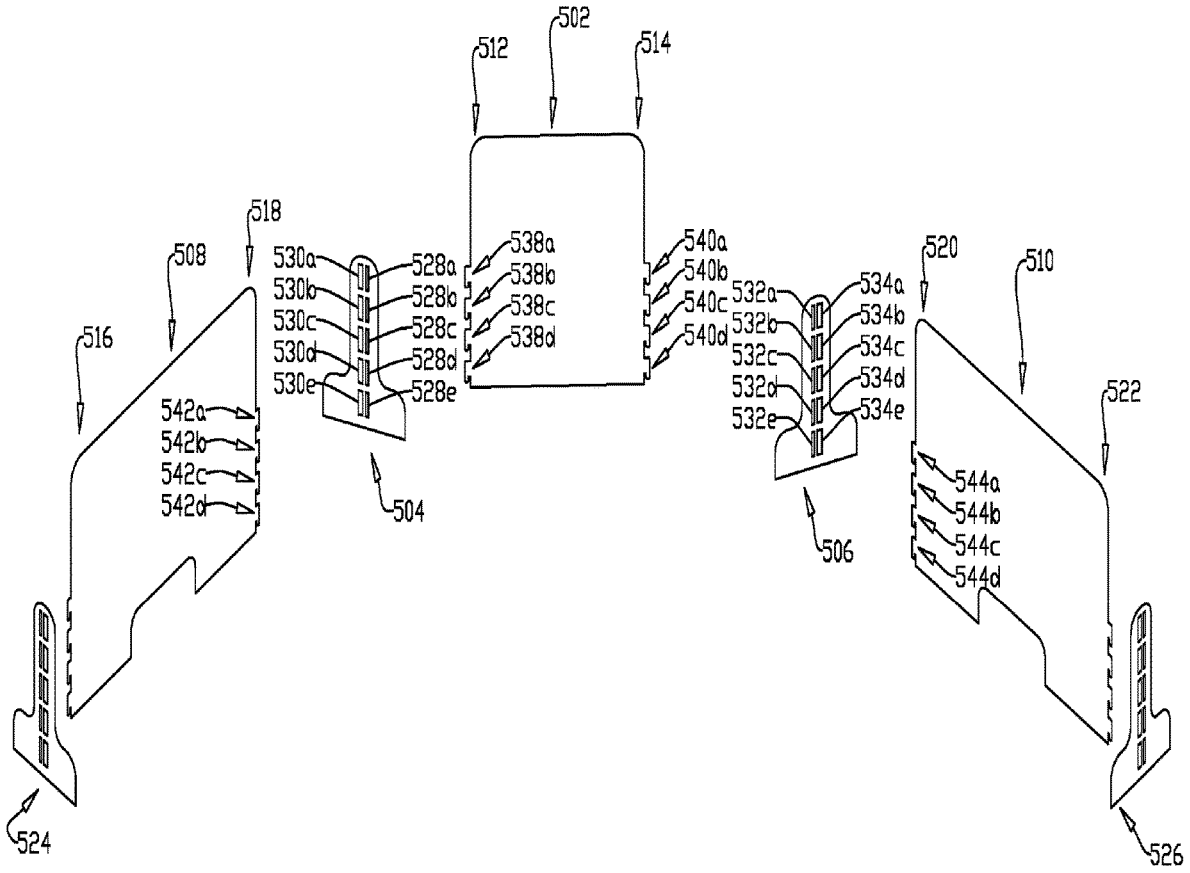
FIG. 5*a* is an exploded perspective view of an example implementation according to the present disclosure.
Figure 5C:
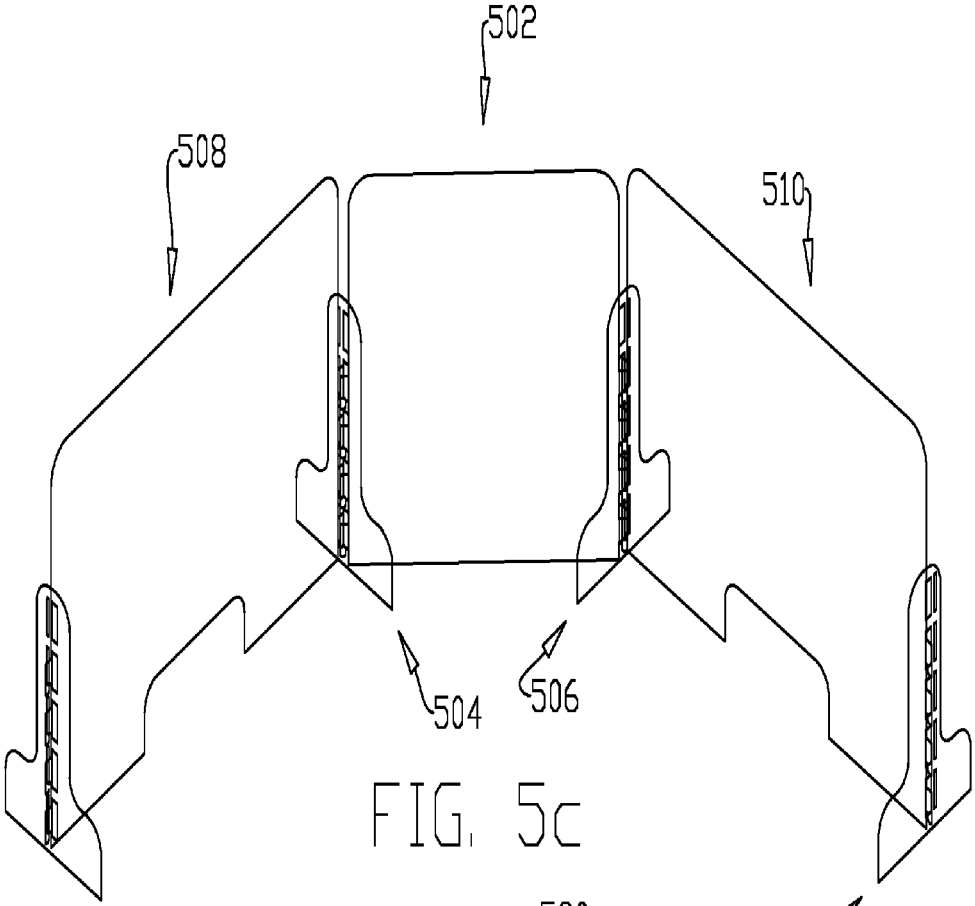
FIG. 5*c* is a perspective view of a modular barrier frame assembly according to the present disclosure.
Figure 5B:
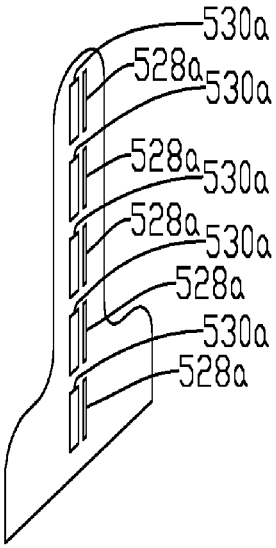
FIG. 5*b* is a side view of a side frame member according to the present disclosure.

In another embodiment, as illustrated in FIGS. 5*a* and 5*b*, first and second side frame members 504, 506 include parallel left and right columns of slots, 528*a-e*, 530*a-e* on the first side frame member and 532*a-e*, 534*a-e* on the second side frame member, configured such that one column of slots, 530*a-e* and 534*a-e* is wider than slots 528*a-e* and 532*a-e*. In this embodiment, one or a plurality of slots have widths greater than, e.g., 1.1 times greater than, the width of the corresponding L-bend connectors of a lateral frame member received in the slots such that the slots allow for low friction independent pivotal and rotatable movement of the lateral frame member, enabling a user to selectively position a lateral frame member at a plurality of different angular orientations to another lateral frame member, as shown in FIG. 5*c*, to allow curvatures of lateral frame members to accommodate various transaction or work areas. Referring to FIG. 5*a*, first lateral frame member 502 includes a first end 512 and a second end 514 opposite to first end 512. The first and second ends 512, 514, respectively, each have L-bend connectors 538*a-d*, 540*a-d*, respectively. The L-bend connectors 538*a-d*, 540*a-d* can be selectively aligned and inserted into slots 528*b-e* and 532*b-e*, respectively, of first and second side frame members, 508, 510, to secure the first end 512 of the first lateral frame member 502 to the first side frame member 508 and the second end 514 of the first lateral frame member 502 to the second side frame member 510.

The wider slots 530*b-e* of the first side frame member 504 are then selectively aligned to receive corresponding L-bend connectors 542*a-d* of a second side 518 of a second lateral frame member 508 to secure the second lateral frame member 508 to the first side frame member 504. The wider slots 534*b-e* of the second side frame member 506 are selectively aligned to receive corresponding L-bend connectors 544*a-d* of a first side 520 of the third lateral frame member 510 to secure the third lateral frame member 510 to the second side frame member 506. Upon placement of the L-bend connectors 542*a-d* of the second side 518 of a second lateral frame member 508 into the wider slots 530*b-e*, and L-bend connectors 544*a-d* of the first side 520 of the third lateral frame member 510 into the wider slots 534*b-e*, additional space is provided within the slots, 530*b-e*, 534*b-e*, respectively, for low friction independent pivotal and rotatable movement of the second and third lateral frame members 508, 510, respectively, to enable the second and third lateral frame members 508, 510 to be rotatable and to provide a curved barrier along the second, first, and third lateral frame members, 508, 502, 510, respectively, so as to form the barrier frame assembly such as shown in FIG. 5*c*. The degree of curvature of such extended barrier may be varied depending on the desired pivotal movement of the second and third lateral frame members 508, 510, with respect to the first lateral frame member 502.

Figure 6A:
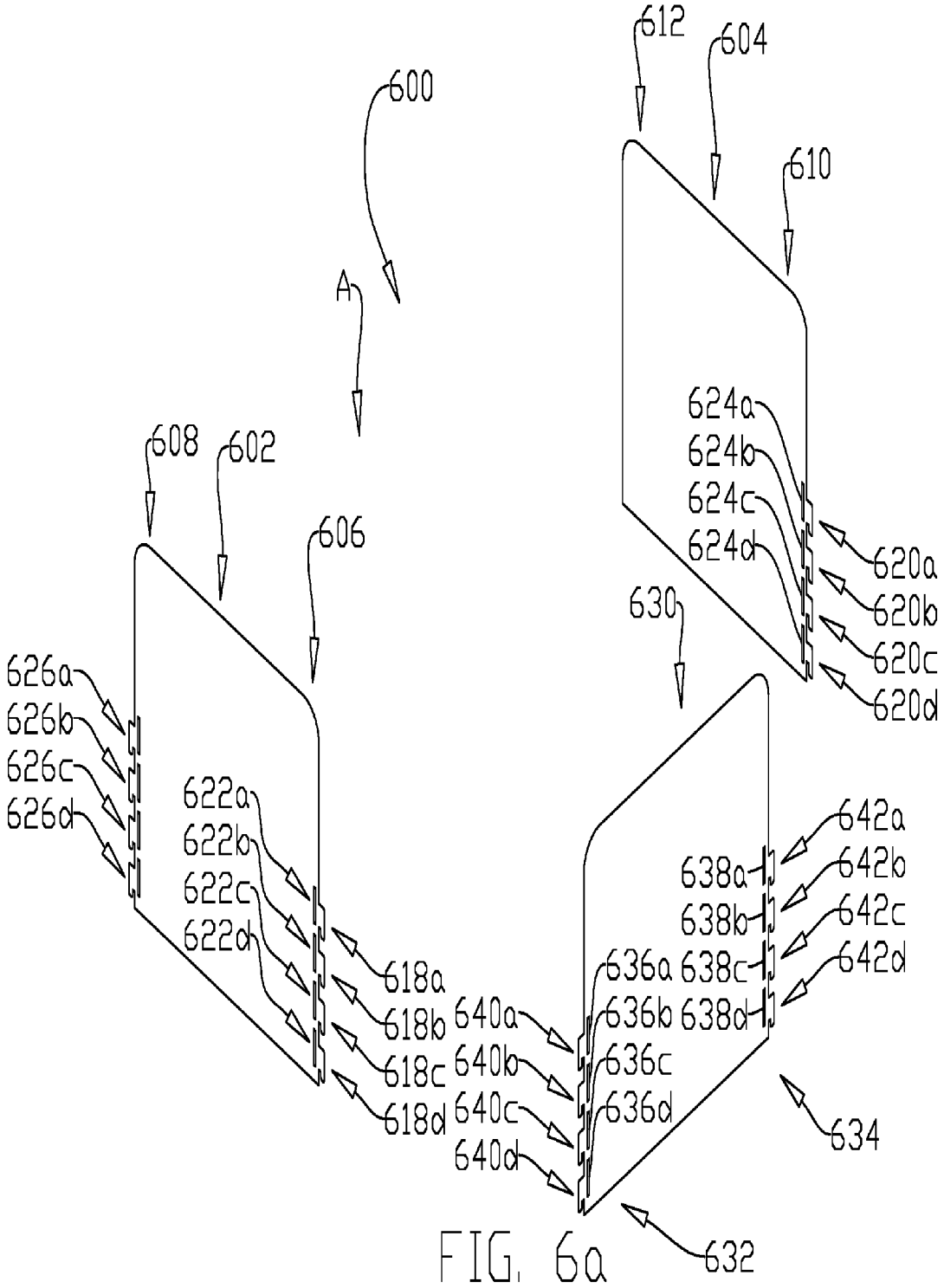
FIG. 6*a* is an exploded perspective view of an example implementation according to the present disclosure.

In still further embodiments, assemblies may be configured from lateral frame members having one or a plurality of receiving members, L-bend connectors, or both, on a first end and/or second end. In an embodiment, referring to FIGS. 6*a* and 6*b*, a modular interlocking frame assembly 600 is illustrated including a first and second lateral frame member 602, 604, each including a first end 606, 610, respectively and a second end 608, 612, respectively opposite to the first end 606, 610. The first ends 606, 610 each include L-bend connectors 618*a-d*, 620*a-d*, respectively, and receiving members, and slots 622*a-d*, 624*a-d*, respectively, along the longitudinal axis of the first ends 606, 610 of first and second lateral frame member 602, 604, however, any number of L-bend connectors or receiving members can be provided in any orientation or configuration. In an embodiment, as shown in FIG. 6*a*, the second end 608 of the first lateral frame member 602 can have L-bend connectors 626*a-d* along the longitudinal axis of the second end 608. In alternative embodiments, the second end 608 of the first lateral frame member 602 may also have a plurality of slots (not shown). In an alternative embodiment, the second end 608 of the first lateral frame member 602 may have neither L-bend connectors nor slots (as shown in the second end 612 of second lateral member 604.

Figure 6B:
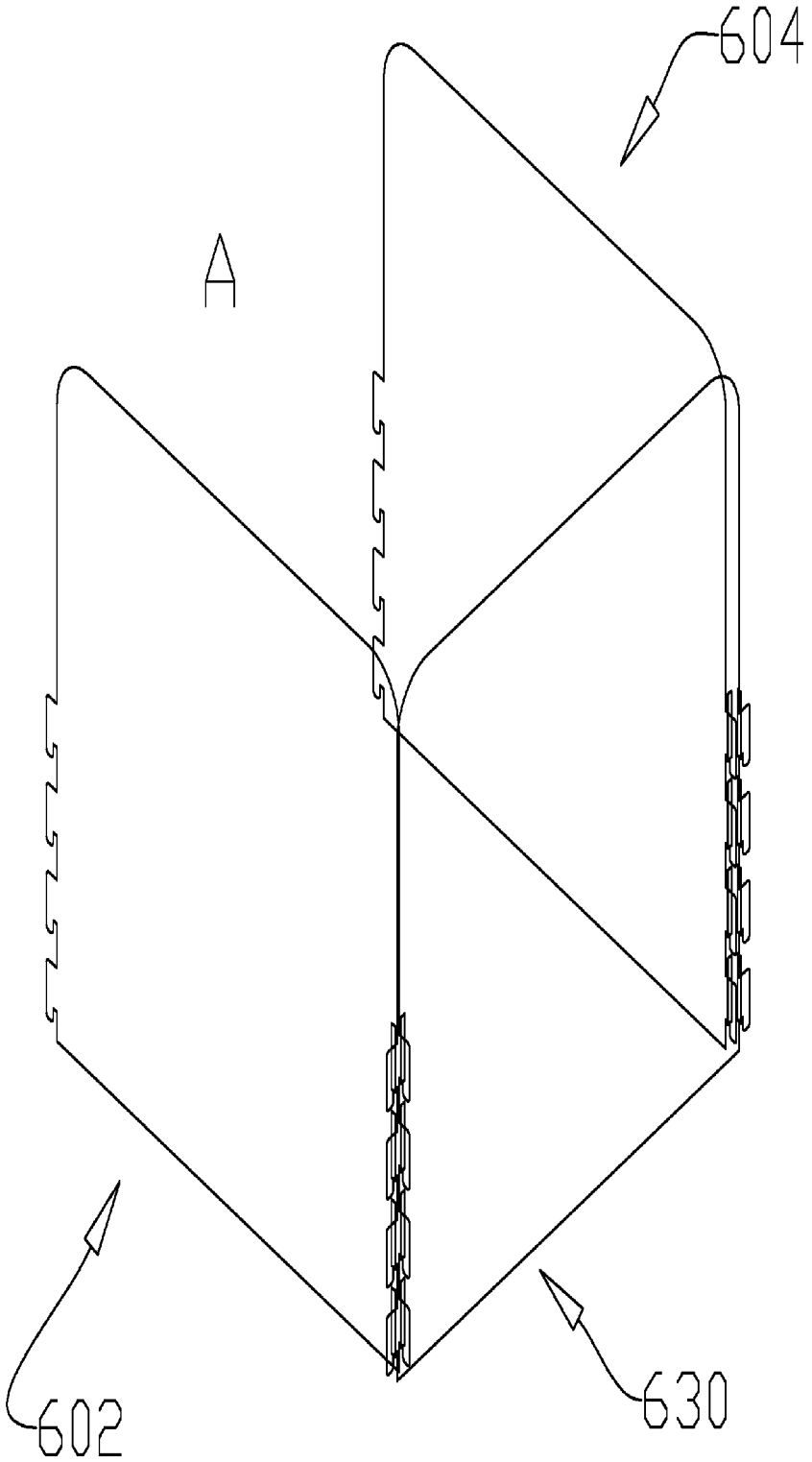
FIG. 6*b* is a perspective view of a modular barrier frame assembly according to the present disclosure.

Referring to FIG. 6*a*, the modular frame assembly 600 further includes a third lateral frame member 630 including a first end 632 and a second end 634 opposite to the first end 632. The first and second ends 632, 634, respectively, each include a vertical column including a plurality of slots 636*a-d*, 638*a-d*, respectively, and L-bend connectors 640*a-d*, 642*a-d*, respectively, however any number of slots or L-bend connectors can be provided in any orientation or configuration. In use, the slots 636*a-d*, 638*a-d*, respectively, of the third lateral frame member 630 are aligned to receive the L-bend connectors 618*a-d* of the first end 606 of the first lateral frame member 602, and L-bend connectors 620*a-d* of the first end 610 of the second lateral frame member 604, to secure the first and third lateral frame members 602, 630, respectively, together and the second and third lateral frame members 604, 630, respectively, together, so as to form the barrier frame assembly such as shown in FIG. 6*b*, and thereby creating a partially enclosed and distinct transaction or work area A. In an embodiment, any one or a plurality of lateral frame members may be configured with a cut out opening, which may be of any shape or size as desired by a user. Alternatively, in use, the L-bend connectors 618*a-d* of the first end 632 of the third lateral frame member 630 are aligned and inserted into the slots 622*a-d* of the first end 606 of the first lateral frame member 602 and the L-bend connectors 620*a-d* of the first end 610 of the second lateral frame member 604 are aligned and inserted into the slots 638*a-d* of the second end 634 of the third lateral frame member 630 to secure the first and third lateral frame members 602, 630, respectively, together and the second and third lateral frame members 604, 630, respectively, together.

Figure 6C:
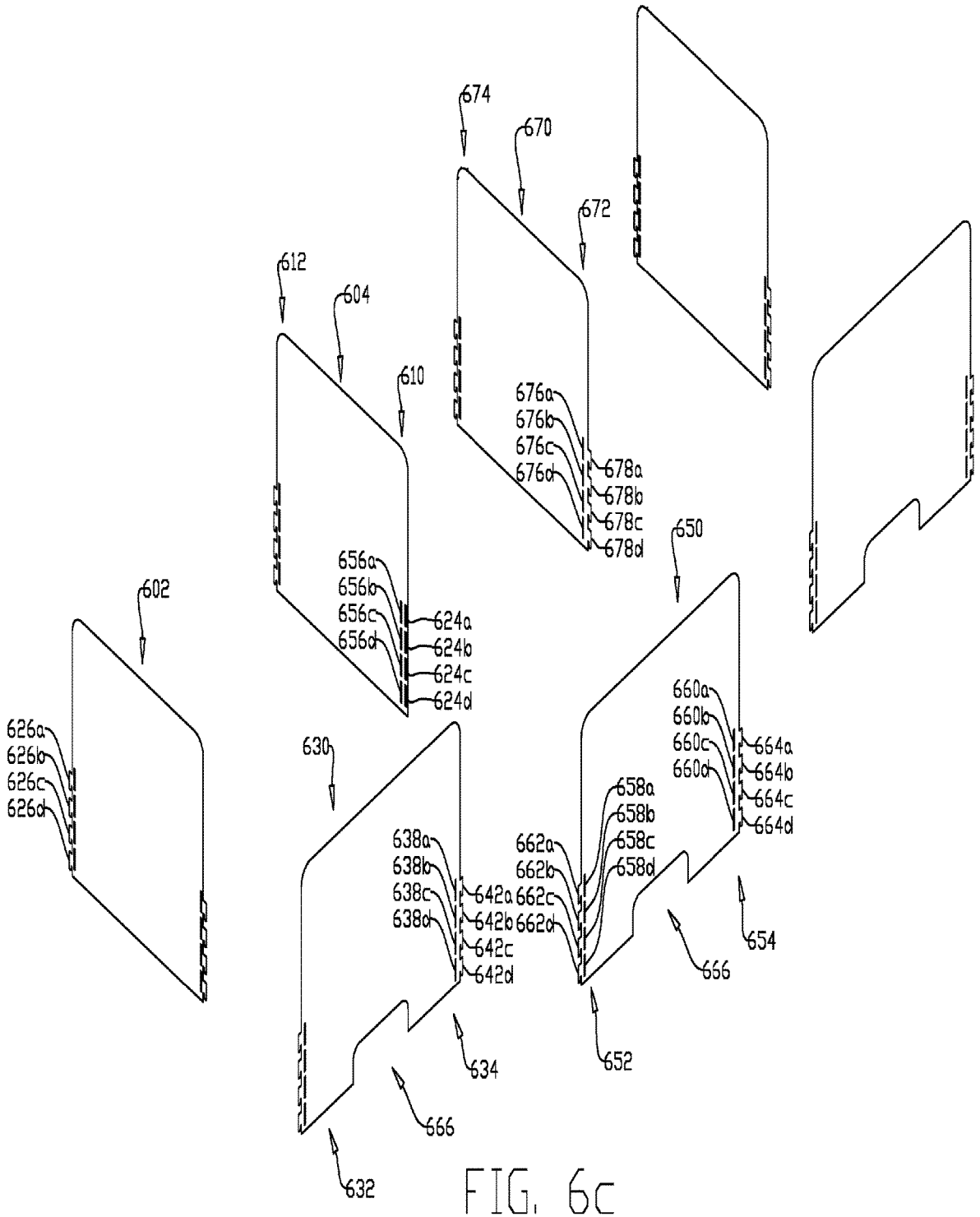
FIG. 6*c* is an exploded perspective view of an example implementation according to the present disclosure.
Figure 6D:
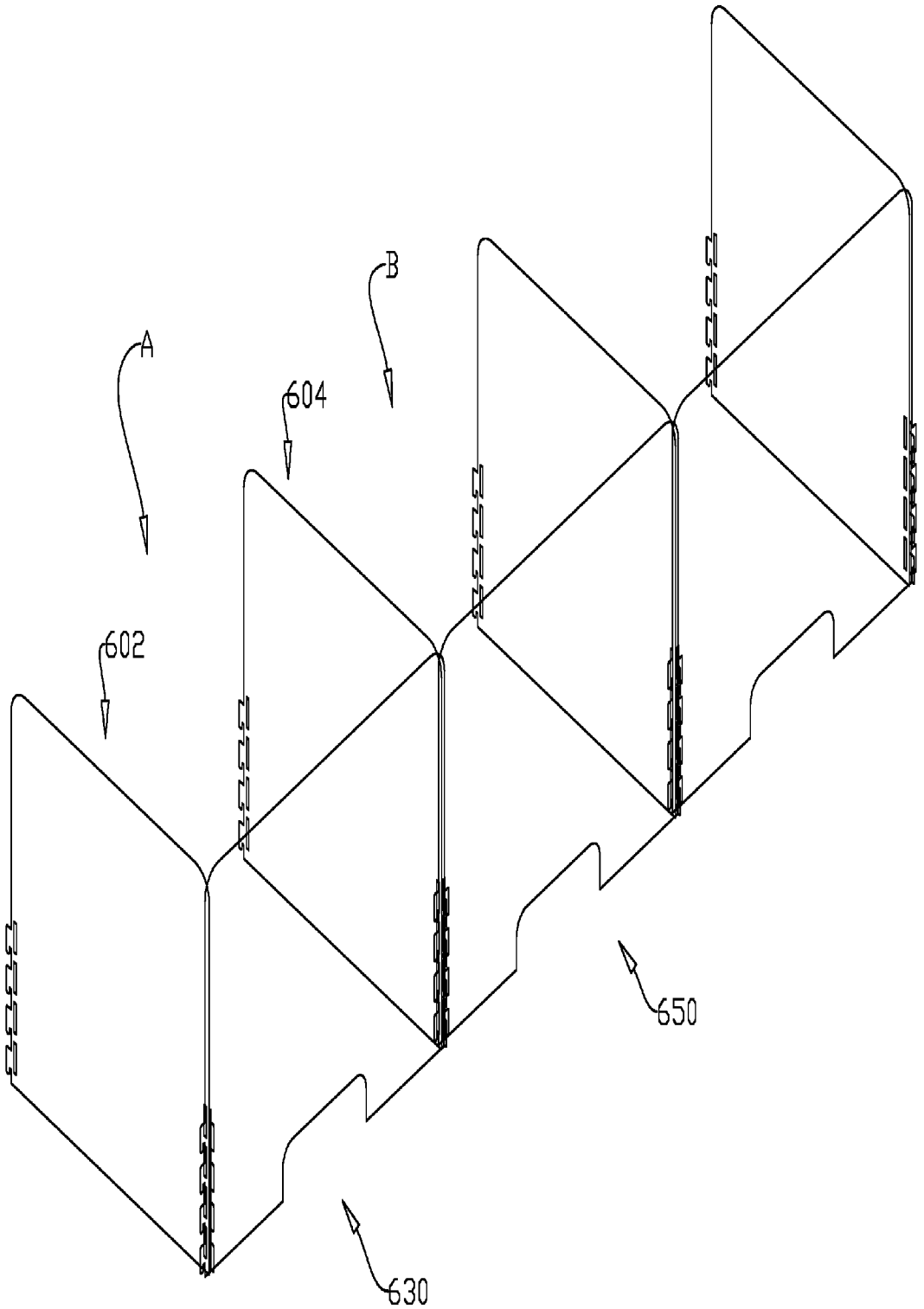
FIG. 6*d* is a perspective view of a modular barrier frame member according to the present disclosure.

In alternative embodiments, any number of transaction or work areas may be configured in any configuration with the addition of lateral frame members. Referring to FIG. 6*c*, the first end 610 of the second lateral frame member 604 may be modified to include an additional plurality of slots 656*a-d* in a vertical configuration parallel to the slots 624*a-d*, however any configuration of slots may be provided. With the inclusion of the additional plurality of slots 656*a-d*, the first end 610 of the second lateral frame member 604 may also be modified to remove the L-bend connectors, as shown in FIG. 6*c*. A fourth lateral frame member 650 is provided. Fourth lateral frame member 650 includes a first end 652 and a second end 654 opposite to the first end 652. The first and second ends 652, 654, respectively, each include a vertical column including a plurality of slots 658*a-d*, 660*a-d*, respectively, and L-bend connectors 662*a-d*, 664*a-d*, respectively, however any number of slots or L-bend connectors can be provided in any orientation or configuration.

In use, as illustrated in FIG. 6*c*, the slots 656*a-d* of the first end 610 of the second lateral frame member 604 are aligned to receive the L-bend connectors 662*a-d* of the first end 652 of the fourth lateral frame member 650 to secure the second and fourth lateral frame members 604, 650, respectively, together. As shown in FIG. 6*c*, any one or a plurality of lateral frame members may be configured with a cut out opening 666, which may be of any shape or size as desired by a user.

Referring to FIG. 6*c*, a fifth lateral frame member 670 is provided. Fifth lateral frame member 670 includes a first end 672 and a second end 674 opposite to the first end 672. The first end 672 of the fifth lateral frame member 670 includes a plurality of slots 676*a-d* and L-bend connectors 678*a-d*. In use, the plurality of slots 676*a-d* on the first end 672 of the fifth lateral frame member 670 are aligned to receive the L-bend connectors 664*a-d* of the second end 654 of the fourth lateral frame member 650 to secure the fifth and fourth lateral frame members 670, 650, respectively, together. In an alternative embodiment, in use, the L-bend connectors 678*a-d* of the first end 672 of the fifth lateral frame member 670 are aligned and inserted into the slots 660*a-d* of the second end 654 of the fourth lateral frame member 650 to secure the fifth and the fourth lateral frame members 670, 650, respectively, together, thereby creating a partially enclosed and distinct transaction or work area B. As shown in FIG. 6*c*, any one or a plurality of lateral frame members may be configured with a cut out opening 666, which may be of any shape or size as desired by a user. In similar manners, additional lateral frame members may be interlockingly secured to create additional barriers and additional transaction or work areas as discussed.

In an alternative embodiment, to create an extended barrier with third and fourth lateral frame members 630, 650, respectively, the first, third, and fifth lateral frame members 602, 604, 670, respectively, could be replaced with side frame members as discussed in reference to FIGS. 1-5, having a plurality of slots in a variety of configurations to receive the L-bend connectors of each of the third and fourth lateral frame members 630, 650, respectively (not shown).

Figure 6F:
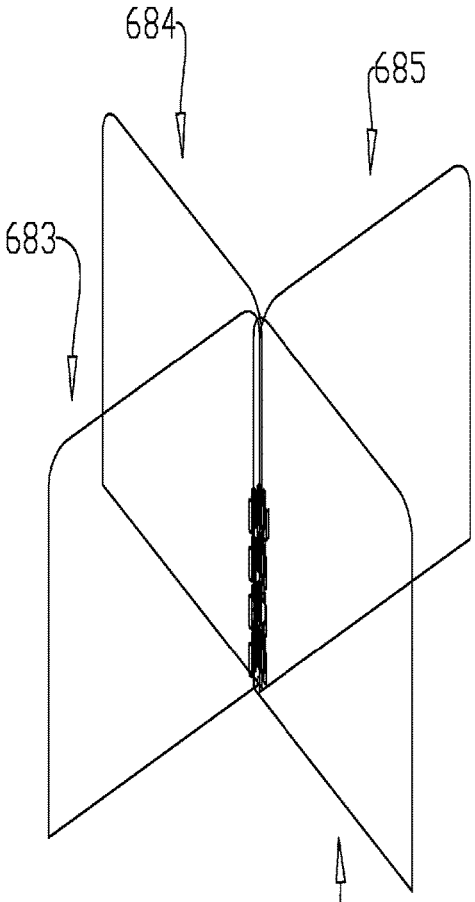
FIG. 6*f* is a perspective view of a modular barrier frame assembly according to the present disclosure.
Figure 6E:
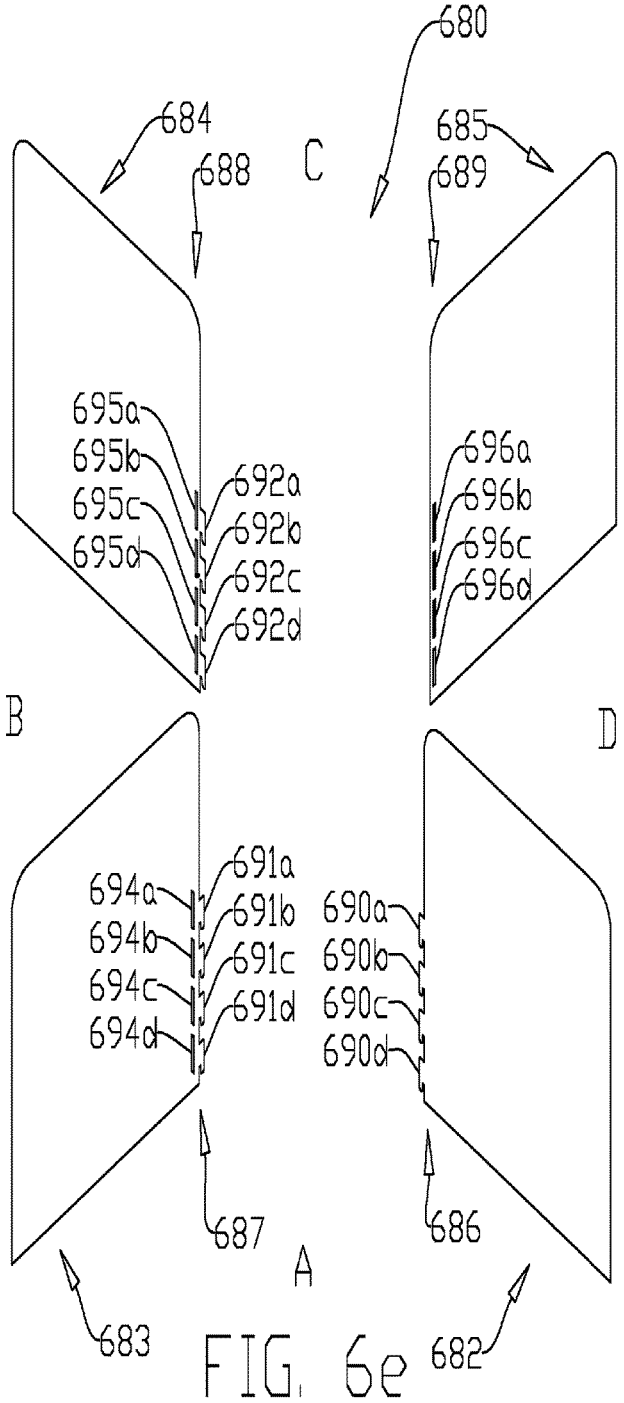
FIG. 6*e* is an exploded perspective view of an example implementation according to the present disclosure.

Referring to FIG. 6*e*, the modular frame assembly 680 includes first, second, third and fourth lateral frame members 682, 683, 684, 685, respectively, each of which including first ends 686, 687, 688, 689. The first end 686 of the first lateral frame member 682 includes L-bend connectors 690*a-d*. The first ends 687, 688, of the second and third lateral frame members 683, 684, respectively, include L-bend connectors 691*a-d* and 692*a-d*, and first ends 687, 688, and 689 of the second, third and fourth lateral frame members, respectively, include slots 694*a-d*, 695*a-d*, 696*a-d*, respectively.

In use, the L-bend connectors 690*a-d* of the first end 686 of the first lateral frame member 682 are aligned and inserted into the slots 694*a-d* of the first end 687 of the second lateral frame member 683 to secure the first and second lateral frame members 682, 683, respectively, to each other. The L-bend connectors 691*a-d* on the first end 687 of the second lateral frame member 683 is aligned and inserted into the slots 695*a-d* of the first end 688 of the third lateral frame member 684 to secure the third lateral frame member 684 to the second lateral frame member 683. The L-bend connectors 692*a-d* on the first end 688 of the third lateral frame member 684 is aligned and inserted into the slots 696*a-d* of the first end 689 of the fourth lateral frame member 685 to secure the fourth lateral frame member 685 to the third lateral frame member 684. The L-bend connectors 693*a-d* on the first end 689 of the fourth lateral frame member 685 is aligned and inserted into the slots 690*a-d* of the first end 686 of the first lateral frame member 682 to secure the fourth lateral frame member 685 to the first lateral frame member 682, thereby mechanically interlocking and releasably securing the first, second, third and fourth lateral frame members 682, 683, 684 and 685, respectively, together, so as to form the barrier frame assembly such as shown in FIG. 6*f*, and creating four partially enclosed and distinct transaction or work areas A, B, C, and D.

In an alternative embodiment, the first end 686 of the first lateral frame member 682 also includes one or a plurality of slots (not shown). In such alternative embodiment, the L-bend connectors of the fourth lateral frame member may be aligned and inserted into the plurality of slots on the first end of the first lateral frame member. In a further alternative embodiment, the first end 689 of the fourth lateral frame member 685 may include only slots.

In an alternative embodiment, each of the first, second, third, and fourth lateral frame members 682, 683, 684, 685, respectively, include second ends opposite to the first ends having one or a plurality of L-bend connectors and/or one or a plurality of slots (not shown). Additional lateral frame members or side frame members may be interlockingly secured to the second ends of each of the first, second, third, and fourth lateral frame members 682, 683, 684, 685, respectively, to interlockingly secure additional lateral frame members and/or side frame members to one or a plurality of the first, second, third, or fourth lateral frame members 682, 683, 684, 685, respectively, to assemble various configurations of lateral frame members, as desired (not shown). This pattern may be repeated to permit any number of lateral frame members to be aligned in a row in such manner or to create a desired number of transaction or work areas as described.

The lateral frame members of the modular frame assembly may be variously shaped and assembled with each other to create any type of construction. In a second family of embodiments, the modular frame assembly is provided with frame members which may be implemented with alternative constructions, and shaped and sized for any practical use, such as, for example, structures such as furniture or a child's toy.

Figure 7B:
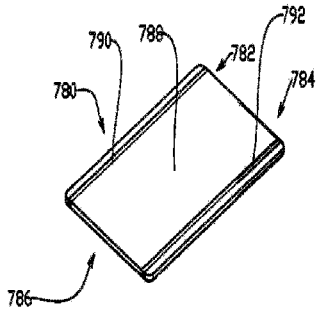
FIG. 7*b* is a perspective view of an example top planar member according to the present disclosure.
Figure 7A:
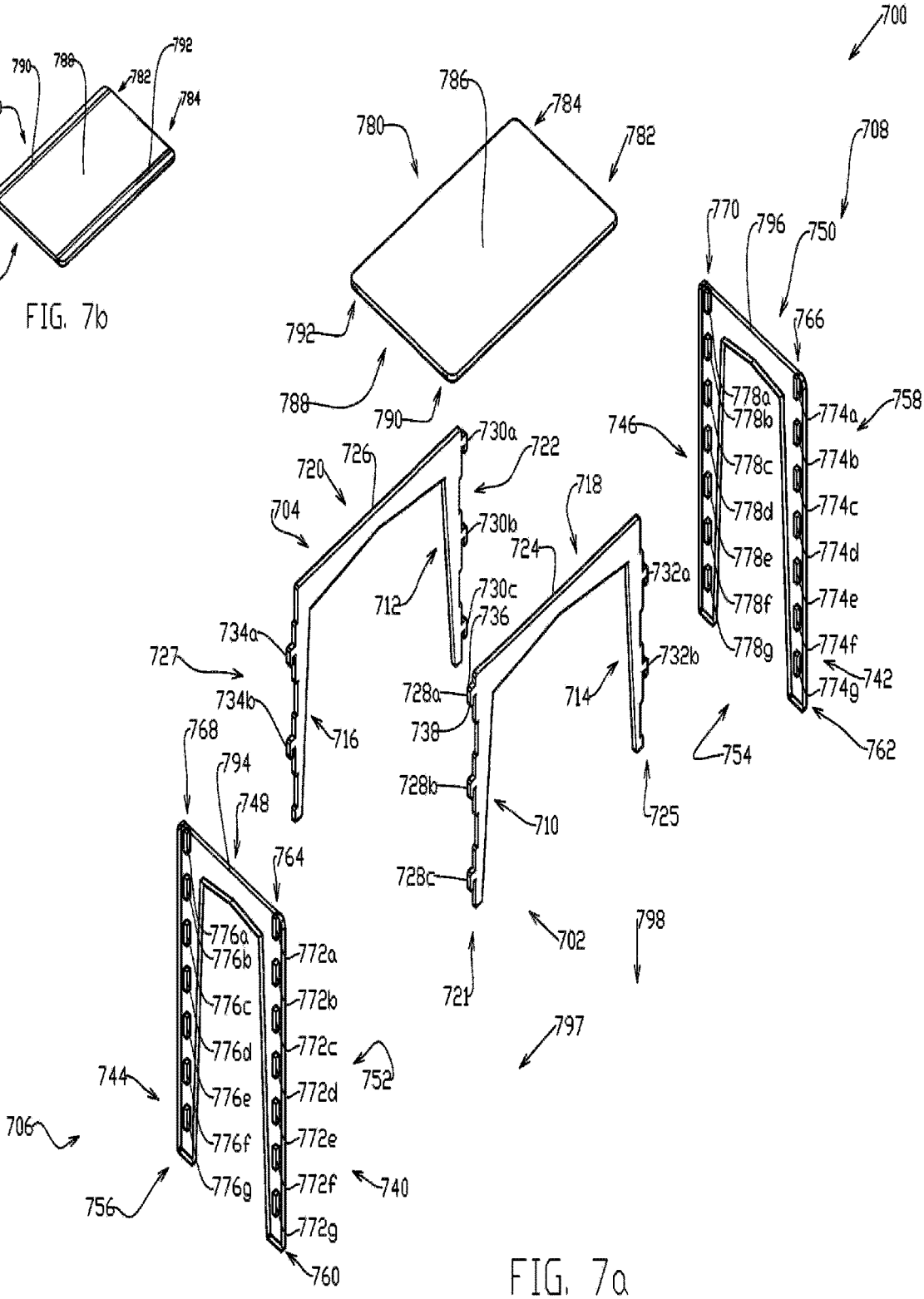
FIG. 7*a* is an exploded perspective view of a modular frame assembly in the configuration of a desk.

Referring to FIG. 7*a*, a modular interlocking frame assembly 700 is illustrated to include a pair of first and second lateral frame members 702, 704, respectively, positioned vertically and spaced apart from each other having a transverse portion along the longitudinal axis defining a length. The first and second lateral frame members 702, 704 further include one or a plurality of flange portion(s). The flange portions can be disposed at any location on the lateral frame members. The lateral frame members are interlockingly connected to a pair of vertical first and second side frame members 706, 708, respectively, positioned between the pair of lateral frame members 702, 704 and spaced apart from each other partially enclosing a space and forming a panel assembly which may be configured as a desk assembly, table assembly, shelf assembly, chair assembly, or other various configurations of furniture assemblies. In alternative embodiments, such furniture assemblies may also be configured as small construction frame assemblies for use as children's toys.

Referring to FIG. 7*a*, the first and second lateral frame members 702, 704 include a first end 710, 712, respectively, a second end 714, 716, respectively, opposite to the first end 710, 712, respectively, and a transverse portion 718, 720, respectively, extending between the first end 710, 712, respectively, and second end, 714, 716, respectively. The first ends 710, 712, respectively, and second ends 714, 716, respectively, each include at least one flange portion 721, 722 on the first ends 710, 712 and 725, 727 on the second ends, 714, 716, respectively, transverse from a longitudinal axis of the first end 710, 712, respectively, and second end 714, 716, respectively, of lateral frame members 702, 704, respectively. The transverse portion 718, 720, respectively, includes an upper edge 724, 726, respectively. First and second lateral frame members 702, 704 can be used on any of the modular frame assemblies described herein in connection with FIGS. 1-11 or any other modular frame assemblies described herein.

Referring to FIG. 7*a*, the flange portions 721 and 722 each include a column of three downwardly extending L-bend connectors 728*a-c*, 730*a-c* of the first ends 710, 712 of the first and second lateral frame members 702, 704, respectively. The flange portions 725 and 727 each include a column of two downwardly extending L-bend connectors 732*a-b*, 734*a-b* of the second ends 714, 716 of the first and second lateral frame members 702, 704, respectively. It is contemplated that any number or configuration of L-bend connectors can be provided to the first or second ends 710, 712, or 714, 716 of the first or second lateral frame members 702, 704, respectively.

Figure 7D:
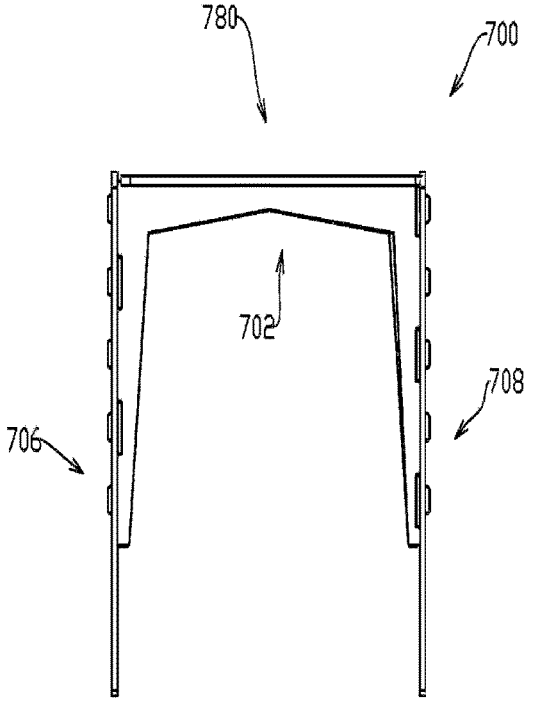
FIG. 7*d* is a side view of a modular frame assembly in the configuration of a desk.
Figure 7E:
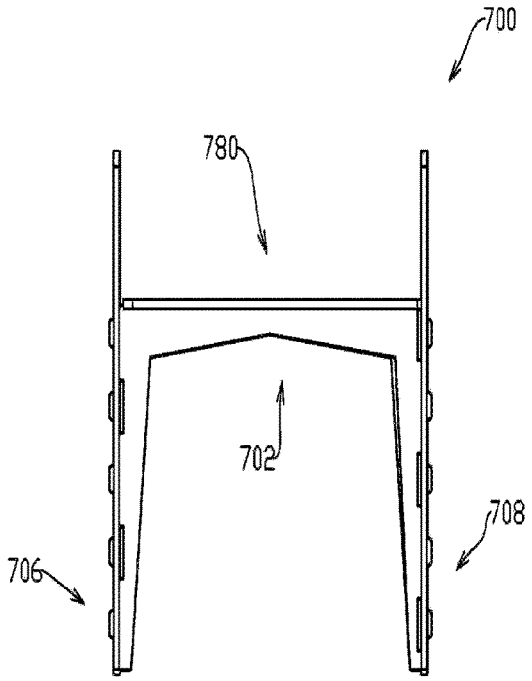
FIG. 7*e* is a side view of an alternate modular frame assembly in the configuration of a desk.
Figure 7C:
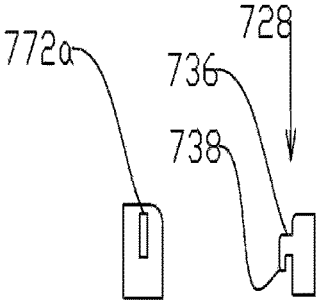
FIG. 7*c* is a perspective view of an example locking mechanism according to the present disclosure.

Referring to FIGS. 7*a* through 7*c*, the L-bend connectors 728*a-c*, 730*a-c*, 732*a-b*, and 734*a-b* each include an extension portion 736 and corresponding perpendicular locking tabs 738. The extensions 736 have a length of approximately 0.5" to 3" and a width of approximately 0.125" to 2.0" and locking tabs 738 have a length of approximately 0.25" to 3" and a width of approximately 0.125" to approximately 2", as illustrated in FIG. 7*c*. The extension portions 736 and locking tabs 738 can be used on any of the modular frame assemblies described herein in connection with FIGS. 1-11 or any other modular frame assemblies described herein.

As illustrated in FIG. 7*a*, the first and second lateral frame members 702, 704 are parallel and substantially identical to each other. Accordingly, the first and second lateral frame members 702, 704 could be flipped over about a central lateral axis whereupon the first end would become the second end, and the second end would become the first end. This enables multiple L-bend connectors of lateral frame members to be inserted into slots on both an inner and outer surface of a pair of parallel and substantially identical side frame members, thereby enabling desk assemblies having a variety of different heights to be aligned in a row, as described in reference to FIGS. 7*a* through 7*f*, and FIGS. 8*a* through 8*g*.

As illustrated in FIG. 7*a*, the modular frame assembly 700 further includes a first and second side frame member 706, 708 including first ends 740, 742, respectively, second ends 744, 746, respectively, opposite to the first ends 740, 742, respectively, and a cross panel 748, 750, respectively, extending therebetween the first and second side frame members 706, 708, respectively. The cross panels 748, 750, each having an upper edge 794, 796, respectively. The first and second side frame members 706, 708, respectively as shown in FIG. 7*a* are parallel and substantially identical. The first and second side frame members 706, 708 include an inner surface 752, 754, respectively, an outer surface 756, 758, respectively, and a thickness 760, 762, respectively. In an alternative embodiment, the thicknesses 760, 762 of the first and second side frame member 706, 708 may differ from each other. First and second side frame members 706, 708 can be used on any of the modular frame assemblies described herein in connection with FIGS. 1-11 or any other modular frame assemblies described herein.

The first ends 740, 742 and second ends 744, 746 of the first and second side frame members 706, 708, respectively, include a longitudinal column 764, 766, and 768, 770 respectively, defining one or a plurality of receiving members, or slots. It is contemplated that receiving members, or slots, may be configured in an arrangement such that the receiving members are aligned in one or more columns or offset from each other, parallel or skewed, in close or distant proximity, equal or different distance apart, or symmetrical or asymmetrical from each other. It is also contemplated that the number or configuration of receiving members in a first end of a side member may be the same or different than in the second end of a side member, and that the number or configuration of receiving members in one side frame member may be different than in another side frame member.

Referring to FIG. 7*a*, the columns 764, 766, 768, 770 of the first and second side frame members each includes seven slots 772*a-g*, 774*a-g*, 776*a-g* and 778*a-g*, respectively, however any number of slots in any shape, height, width or configuration, can be provided. In another embodiment, the height of the side frame members 706, 708 may be adjusted thereby increasing or decreasing the number of slots within the columns 764, 766, 768, 770. A side frame member may be of about approximately 12" to 96" and include one or any number of slots. Alternate sized and shaped side frame members may be used in any of the assemblies contemplated herein.

Referring to FIGS. 7*a* and 7*b*, the modular frame assembly further includes a top planar member 780 having a first end 782 and a second end 784 opposite to the first end 782. Top planar member 780 further includes an upper surface 786 and a lower surface 788. The lower surface 788 of the top planar member 780 includes parallel chambers 790, 792 on the first and second end of the lower surface 788 coincident with the longitudinal axis of the top planar member 780. Top planar member 780 can be used on any of the modular frame assemblies described herein in connection with FIGS. 1-11 or any other modular frame assemblies described herein.

In use, to configure the frame members to assemble a table, desk, or any structure having a work surface, as illustrated in FIGS. 7*a*-7*c*, the first lateral frame member 702 may be interlocked with the first side frame member 706 at a desired height by positioning the first end 710 of the first lateral frame member 702 such that the L-bend connectors 728*a-c* of the first end 710 of the first lateral frame member 702 are aligned with the desired slots of the plurality of slots 772*a-g* in the first end 740 of the first side frame member 706. In one embodiment, as shown in FIG. 7*a*, as desired by the user, the upper edge 724 of the transverse portion 718 of the first lateral frame member 702 is positioned to be at substantially the same height as the upper edge 794 of the cross panel 748 of the first side frame member 706. To assemble the frame members with such positioning, the three L-bend connectors 728*a-c* are individually or simultaneously aligned with and inserted in direction 797 into the corresponding first, third and fifth slots 772*a*, 772*c*, and 772*e* of the first end 740 of the first side frame member 706, or in any corresponding unoccupied slots of slots 772*a-g* of the first end 740 of the first side frame member 706 directly aligned with the three L-bend connectors 728*a-c*, until the extension portions 736 and locking tabs 738 of each of the L-bend connectors 728*a-c* pass through the thickness 760 of the first end 740 of the first side frame member 706 and the L-bend connectors 728*a-c* are then pressed downwardly simultaneously by a user pressing down the first end 710 of the first lateral frame member 702 in the direction of gravity as indicated by arrow 798. This action causes the downwardly extending locking tabs 738 of L-bend connectors 728*a-c* to be mechanically captured by the outer surface 756 of the first end 740 of the first side frame member 706 directly beneath the slots 772*a*, 772*c*, and 772*e* while engaging the extension portions 736 in the slots 772*a*, 772*c*, and 772*e*, thereby mechanically interlocking and releasably securing the first lateral frame member 702 with the first side frame member 706. The thickness 760 of the first end 740 of the first side frame member 706 being greater than, e.g., 1.1 times greater than, the width of the L-bend connectors 728*a-c* enable a friction fit of the extension portions 736 and locking tabs 738.

Referring to FIGS. 7*a* through 7*f*, the second lateral frame member 704 may then be interlocked with the first side frame member 706 at the same height as the first lateral frame member 702. Such assemblage may be performed by positioning the second end 716 of the second lateral frame member 704 such that its two L-bend connectors 734*a-b* are aligned with the second and fourth slots 776*b* and 776*d* in the second end 744 of the first side frame member 706. Once aligned, the two L-bend connectors 734*a-b* on the second end 716 of the second lateral frame member 704 can be individually or simultaneously inserted into the corresponding slots 776*b* and 776*d* in the second end 744 of the first side frame member 706, or in any corresponding unoccupied slots of slots 776*a-g* of the second end 744 of the first side frame member 706 directly aligned with the two L-bend connectors 734*a-b*, thereby mechanically interlocking and releasably securing the second lateral frame member 704 with the first side frame member 706 in the same manner described with respect to the first end 710 of the first lateral frame member 702 being secured with the first end 740 of the first side frame member 706.

Referring to FIGS. 7*a* through 7*f*, the second end 714 of the first lateral frame member 702 is then interlockingly secured with the first end 742 of the second side frame member 708 to enable the height of the upper edge 796 of the cross panel 750 of the second side frame member 708 to be maintained at the substantially same height as the upper edge 724 of the transverse portion 718 of the first lateral frame member 702. Such assemblage may be performed by positioning the two L-bend connectors 732*a-b* of the second end 714 of the first lateral frame member 702 such that they are simultaneously aligned with the corresponding second and fourth slots 774*b* and 774*d* in the first end 742 of the second side frame member 708 and then individually or simultaneously inserted into the second and fourth slots 774*b* and 774*d* in the first end 742 of the second side frame member 708, or in any corresponding unoccupied slots of slots 774*a-g* in the first end 742 of the second side frame member 708 directly aligned with the two L-bend connectors 732*a*, 732*b* of the second end 714 of the first lateral frame member 702, thereby mechanically interlocking and releasably securing the second side frame member 708 with the first lateral frame member 702 in the same manner described with respect to the first end 710 of the first lateral frame member 702 being secured with the first end 740 of the first side frame member 706.

Referring to FIGS. 7*a* through 7*f*, the first end 712 of the second lateral frame member 704 may then be interlocked with the second end 746 of the second side frame member 708 to enable the height of the upper edge 796 of the cross panel 750 of the second side frame member 708 to be maintained at the substantially same height as the upper edge 726 of the transverse portion 720 of the second lateral frame member 704. For such positioning, the three L-bend connectors 730*a-c* of the first end 712 of the second lateral frame member 704 are simultaneously aligned with the corresponding first, third and fifth slots 778*a*, 778*c*, and 778*e* in the second end 746 of the second side frame member 708 and then individually or simultaneously inserted into the first, third, and fifth slots 778*a*, 778*c*, and 778*e* in the second end 746 of the second side frame member 708, or in any corresponding unoccupied slots of slots 778*a-g* in the second end 746 of the second side frame member 708 directly aligned with the three L-bend connectors 730*a-c* of the first end 712 of the second lateral frame member 704, thereby mechanically interlocking and releasably securing the second side frame member 708 with the second lateral frame member 704 in the same manner described with respect to the first end 710 of the first lateral frame member 702 being secured with the first end 740 of the first side frame member 706. It is contemplated that a user may assemble the interlocking frame members starting with either of the lateral frame members 702, 704, respectively, or side frame members 706, 708, respectively, as desired.

Figure 7F:
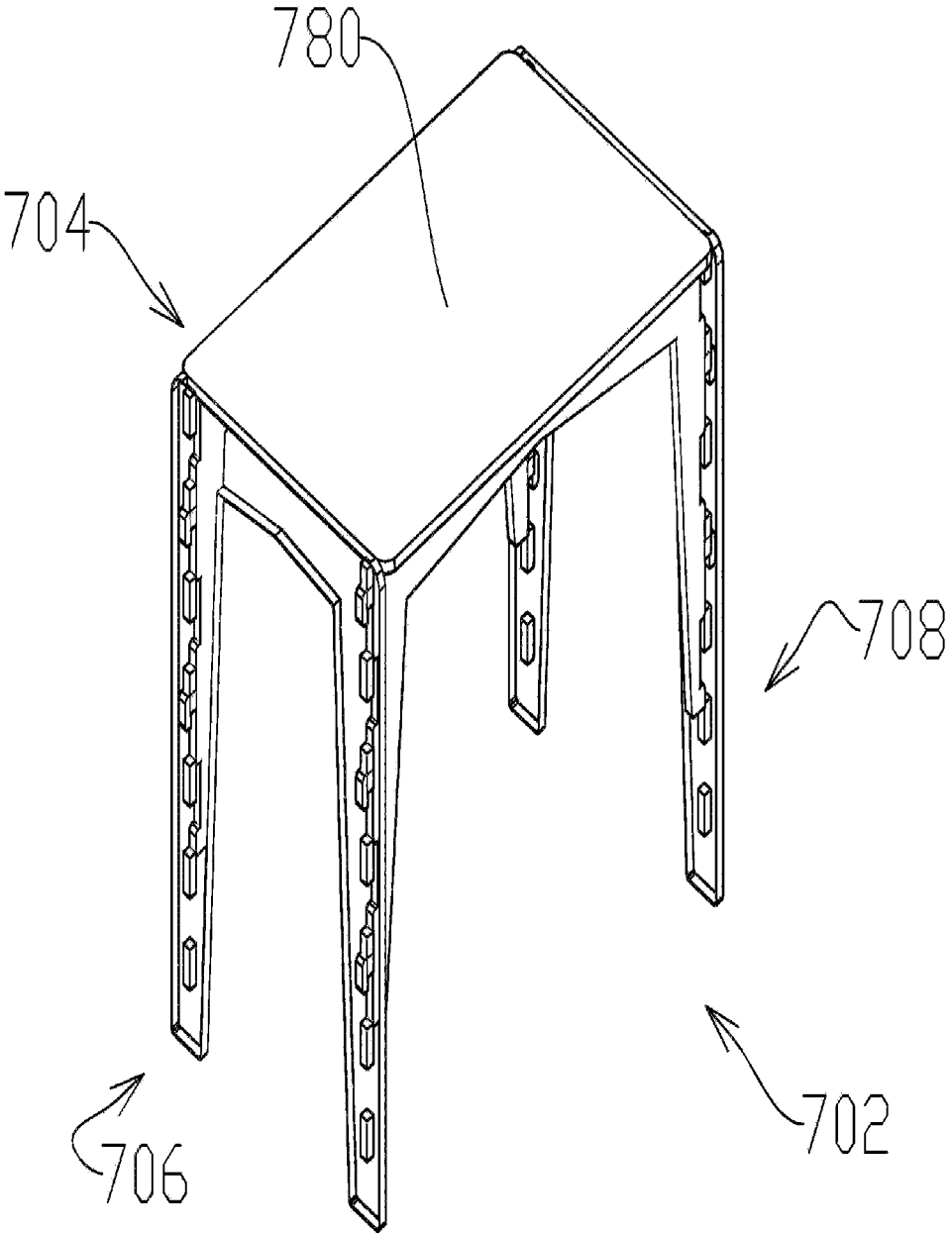
FIG. 7*f* is a perspective view of a modular frame assembly in the configuration of a desk.

Referring to FIGS. 7*a* through 7*f*, the top planar member 780 is then assembled by aligning the parallel chambers 790, 792 on the first and second end 782, 784, respectively, of the lower surface 788 with the upper edges 724, 726 of the transverse portions 718, 720, respectively, of the first and second lateral frame members 702, 704, such that the chambers, 790, 792, having a width and position coincident with and approximately 1.1 times greater than the upper edges 724, 726, receive the upper edges 724, 726 therein. By placing the top planar member 780 over the top of the transverse portions 718, 720, the top planar member 780 is fixed in place longitudinally by the upper edges 794, 796, respectively, of the cross panels 748, 750 of the first and second side frame members 706, 708 and laterally by the chambers 790, 792 positioned over and receiving the upper edges 724, 726 of the transverse portions 718, 720, respectively, of the first and second lateral frame members 702, 704, respectively, so as to form the desk or table assembly such as shown in FIGS. 7*d*, 7*e* and 7*f*. As shown in FIGS. 7*d*, 7*e* and 7*f*, in use, the top planar member 780 may serve as a writing surface or any support surface desired. The height of the desk surface may be variable and adjusted to be from approximately 12" from the surface of a floor or support surface to approximately 50" from the surface of a floor or support surface, with a typical height of a desk assembly for an adult being approximately 20" to 40". In the event the desk surface is utilized as a child's toy, the height of a desk assembly may be about approximately 1" to 24". Here, the top planar member 780 does not extend beyond the upper edges 794, 796 such that further assemblies may be made to the distal or outer side of first and second side frame members 706 and 708 through the use of yet another set of first and second lateral frame members 702, 704 without interference from the top planar member 780. The first and second side frame members 706 and 708 are attached to the first and second lateral frame members 702 and 704 utilizing the odd or even reverse number of L-bend connectors through available slots. As an example, second lateral frame member 702 may be attached to the outer or distal portion of side frame members 706 through the available slots in longitudinal column 764 utilizing L-bend connectors 732*a* and 732*b*. This action will be repeated with lateral frame member 704 attached to the outside or distal portion of longitudinal column 768.

The first and second lateral frame members 702, 704 may be selectively adjustable to increase or decrease the height of the top planar member 780 to accommodate different sized desks for different sized users or as desired, as shown in FIGS. 7*d* and 7*e*. If desired by a user, the height of the top planar member 782 may be adjusted by repositioning the three L-bend connectors 728*a-c* of the first end 710 of the first lateral frame member 702 into three corresponding slots of slots 772*a-g* that are disposed lower in the first end 740 of the first side frame member 706. As illustrated in FIG. 7*e*, a top planar member may be adjusted to a lower height of approximately 12" for use by a toddler. This is performed by aligning the three L-bend connectors 728*a-c* of the first end 710 of the first lateral frame member 702 into the third, fifth and seventh slots 772*c*, 772*e*, and 772*g*, respectively, in the first end 740 of the first side frame member 706. In another embodiment, the length of the first and second ends 710, 712, and 714, 716, respectively, of the first and second lateral frame members 702, 704 may be a shorter length of approximately 6" to 12" and have one or a plurality of L-bend connectors closer or further away from each other (not shown).

To assemble the desk for a toddler, the second end 716 of the second lateral frame member 704 is also repositioned such that the two L-bend connectors 734*a-b* of the second end 716 of the second lateral frame member 706 are aligned with and inserted into the fourth and sixth slots, 776*d* and 776*f* in the second end 744 of the first side frame member 706. Then the two L-bend connectors 732*a-b* of the second end 714 of the first lateral frame member 702 are repositioned to align with inserted into the fourth and sixth slots 774*d* and 774*f* in the first end 742 of the second side frame member 708. The three L-bend connectors 730*a-c* of the first end 712 of the second lateral frame member 704 are repositioned to align with and inserted into the third, fifth and seventh slots 778*c*, 778*e*, and 778*g*, respectively, in the second end 746 of the second side frame member 708. The top planar member 780 is then fixed into position over the upper edges 724, 726 of the transverse portions 718, 720, respectively, of the first and second lateral frame members 702, 704, respectively. This readjustment and reconfiguration of the height of the top planar member 780 may be performed as many times as desired by a user.

Figure 8A:
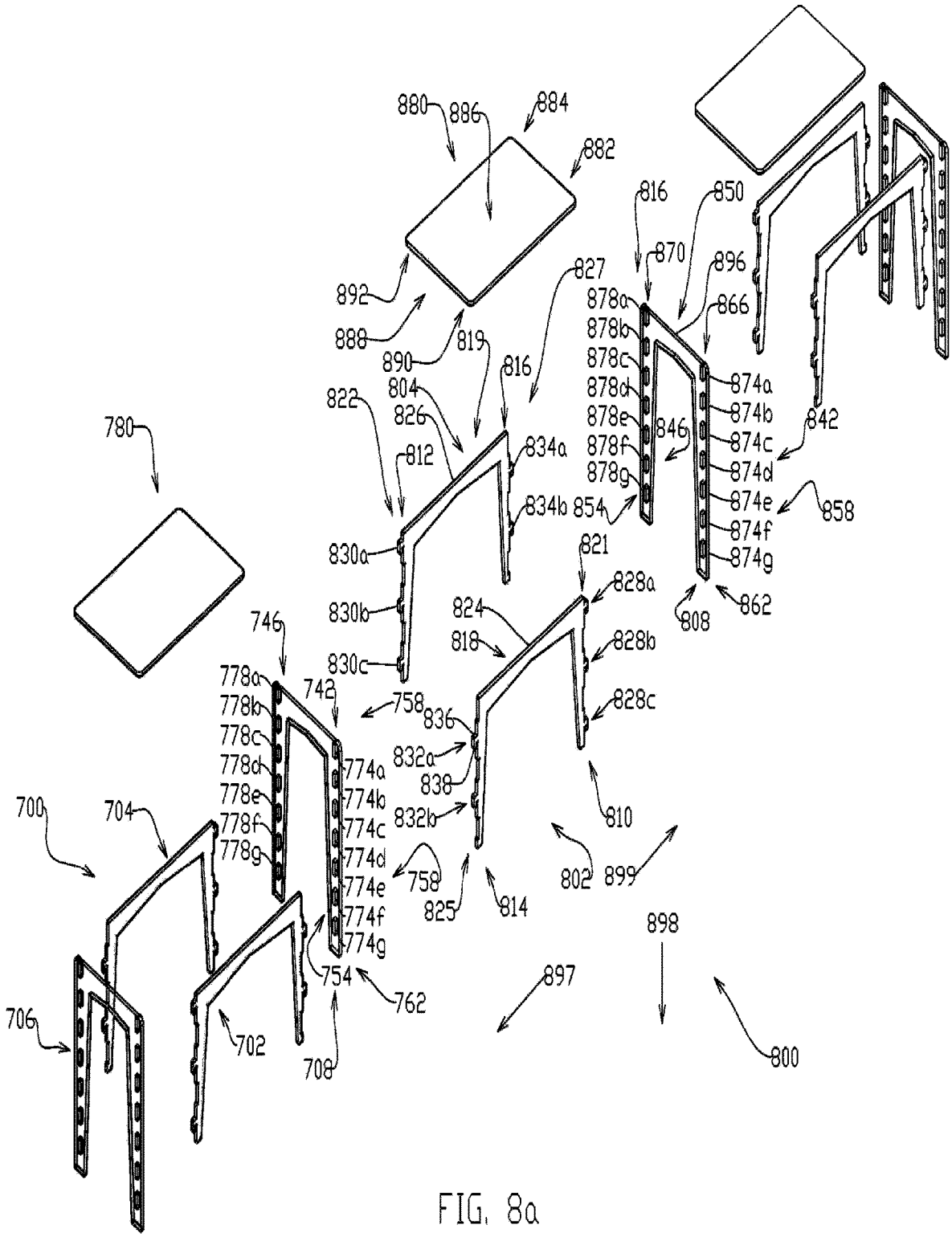
FIG. 8*a* is an exploded perspective view of a modular frame assembly in the configuration of a plurality of desks.

As illustrated in FIG. 8*a*, in this same manner, another desk assembly 800 may be interlockingly secured to the desk assembly 700, as illustrated in FIG. 7*a*, with the addition of substantially identical lateral frame members, side frame members, and top planar members. The positioning of the lateral frame members is determined by the height at which a user desires to position the top planar member of the additional desk assemblies. The assembly of the additional desk assemblies may be configured on either or both sides of the first desk assembly, as shown in FIGS. 8*a* through 8*i*.

In use, as shown in FIG. 8*a*, a user may desire for the top planar member of another interlockingly secured desk assembly 800 to be positioned at a lower height than the top planar member 780 of the first desk assembly 700, or may desire for the top planar member 780 of the first desk assembly 700 to be lowered prior to the assembly of an adjacent desk assembly 800.

As illustrated in FIG. 8*a*, the second desk assembly 800 may have a top planar member 880 lower than the top planar member 780 of the first desk assembly 700 for use for a child or any other desired purpose. The second desk assembly 800 includes the substantially identical frame members as utilized to assemble the first desk assembly 700. As illustrated in FIG. 8*a*, a third and fourth lateral frame member 802, 804, respectively, substantially identical to the lateral frame members 702, 704, are positioned vertically and spaced apart from each other having a longitudinal axis defining a length. The third and fourth lateral frame members 802, 804, respectively, each include a first end 810, 812, respectively, a second end 814, 816, respectively, opposite to the first end 810, 812, respectively, and a transverse portion 818, 819, respectively, extending between the first end 810, 812, respectively, and second end, 814, 816, respectively. The first ends 810, 812, respectively, and second ends 814, 816, respectively, each include at least one flange portion 821, 822 on the first ends 810, 812 and 825, 827 on the second ends, 814, 816, respectively, extending downward from a longitudinal axis of the first end 810, 812, respectively, and second end 814, 816, respectively, of third and fourth lateral frame members 802, 804, respectively. The transverse portion 818, 819, respectively, includes an upper edge 824, 826, respectively.

Referring to FIG. 8*a*, the flange portions 821 and 822 each include a column of three downwardly extending L-bend connectors 828*a-c*, 830*a-c* of the first ends 810, 812 of the first and second lateral frame members 802, 804, respectively. The flange portions 825 and 827 each include a column of two downwardly extending L-bend connectors 832*a-b*, 834*a-b* of the second ends 814, 816 of the first and second lateral frame members 802, 804, respectively. It is contemplated that any number or configuration of L-bend connectors can be provided to the first or second ends 810, 812, or 814, 816 of the first or second lateral frame members 802, 804, respectively. Referring to FIG. 8*a*, the L-bend connectors 828*a-c*, 830*a-c*, 832*a-b*, and 834*a-b* each include an extension portion 836 and corresponding perpendicular locking tabs 838 identical to those illustrated in FIG. 7*a*, with respect to frame assembly 700.

As illustrated in FIG. 8*a*, the third and fourth lateral frame members 802, 804 are substantially identical to each other and to the first and second lateral frame members 702, 704 of assembly 700. In the frame assembly 800, the placement and relative positioning of the third and fourth lateral frame members 802, 804 will be determined by the desired height of the top planar member 880 relative to, and in conjunction with, the height of the top planar member 780 of the frame assembly 700. The third and fourth lateral frame members 802, 804 may be positioned in a substantially identical orientation to the first and second lateral frame members 702, 704, and at any height such first and second lateral frame members 702, 704 may be positioned, or they may be flipped over about their central lateral axis whereupon the first ends 810, 812 of the third and fourth lateral frame members 802, 804 are in the substantially same orientation as the second ends 714, 716 in the frame assembly 700, as shown in FIG. 7*a*, and the second ends 814, 816 are in the substantially same orientation as the first ends 710, 712 in the frame assembly 700, as shown in FIG. 7*a*. In the event the desired height of the top planar member 880 is at a different height than the top planar member 780 then depending on the precise lowered height desired, the orientation of the third and fourth lateral members may be substantially similar to the first and second lateral frame members shown in FIG. 7*a*, or they may be reversed, as shown in FIG. 8*a*.

Figure 8B:
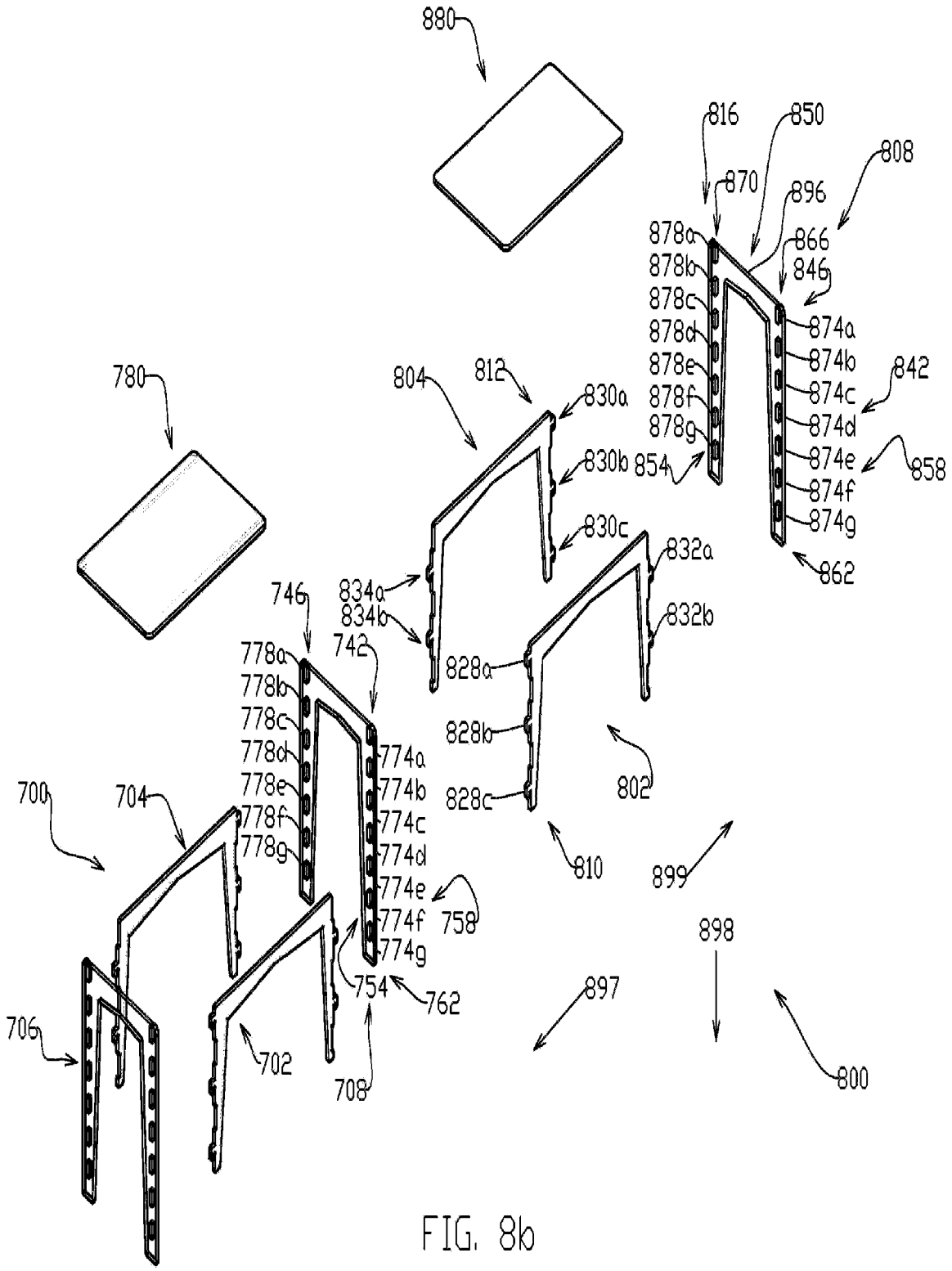
FIG. 8*b* is an exploded perspective view of an alternate modular frame assembly in the configuration of a plurality of desks.
Figure 8C:
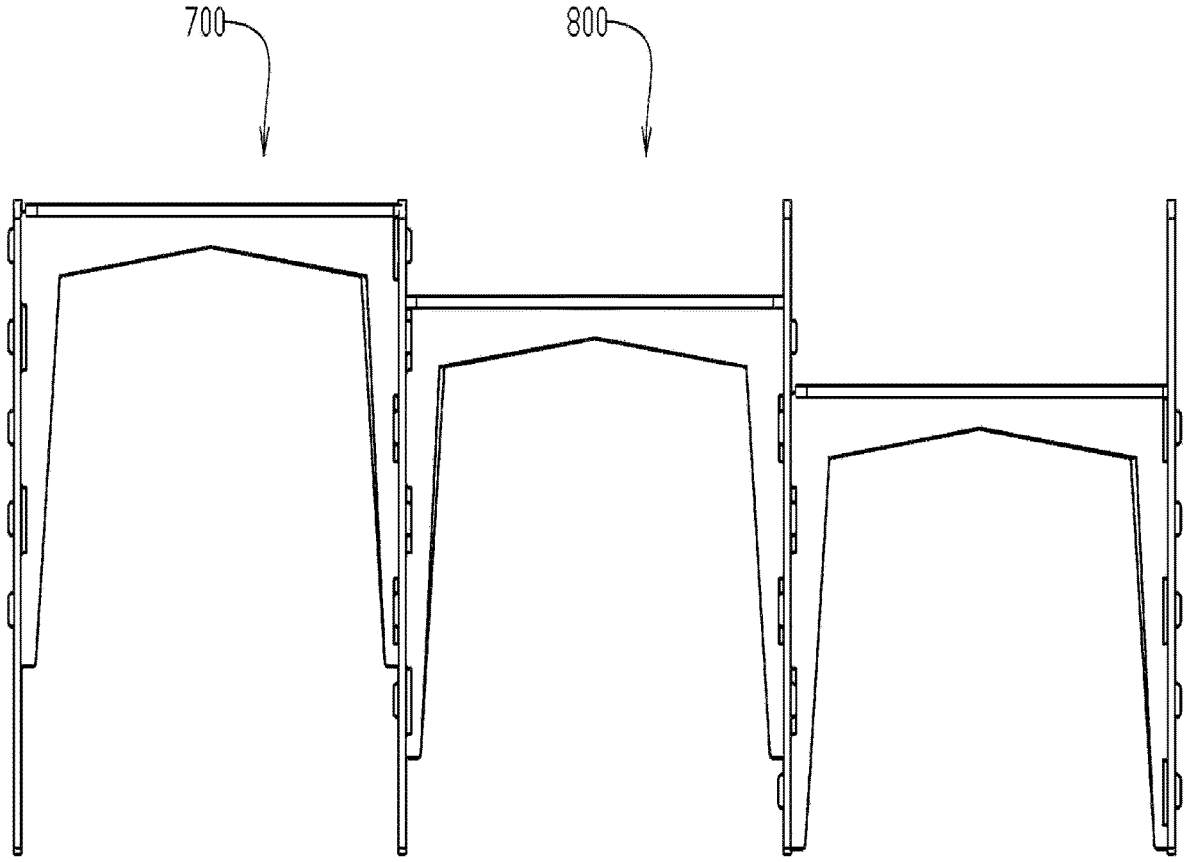
FIG. 8*c* is a side view of a modular frame assembly in the configuration of a plurality of desks.
Figure 8D:
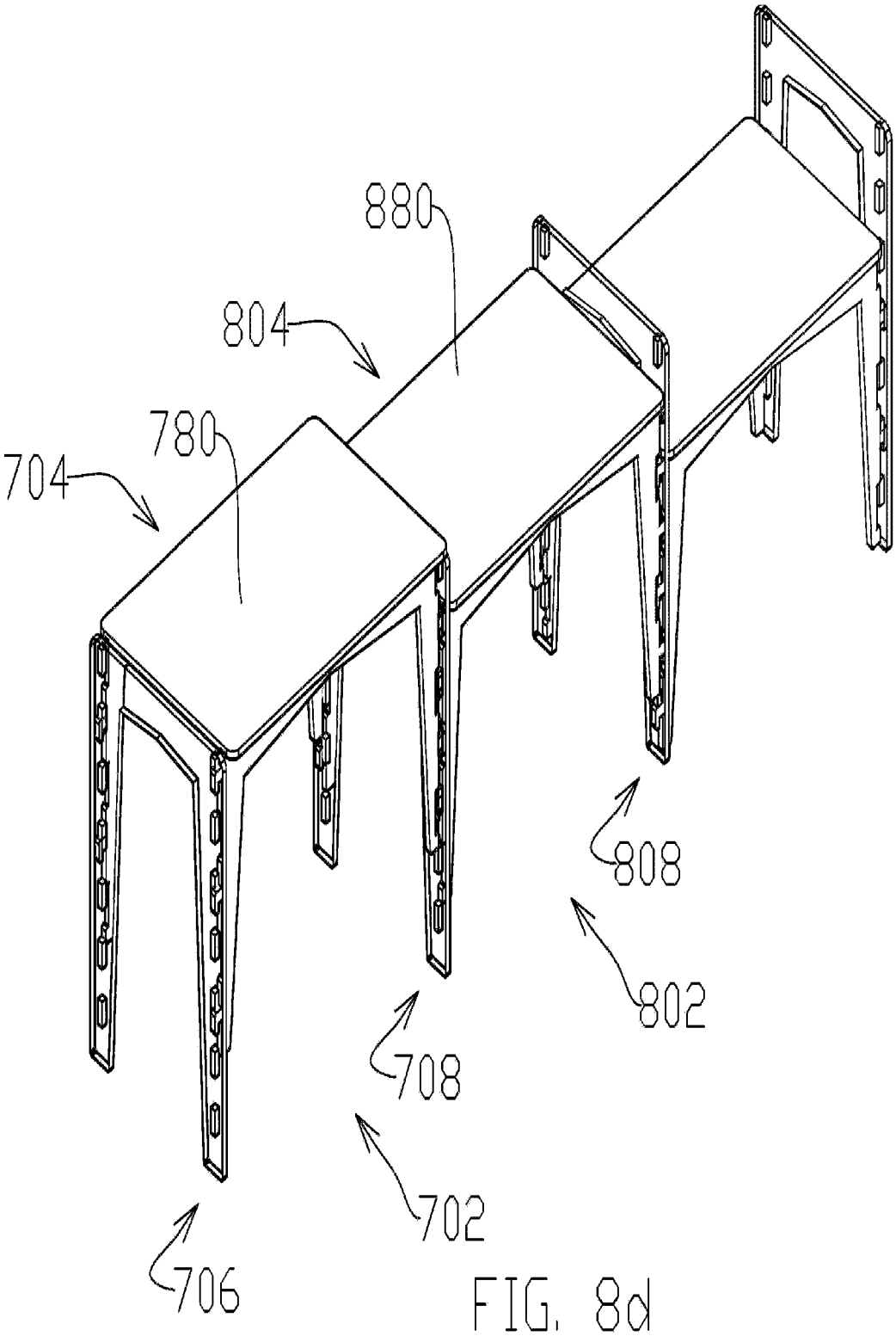
FIG. 8*d* is a perspective view of a modular frame assembly in the configuration of a plurality of desks.
Figure 8E:
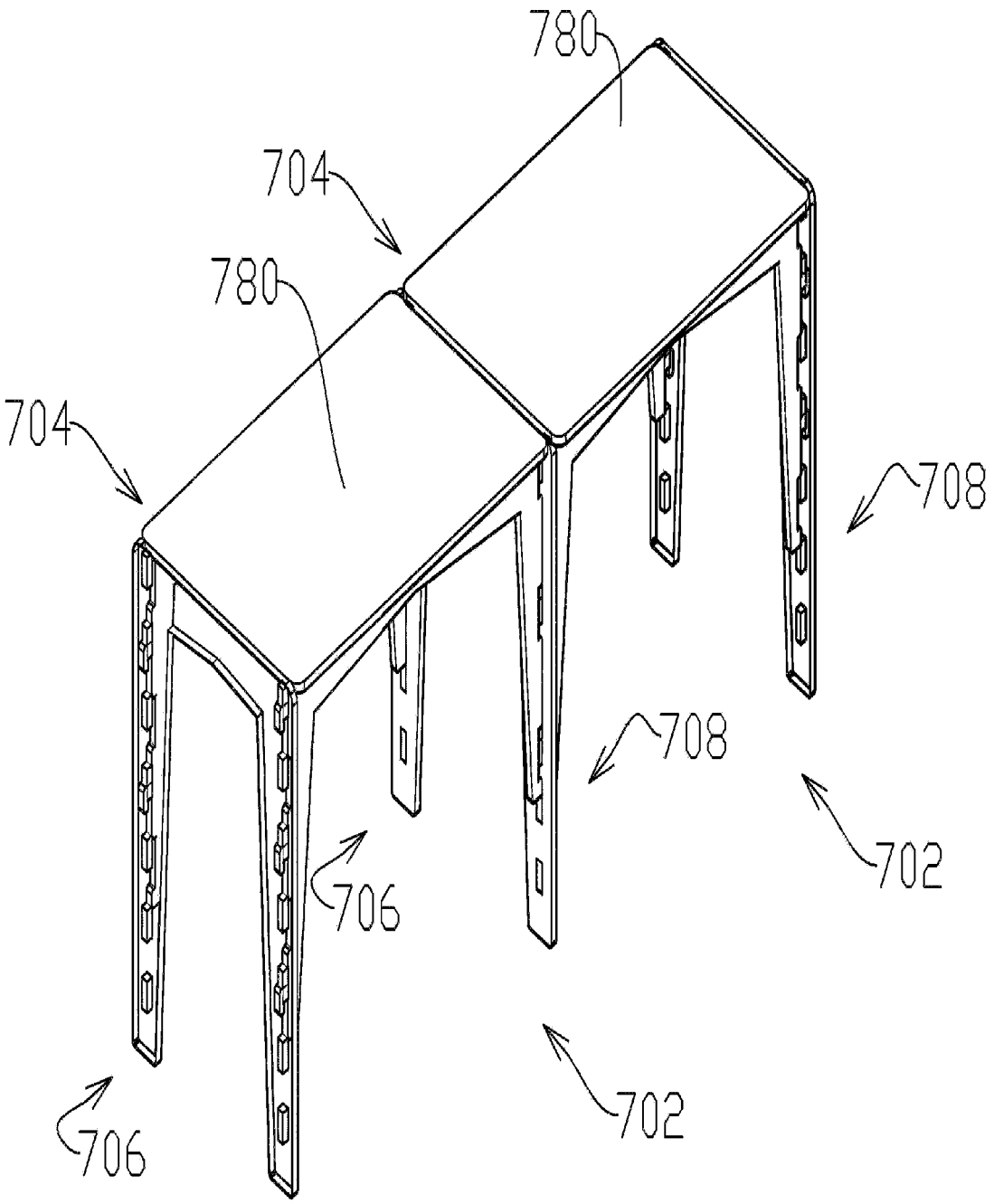
FIG. 8*e* is a perspective view of an alternate modular frame assembly in the configuration of a plurality of desks.

As shown in FIG. 8*b*, in the event the height of the top planar member 880 is desired to be substantially equivalent to the top planar member 780, the third and fourth lateral frame members 802, 804 are positioned in the same orientation as the first and second lateral frame members 702, 704, respectively, as shown in FIG. 7*a*. This positioning enables L-bend connectors 828*a-c*, 834*a-b* of the lateral frame members 802, 804, respectively, to be aligned and inserted into corresponding unoccupied slots 774*a*, 774*c*, 774*e* from among slots 774*a-g* and slots 778*b*, 778*d*, of the first end 742 and second 746 of second side frame member 708, respectively, that are not occupied by the L-bend connectors 732*a-b* and 730*a-c* of the first and second lateral frame members 702, 704, respectively, so as to form an adjacent desk assembly 800 having a top planar member 880 with a height substantially similar to the top planar member 780, as illustrated in FIG. 8*e*.

In another embodiment, in the event the desired height of the top planar member 880 is lower than the top planar member 780, as shown in FIG. 7*a*, by a distance greater than the distance between two receiving members such as 774*a* and 774*b* on the second side frame member 708, then the third and fourth lateral frame members 802, 804 may also remain positioned in the same orientation as the first and second lateral frame members 702, 704, respectively, as shown in FIG. 7*a*. This positioning enables L-bend connectors 828*a-c*, 834*a-b* of the third and fourth lateral frame members 802, 804, respectively, to be aligned and inserted into corresponding unoccupied slots 774*c*, 774*e*, and 774*g* from among slots 774*a-g* and slots 776*d*, and 776*f*, of the first end 742 and second 746 of second side frame member 708, respectively, that are not occupied by the L-bend connectors 732*a-b* and 730*a-c* of the first and second lateral frame members 702, 704, respectively, so as to form an adjacent desk assembly having a top planar member 880 having a height lower than the height of the top planar member 780 of desk assembly 700 (not shown).

As shown in FIG. 8*a*, in the event a user desires the height of the top planar member 880 to be lowered a distance substantially equivalent to the distance between two receiving members such as 774*a* and 774*b* on the second side frame member 708, then the third and fourth lateral frame members 802, 804 are positioned such that the orientation of the third and fourth lateral frame members 802, 804 are in a reversed position to the orientation of the first and second lateral frame members 702, 704, respectively, as shown in FIG. 7*a*. This positioning enables L-bend connectors 832*a-b*, 830*a-c* of the third and fourth lateral frame members 802, 804, respectively, to be aligned and inserted into corresponding unoccupied slots 774*c*, 774*e* from among slots 774*a-g* and slots 778*b*, 778*d*, and 778*f*, of the first end 742 and second 746 of second side frame member 708, respectively, that are not occupied by the L-bend connectors 732*a-b* and 730*a-c* of the first and second lateral frame members 702, 704, respectively, so as to form an adjacent desk assembly having a top planar member 880 having a height lower than the height of the top planar member 780 of desk assembly 700.

As shown in FIG. 8*a*, the modular frame assembly 800 further includes a third side frame member 808 including first end 842, second end 846 opposite to the first end 842, and a cross panel 850 extending therebetween. The cross panel 850 includes an upper edge 896. The third side frame member 808 is parallel and substantially identical to the second side frame member 708. The third side frame member 808 further includes an inner surface 854, an outer surface 858, and a thickness 862 substantially equivalent to the thickness 762 of the second side frame member 708. In an alternative embodiment, the thickness 862 of the third side frame member 808 is different than the thickness 762 of the second side frame member 708.

The first and second ends 842, 846 of the third side frame member 808 are substantially identical the first and second ends 742, 746 of the second side frame member 708, including longitudinal columns 866, 870, respectively, defining one or a plurality of receiving members, or slots 874*a-g*, 878*a-g*. It is contemplated that receiving members, or slots, in the first and second ends 742, 746 of the third side frame member 808 may be configured in an arrangement such that the receiving members are aligned in one or more columns or offset from each other, parallel or skewed, in close or distant proximity, equal or different distance apart, or symmetrical or asymmetrical from each other. It is also contemplated that the number or configuration of receiving members in a first end of a side member may be the same or different than in the second end of a side member, the number or configuration of receiving members in one side frame member may be different than in another side frame member, and the height of the side members may be the same or different than each other. Referring to FIG. 8*a*, the columns 864, 866, of the third side frame member 808 each includes seven slots 874*a-g* and 878*a-g*, respectively, however any number of slots in any shape, height, width or configuration, can be provided.

Referring to FIG. 8*a*, the modular frame assembly 800 further includes a top planar member 880 having a first end 882 and a second end 884 opposite to the first end 882. Top planar member 880 further includes an upper surface 886 and a lower surface 888. The lower surface 888 of the top planar member 880 includes parallel chambers 890, 892 on the first and second end of the lower surface 888 coincident with the longitudinal axis of the top planar member 880 (not shown), substantially similar to that shown in FIG. 7*b*. In use, a modular frame assembly 800 is configured in a substantially similar manner as the modular frame assembly 700 is configured in FIG. 7*a*, with the exception of the determination of whether the position of the third and fourth lateral frame members 802, 804, respectively will be assembled in a reverse manner. As illustrated in FIG. 8*a*, the two L-bend connectors 832*a-b* of the second end 814 of the third lateral frame member 802 are simultaneously aligned with the corresponding third and fifth slots 774*c*, 774*e* of the first end 742 of the second side frame member 708. The first end 742 of the second side frame member 708 has second and fourth slots 774*b* and 774*d* filled with the L-bend connectors 732*b* and 732*d* of the second end of the first lateral frame member. Accordingly, the third and fifth slots 774*c*, 774*e*, respectively, of the first end 742 of the second side frame member 708 are empty or unoccupied ("unoccupied") and available and aligned to receive the L-bend connectors 832*a-b* of the second end 814 of the third lateral frame member. The L-bend connectors 832*a-b* are inserted in direction 897 into the corresponding third and fifth slots 774*c*, 774*e* from the outer surface 758 of the first end 742 of the second side frame member 708, or in any corresponding unoccupied slots among the slots 774*a-g* of the first end 742 of the second side frame member 708 directly aligned with the two L-bend connectors 832*a-b*, until the extension portions 836 and locking tabs 838 of each of the L-bend connectors 832*a-b* pass through the thickness 762 of the first end 742 of the second side frame member 708 and the L-bend connectors 832*a-b* are then pressed downwardly simultaneously by a user pressing down the second end 814 of the third lateral frame member 802 in the direction of gravity as indicated by arrow 898. This action causes the downwardly extending locking tabs 838 of L-bend connectors 832*a-b* to be mechanically captured by the inner surface 754 of the first end 742 of the second side frame member 708 directly beneath the slots 774*c*, 774*e* while engaging the extension portions 836 in the slots 774*c* and 774*e*, thereby mechanically interlocking and releasably securing the third lateral frame member 802 with the second side frame member 708.

Referring to FIG. 8*a*, the fourth lateral frame member 804 may then be interlocked with the second side frame member 708 at the same height as the third lateral frame member 802. Such assemblage may be performed by positioning the first end 812 of the fourth lateral frame member 804 such that its three L-bend connectors 830*a-c* are aligned with the second, fourth and sixth slots 778*b*, 778*d*, and 778*f* in the second end 746 of the second side frame member 708. Once aligned, the three L-bend connectors 830*a-c* on the first end 812 of the fourth lateral frame member 804 can be simultaneously inserted into the corresponding slots 778*b*, 778*d*, and 778*f* in the second end 746 of the second side frame member 708, or in any corresponding unoccupied slots among slots 778*a-g* of the second end 746 of the second side frame member 708 directly aligned with the three L-bend connectors 830*a-c*, thereby mechanically interlocking and releasably securing the fourth lateral frame member 804 with the second side frame member 708.

As illustrated in FIG. 8*a*, similarly, the three L-bend connectors 828*a-c* of the first end 810 of the third lateral frame member 802 are simultaneously aligned with and inserted in direction 899 into the corresponding second, fourth, and sixth slots 874*b*, 874*d*, and 874*f*, respectively, of the third side frame member 808 from the inner surface 854 of the third side frame member 808, or in any corresponding unoccupied slots among the slots 874*a-g* of the first end 842 of the third side frame member 808 directly aligned with the three L-bend connectors 828*a-c*, until the extension portions 836 and locking tabs 838 of each of the L-bend connectors 828*a-c* pass through the thickness 862 of the first end 842 of the third side frame member 808 and the L-bend connectors 828*a-c* are then pressed downwardly simultaneously by a user pressing down the first end 842 of the third side frame member 808 in the direction of gravity as indicated by arrow 898. This action causes the downwardly extending locking tabs 838 of L-bend connectors 828*a-c* to be mechanically captured by the inner surface 854 of the first end 842 of the third side frame member 808 directly beneath the slots 874*b*, 874*d*, and 874*f* while engaging the extension portions 836 in the slots 874*b*, 874*d*, and 874*f*, thereby mechanically interlocking and releasably securing the third lateral frame member 802 with the third side frame member 808.

Referring to FIG. 8*a*, the second end 816 of the fourth lateral frame member 804 is then interlockingly secured with the second end 846 of the third side frame member 808. Such assemblage may be performed by positioning the two L-bend connectors 834*a-b* of the second end 816 of the fourth lateral frame member 804 such that they are simultaneously aligned with the corresponding third and fifth slots 878*c* and 878*e* in the second end 846 of the third side frame member 808 and then simultaneously inserted into the third and fifth slots 878*c* and 878*e* in the second end 846 of the third side frame member 808, or in any corresponding unoccupied slots among slots 878*a-g* in the second end 846 of the third side frame member 808 directly aligned with the two L-bend connectors 834*a-b* of the second end 816 of the fourth lateral frame member 804, thereby mechanically interlocking and releasably securing the third side frame member 808 with the fourth lateral frame member 804.

Referring to FIG. 8*a*, the top planar member 880 is then assembled onto the upper edges 824, 826 of the third and fourth lateral frame members 802, 804 in the same manner as the top planar member 780 was assembled onto the upper edges 724, 726 of the first and second lateral frame members 702, 704, thereby fixing the top planar member 880 in place. With the addition of another desk assembly adjacent to desk assembly 800, a row of desk assemblies may be configured as shown in FIG. 8*c*. As shown in FIGS. 8*c* and 8*d*, in use, the top planar member 880 may serve as a writing surface or any support surface desired.

Figure 8F:
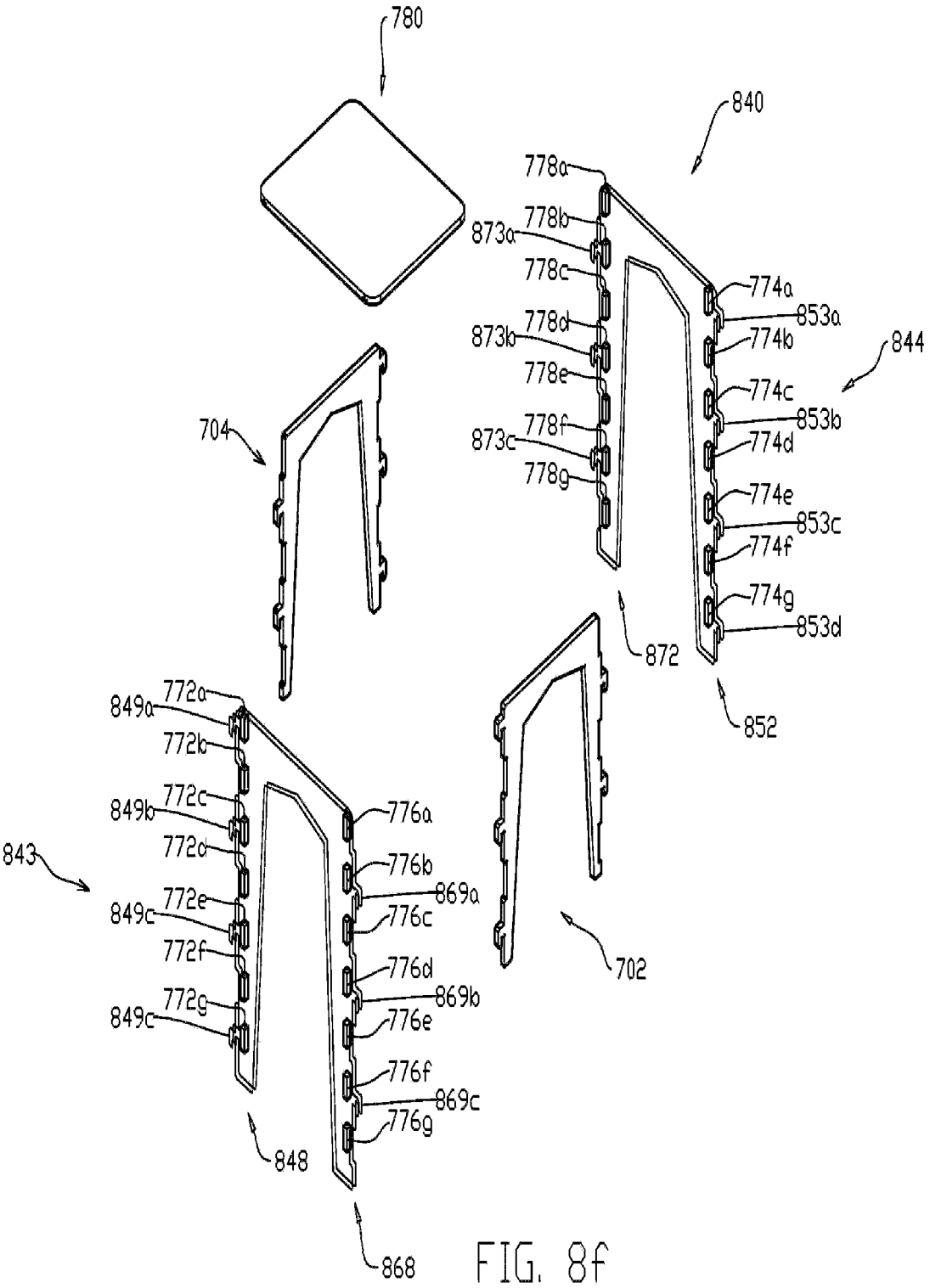
FIG. 8*f* is an exploded perspective view of a modular frame assembly in the configuration of a corner assembly.
Figure 8G:
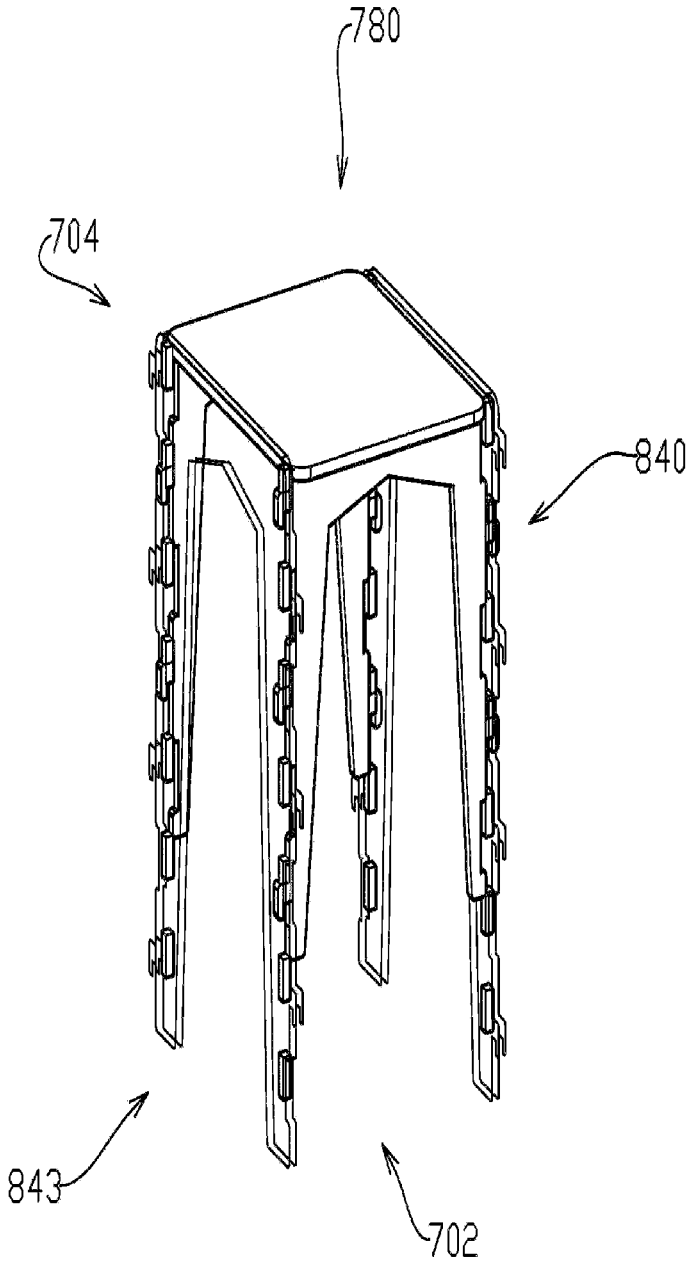
FIG. 8*g* is a perspective view of a modular frame assembly in the configuration of a corner assembly.
Figure 8H:
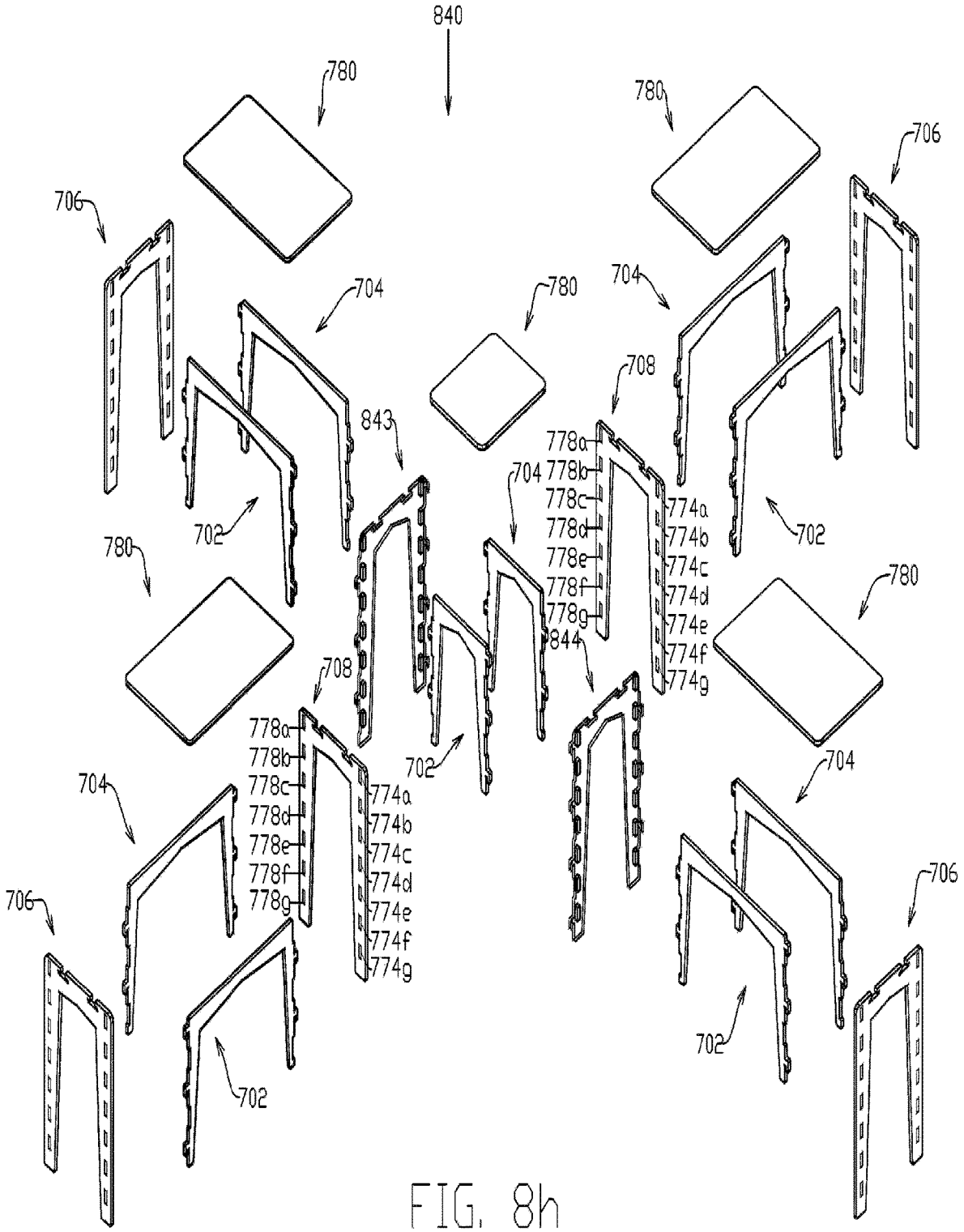
FIG. 8*h* is an exploded perspective view of an alternate modular frame assembly in the configuration of a plurality of desks.
Figure 81:
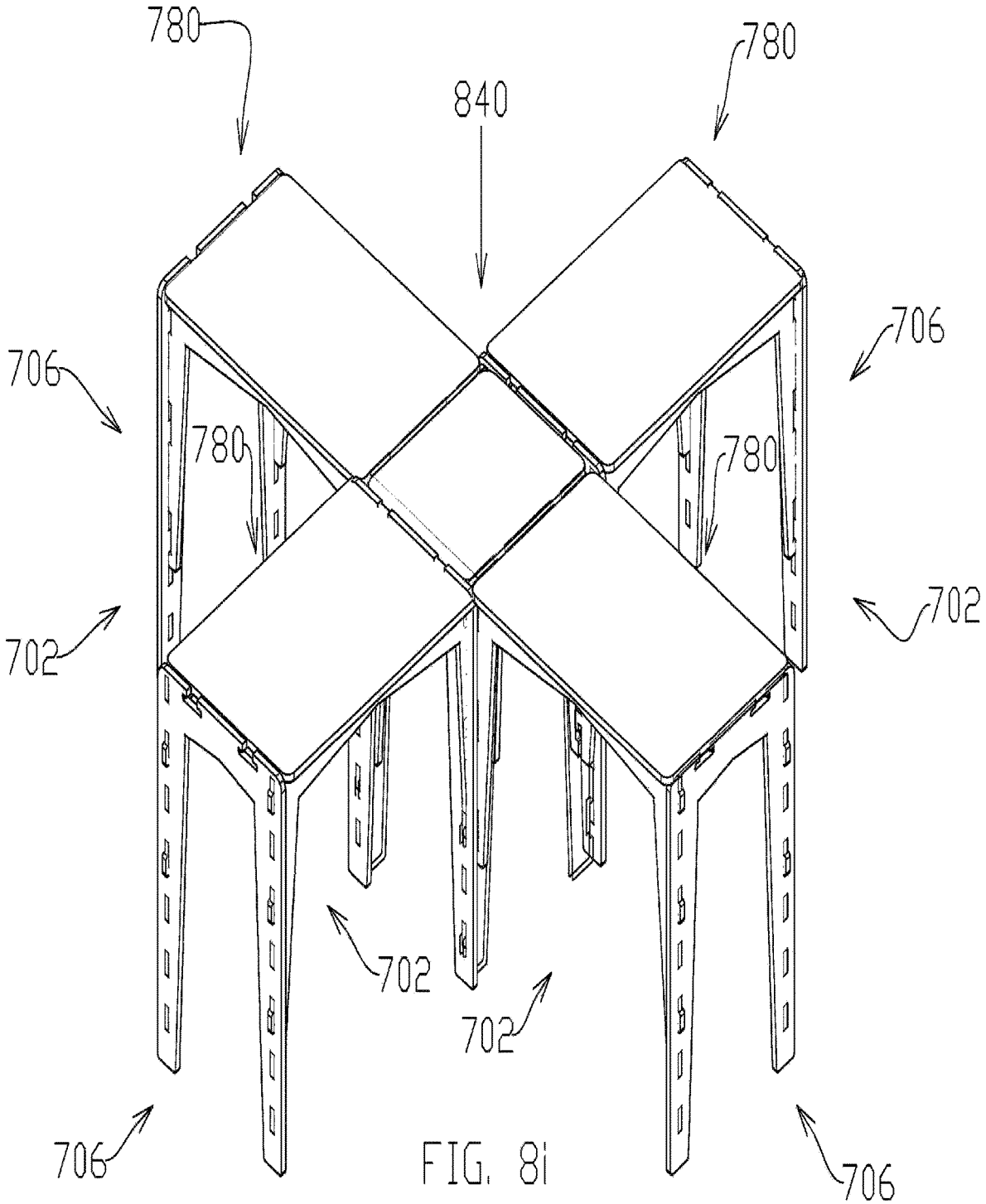

As shown in FIGS. 8*a* through 8*e*, this pattern of assembling modular frame assemblies may be repeated to permit any number of desk assemblies to be aligned in a row. Additional desk assemblies may also be configured to enable a perpendicular row of desk assemblies to be constructed, as shown in FIGS. 8*h* and 8*i*. As shown in FIGS. 8*f* through 8*i*, a perpendicular row of desk assemblies may be configured with the use of a corner assembly 840.

As shown in FIGS. 8*f* through 8*i*, corner assembly 840 is assembled using a substantially similar pair of first and second lateral frame members 702, 704, and a top planar member 780, as described in the construction of modular frame assembly 700 in FIG. 7*a* and first and second corner side frame members 843, 844. The first and second corner side frame members 843, 844 each include first ends 848, 852 and second ends 868, 872. The first and second ends 848, 852 and 868, 872, respectively, include a plurality of receiving members 772*a-g*, 774*a-g*, 776*a-g*, and 778*a-g*, as described with respect to the first and second ends 740, 744 and 742, 746 of the first and second side frame members 706, 708 in FIG. 7*a*.

The first and second ends 848, 852 and 868, 872, respectively, also include one or a plurality of L-bend connectors. As shown in FIG. 8*f*, the first ends, 848, 852 include four L-bend connectors 849*a-d*, 853*a-d*, and the second ends, 868, 872 include three L-bend connectors 869*a-c*, and 873*a-c*, respectively.

In use, as shown in FIG. 8*f*, a corner assembly 840 may be utilized when a user desires to configure desk assemblies adjacent to either of the first and/or second lateral frame members 702, 704 and/or adjacent to either the first and/or second corner side frame member 843, 844, as shown in FIG. 8*h*. A corner assembly 840 is configured in a substantially similar manner as the modular frame assembly 700 was configured in FIG. 7*a*. As shown in FIGS. 8*f* and 8 *h*, the unoccupied receiving members 772*a-g*, 774*a-g*, 776*a-g*, and 778*a-g* of the first and second ends 848, 852 and 868, 872, respectively are available to receive L-bend connectors of additional lateral frame members 702, 704, respectively, of additional desk assemblies extending down the longitudinal axis of the top planar member 780. It is contemplated that a first and second end can be flipped over about a central lateral axis whereupon the first end 848 is in the position of the second end 868, and the second end 868 is in the position of the first end 848, as shown in FIG. 8*f*. Similarly, to assemble additional desk assemblies in a perpendicular orientation, the unoccupied L-bend connectors 849*a-d*, 853*a-d* on the first ends 848, 852 and the unoccupied L-bend connectors 869*a-c* and 873*a-c* on the second ends 868, 872, respectively, are available to be aligned with and inserted into receiving members 774*a-g*, 778*a-g* of additional adjacent side frame members 708 of additional desk assemblies extending down the lateral axis of the top planar member 780, thereby assembling the perpendicular desk assemblies as shown in FIG. 8*i*.

It is contemplated that other modular frame assemblies may be constructed from or in combination with the assemblies 700 or 800, as illustrated in FIGS. 7*a*-7*f* and 8*a*-8*i*, such that a user can optionally use the frame members of FIGS. 7*a*-*g* and 8*a*-*i*, to provide a user with numerous and varied options for assembling the frame member to a desired function.

Figure 9A:
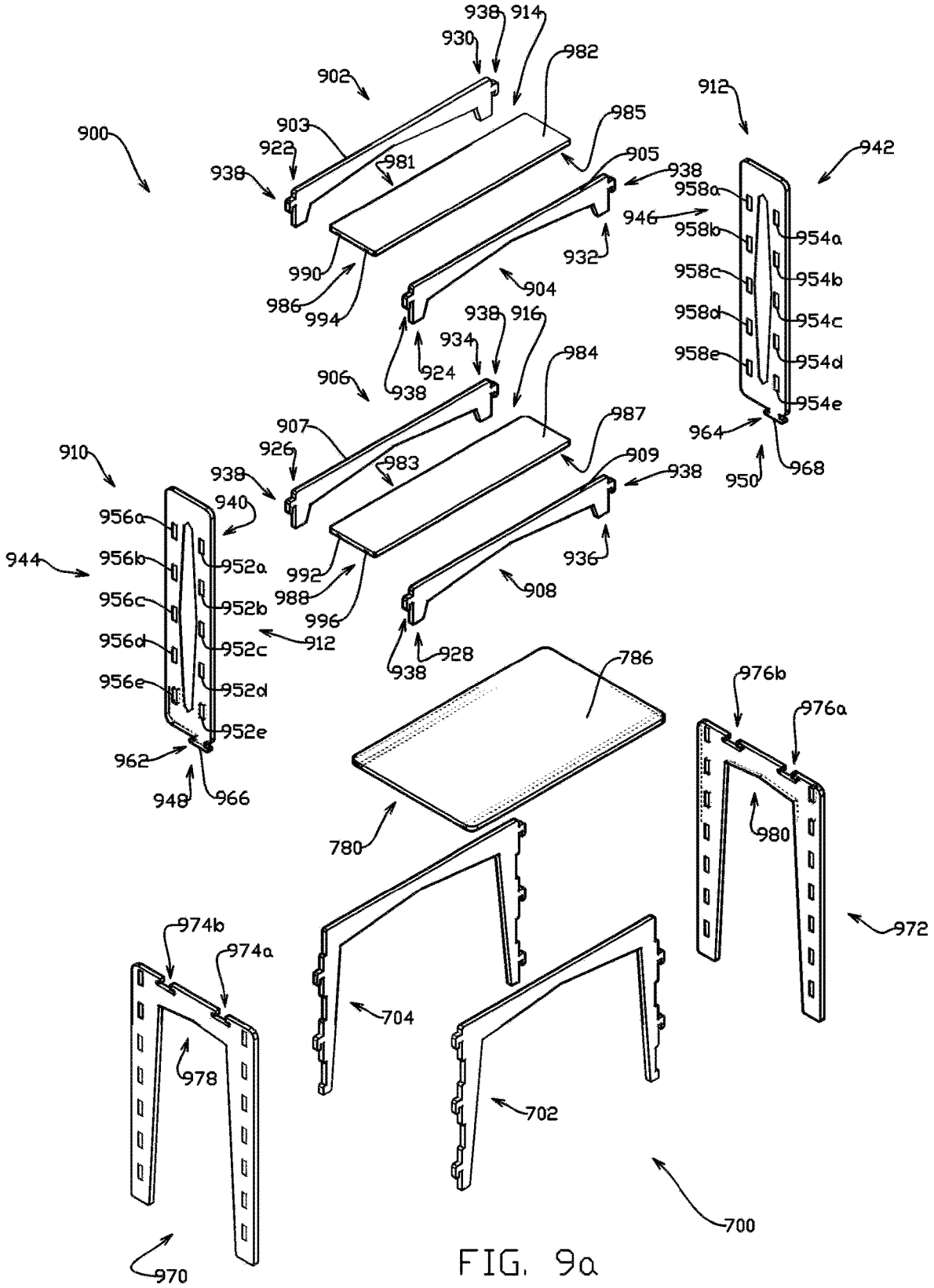
FIG. 9*a* is an exploded perspective view of a modular frame assembly in the configuration of a desk and shelf assembly.

Referring to FIG. 9*a*, a modular interlocking shelf frame assembly 900 is illustrated. The shelf frame assembly 900 includes a desk assembly 700, as shown in FIG. 7*a*. As shown in FIG. 9*a*, the first and second side frame members 706, 708 of the desk assembly illustrated in FIG. 7*a* are modified to form first and second side frame members 970, 972 each of which includes one or more receiving members, or dual-end slots, 974*a*-*b*, 976*a*-*b*, respectively, on the cross panels 978, 980, respectively.

The shelf frame assembly 900 further includes a pair of first and second lateral frame members of the desk assembly illustrated in FIG. 7*a* modified in length to form a pair of first and second lateral shelf frame members 902, 904, and 906, 908, respectively. The shelf frame assembly 900 further includes first and second side shelf frame members 910, 912, respectively. Shelf frame assembly 900 further includes additional top planar members forming a first and second top shelf planar member 914, 916. The first and second lateral shelf frame members 902, 904, 906, 908, respectively, first and second side shelf frame members 910, 912, and first and second top shelf planar members 914, 916 form a shelf assembly above an upper surface 786 of the top planar member 780 of desk assembly 700 as illustrated in FIG. 7*a*.

The first and second lateral shelf frame members 902, 904 and 906, 908 each include a first end 922, 924, 926, 928, respectively, and a second end 930, 932, 934, 936, respectively, opposite to the first end 922, 924, 926, 928, respectively. The first ends 922, 924, 926, 928, respectively, and second ends 930, 932, 934, 936, respectively, each have at least one or more L-bend connectors 938, the L-bend connector 938 having the same members and performing in the same manner as shown with respect to L-bend connector 728 in FIG. 7*c*. L-bend connectors 938 in FIG. 9, or L-bend connectors 728 in FIG. 7*c*, can be used on any of the modular frame assemblies described herein in connection with FIGS. 1-11 or any other modular frame assemblies described herein.

The first and second side shelf frame members 910, 912 include a first end 940, 942 and second end 944, 946 opposite to the first end 940, 942, and a bottom surface 948, 950. The first ends 940, 942 and second ends 944, 946 of the side shelf frame members 910, 912 each having a plurality of receiving members 952*a*-*e*, 954*a*-*e*, and 956*a*-*e*, 958*a*-*e* configured along the longitudinal axis of the side shelf frame members 910, 912. In alternative embodiments, the side shelf frame members 910, 912 may have one or a plurality of receiving members configured in an arrangement such that the receiving members are aligned in one or more columns or offset from each other, parallel or skewed, in close or distant proximity, equal or different distance apart, or symmetrical or asymmetrical from each other. First and second side shelf frame members 910, 912 can be used on any of the modular frame assemblies described herein in connection with FIGS. 1-11 or any other modular frame assemblies described herein.

Referring to FIG. 9*a*, the receiving members 952*a*-*e*, 954*a*-*e*, and 956*a*-*e*, 958*a*-*e* are configured to receive the L-bend connectors 938 of the first end 922, 924, 926, 928, respectively, and a second end 930, 932, 934, 936, respectively, of the first and second lateral shelf frame members 902, 904 and 906, 908, respectively. In an alternative embodiment, the first ends 940, 942 and second ends 944, 946 of the side shelf frame members 910, 912 may have a single set of columns configured to receive the L-bend connectors 938 of the first and second lateral shelf frame members 902, 904 and 906, 908. Referring to FIG. 9*a*, the bottom surfaces 948, 950 of the side shelf frame members 910, 912 have a flange portion 962, 964. The flange portion 962, 964 includes a dual-end connector 966, 968. The dual-end connectors 966, 968 can be received by the dual-end slots, 974*a* or 974*b*, and 976*a* or 976*b*, respectively, on the cross panels 978, 980, respectively. In an alternative embodiment, there may be one or a plurality of flange portions on the bottom surface 948, 950 of the side shelf frame members 910, 912, having any shape, configuration or orientation. In one embodiment, the flange portion may be an L-bend connector 938. It is contemplated that dual-end connectors can be used in the same manner as any L-bend connectors on any of the modular frame assemblies described herein in connection with FIGS. 1-11 or any other modular frame assemblies described herein.

In use, to configure the shelf frame assembly 900, as shown in FIG. 9*a*, the dual-end connectors 966, 968 on the bottom surface 948, 950, respectively, of the first and second side shelf frame members 910, 912 are aligned adjacent to and received by the receiving member 974*b*, 976*b*, respectively, on the cross panel 978, 980, respectively, of the first and second side frame members 970, 972, by sliding the dual-end connectors 966, 968 into the friction fit dual-end slot 974*b*, 976*b* on the cross panels 978, 980. In another embodiment, the flange portion may include a plurality of dual-end connectors, which slide individually or simultaneously into similarly shaped receiving members, or dual-end slots, 974*a*-*b*, 976*a*-*b*, respectively, on the cross panel of the first and second side frame members 970, 972. In an alternative embodiment, the first and second shelf side frame members 910, 912 may be formed integral with the side frame members 970, 972, respectively.

The shelf lateral frame members 902, 904, 906, 908 are vertically oriented and positioned in between the first and second shelf side frame members 910, 912. The shelf lateral frame members 902, 904, 906, 908 each have an upper edge 903, 905, 907, 909, respectively. The shelf assembly is performed by aligning the L-bend connector 938 of the first end 922 of the first shelf lateral frame member with one of the receiving members 956*a*-*e* of the side shelf frame member 910. A user may determine the desired receiving member 956*a*-*e* into which the L-bend connector 938 is aligned and inserted by determining the height at which it desires a first shelf to be positioned. A user will determine the height from a choice of selective locations or receiving members 956*a*-*e* on the side shelf frame member 910. Additionally, a user may determine to position one or a plurality of shelves on the side shelf frame member 910.

In use, as illustrated in FIG. 9*a*, in one embodiment, although any number of alternatives may be considered in any desired sequence, a user may align and insert the L-bend connector 938 of the first end 922 of the first shelf lateral frame member 902 with receiving member 956*a* of the side shelf frame member 910. The L-bend connector 938 of the second end 930 of the first shelf lateral frame member 902 is then aligned with and inserted into receiving member 958*a* of the side shelf frame member 912. The L-bend connector 938 of the first end 924 of the second shelf lateral frame member 904 is then aligned with and inserted into receiving member 952*a* of the side shelf lateral frame member 910. The L-bend connector 938 of the second end 932 of the second shelf lateral frame member 904 is then aligned with and inserted into receiving member 954*a* of the side shelf lateral frame member 912. The L-bend connector 938 of the first end 926 of the third lateral frame member 906 is then aligned with and inserted into any of the unoccupied receiving member of the slots 956*b-e*. In one embodiment, the L-bend connector 938 of the first end 926 of the third lateral frame member 906 is aligned with and inserted into receiving member 956*d* of the side shelf lateral frame member 910. The L-bend connector 938 of the second end 934 of the third lateral frame member 906 is then aligned with and inserted into receiving member 958*d* of the side shelf lateral frame member 912. The L-bend connector 938 of the first end 928 of the fourth lateral frame member 908 is then aligned with and inserted into receiving member 952*d* of the side shelf lateral frame member 910. The L-bend connector 938 of the second end 936 of the fourth lateral frame member 908 is then aligned with and inserted into receiving member 954*d* of the side shelf lateral frame member 912.

In use, as illustrated in FIG. 9*a*, shelf top planar members 914, 916 are then longitudinally positioned on the top of the pair of shelf lateral frame members 902, 904, and 906, 908, respectively, and in between the first and second shelf side frame members 910, 912. The shelf top planar members 914, 916 each have a first end 981, 983 and a second end 985, 987 opposite to the first end 981, 983, and an upper surface 982, 984, respectively, and a lower surface 986, 988, respectively. As shown in FIG. 7*a* with respect to the top planar member 780, the lower surfaces 986, 988 of the shelf top planar members 914, 916 include parallel chambers 990, 992, and 994, 996, respectively, on first and second ends 981, 983, 985, 987, respectively, of the lower surfaces 986, 988, coincident with the longitudinal axis of the shelf top planar members 914, 916. In an alternative embodiment, any number of channels may be provided.

Figure 9B:
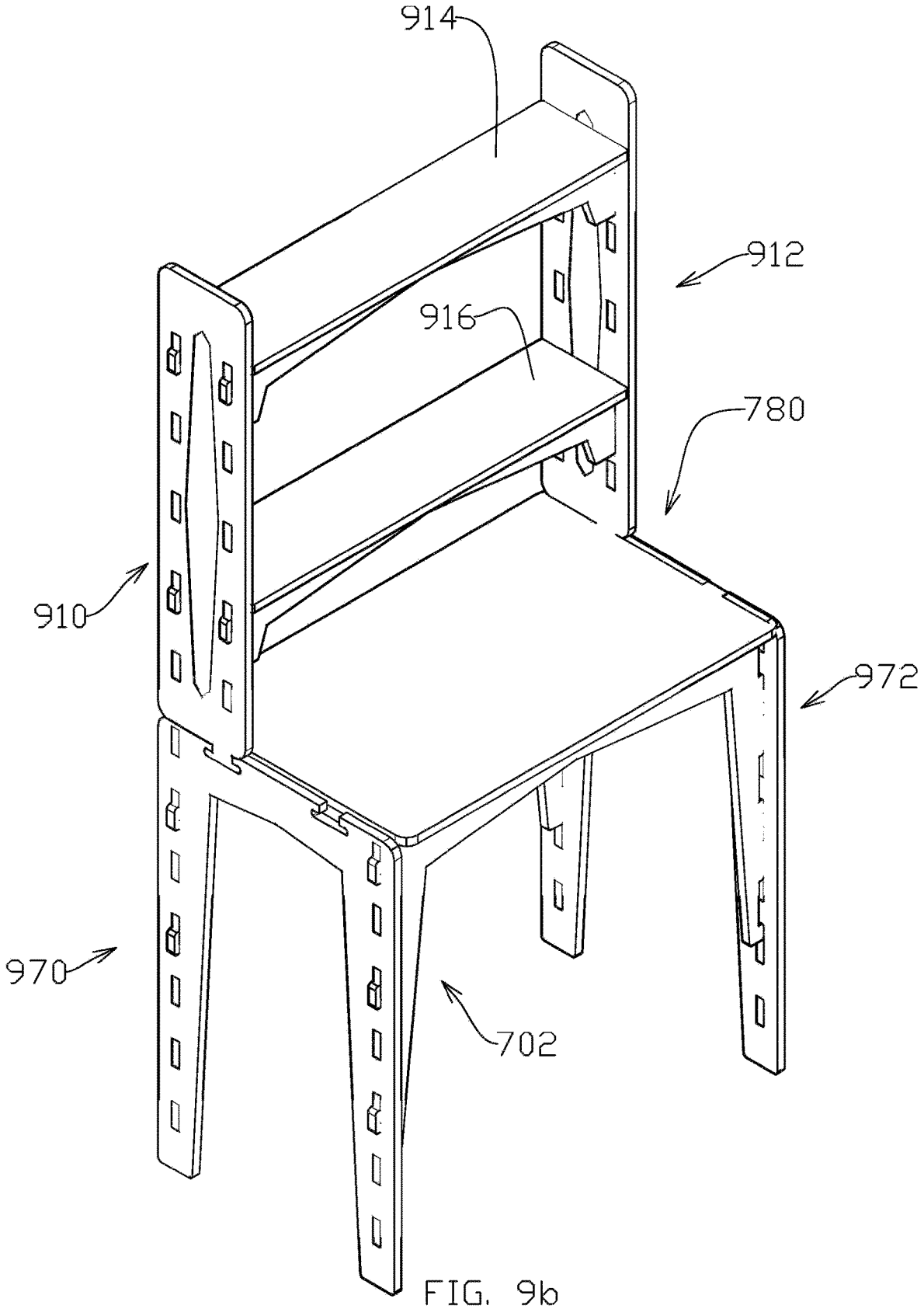
FIG. 9*b* is a perspective view of a modular frame assembly in the configuration of a desk and shelf assembly.

Referring to FIG. 9*a*, the chambers 990, 992, and 994, 996 each have a width and position coincident with upper edges 903, 905, 907, 909 of the shelf lateral frame members 902, 904, 906, 908, respectively, to receive the upper edges 903, 905, 907, 909, respectively, within the chambers 990, 992, and 994, 996, respectively. By placing the shelf top planar members 914, 916 over the top of the upper edges 903, 905, 907, 909, respectively, the shelf top planar members 914, 916 are fixed in place longitudinally by the first and second shelf side frame members 910, 912 and laterally by the chambers 990, 992, 994, 996, respectively, positioned over the upper edges 903, 905, 907, 909 of the shelf lateral frame members 902, 904, 906, 908, respectively. The shelf top planar members 914, 916 serve as a shelf surface so as to form the shelf frame assembly such as shown in FIG. 9*b*.

Figure 10A:
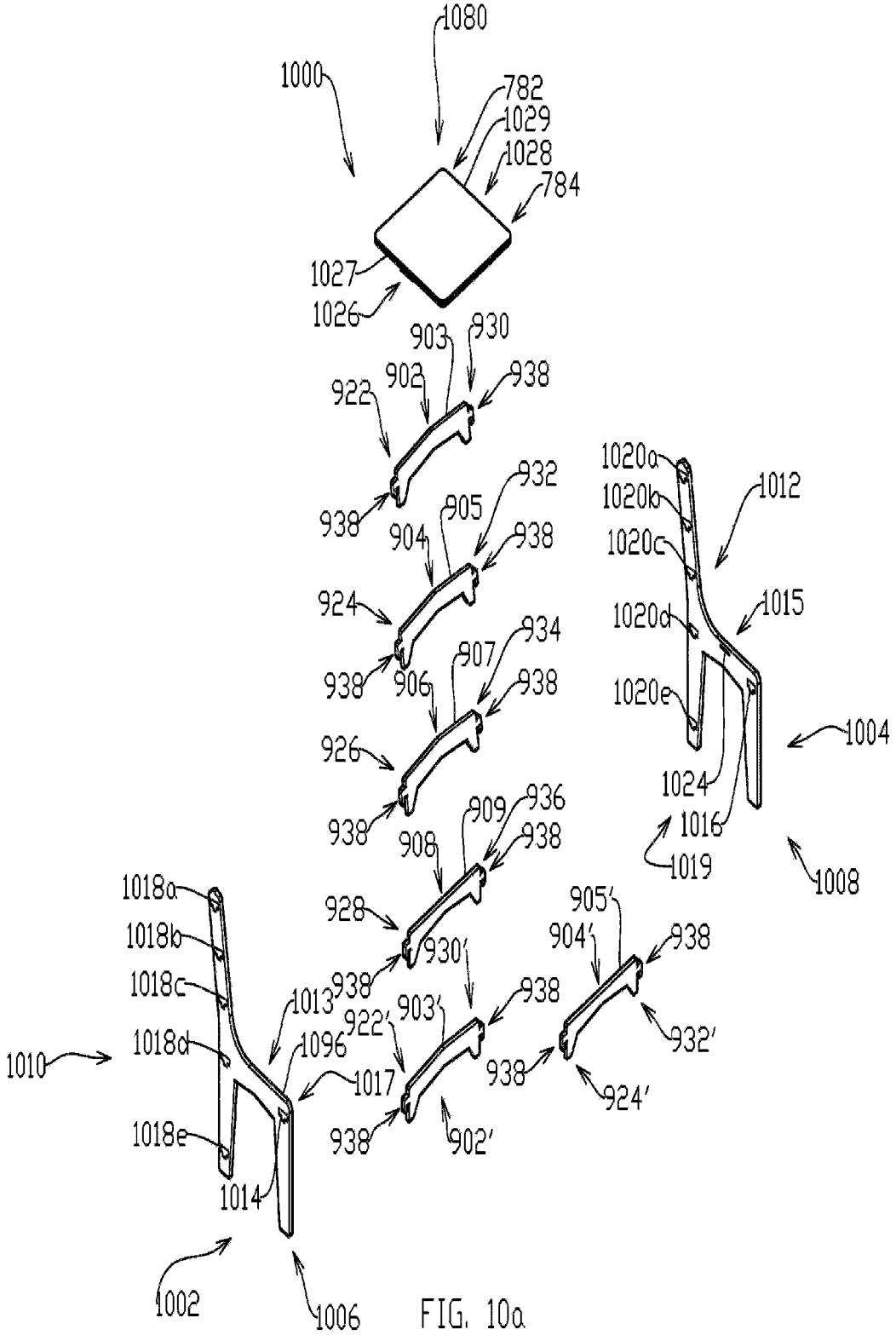
FIG. 10*a* is an exploded perspective view of a modular frame assembly in the configuration of a chair assembly.
Figure 10B:
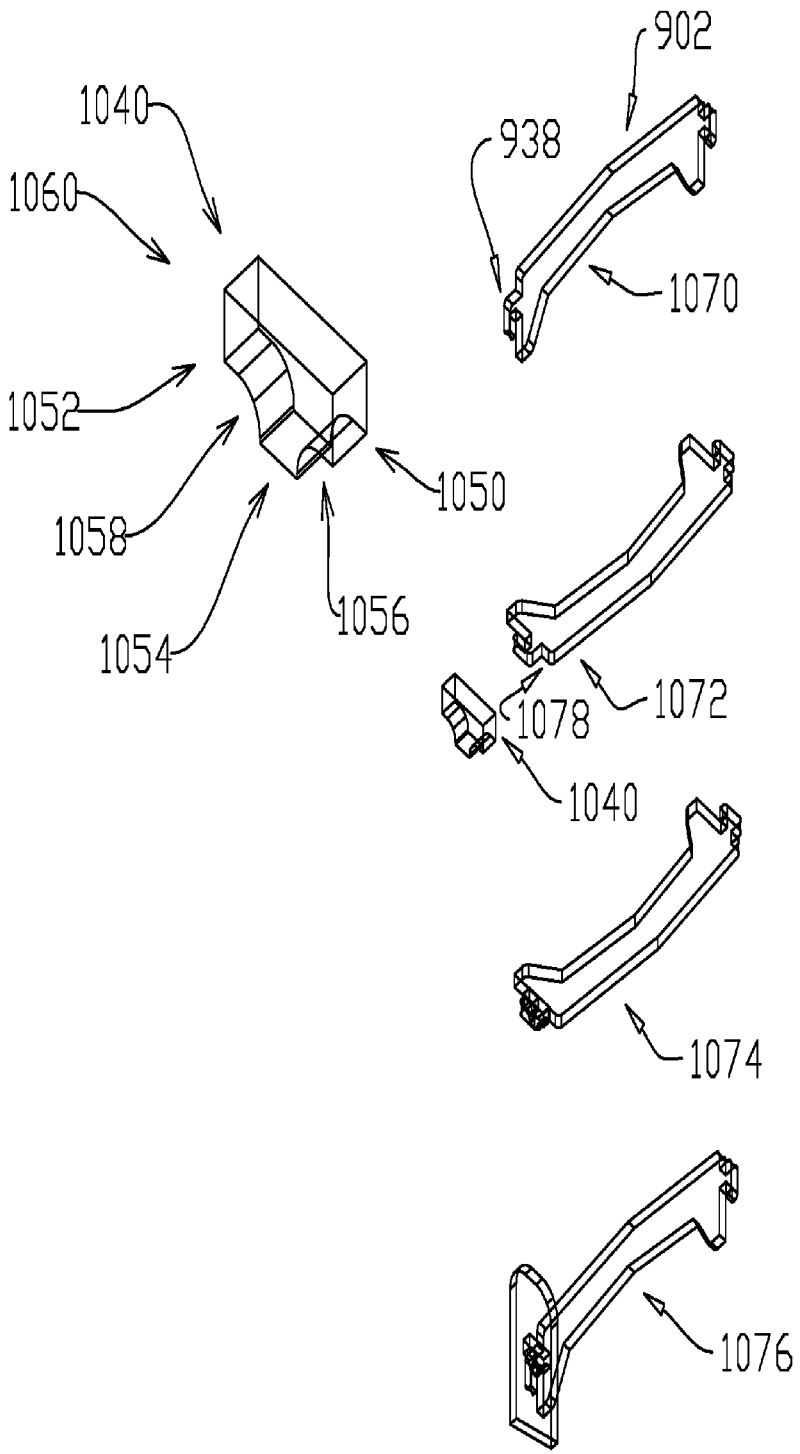
FIG. 10*b* is an exploded perspective view of an alternate locking mechanism according to the present disclosure.
Figure 10D:
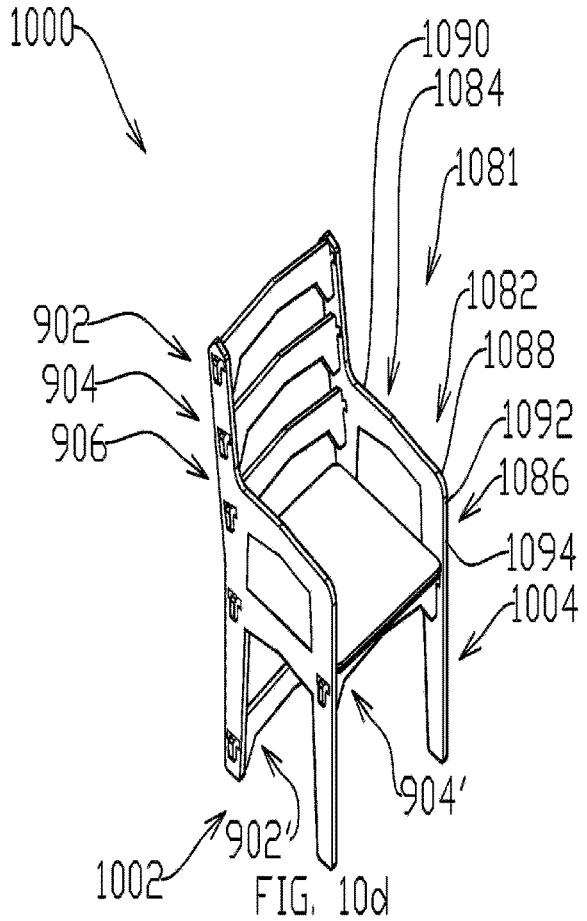
FIG. 10*d* is a perspective view of an alternate modular frame assembly in the configuration of a chair assembly.
Figure 10C:
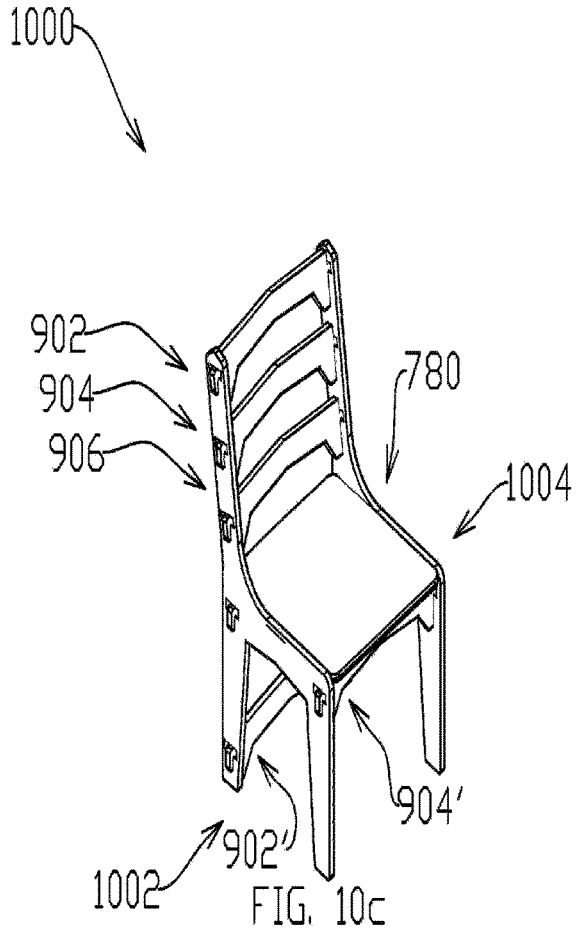
FIG. 10*c* is a perspective view of a modular frame assembly in the configuration of a chair assembly.

It is contemplated that other modular frame assemblies may be constructed from or in combination with the desk assemblies 700 or 800, as illustrated in FIGS. 7*a-g* and 8*a-i*, and the shelf assembly 900, as illustrated in FIG. 9*a* such that a user can optionally use the lateral frame members, side frame members and top planar member illustrated in FIGS. 1-9 to form a modular chair assembly 1000, as illustrated in FIGS. 10*a* through 10*c*.

Referring to FIG. 10*a*, modular chair assembly 1000 includes first and second lateral shelf frame members 902, 904, 906, 908, respectively, as well as an additional pair of first and second lateral shelf frame member 902' and 904'. The modular chair assembly 1000 further includes shelf side frame members 910, 912 of FIG. 9 modified to be formed integral with side frame members 970, 972, respectively, to form first and second side chair frame members 1002, 1004. In an alternative embodiment, the first and second side chair frame members 1002, 1004 may be configured from the shelf side frame members 910, 912 assembled with the first and second side frame members 970, 972, or first and second side frame members 706, 708, as desired by a user. The modular chair assembly 1000 further includes a top planar member 1080 modified from the top planar member 780, as shown in FIG. 7*a*, to include a rectangular projection 1026, 1028 on edges 1027, 1029 extending between the first end 782 and second end 784. It is understood that the projections 1026, 1028 may be of any shape or size.

In an alternative embodiment, as shown in FIG. 10*d*, the first and second side chair frame members 1002, 1004, may be modified to include an additional brace member 1081 to form a supporting arm member with the chair assembly 1000. The additional brace member 1081 includes an L-shaped support member 1082 having a horizontal extension 1084 and a vertical extension 1086. The horizontal extension 1084 has a first side 1088 and second side 1090 opposite to the first side 1088. The vertical extension 1086 has a first side 1092 and a second side 1094 opposite to the first side 1092. The brace member 1081 is formed integral with the side frame member 1002 whereby the second side 1090 of the horizontal extension 1084 is integral with a second end 1010 of side chair frame member 1002 at a height approximate to the height of the receiving member 1018*c* of the second end 1010, and the second side 1094 is formed integral with a top edge 1096 of the first end 1006 of side chair frame member 1002. The first side 1088 of the horizontal extension 1084 and the first side 1092 of the vertical extension 1086 being formed in a perpendicular manner to form a corner 1098. In an alternative embodiment, the brace member 1081 is added as an additional member to the chair assembly 1000, as shown in FIG. 10*a*.

Referring to FIG. 10*a*, first and second side chair frame members 1002, 1004, respectively, include a first end 1006, 1008, respectively, and a second end 1010, 1012, respectively, opposite to the first end 1010, 1012, respectively. The first ends 1006, 1008, respectively, and second ends 1010, 1012, respectively, each include at least one receiving member 1014, 1016 on the first ends 1006, 1008 and a plurality of receiving members 1018*a-e*, 1020*a-e* on the second ends, 1010, 1012. It is contemplated that any number or configuration of receiving members can be provided on the first and/or section ends 1006, 1008, 1010, 1012, respectively, of the first and/or second side chair frame members 1002, 1004, respectively. Referring to FIG. 10*a*, first and second side chair frame members 1002, 1004 further include a longitudinal portion 1013, 1015 extending between the first ends 1006, 1008 and second ends 1010, 1012, respectively. The longitudinal portions 1013, 1015 include a chamber, or groove 1023, 1024, disposed on the inner surface 1017, 1019 of the longitudinal portions 1013, 1015, respectively. The chamber or groove may be rectangularly shaped, as shown in FIG. 10*a*. It is understood that the chamber or groove 1023, 1024 may be of any shape or size.

Still further, it is contemplated that a user may optionally use a modified receiving member in any modular frame assemblies constructed from or in combination with the assemblies illustrated in FIGS. 1-34 herein or in any other assemblies described herein. As illustrated in FIG. 10*b*, a modified receiving member 1040 includes a T-shape receiving space having a first end 1050, a second end 1052 opposite to the first end 1050 and a bridge portion 1054 extending between the first and second ends 1050, 1052. The bridge portion 1054 extends downward in a perpendicular axis to the longitudinal axis of the receiving member 1040.

A first and second curvature 1056 and 1058 are curved inward between the first end 1050 and the bridge portion 1054, and the second end 1052 and the bridge portion 1054, respectively, so as to facilitate the rotation of an L-bend connector in the receiving member 1040. Receiving member 1040 includes a thickness 1060.

Referring to FIG. 10*a*, the lateral shelf frame members 902, 904, 906, 908 include a transverse portion 903, 905, 907, 909, respectively, and one or a plurality of flange portion(s). As shown in FIG. 10*a*, the lateral shelf frame members 902, 904, 906, 908 further include a first end 922, 924, 926, 928, respectively, and a second end 930, 932, 934, 936, respectively, opposite to the first end 922, 924, 926, 928, respectively. The flange portions include L-bend connectors 938. Such L-bend connectors 938 extending transversely from first ends 922, 924, 926, 928, respectively, and second ends 930, 932, 934, 936, respectively, of the lateral shelf frame members 902, 904, 906, 908. The lateral shelf frame members 902', 904' each include a first end 922', 924', respectively, and a second end 930', 932', respectively, opposite to the first end 922', 924', respectively. The first ends 922', 924', respectively, and second ends 930', 932', respectively, each have an L-bend connector 938 extending transversely therefrom.

As illustrated in FIG. 10*b*, in use, an L-bend connector 938 of first lateral shelf frame member 902 at position 1070 is rotated approximately 90 degrees about the longitudinal axis of a first lateral shelf frame member 902 to which the L-bend connector 938 is extending, to position 1072, to insert an extension portion 736 and locking tab 738 of L-bend connector 938 into and through the first and second ends 1050, 1052 of the receiving member 1040 with a friction fit until the locking tab 738 passes through the thickness 1060 and protrudes through the receiving member 1040 at position 1074. The L-bend connector 938 is then rotated back 90 degrees upward about the longitudinal axis of the lateral frame member 902. These actions cause the downwardly extending locking tab 738 of L-bend connectors 938 to be mechanically captured and locked by the bridge portion 1054 between the first and second ends 1050, 1052, respectively, while engaging the extension portion 736 in the bridge portion 1054. A forward edge 1078 of the lateral frame member 902 thus becomes releasably and securely mechanically interlocked with the receiving member 1040. The L-bend connector 938 may be released from the receiving member by similar rotation of the L-bend connector 938. In an alternative embodiment, the receiving member may be oriented 180 degrees on the first and/or second side chair frame members 1002, 1004, respectively, thereby being maintained in a position such that the bridge portion 1054 remains upward upon the locking of the L-bend connector 938 in the receiving member 1040. T-shaped receiving members 1040, as shown in FIG. 10*b*, can be used on any of the modular frame assemblies described herein in connection with FIGS. 1-11 or any other modular frame assemblies described herein.

In use in one embodiment, although any number of alternatives may be considered in any desired sequence, a user may form a modular chair assembly by aligning and inserting the L-bend connector 938 of the first end 922 of the first shelf lateral frame member 902 into the receiving member 1018*a* of the second end 1010 of side chair frame member 1002. The L-bend connector 938 of the first end 924 of the second shelf lateral frame member 904 is then aligned and inserted into the receiving member 1018*b* of the second end 1010 of side chair frame member 1002. The L-bend connector 938 of the first end 926 of the third shelf lateral frame member 906 is then aligned and inserted into the receiving member 1018*c* of the second end 1010 of side chair frame member 1002. The L-bend connector 938 of the first end 928 of the fourth shelf lateral frame member 908 is then aligned and inserted into the receiving member 1018*d* of the second end 1010 of side chair frame member 1002. The L-bend connector 938 of the first end 922' of the first shelf lateral frame member 902' is then aligned and inserted into the receiving member 1018*e* of the second end 1010 of side chair frame member 1002. The L-bend connector 938 of the first end 924' of the second shelf lateral frame member 904' is then aligned and inserted into the receiving member 1014 of the first end 1006 of side chair frame member 1002.

In use, although any number of alternatives may be considered in any desired sequence, the L-bend connector 938 of the second end 930 of the first shelf lateral frame member 902 is then aligned and inserted into the receiving member 1020*a* of the second end 1012 of side chair frame member 1004. The L-bend connector 938 of the second end 932 of the second shelf lateral frame member 904 is then aligned and inserted into the receiving member 1020*b* of the second end 1012 of side chair frame member 1004. The L-bend connector 938 of the second end 934 of the third shelf lateral frame member 906 is then aligned and inserted into the receiving member 1020*c* of the second end 1012 of side chair frame member 1004. The L-bend connector 938 of the second end 936 of the fourth shelf lateral frame member 908 is then aligned and inserted into the receiving member 1020*d* of the second end 1012 of side chair frame member 1004. The L-bend connector 938 of the second end 930' of the first shelf lateral frame member 902' is then aligned and inserted into the receiving member 1020*e* of the second end 1012 of side chair frame member 1004. The L-bend connector 938 of the second end 932' of the second shelf lateral frame member 904' is then aligned and inserted into the receiving member 1016 of the first end 1008 of side chair frame member 1004.

Referring to FIG. 10*a*, the top planar member 1080 is then positioned and fixed over the top of the upper edge 909 of the top of shelf lateral frame member 908, and upper edge 905' of the top of shelf lateral frame member 904'. The projections 1026, 1028 on edges 1027, 1029 are aligned and inserted into the grooves 1023 (not shown), 1024 on the inner surface 1017, 1019 of the longitudinal portions 1013, 1015, respectively. The top planar member 1080 remains fixed in place longitudinally by the first and second chair side frame members 1002, 1004 and laterally by the insertion of the projections 1026, 1028 into the grooves 1023, 1024 on the lower surface of the top planar member 1080, so as to form the chair frame assembly such as shown in FIG. 10*c*. The top planar member 1080 functions as a seat portion of the chair assembly 1000.

Figure 11A:
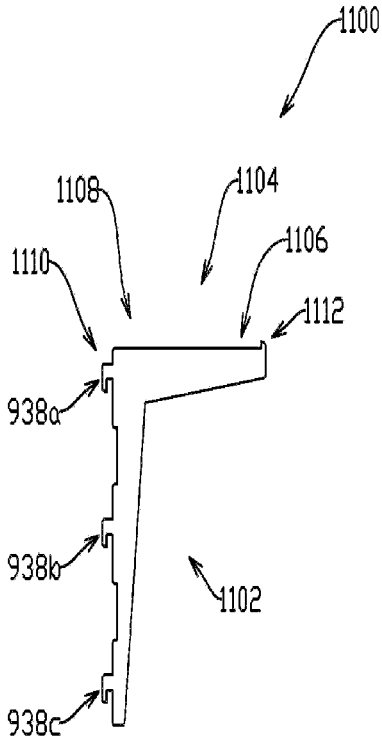
FIG. 11*a* is a side view of an modular outrigger component according to the present disclosure.

In another embodiment, a user may desire another work surface adjacent to a desk or table, as shown in FIGS. 7 through 10. An additional work surface may be configured by assembling an additional desk assembly, as shown in FIGS. 7 through 10. In addition, such work surface may also be configured with the use of a pair of outrigger modular component members, as illustrated in FIG. 11*a*. Outrigger modular component members 1100 include an L-bend body 1102 having an elongated support portion 1104 having a first end 1106 and a second end 1108 opposite to the first end 1106. The second end 1108 of the support portion 1104 having a perpendicular flange portion 1110 extending downward therefrom. The first end 1106 includes a projection 1112 extending perpendicularly upward from the longitudinal axis of the first end 1106. The flange portion 1110 has one or a plurality of L-bend connectors 938 extending therefrom.

Figure 11C:
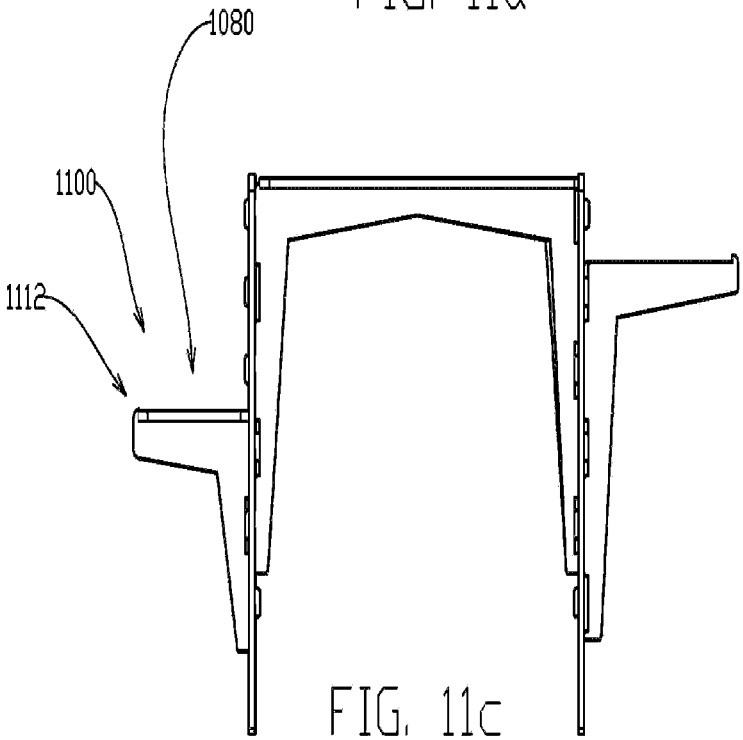
FIG. 11*c* is a side view of a modular frame assembly in the configuration of a desk and outrigger modular component assembly.
Figure 11B:
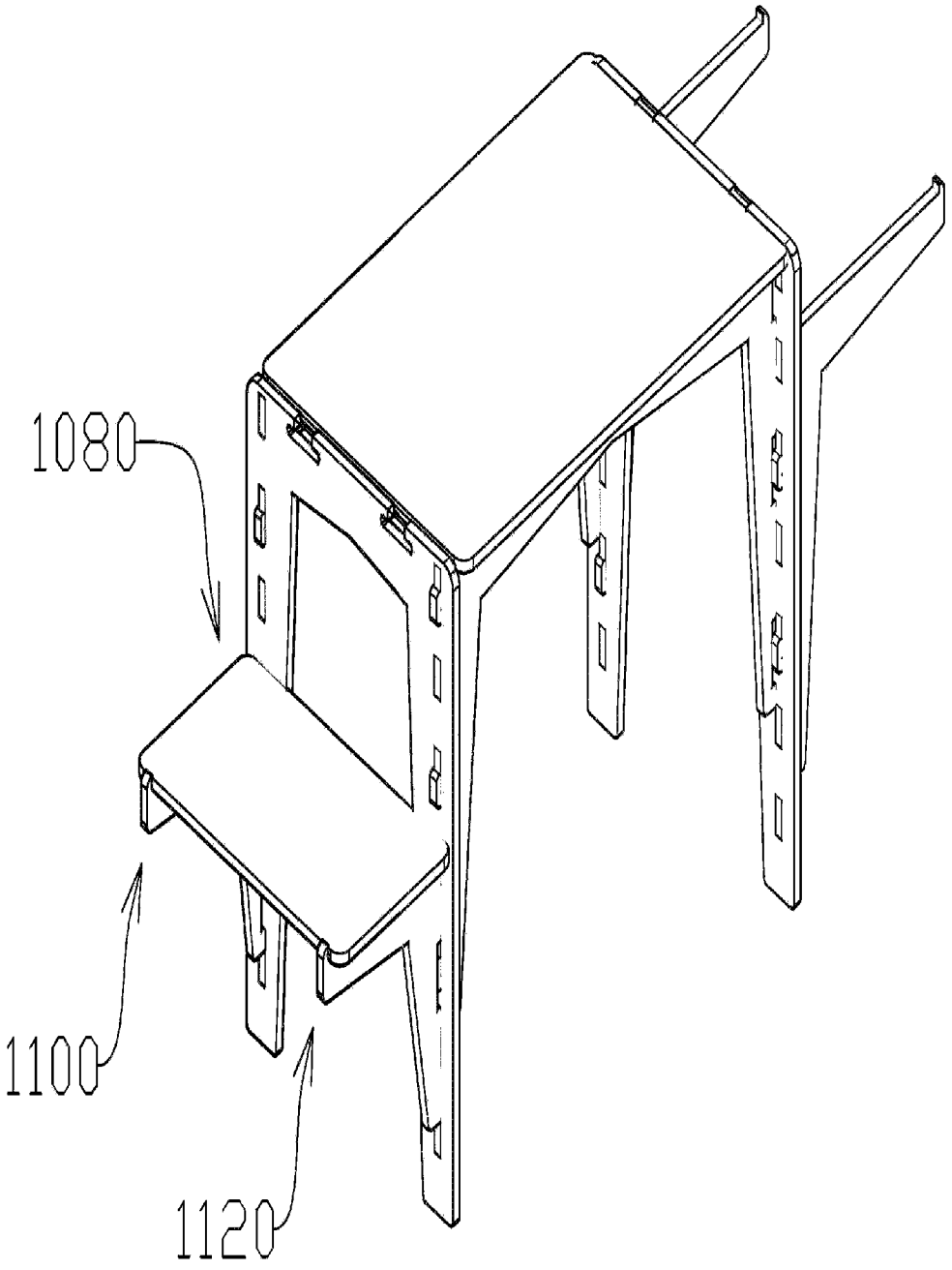
FIG. 11*b* is a perspective view of a modular frame assembly in the configuration of a desk and modular outrigger component assembly.

In use, as shown in FIG. 11*b*, one or a plurality of L-bend connectors 938 on a first and second outrigger modular component member 1100 is aligned with and inserted into one or more unoccupied slots on an outer surface of a first or second end of a first or second side frame member. A second L-bend connector 938 of a second outrigger modular component member 1120 is aligned with and interlocked with one or more unoccupied slots at the same height, as the first outrigger modular component member 1100, as shown in FIG. 11*b*. A user may determine the desired height of the outrigger modular component members 1100, 1120. As illustrated in FIG. 11*b*, the first and second outrigger modular component, 1100, 1120, respectively, are interlocked with the fourth and sixth slots in the first or second ends of the first and/or second side frame member. As shown in FIGS. 11*b* and 11*c*, a top panel frame member 1080 is placed on the support member or portion 1104 of each of the first and second outrigger modular component members 1100, 1120, respectively. The top panel frame member 1080 is fixed on the first and second outrigger modular component members 1100, 1120, respectively, longitudinally by being fixed between the projection 1112 and the first or second end of the first or second side frame members, and laterally by the chambers 990, 992 on the lower surface (not shown) of the top planar member 1080 positioned over the upper edges of the first and second outrigger modular component members 1100, 1120, respectively, so as to form an additional surface adjacent to a desk or table assembly 700, as shown in FIGS. 11*b* and 11*c*. The top panel frame member provides a user with an additional surface on which to work. Additional outrigger modular components may be added to the opposite side of the desk or table assembly 700, as shown in FIGS. 11*b* and 11*c*, at any height desired by a user, to receive additional top planar members. In another embodiment, outrigger modular components may be added at any height to any side frame member or corner assembly as desired. Outrigger modular component members 1100 can be used on any of the modular frame assemblies described herein in connection with FIGS. 1-11 or any other modular frame assemblies described herein.

Figure 12D:
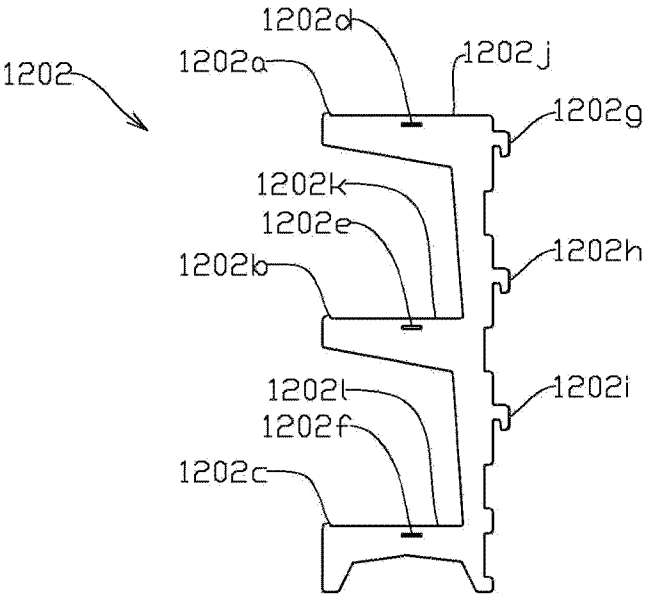
FIG. 12*d* is a side view of a modular outrigger component with three lateral components according to the present disclosure. The modular outrigger component may also be configured with a plurality of lateral components.
Figure 12B:
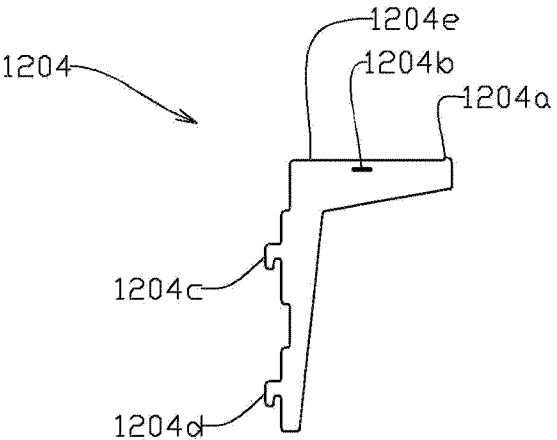
FIG. 12*b* is a side view of an modular outrigger component with one lateral component according to the present disclosure.
Figure 12C:
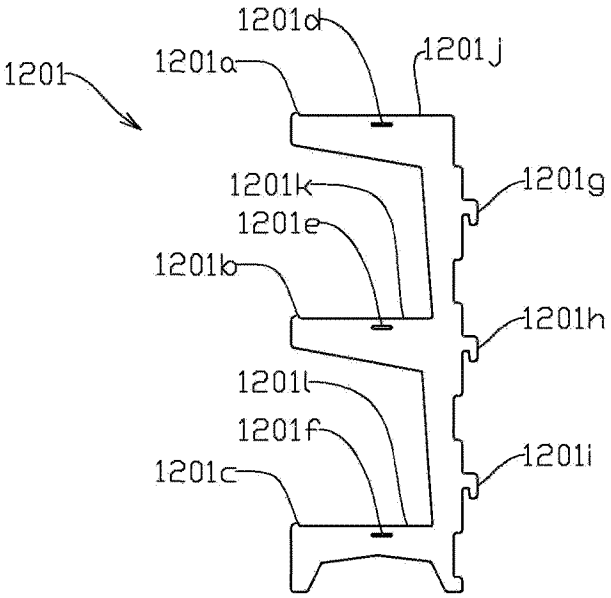
FIG. 12*c* is a side view of a modular outrigger component with three lateral components according to the present disclosure. The modular outrigger component may also be configured with a plurality of lateral components.
Figure 12A:
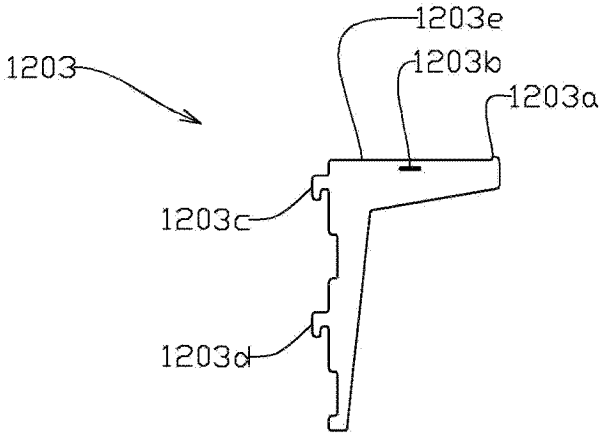
FIG. 12*a* is a side view of an modular outrigger component with one lateral component according to the present disclosure.

FIG. 12*a* is a side view of a modular outrigger component with one lateral component according to the present disclosure. The modular component 1203 has two L-bend connectors 1203*c-d* with a connecting slot 1203*b*, an upper transverse portion 1203*e* with an upward extending tab 1203*a* on the lateral edge of the upper transverse portion 1203*e*. The upward extending tab 1203*a* is configured to confine a horizontal planar modular component on the outside edge of the horizontal planar modular component when the 1203 modular outrigger component is incorporated into a modular assembly.

FIG. 12*b* is a side view of a modular outrigger component with one lateral component according to the present disclosure. The modular component 1204 has two L-bend connectors 1204*c-d* with a connecting slot 1204*b*, an upper transverse portion 1204*e* with an upward extending tab 1204*a* on the lateral edge of the upper transverse portion 1204*e*. The upward extending tab 1204*a* is configured to confine a horizontal planar modular component on the outside edge of the horizontal planar modular component when the 1204 modular outrigger component is incorporated into a modular assembly.

FIG. 12*c* is a side view of a modular outrigger component 1201 with three lateral components according to the present disclosure. The modular outrigger component may also be configured with a plurality of lateral components. The modular component 1201 has three L-bend connectors 1201*g-i* with connecting slots 1201*d-f*, three upper transverse portions 1201*j*-1 with upward extending tabs 1201*a-c* on the lateral edge of the upper transverse portions 1201*j*-1. The upward extending tabs 1201*a-c* are configured to confine horizontal planar modular components on the outside edge of the horizontal planar modular components when the 1201 modular outrigger component is incorporated into a modular assembly.

FIG. 12*d* is a side view of a modular outrigger component with three lateral components according to the present disclosure. The modular outrigger component may also be configured with a plurality of lateral components. The modular component 1202 has three L-bend connectors 1202*g-i* with connecting slots 1202*d-f*, three transverse portions 1202*j*-1 with upward extending tabs 1201*a-c* on the lateral edge of the transverse portions 1201*j*-1. The upward extending tabs 1201*a-c* are configured to confine horizontal planar modular components on the outside edge of the horizontal planar modular components when the 1202 modular outrigger component is incorporated into a modular assembly.

Figure 13:
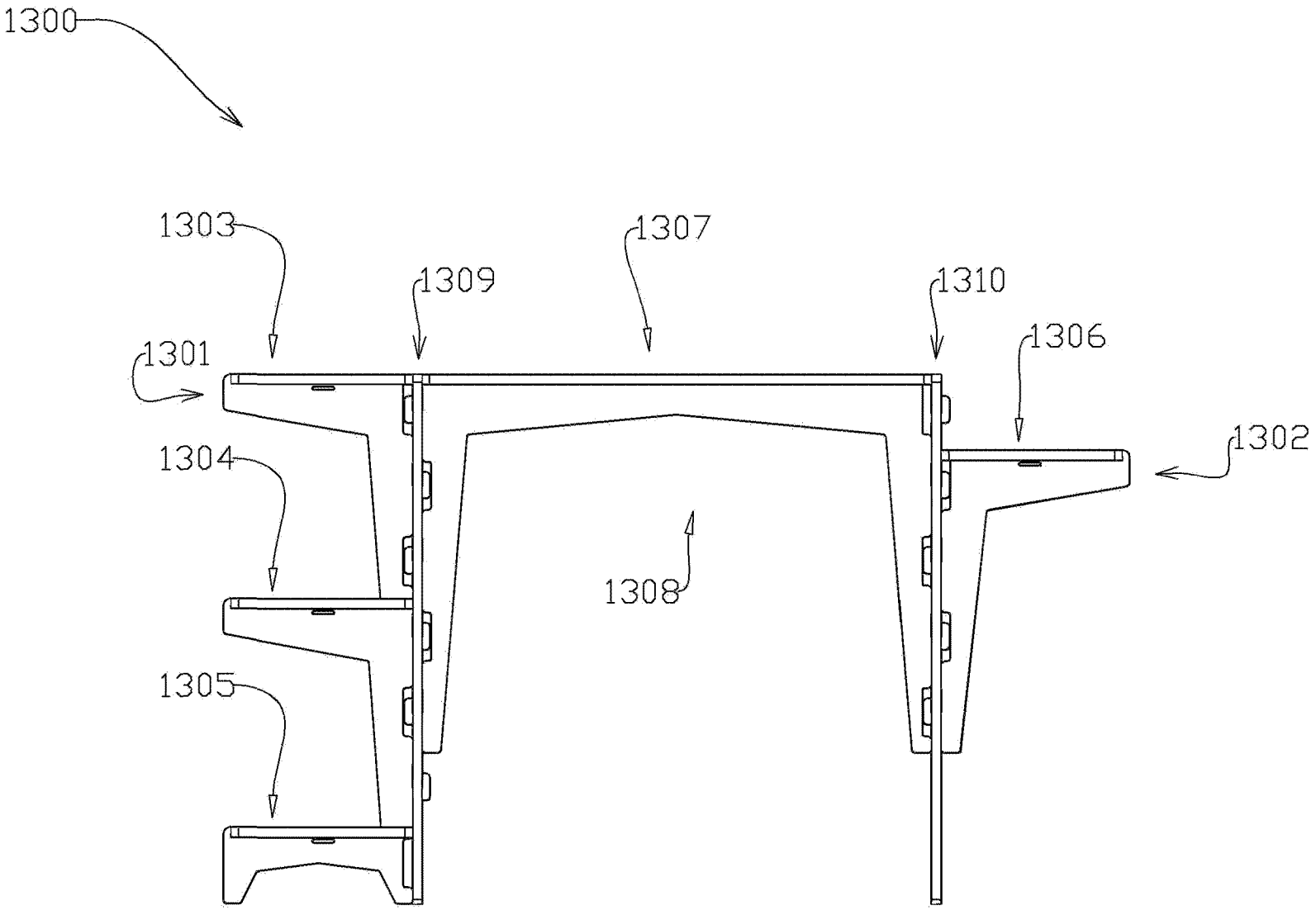
FIG. 13 is a front view of several modular outrigger components according to the present disclosure attached to a modular construction assembly.

FIG. 13 is a front view of several modular outrigger components according to the present disclosure attached to a modular construction assembly. The modular component assembly 1300 has four horizontal planar elements 1303, 1304, 1305, and 1306 that are incorporated onto the upper lateral edge of the three modular outrigger components on one side of the modular assembly and onto the upper lateral edge of the single modular outrigger component on the opposite side of the modular assembly. The modular outrigger component assemblies are separated by a transverse modular component 1308 that is incorporated into the three modular outrigger components on one side by modular component 1309 and the singular modular outrigger component on the opposite side by modular component 1310 where modular components 1309 and 1310 are cooperatively connected through the use of L-bend connectors and connecting slots. The horizontal planar element 1307 is incorporated into the modular component assembly upper transverse edge of 1308 and the horizontal planar element 1307 is at the same level as the upper edge of modular components 1309 and 1310.

Figure 14:
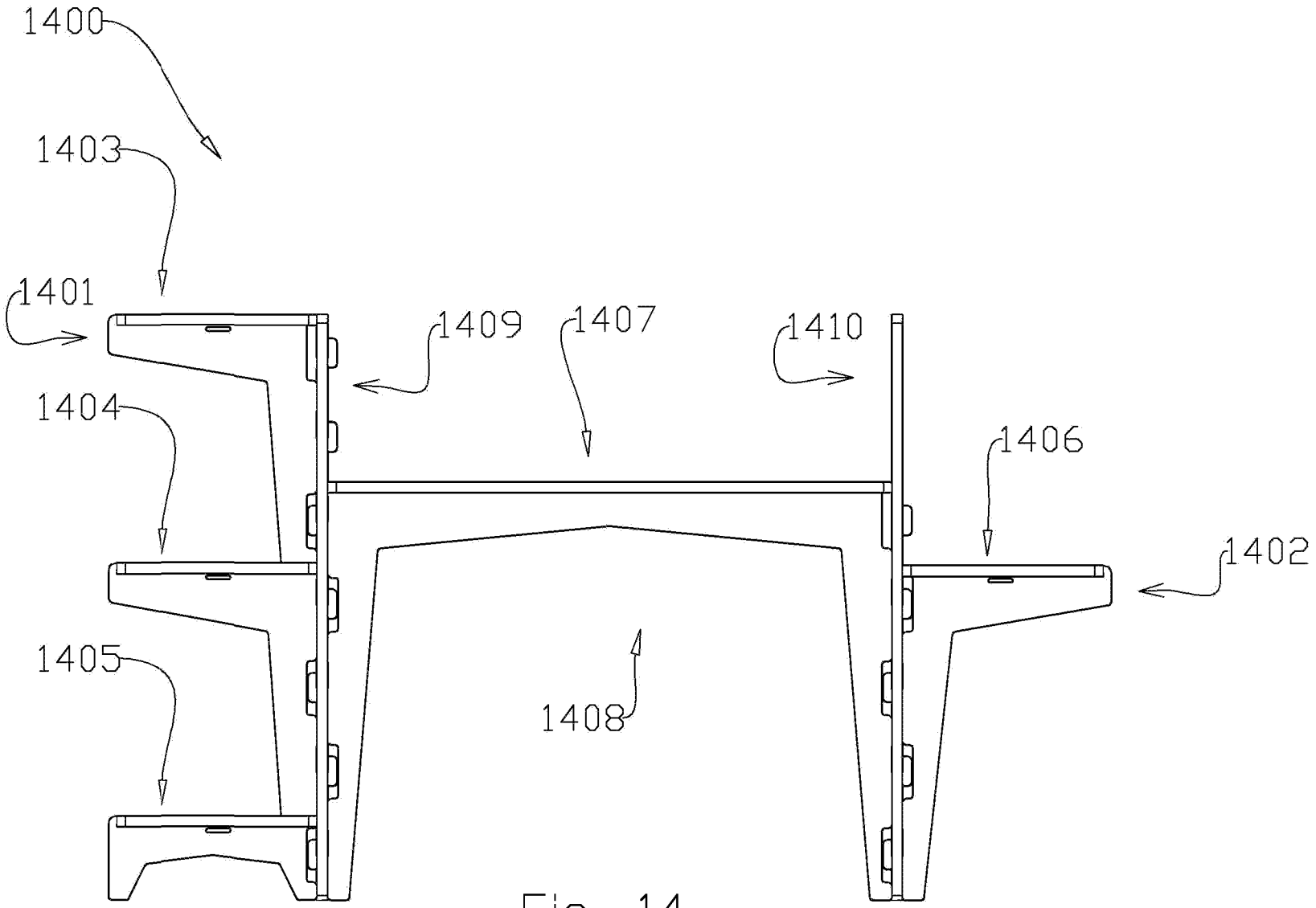
FIG. 14 is a front view of several modular outrigger components according to the present disclosure attached to a modular construction assembly.

FIG. 14 is a front view of several modular outrigger components according to the present disclosure attached to a modular construction assembly. The modular component assembly 1400 has four horizontal planar elements 1403, 1404, 1405, and 1406 that are incorporated onto the upper lateral edge of the three modular outrigger components on one side of the modular assembly and onto the upper lateral edge of the single modular outrigger component on the opposite side of the modular assembly. The modular outrigger component assemblies are separated by a transverse modular component 1408 that is incorporated into the three modular outrigger modular components on one side by modular component 1409 and the singular modular outrigger component on the opposite side by modular component 1410 where modular components 1409 and 1410 are cooperatively connected through the use of L-bend connectors and connecting slots. The horizontal planar element 1407 is incorporated into the modular component assembly upper transverse edge of 1408 and the horizontal planar element 1407 is at a lower level than the upper edge of modular components 1409 and 1410.

Figure 15:
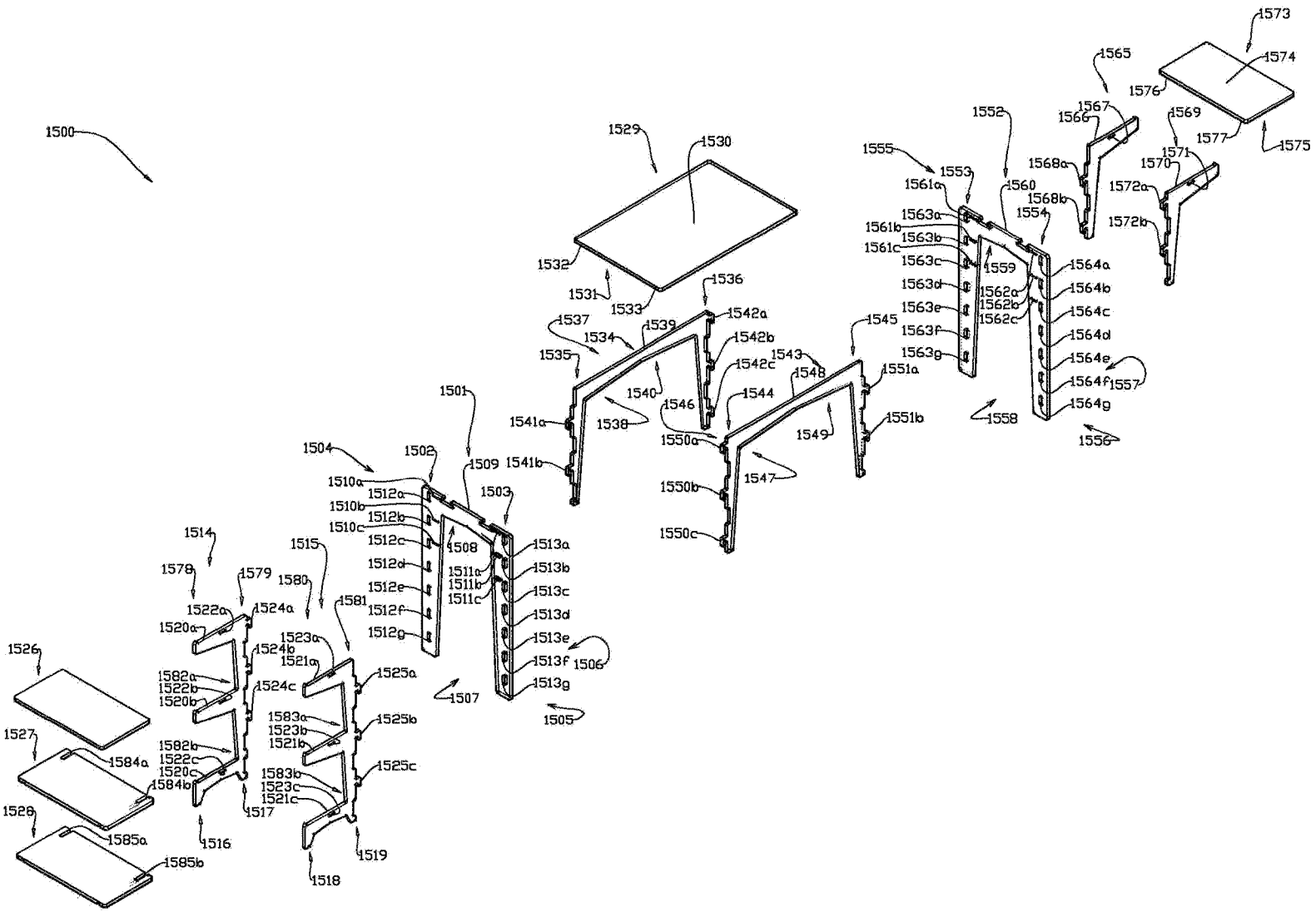
FIG. 15. Is an exploded view of a modular construction with modular outrigger components and modular planar elements.

FIG. 15. Is an exploded view of a modular construction with modular outrigger components and modular planar horizontal components. The entire modular assembly 1500 is comprised of multiple modular assembly subsystems that are configured to cooperatively connect together through the use of L-bend connectors and connecting slots. Three horizontal planar elements on one side of the modular assembly 1526, 1527, and 1528 are cooperatively connected to the modular assembly on the upper lateral edges of the lateral components of modular assemblies 1514 and 1515. The upper lateral edges 1520*a-c* and 1521*a-c* support the underside of horizontal planar elements 1526, 1527, and 1528. The lateral components of modular assemblies 1514 and 1515 also are configured with connecting slots 1522*a-c* in the lateral components of 1514 and 1523*a-c* in the lateral components of 1515 for further cooperative connection of modular components. Open connecting slots 1584*a* and 1584*b* of horizontal planar element 1527 cooperatively connect with the lateral edge of 1582*a* and 1583*a* of modular component 1514 and 1515 respectively. In a similar fashion, open connecting slots 1585*a* and 1585*b* of horizontal planar element 1528 cooperatively connect with the lateral edge of 1582*b* and 1583*b* of modular components 1514 and 1515 respectively. The front edge 1578 of modular component 1514 and the front edge 1580 of modular component 1515 are configured with upward facing tabs to contain the edge of horizontal planar elements 1526, 1527, and 1528. The bottom legs 1516 and 1517 of modular assembly 1514 and the bottom legs 1518 and 1519 of modular assembly 1515 rest on a horizontal surface such as a floor. The L-bend connectors 1524*a-c* of modular component 1514 are cooperatively connected into the connecting slots 1512*a-g* of modular component 1501 and the L-bend connectors 1525*a-c* of modular component 1515 are cooperatively connected into the connecting slots 1513*a-g* of modular component 1501. The connecting slots 1512*a-g* and 1513*a-g* of modular component 1501 are configured to form columns 1502 and 1503 respectively in modular component 1501. The L-bend connectors 1524*a-c* and 1525*a-c* may alternate so as to connect to different level connecting slots and connecting slot columns 1502 and 1503 respectively. Modular component 1501 is configured to have a lateral side 1504 and an opposite lateral side 1505. The connecting slot columns 1502 and 1503 of modular component 1501 are connected by transverse portion 1508. Modular component 1501 has a front side 1507 and the backside 1506. Modular component 1501 has an upper transverse edge 1509. Modular component 1501 and modular component 1552 will connect to either lateral edge of modular component 1534 and 1543. In one orientation, modular component 1543 has a transverse portion 1548 that connects to longitudinal end portions 1544, with L-bend connectors 1550*a-c*, and 1545, with L-bend connectors 1551*a-b*. The L-bend connectors on modular component 1543 in column 1544 may be cooperatively connected with the connecting slots in column 1503 while the L-bend connectors in column 1545 may be cooperatively connected with the connecting slots in column 1554 of modular component 1552. In a similar fashion, modular component 1534 is configured with L-bend connectors in column 1535, 1541*a-b*, that are cooperatively connected with the connecting slots in column 1502 of modular component 1501 and the L-bend connectors in column 1536, L-bend connectors 1542*a-c*, may be cooperatively connected with column 1553, connecting slots 1563*a-g*. In a similar fashion column 1545, with L-bend connectors 1551*a-b*, may be cooperatively connected to the connecting slots in column 1554 utilizing connecting slots 1564*a-g*. Horizontal planar modular component 1529 may be configured to engage with the top lateral surface of the transverse section 1539 and 1548 where channels 1532 and 1533, respectively, on the underside of horizontal planar modular component 1529 engage with the top lateral component 1539 and 1548 of 1534 and 1543 respectively. Further, modular components 1534 and 1543 are configured with a back face 1537 and a front face 1538 for 1534 and a back face of 1546 and a front face of 1547 for modular component 1543. Modular component 1534 and 1543 are further configured with a transverse portion 1540 and 1549 respectively. It is important to note that the L-bend connectors that connect on either side of modular component 1501 and 1552 through the connecting slots in 1501 and 1552 utilize alternating connecting slots so that the modular component assembly 1500 may be extended in both directions. In a similar fashion to modular components 1514 and 1515, modular components 1565 and 1569 are cooperatively connected to modular component 1552 utilizing L-bend connectors 1568*a-b* and 1572*a-b* that cooperatively connect with connecting slots 1563*a-g* in column 1553 and connecting slots 1564*a-g* in column 1554 respectively. Modular horizontal planar element 1573 is configured to have a top surface 1574 and a bottom surface 1575 and channels 1576 and 1577 where these channels cooperatively connect with the linear surfaces 1566 and 1570 respectively. The modular horizontal planar element 1573 may be locked in place utilizing locking cams and connecting slots 1567 and 1571. The modular components 1565 and 1569 may be cooperatively attached to modular component 1552 at different heights through the utilization of different connecting slots for the L-bend connectors on both 1565 and 1569. This cooperative connection at different heights of 1565 and 1569 will allow modular horizontal planar element 1573 to be at different heights depending upon the cooperative connection of 1565 and 1569 to modular component 1552.

Figures 16A, 16B:
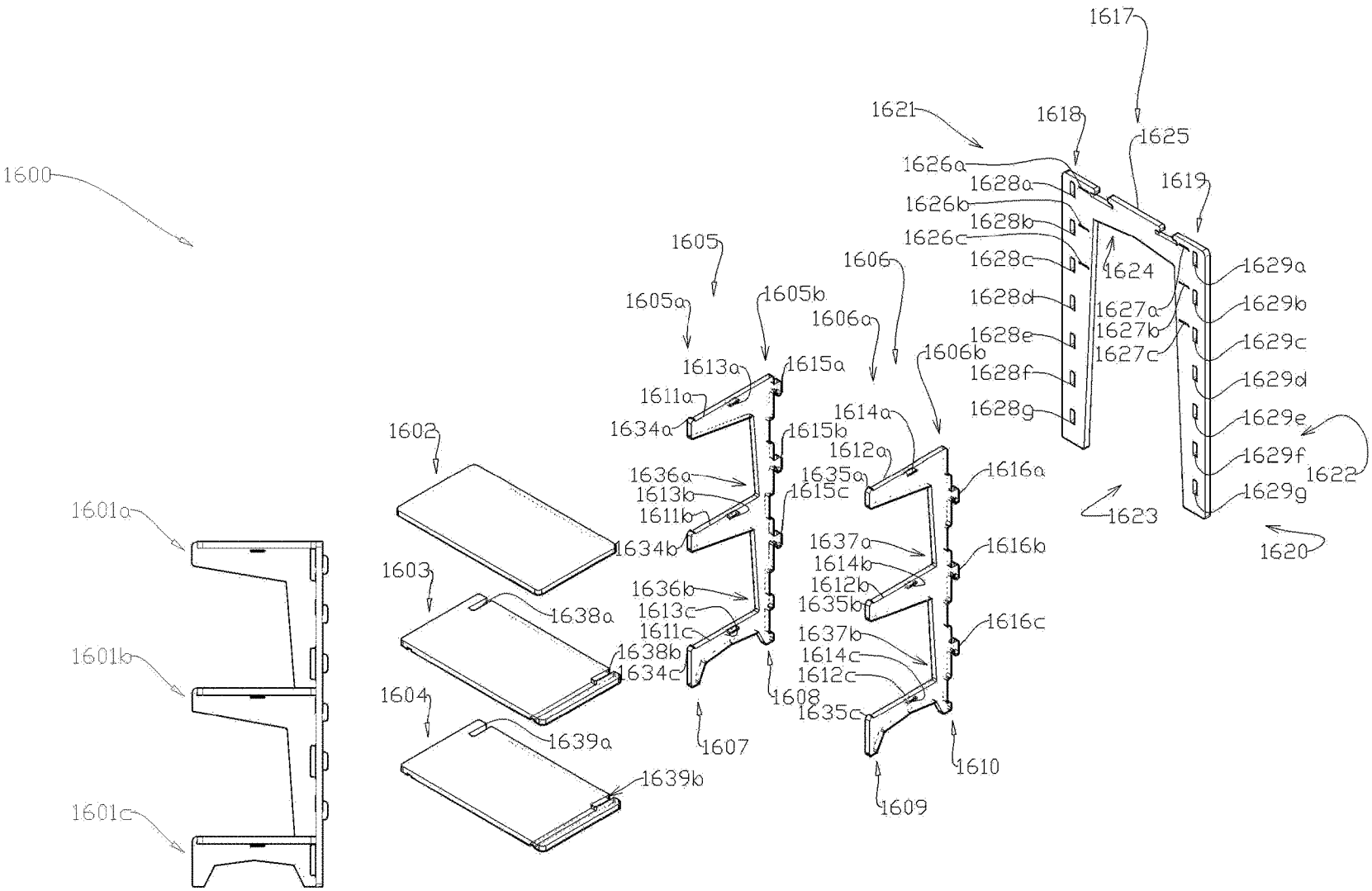
FIG. 16*a* is a side view of a single column of assembled modular outrigger components and modular planar elements.
FIG. 16*b* is an exploded view of assembled modular outrigger components and modular planar elements.

FIG. 16*a* is a side view of a single column of assembled modular outrigger components and modular planar elements with modular lateral components 1601*a*, 1601*b*, and 1601*c*.

FIG. 16*b* is an exploded view of assembled modular outrigger components and modular planar elements. Modular horizontal planar element 1602 will rest on the lateral top surface 1611*a* and 1612*a* of modular components 1605 and 1606 respectively. Modular horizontal planar element 1603 will rest on the lateral element 1611*b* and 1612*b* of modular components 1605 and 1606 modular components respectively with slot 1638*a* engaging with the column edge of 1605 and 1606 respectively. In a similar fashion, modular horizontal planar element 1604 will rest on lateral element 1611*c* and 1612*c* with slot 1639*a* and 1639*b* engaging with the edge 1636*b* and 1637*b* of column 1605 and 1606 respectively. Connecting slots 1613*a-c* and 1614*a-c* are located in the lateral components of modular components 1605 and 1606 respectively to provide further cooperative connections. The bottom legs 1607 and 1608 of modular component 1605 and the bottom legs 1609 at 1610 of modular component 1606 rest on a level surface such as a floor. The L-bend connectors 1615*a-c* of modular component 1605 are configured to cooperatively connect with the connecting slots 1628*a-g* of column 1618 of modular component 1617 and the L-bend connectors 1616*a-c* of modular component 1606 are configured to cooperatively connect with the connecting slots 1629*a-g* of column 1619 of modular component 1617. Modular components 1617 has a front 1623 and the back 1622. Connecting slots 1626*a-c* in column 1618 of modular component 1617 and connecting slots 1627*a-c* in column 1619 of modular component 1617 are configured to accept further connections to modular component 1617. Transverse upper lateral surface 1625 of modular component 1617 is configured to be flush with planar component 1602. 1621 is one lateral side of the modular component 1617 and 1620 is the opposite lateral side of modular component 1617. The open connecting slots 1638*a* and 1638*b* engage with the edge 1636*a* of modular component 1605 and the edge 1637*a* of modular component 1606 respectively. In a similar fashion, open connecting slots 1639*a* and open connecting slot 1639*b* engage with edge 1636*b* of modular component 1605 and edge 1637*b* of modular component 1606 respectively. Tabs 1634*a* and 1635*a* are configured to contain the edge of modular planar component 1602. In a similar fashion, tabs 1634*b* and 1635*b* are configured to contain the edge of modular planar component 1603. Also, tabs 1634*c* and 1635*c* are configured to contain the edge of modular planar component 1604 where the contained edge, as in 1602 and 1603, is on the distal edge of 1602, 1603, and 1604 from proximal columns 1605*b* and 1606*b*. In modular component 1605, 1605*a* designates the front edge of the linear projections from column 1605*b*. In a similar configuration, 1606*b* designates the front edge of the linear projections from column 1606*b*.

Figure 16D:
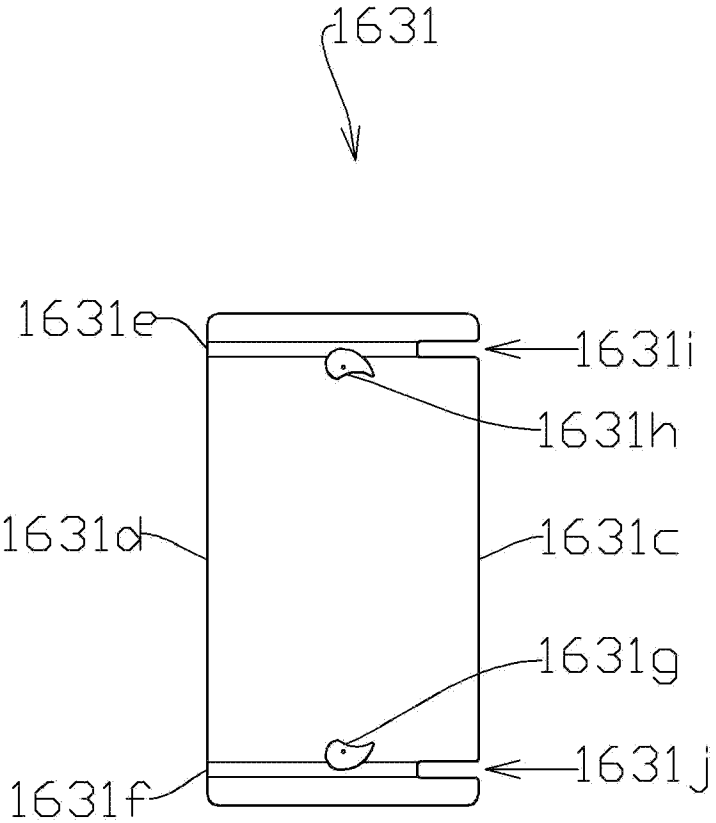
FIG. 16*d* is a planar element with locking cam elements and receiving chambers in the planar element and where the chambers extend through one edge of the planar element forming an open slot.
Figure 16C:
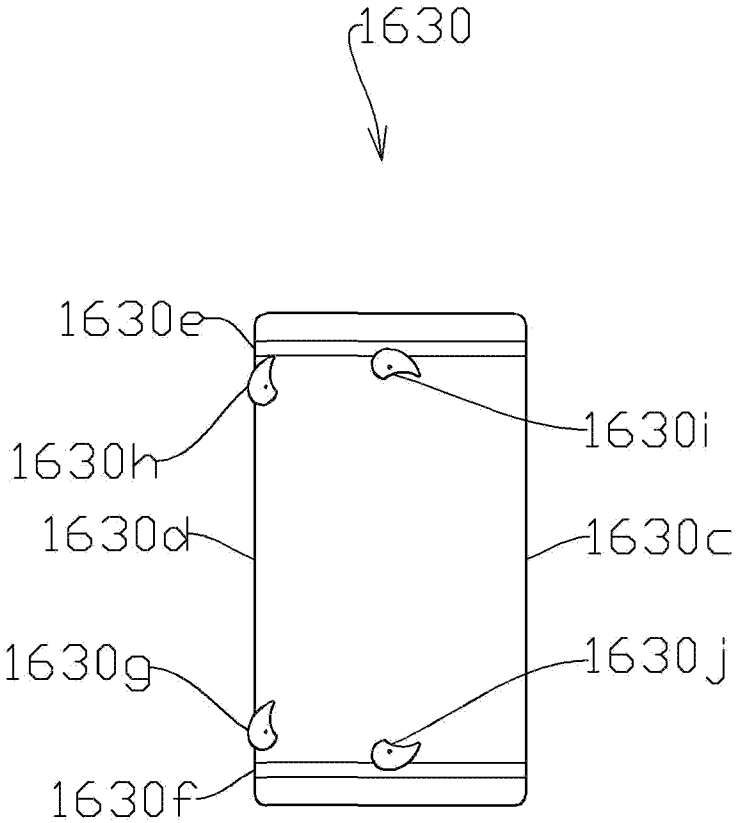
FIG. 16*c* is a planar element with locking cam elements and receiving chambers in the modular planar element.

FIG. 16*c* is a planar element with locking cam elements and receiving chambers in the planar element. A modular planar element 1630 is comprised of two chambers 1630*e* and 1630*f* where these chambers may engage with the lateral surface of the modular component assembly. Locking cams 1630*i* and 1630*j* are configured to lock to another modular component that is engaged with channels 1630*e* and 1630*f*. In a similar fashion, locking cams 1630*h* and 1630*g* are configured to lock edge 1630*d* to another modular component. Edge 1630*c* is not engaged utilizing locking cams but will benefit from the interference fit of locking cams 1630*h, i, g*, and *j*.

FIG. 16*d* is a planar element with locking cam elements and receiving chambers in the planar element and where the chambers extend through one edge of the planar element forming an open slot. A modular planar element 1631 is comprised of two chambers 1631*e* and 1631*f* where these chambers may engage with the lateral surface of the modular component assembly and where open slot 1631*i* of channel 1631*e* and open slot 1631*j* of channel 1631*f* are configured to horizontally engage with a modular component. Locking cams 1631*h* and 1631*g* are configured to lock to another modular component that is engaged with channels 1631*e* and 1631*f*. Edge 1631*d* is not engaged utilizing locking cams but will benefit from the interference fit of locking cams 1631*h* and *g*, and slots 1631*i* and 1631*j*.

Figure 17B:
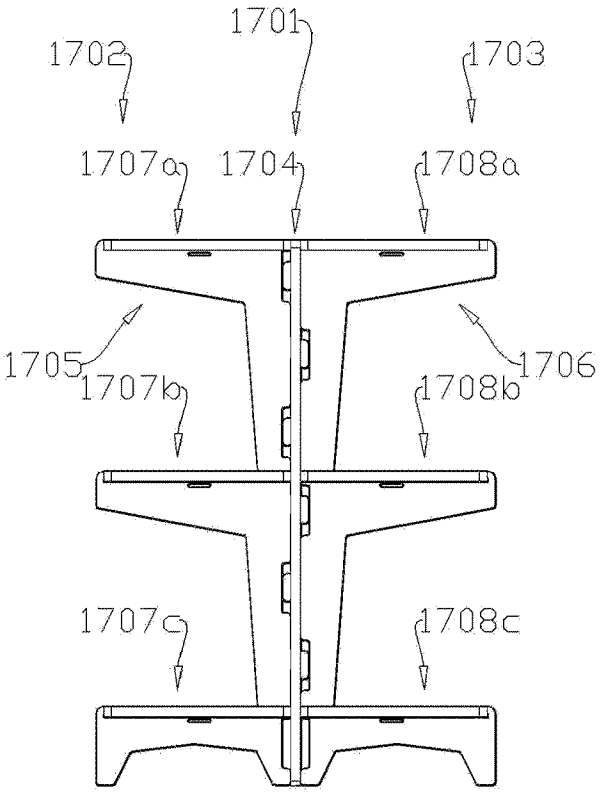
FIG. 17*b* is a side view of a modular assembly of cooperatively connected modular outrigger components and stacked modular planar elements.
Figure 17A:
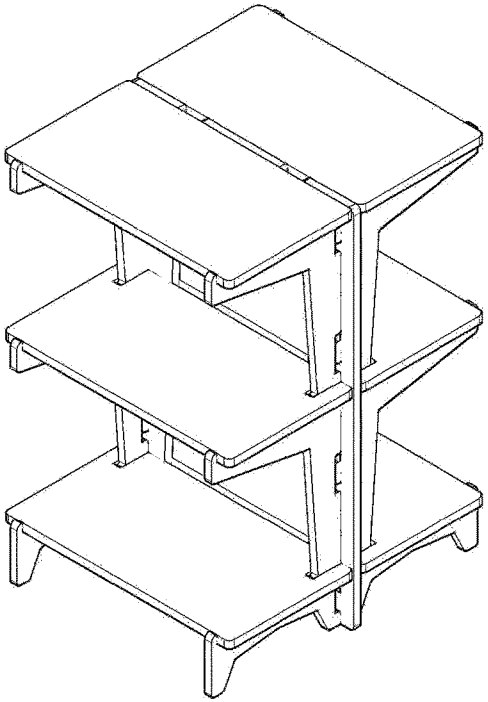
FIG. 17*a* is a perspective view of a modular assembly of cooperatively connected modular outrigger components and stacked modular planar elements.

FIG. 17*a* is a perspective view of a modular assembly of cooperatively connected modular outrigger components and modular planar elements.

FIG. 17*b* is a side view of a modular assembly of modular outrigger components and modular horizontal planar elements. The modular component assembly 1701 consist of two opposite sides 1702 and 1703 that are joined together utilizing modular component 1704. Modular horizontal planar elements 1707*a* and 1708*a* are on the top lateral surface of lateral modular components 1705 and 1706 respectively. Modular horizontal planar elements 1707*b-c* and 1708*b-c* are configured to be on an upper lateral surface of a lower modular component and horizontally engage with the lower section of upper lateral components utilizing channels and slots respectively.

Figure 17C:
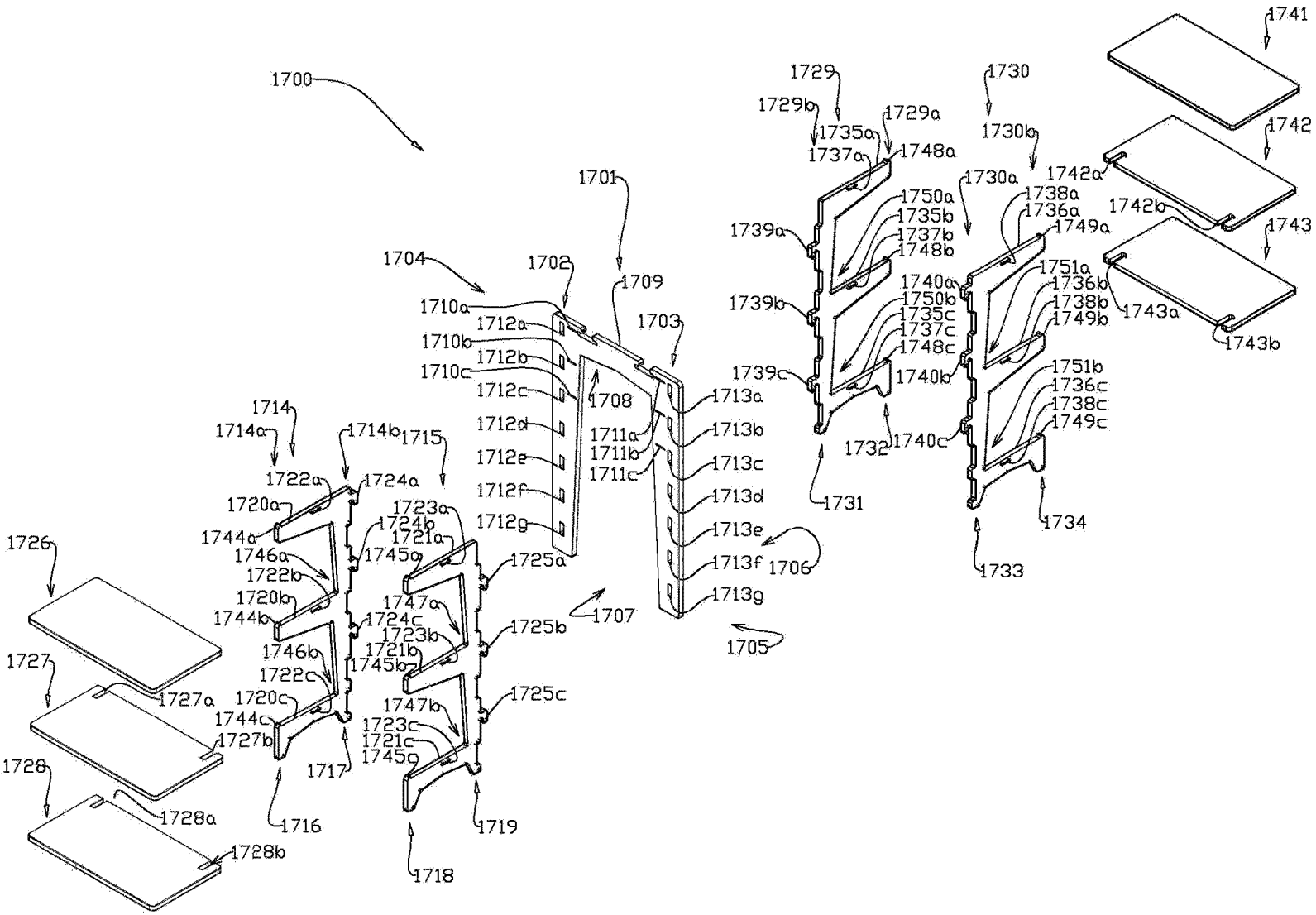
FIG. 17*c* is an exploded view of a modular assembly of cooperatively connected modular outrigger components and stacked planar elements.

FIG. 17*c* is an exploded view of a modular assembly of cooperatively connected modular outrigger components and modular planar elements. Modular horizontal planar element 1726 engages with the upper lateral surface 1720*a* and 1721*a* of modular components 1714 and 1715 respectively. Modular horizontal planar element 1727 engages with the upper lateral surface 1720*b* and 1721*b* of modular components 1714 and 1715 respectively. Open slots 1727*a* and 1727*b* cooperatively connect with edge 1746*a* and 1747*a* respectively. Modular horizontal planar element 1728 engages with the upper lateral surface 1720*c* and 1721*c* of modular components 1714 and 1715 respectively. Open slots 1728*a* and 1728*b* cooperatively connect with edge 1746*b* and 1747*b* respectively. The upward facing tabs 1744*a-c* and 1745*a-c* are configured to contain the front edge of modular horizontal planar elements 1726, 1727, and 1728 with the front edge of these modular horizontal planar elements distal from the proximal location of the L-bend connectors 1724*a-c* and 1725*a-c*. The modular components 1714 and 1715 are configured to have a proximal portion designated by column 1714*b* and distal column 1714*a* on modular component 1714 with a similar proximal and distal configuration in modular component 1715. The lower legs 1716 and 1717 of modular component 1714 and the lower legs 1718 and 1719 of modular component 1715 rest on a flat surface such as a floor. Connection slots 1722*a-c* of modular component 1714 and connection slots 1723*a-c* of modular component 1715 allow for further cooperative connection of modular components. L-bend connectors 1724*a-c* of modular component 1714 are configured to cooperatively connect with connection slots 1712*a-g* of column 1702 of modular component 1701. In a similar fashion but with alternating connection, L-bend connectors 1725*a-c* are configured to cooperatively connect with connecting slots 1713*a-g* of column 1703 of modular component 1701. Modular component 1701 has a front 1707 and a back 1706 with one lateral side 1704 and opposite lateral side 1705 connected by a transverse section 1708. In a similar configuration to the earlier modular horizontal planar elements, modular horizontal planar element 1741 engages with the upper linear surface of 1735*a* and 1736*a*. Modular horizontal planar element 1742 engages with the upper linear surface of 1735*b* and 1736*b* and horizontally engages with the column of modular component 1729 and 1730 utilizing slots 1742*a* and 1742*b* respectively. As with modular components 1714 and 1715, modular components 1729 and 1730 are configured with elements 1731 and 1732 and 1733 and 1734, respectively, as feet for the modular components 1729 and 1730. Connection slots 1737*a-c* for modular component 1729 and 1738*a-c* for modular component 1730 provide further configurations for connections to the modular components. L-bend connectors 1739*a-c* of modular component 1729 and L-bend connectors 1740*a-c* of modular component 1730 are configured to cooperatively connect with the connection slots 1712*a-g* and 1713*a-g*, respectively. It is important to note that the L-bend connectors on the opposite sides of modular component 1701, 1724*a-c* and 1725*a-c* on the 1707 side of modular component 1701 and 1739*a-c* and 1740*a-c* on the 1706 side of modular component 1701, alternate when connecting to the connection slots 1712*a-g* and 1713*a-g*. In a similar fashion to modular components 1714 and 1715, modular components 1729 and 1730 are configured with a proximal column 1729*b* and a distal column 1729*a* and a proximal column 1730*a* and a distal column 1730*b* respectively. The distal column 1729*a* is configured with an upward facing tabs 1748*a-c* while the distal column 1730*b* is configured with upward facing tabs 1749*a-c*. The upward facing tabs are configured to contain the front edges of modular horizontal planar elements 1741, 1742, and 1743. Open connecting slots 1742*a* and 1742*b* cooperatively connect with edge 1750*a* and 1751*a*. In a similar fashion, open connecting slots 1743*a* and 1743*b* cooperatively connect with edge 1750*b* and 1751*b*.

Figure 18C:
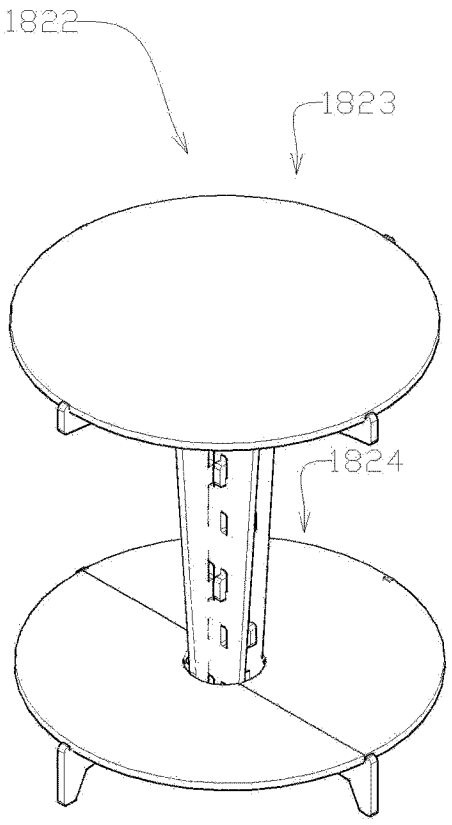
FIG. 18*c* is a perspective view of a modular assembly forming a table with a single top located planar element and a single lower located circular planar element.
Figure 18B:
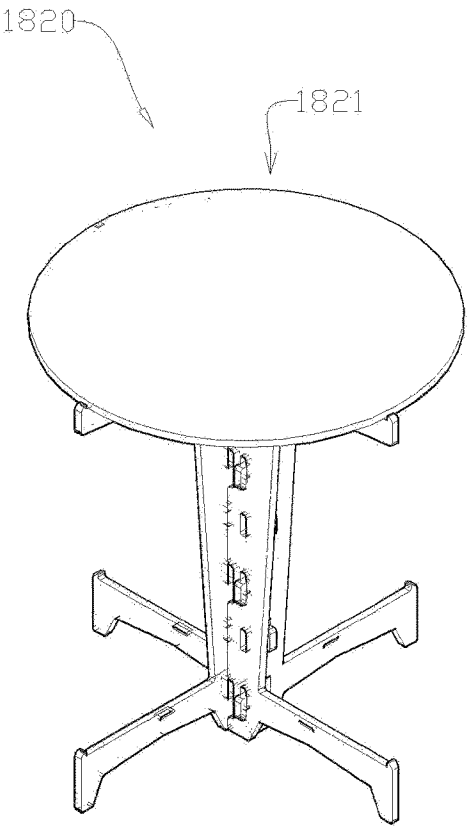
FIG. 18*b* is a perspective view of a modular assembly forming a table with a single top located circular planar element.
Figure 18A:
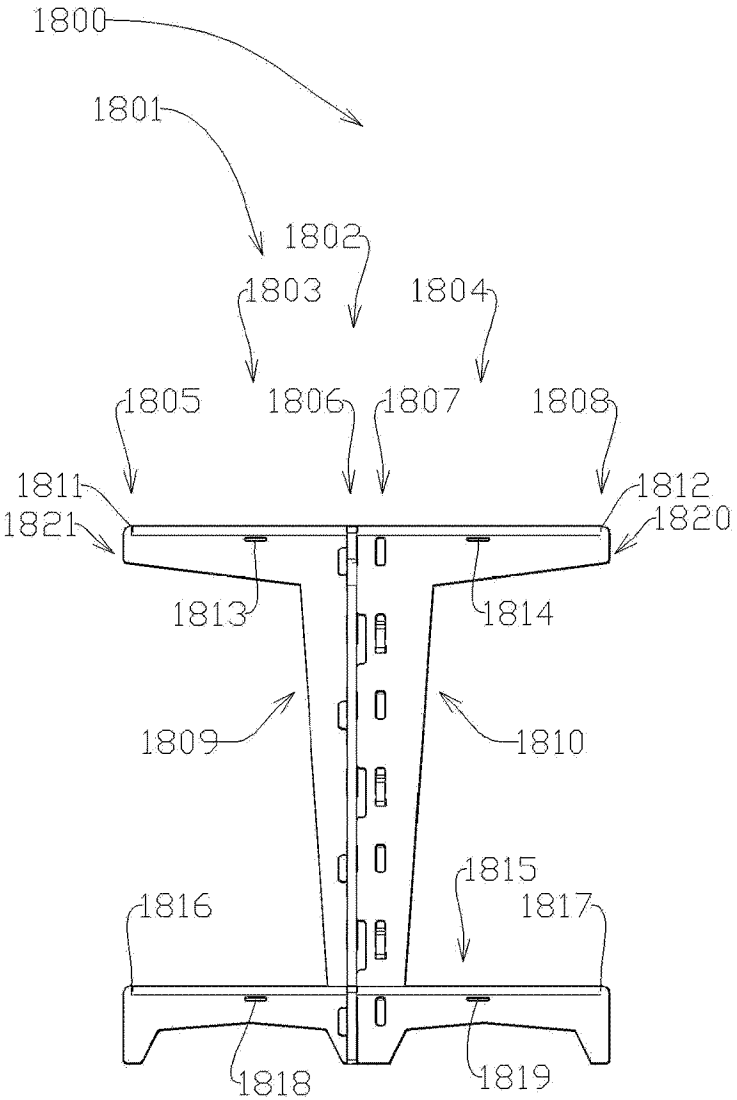
FIG. 18*a* is a side view of a modular assembly forming a table with two levels of circular planar elements.

FIG. 18*a* is a side view of a modular assembly forming a table with two levels of circular planar elements. The modular assembly may be configured to have more than two levels of circular planar elements. Modular component assembly 1801 has an upper circular planar modular component 1802 and a lower circular planar modular component 1815 where the upper circular planar modular component 1802 is constrained by tabs 1812 and 1811 at the edge of linear components 1820 and 1821 and the lower circular planar modular component 1815 is similarly constrained by tabs 1816 and 1817. Modular components 1809 and 1810 cooperatively connect utilizing L-bend connectors and connecting slots to form a modular assembly to support 1802 and 1815. And modular connecting component 1806 is shown on edge and a column of connecting slots 1807 is depicted with some of the slots utilized by L-bend connectors. Designation 1803 and designation 1804 are pointed to the cooperative connection that is formed by locking cams and connecting slots 1813 and 1814 respectively. Connecting slots 1818 and 1819 are configured to cooperatively connect circular planar modular component 1815. In a similar fashion, connecting slots 1813 and 1814 are configured to cooperatively connect circular planar modular component 1802. Any planar polygon component may be substituted for the circular planar modular component and the modular assembly adjusted to contain the edges of the planar polygon component.

FIG. 18*b* is a perspective view of a modular assembly forming a table with a single top located circular planar element. Modular assembly 1820 is configured to accept a singular circular planar modular component 1821. Here, any planar polygon component may be substituted for the circular planar modular component and the modular assembly adjusted to contain edges of the planar polygon component.

FIG. 18*c* is a perspective view of a modular assembly forming a table with a single top located planar element 1823 and a single lower located circular planar element 1824. Here, any planar polygon component may be substituted for the circular planar modular component and the modular assembly adjusted to contain the edges of the planar polygon component.

Figure 18F:
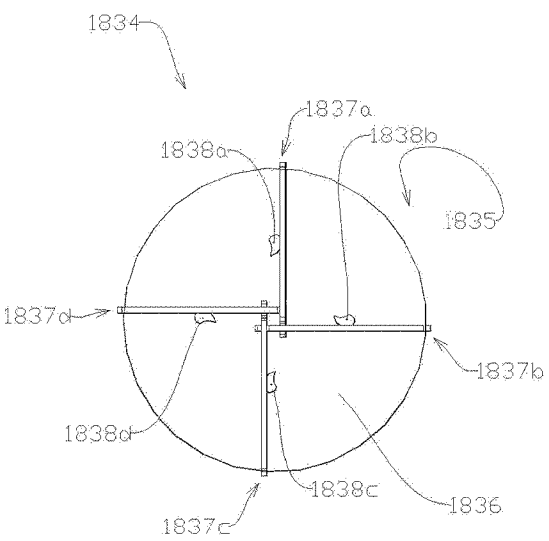
FIG. 18*f* is a bottom view of a circular modular planar element with locking cam elements.
Figure 18E:
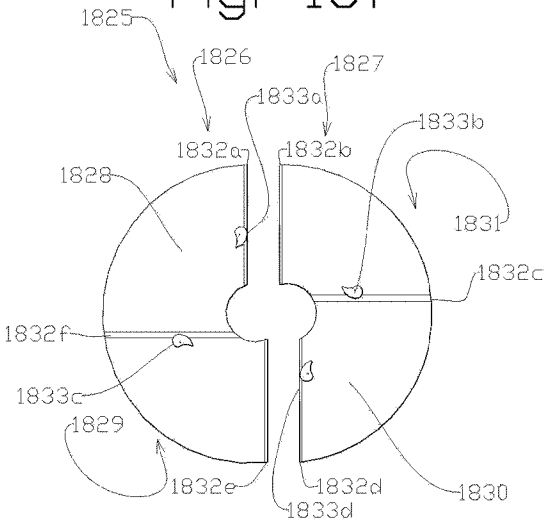
FIG. 18*e* is a bottom view of the circular planar elements with locking cam elements and is comprised of two hemispheres.
Figure 18D:
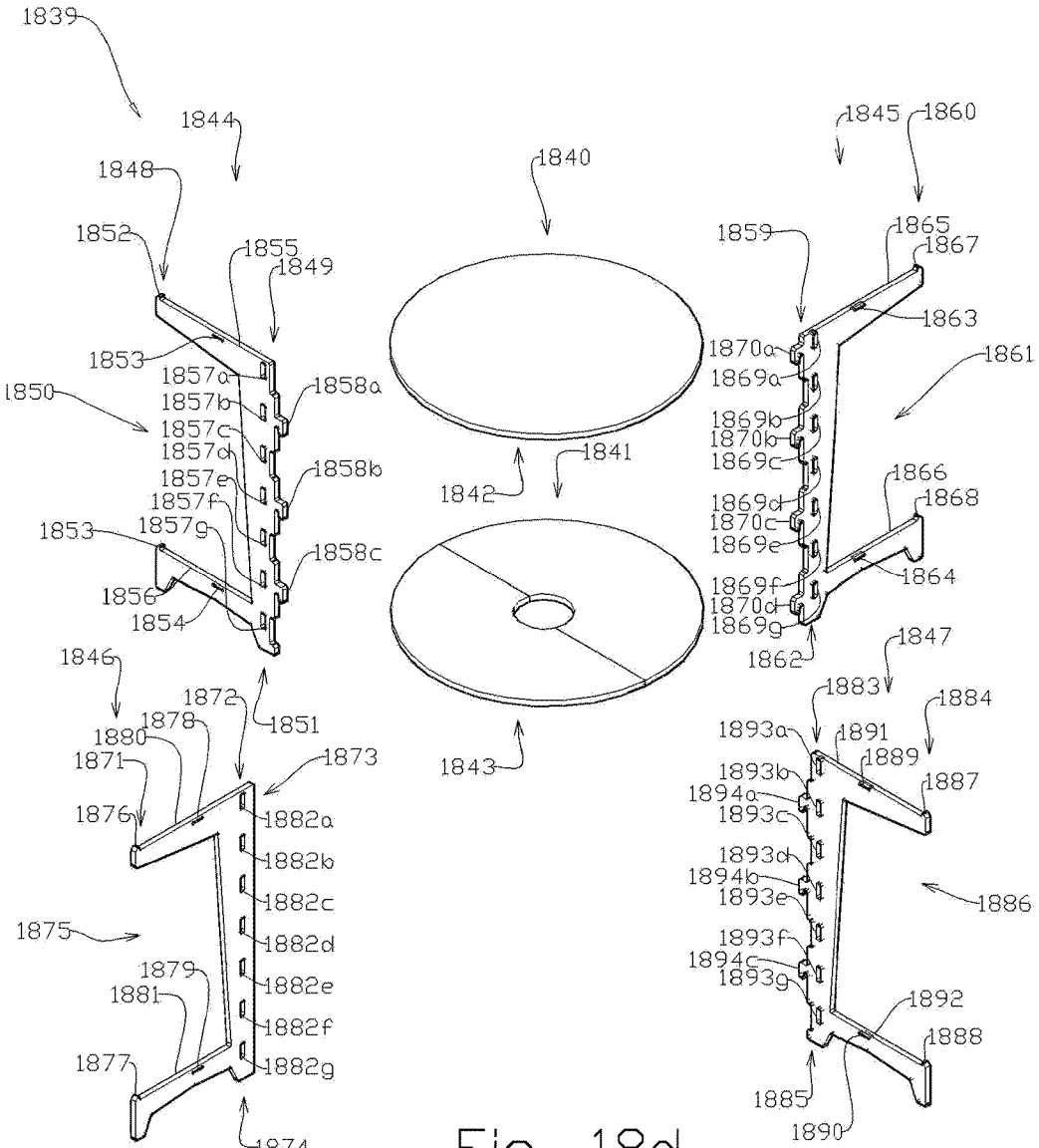
FIG. 18*d* is an exploded view of a modular assembly forming a table element with a top located circular planar element and a lower located circular planar element where the lower located circular planar element is comprised of two hemispheres.

FIG. 18*d* is an exploded view of a modular assembly 1839 forming a table element with a top located circular planar element with an upper surface 1840 and a lower surface 1842 and a lower located circular planar element where the lower located circular planar element has an upper surface 1841 and the lower surface 1843 and is comprised of two hemispheres. Four modular components, 1844, 1845, 1846, and 1847 are cooperatively connected to form the stand for the circular planar element. The bottom portion 1842 of the top circular planar element will rest on the top linear surfaces 1865, 1855, 1880, and 1891. Tabs 1852, 1867, 1887, and 1876 will contain the edge of the upper circular planar element on the top. Connecting slots 1863, 1889, 1878, and 1853 are configured to cooperatively connect with the locking cams on the bottom of the top circular planar element. In a similar fashion, the bottom portion of the lower circular planar element will rest on the linear surface 1866, 1892, 1881, and 1856. Tabs 1888, 1877, 1853, and 1868 will contain the edge of the lower circular planar element. Connecting slots 1890, 1879, 1854, and 1864 are configured to cooperatively connect with the locking cams located on the bottom of the lower circular planar element. The four modular elements 1844, 1845, 1846, and 1847 are cooperatively connected utilizing L-bend connectors and connecting slots. The connecting slots are arranged in columns 1849, 1859, 1883, and 1872. For instance, L-bend connectors 1858*a-c* are configured to connect with the connecting slots 1882*a-g* while the L-bend connectors 1870*a-d* are configured to cooperatively connect with the connecting slots 1857*a-g* and the L bend connectors 1894*a-c* are configured to cooperatively connect with the connecting slots 1869*a-g*. Spaces 1850, 1861, 1886, and 1875 are left open under the single or multilevel modular assembly table. The lowest portion of the connecting slot columns 1851, 1862, 1885, and 1874 will sit on a level surface such as a floor. Connecting slots 1893*a-g* are configured to cooperatively connect with other modular components. Here, any planar polygon component may be substituted for the circular planar modular component and the modular assembly adjusted to contain the edges of the planar polygon component. Modular components 1845, 1847, 1846, and 1844 may be extended in height with an increased number of L-bend connectors and connecting slots. The modular component 1839 may also be configured with multiple levels of circular planar elements and for polygonal planar elements.

FIG. 18*e* is a bottom view of the circular planar elements with locking cam elements. The modular assembly 1825 is comprised of two modular component hemispheres 1826 and 1827. Modular component 1826 has an underside 1828 and a top 1829. Modular component 1827 has an underside 1830 and the top 1831. Locking cams 1833*a* and 1833*c* are located on the underside of modular component 1826 and are configured to form an interference fit to lock the hemisphere modular component onto a second modular component or modular assembly. In similar fashion, locking cams 1833*b* and 1833*d* on the underside of hemisphere modular component 1827 and are configured to form an interference fit with a second modular component or modular assembly. Partial channels 1832*a* and 1832*b* are configured to be brought together in a shiplap joint to create a single channel that is then configured to cooperatively connect with a modular component that fits into the resulting channel. In a similar fashion, partial channels 1832*e* and 1832*d* are brought together in a shiplap joint to create a single channel that is then configured to cooperatively connect with a modular component that fits into the resulting channel. Channels 1832*f*, and 1832*c* are configured to cooperatively connect with a modular component that fits into the channels. Here, any planar polygon component may be substituted for the circular planar modular component and the modular assembly adjusted to contain the edges of the planar polygon component.

FIG. 18*f* is a bottom view of a circular modular planar element 1834. The circular modular planar element is configured on the bottom side 1836 to cooperatively connect with another modular component or modular assembly while the top portion 1835 is configured to serve as a work surface. Locking cams 1838*a*, 1838*b*, 1838*c*, and 1838*d* are configured to cooperatively connect with a modular component or modular assembly through the use of an interference fit between the locking cams and the other modular component or modular assembly. In a similar fashion, channels 1837*a*, 1837*b*, 1837*c*, and 1837*d* are configured to cooperatively connect with a modular component or modular assembly where the modular component or modular assembly fits into the channels of the bottom side 1836 of the circular modular planar element 1834. Here, any planar polygon component may be substituted for the circular planar modular component and the modular assembly adjusted to contain the edges of the planar polygon component.

Figure 19:
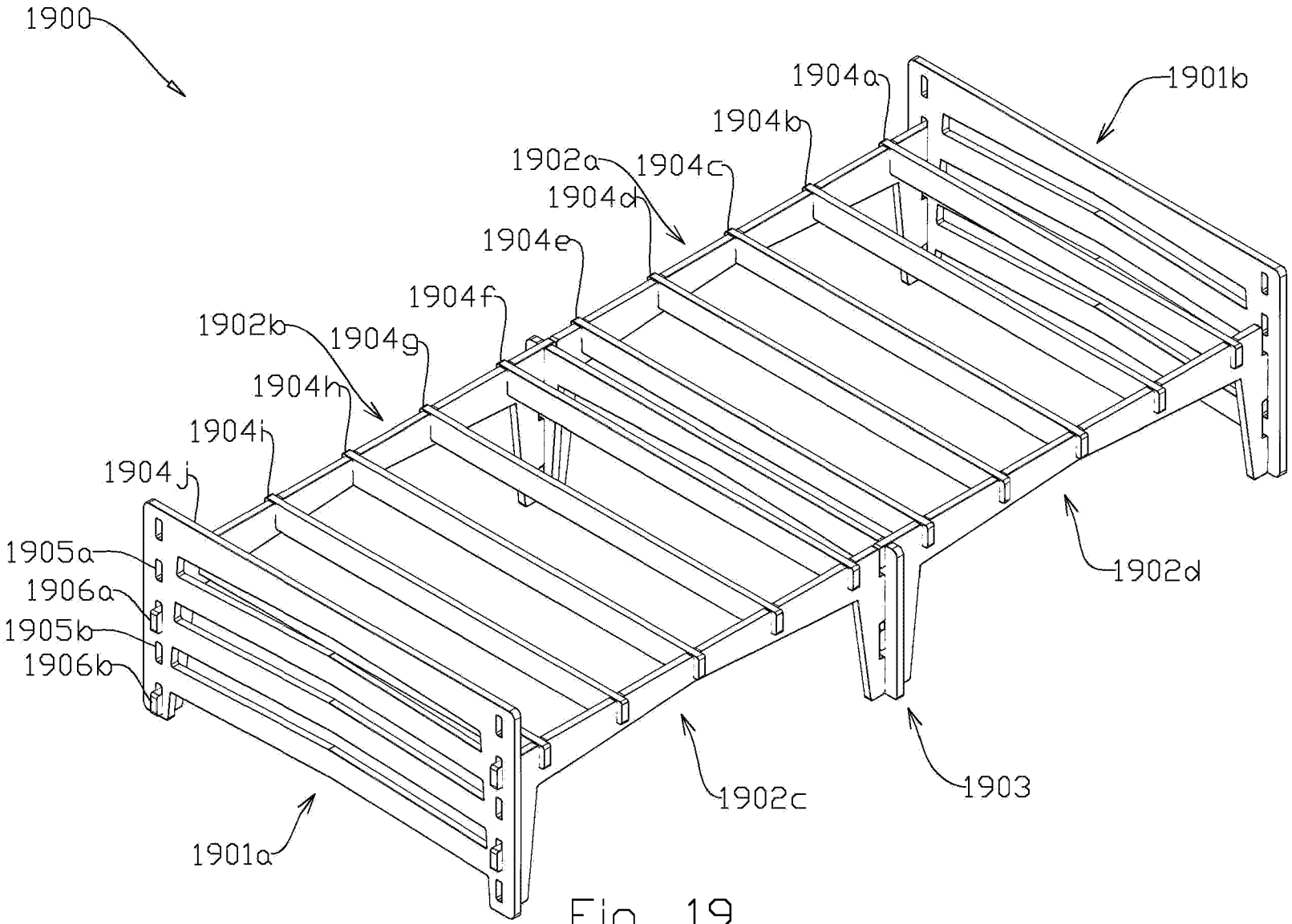
FIG. 19 is an assembled modular unit forming a modular bed assembly.

FIG. 19 is an assembled modular unit forming a bed element 1900. Modular component 1901*a* is configured to form the distal end or foot of the bed while modular component 1901*b* is configured to form the proximal end or head of the bed. Modular lateral components 1902*a* and 1902*d* are cooperatively connected on one end to the proximal end of the bed and cooperatively connected on the other end to a central modular component 1903. In a similar fashion modular lateral components 1902*b* and 1902*c* are connected on one end to the distal end of the bed and cooperatively connected on the other end to a central modular component 1903. This connection of the lateral components 1902*a*, 1902*b*, 1902*c*, and 1902*d* to modular components 1901*b*, 1901*a* and 1903 form the frame of the modular bed assembly. Modular components 1904*a-j* are configured to form the cross slats of the modular bed assembly. Connecting slot 1905*a* and 1905*b* are configured to cooperatively connect L-bend connectors of other modular components as is shown with 1906*a* and 1906*b*.

Figure 20:
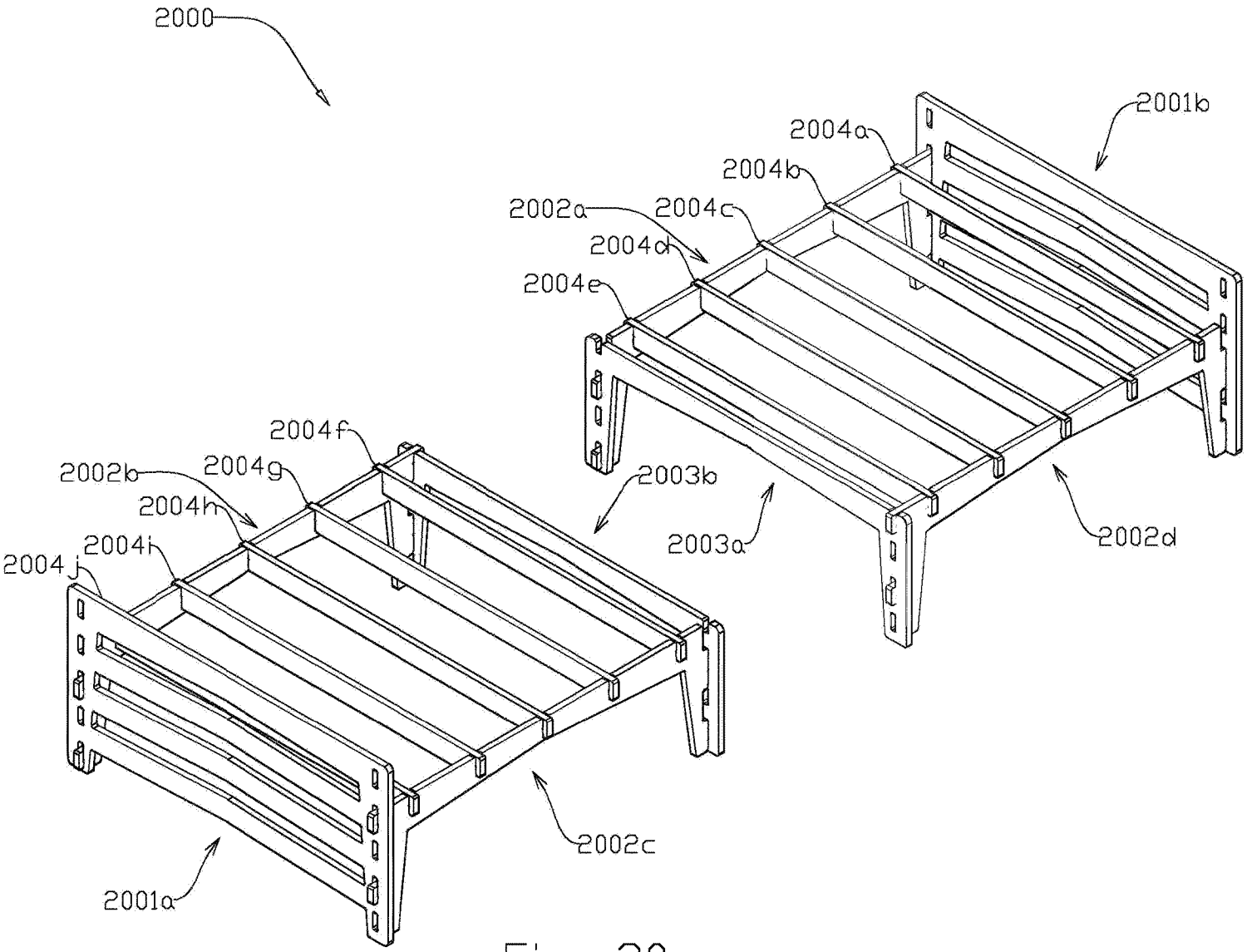
FIG. 20 is a partially exploded view of a modular bed assembly.

FIG. 20 is a partially exploded view of a modular bed element 2000. The distal end 2001*a* or foot of the bed is cooperatively connected to lateral components 2002*c* and 2002*b*. Lateral components 2002*c* and 2002*b* are also cooperatively connected to modular component 2003*b*. The proximal end 2001*b* or head of the modular bed assembly is cooperatively connected to lateral modular components 2002*a* and 2002*d*. Lateral modular components 2002*a* and 2002*d* are also cooperatively connected to modular component 2003*a* thus forming part of the frame of the modular bed assembly. Slats 2004 *a-j* are disposed between the lateral modular components.

Figure 21:
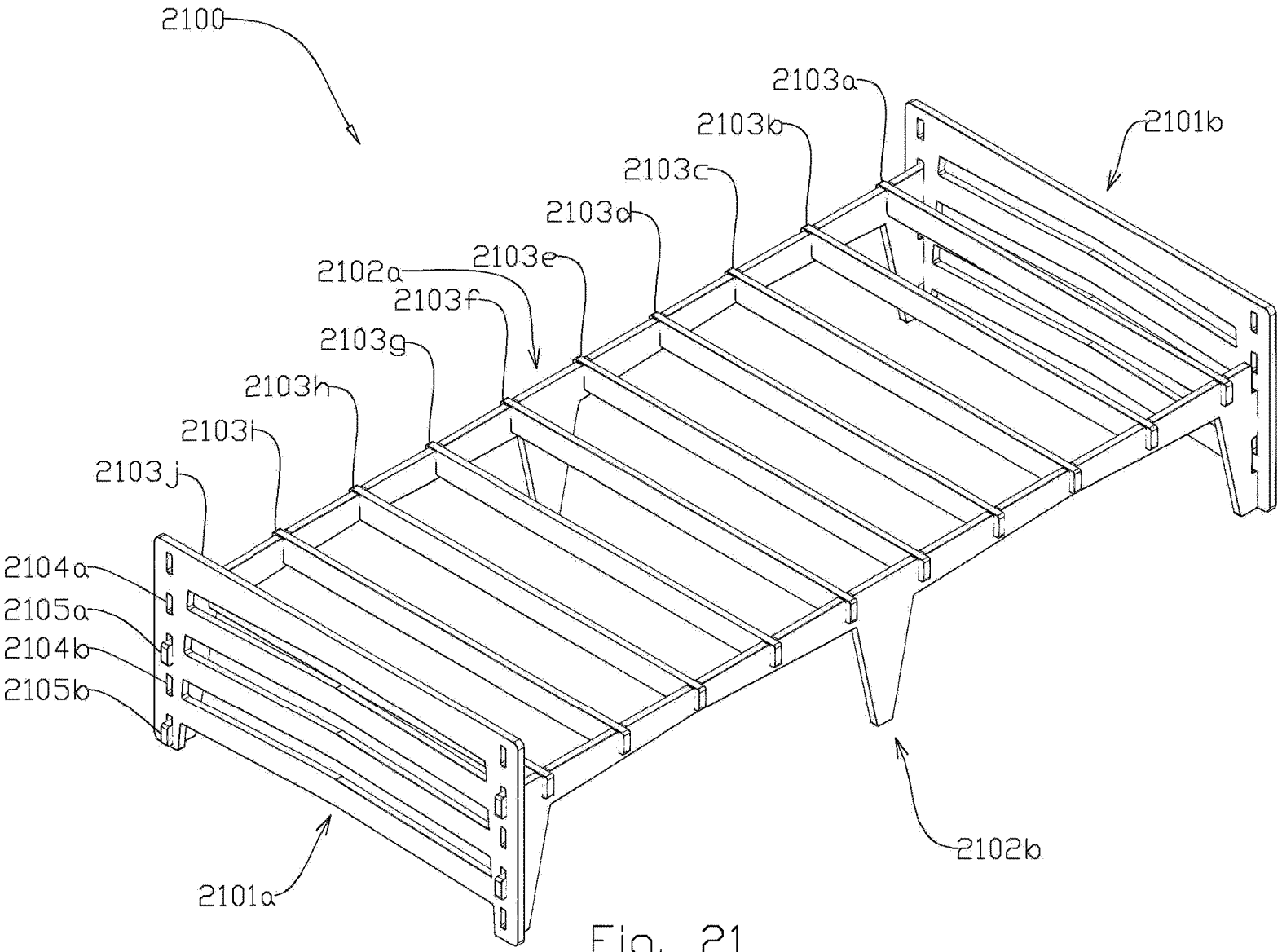
FIG. 21 is an assembled modular bed element with unitary connecting longitudinal elements.

FIG. 21 is an assembled modular bed element with unitary connecting longitudinal elements. The modular bed assembly 2100 is comprised of two main lateral components 2102*a* and 2102*b* that are cooperatively connected to a distal end or foot of the modular bed assembly 2101*a* and the proximal end or head of the modular bed assembly 2101*b* utilizing connecting slots and L-bend connectors as shown in 2104*a-b* and 2105*a-b*, respectively. Slats 2103*a-j* complete the frame construction of the modular bed assembly 2100.

Figure 22:
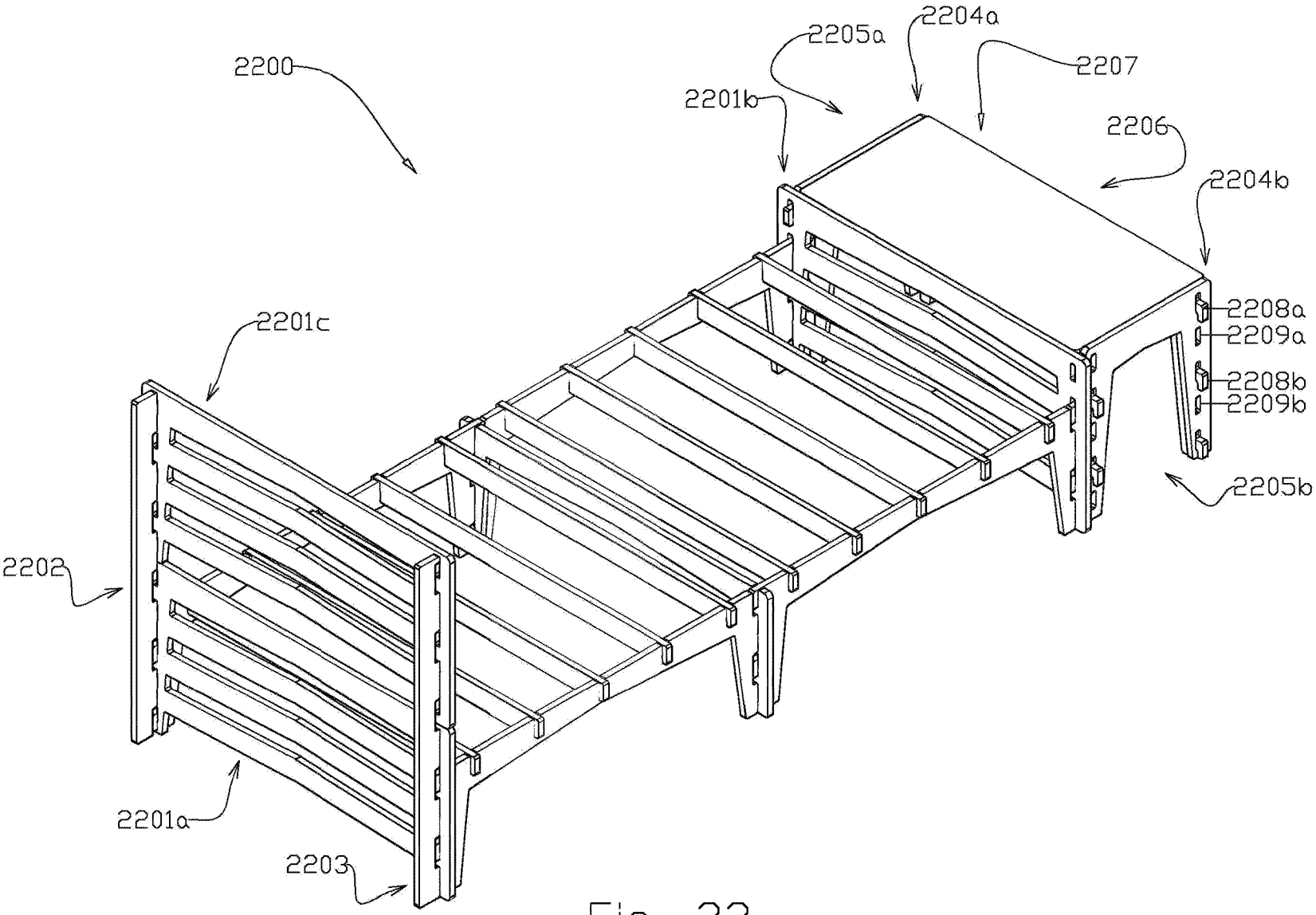
FIG. 22 is an modular bed assembly and a connected modular table element.

FIG. 22 is an assembled modular bed element and a connected modular assembly with a planar element. Modular additions may be made to both the proximal end and distal end of the modular bed assembly as is seen in the modular bed assembly 2200. Modular components 2201*a* and 2201*c* are configured to be stacked and cooperatively connected in the stacked configuration utilizing modular components 2202 and 2203 to form the head or proximal end of the modular bed assembly. Modular component 2201*b* is cooperatively connected to the modular bed frame and forms the distal end or foot of the modular bed assembly. A planar element 2207 may be connected between modular components 2204*a* and 2204*b* to form a modular assembly. The modular assembly has two open sides 2205*a* and 2205*b* and an opened end 2206. Connecting slots 2209*a-b* may be utilized to cooperatively connect L-bend connectors as is shown in 2208*a* and 2208*b*. The modular assembly attached to modular component 2201*b* may also be configured to be a six sided modular assembly with a top modular component, a bottom or lower modular component, a left side modular component, a right side modular component, a front side modular component and a rear side modular component. The top, front, left, and right modular components may be configured to be operable in an opening and closing action. As an example, the six sided modular assembly may be of footlocker where the top modular component is configured to open and close in a hinged manner.

Figure 23:
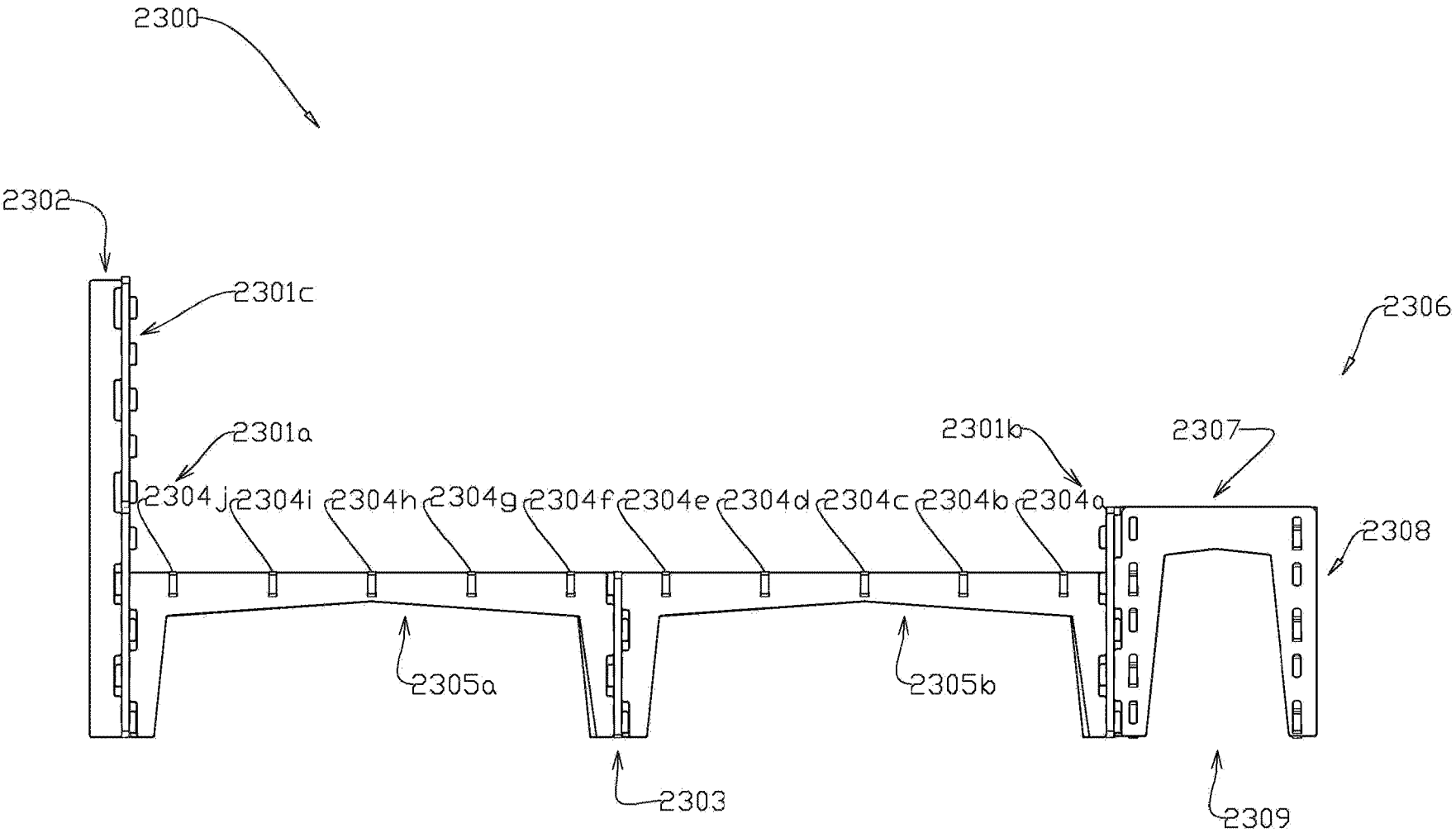
FIG. 23 is a side view of an assembled modular bed and a connected table element.

FIG. 23 is a side view of an assembled bed element and a connected table element. The modular bed assembly 2300 is comprised of a proximal end or head 2302 that is comprised of two stacked modular components 2301*c* and 2301*a*. Lateral component 2305*a* cooperatively connects to both modular assembly 2302 and modular component 2303. Lateral component 2305*b* cooperatively connects to modular component 2303 and cooperatively connects to modular element 2301*b*. Modular component 2306 is cooperatively connected to modular component 2301*b* and where modular component 2306 has open sides 2307 and 2309 and an open end 2308. Slats 2304*a-j* complete the modular bed assembly. The modular assembly attached to modular component 2301*b* may also be configured to be a six sided modular assembly with a top modular component, a bottom or lower modular component, a left side modular component, a right side modular component, a front side modular component and a rear side modular component. The top, front, left, and right modular components may be configured to be operable in an opening and closing action. As an example, the six sided modular assembly may be of footlocker where the top modular component is configured to open and close in a hinged manner.

Figure 24:
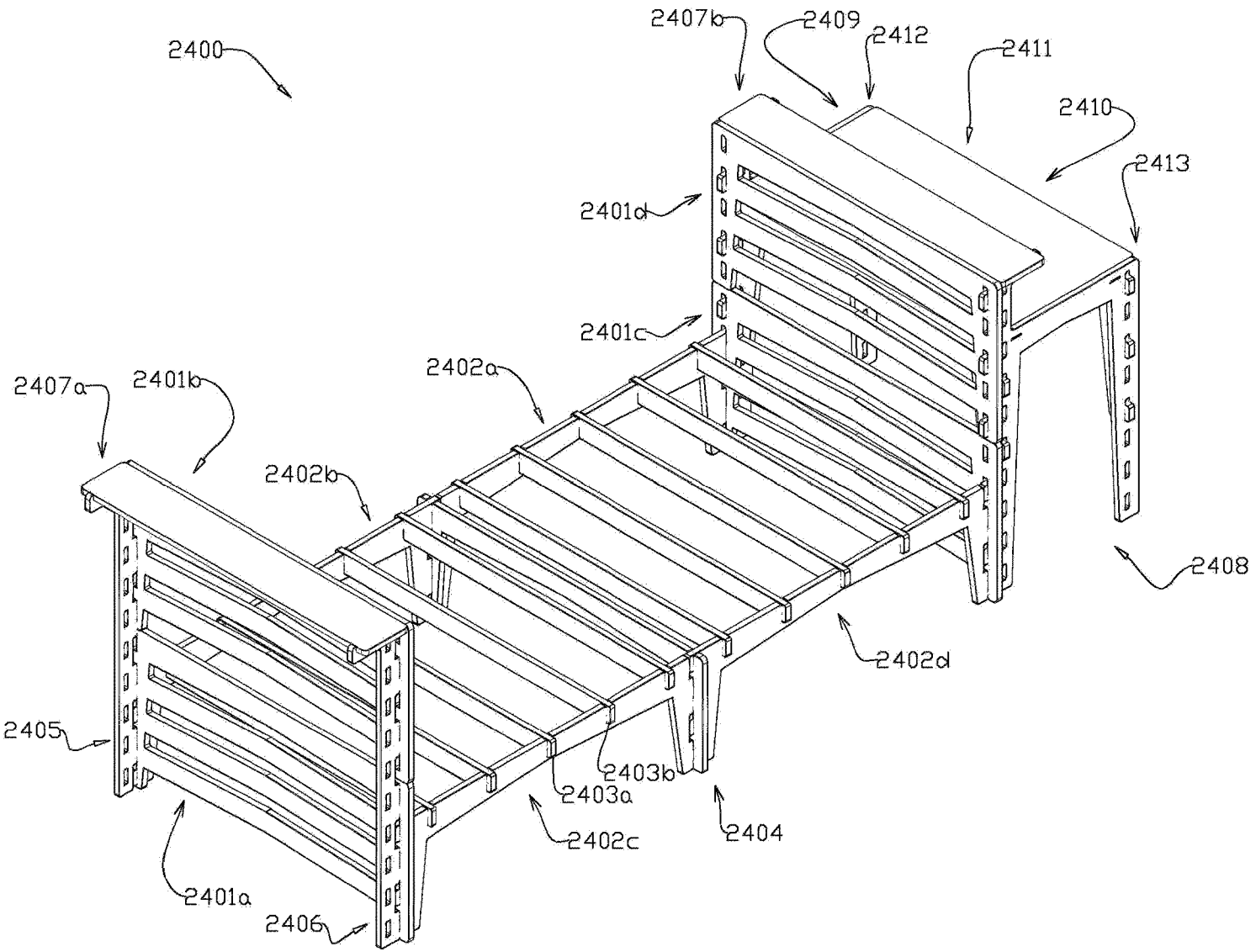
FIG. 24 is an assembled modular unit forming a modular bed assembly with modular stacked ends and a modular table element connected on one end of the assembled modular bed element.

FIG. 24 is an assembled modular unit forming a bed element with modular stacked ends and a modular table element connected on one end of the assembled modular bed element. The modular bed assembly 2400 has a proximal end or head of the bed and is comprised of modular components 2401*b* stacked on top of 2401*a* and cooperatively connected to each other in the stack position utilizing modular components 2405 and 2406. The stacked components are cooperatively connected utilizing connection slots and L-bend connectors. A modular component shelf 2407*a* is attached cooperatively to the top of modular components 2405 and 2506. Linear modular components 2402*b* and 2402*c* are cooperatively attached to the proximal end modular component 2401*a* and the centrally located modular component 2404. In a similar fashion, linear modular components 2402*a* and 2402*d* are cooperatively attached to 2401*c* at the distal end of the modular bed assembly and to 2404 at the middle of the modular bed assembly. These connections are cooperatively made utilizing connecting slots and L-bend connectors. A planar element 2407*b* that may be utilized as a shelf is cooperatively connected to the top of the modular components 2412 and 2413. Another planar element 2411 may be located at the distal end of the modular bed assembly where the planar element 2411 has open sides 2408 and 2409 and an open end 2410. Slats such as 2403*a* and 2403*b* are configured to be disposed across the lateral frame to complete the modular bed assembly. The planar element 2411 sits between sides 2408 and 2409, allowing it to be located at different heights depending upon the cooperative connection with the side modular components. The modular assembly attached to modular components 2401*d* and 2401*c* may also be configured to be a six sided modular assembly with a top modular component, a bottom or lower modular component, a left side modular component, a right side modular component, a front side modular component and a rear side modular component. The top, front, left, and right modular components may be configured to be operable in an opening and closing action. As an example, the six sided modular assembly may be of footlocker where the top modular component is configured to open and close in a hinged manner.

Figure 25:
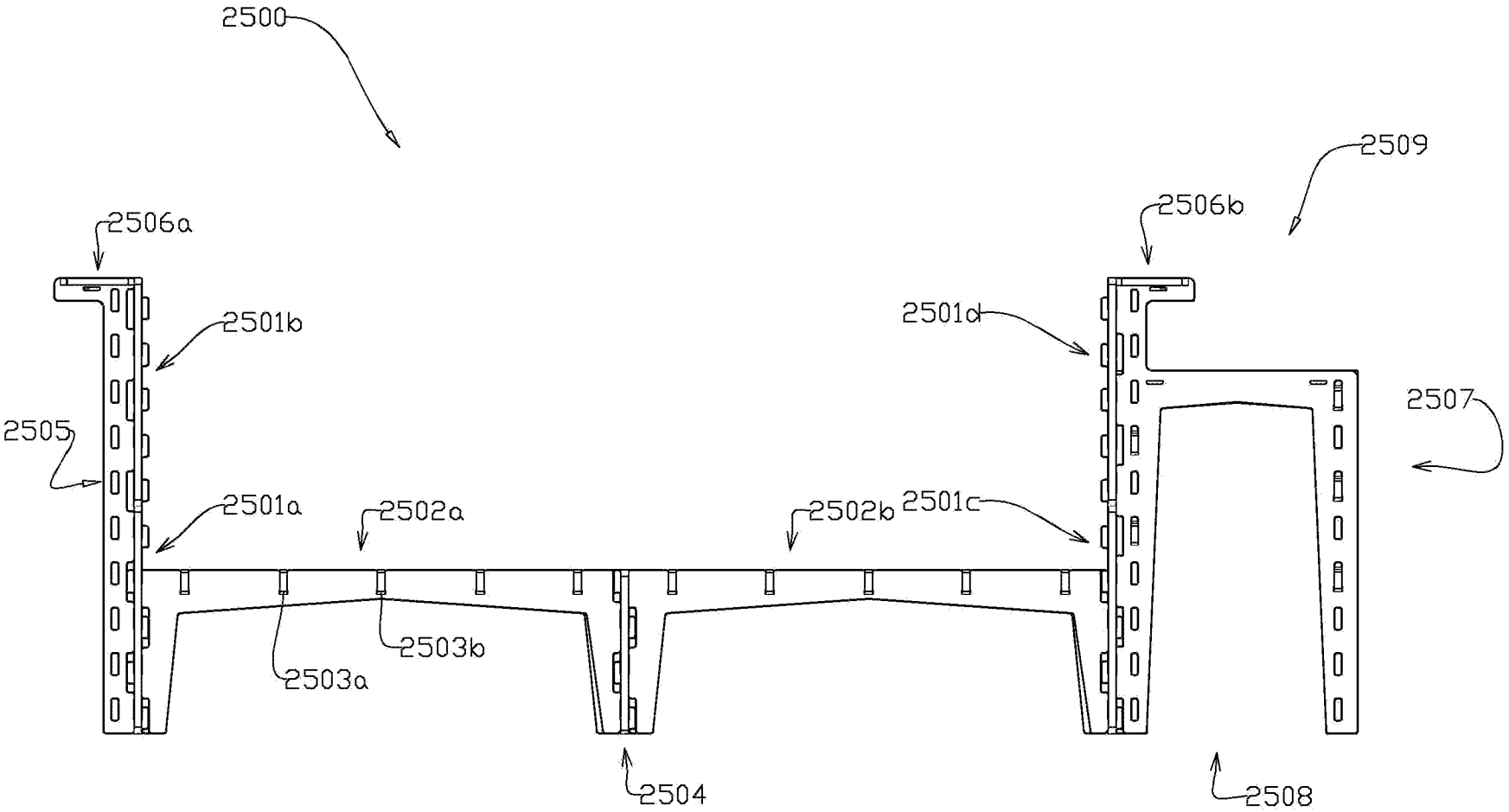
FIG. 25 is a side view of an assembled modular unit forming a modular bed assembly with modular stacked ends and a modular table element connected on one end of the modular bed assembly.

FIG. 25 is a side view of an assembled modular unit forming a bed element with modular stacked ends and a modular table element connected on one end of the assembled modular bed. Modular component 2501*b* is stacked on top of 2501*a* and secured in place utilizing modular component 2505 that cooperatively connects the stacked elements 2501*b* and 2501*a* utilizing connecting slots and L-bend connectors. A planar element 2506*a* is cooperatively connected to modular component 2505. Linear element 2502*a* is cooperatively connected to modular component 2501*a* and modular component 2504. In a similar fashion, linear element 2502*b* is cooperatively connected to modular component 2504 and modular component 2501*c*. Slats such as 2403*a* and 2403*b* are configured to be disposed across the lateral frame to complete the modular bed assembly. At the distal end of the modular bed assembly, modular component 2501*d* is stacked on top of modular component 2501*c* and cooperatively connected utilizing connecting slots and L-bend connectors. A planar modular component 2506*b* is cooperatively attached to modular component 2509. The modular component at the distal end of the modular bed assembly 2500 has an open end 2507 and open sides 2508 and 2509. The modular assembly attached to modular components 2501*d* and 2501*c* may also be configured to be a six sided modular assembly with a top modular component, a bottom or lower modular component, a left side modular component, a right side modular component, a front side modular component and a rear side modular component. The top, front, left, and right modular components may be configured to be operable in an opening and closing action. As an example, the six sided modular assembly may be of footlocker where the top modular component is configured to open and close in a hinged manner.

Figure 26A:
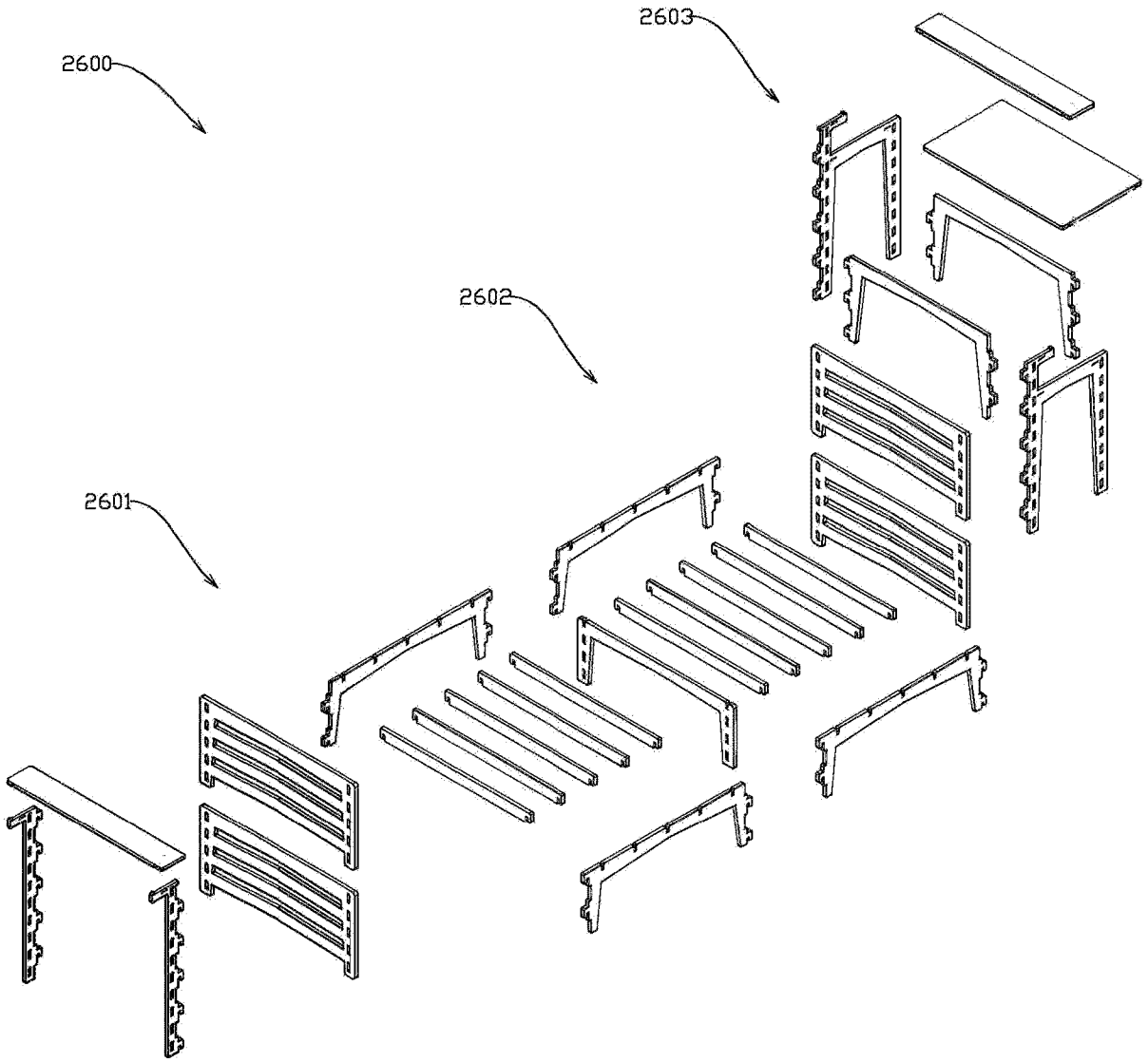
FIG. 26*a* is an exploded view of an assembled modular unit forming a modular bed assembly with modular stacked ends and a modular table element connected on one end of the modular bed assembly.

FIG. 26*a* is an exploded view of an assembled modular unit forming a bed element with modular stacked ends and a modular table element connected on one end of the assembled modular bed element. The modular bed assembly has three major subsystems 2601, 2602, and 2603.

Figure 26B:
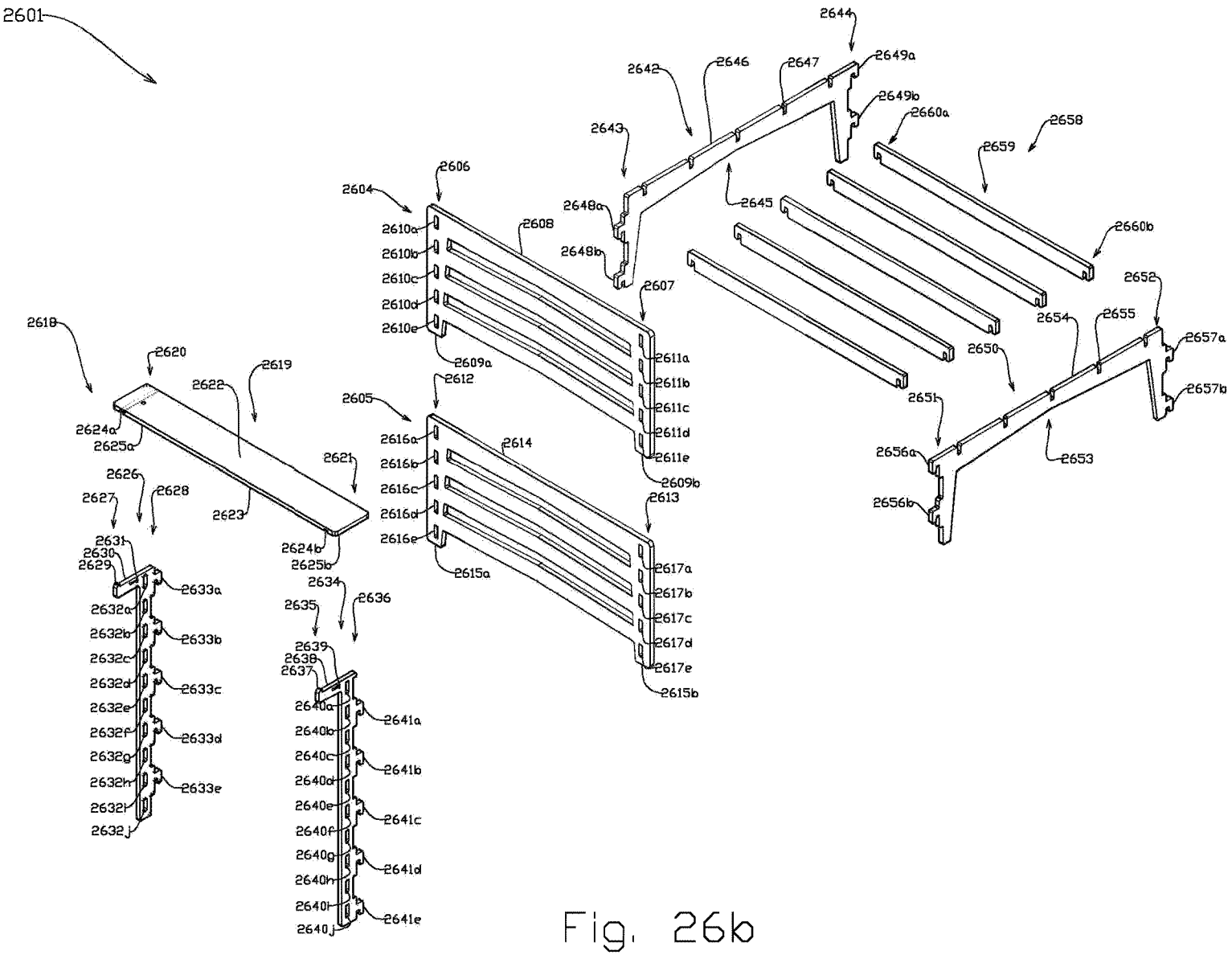
FIG. 26*b* is an exploded view of the 2601 group in FIG. 26*a*.

FIG. 26*b* is an exploded view of the 2601 subsystem in FIG. 26*a*. Modular component 2604 is stacked on top of modular component 2605 and cooperatively connected utilizing modular components 2626 and 2634. L-bend connectors 2633*a-e* cooperatively connect with connecting slots 2610*a-e* and 2616*a-e*. In a similar fashion, L-bend connectors 2641*a-e* cooperatively connect with connecting slots 2611*a-e* and 2617*a-e*. The lower end of column 2606 represented by 2609*a* rests on the top of modular component 2614 at 2612. In a similar fashion, the lower end of column 2607 shown by 2609*b* rest on the top of modular component 2605 at the linear edge 2614. The lower end of column 2612 represented by 2615*a* and the lower end of column 2613 represented by 2615*b* rests on a level surface such as a floor. Planar modular component 2619 rests on top of the linear edge 2630 of modular component 2626 and the top linear edge 2638 of modular component 2634. 2631 and 2639 are connecting slots that cooperatively connect with 2625*a* and 2625*b*. Tab 2629 and tab 2637 contain the planar element 2619 on the edge. Planar modular component 2619 has an underside 2623 and upper side 2622. Modular components 2626 and 2634 are comprised of connecting slots 2632*a-j* and 2640*a-j* respectively to allow for further cooperative connection of modular components. Linear modular components 2642 and 2650 are cooperatively connected to modular component 2605 utilizing L-bend connectors 2648*a-b* and connecting slots 2616*a-e* and L-bend connectors 2656*a-b* and connecting slots 2617*a-e* respectively. Slats 2658 are comprised of a transverse section 2659 and a notch on either end of the transverse section designated as 2660*a* and 2660*b*. The notches on either end of the 2658 slats will cooperatively connect with the notches 2647 and 2655 on linear modular components 2642 and 2650 respectively. Linear modular component 2642 is further comprised of L-bend connectors 2649*a-b* and in a similar fashion linear modular component 2650 is further comprised of L-bend connectors 2657*a-b*.

Figure 26C:
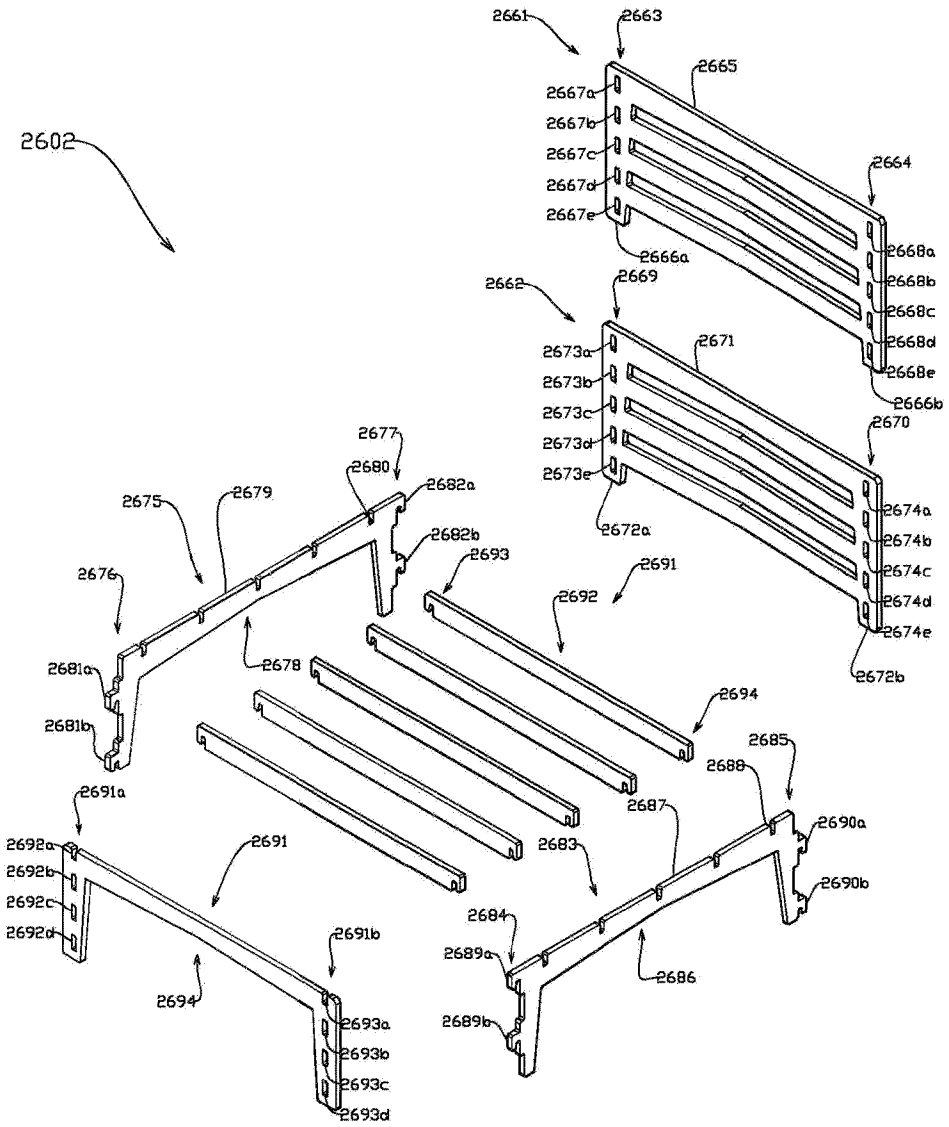
FIG. 26*c* is an exploded view of the 2602 group in FIG. 26*a*.

FIG. 26*c* is an exploded view of the 2602 group in FIG. 26*a*. Linear modular components 2675 and 2683 cooperatively connected with modular component 2662 through the use of L-bend connectors 2682*a-b* and connecting slots 2673*a-e* and L-bend connectors 2690*a-b* and connecting slots 2674*a-e*, respectively. Modular components 2661 and 2662 are stacked on top of each other and cooperatively connected utilizing L-bend connectors and connecting slots. Modular component 2661 has a top transverse portion 2665 with columns of connecting slots on either end designated by column 2663 on one side and column 2664 on the opposite side. Column 2663 has connecting slots 2667*a-e* and column 2664 has connecting slots 2668*a-e*. In a similar fashion, modular component 2662 has a transverse portion 2671 with a column of connecting slots at 2669 and a second column of connecting slots on the opposite side of the transverse portion designated as 2670. Connecting slots 2673*a-e* are in column 2669 and connecting slots 2674*a-e* are in column 2670. The lower edge of column 2663 designated by 2666*a* will sit on top of column 2669 and in a similar fashion the bottom edge of column 2664 designated by 2666*b* will sit on top of column 2670. The bottom of column 2669 designated by 2672*a* and the bottom of column 2670 designated by 2672*b* will sit on a linear surface such as a floor. Slats 2691 are comprised of a transverse portion 2692 with notches 2693 and 2694 on either end. Notch 2693 will cooperatively connect with notch 2680 and notch 2694 will cooperatively connect with notch 2688. L-bend connectors 2681*a-b* and 2689*a-b* allow for further connection of linear modular components 2675 and 2683 respectively. Modular component 2691 is configured with a transverse portion 2694 and open connecting slots 2692*a* and 2693*a* on either end of the 2694 transverse portion of the 2691. These open connecting slots are configured to cooperatively connect with L-bend connectors such as 2681*a-b* and 2689*a-b*. The L-bend connectors may also cooperatively connect with connecting slots 2692*b-d* and 2693*b-d*.

Figure 26D:
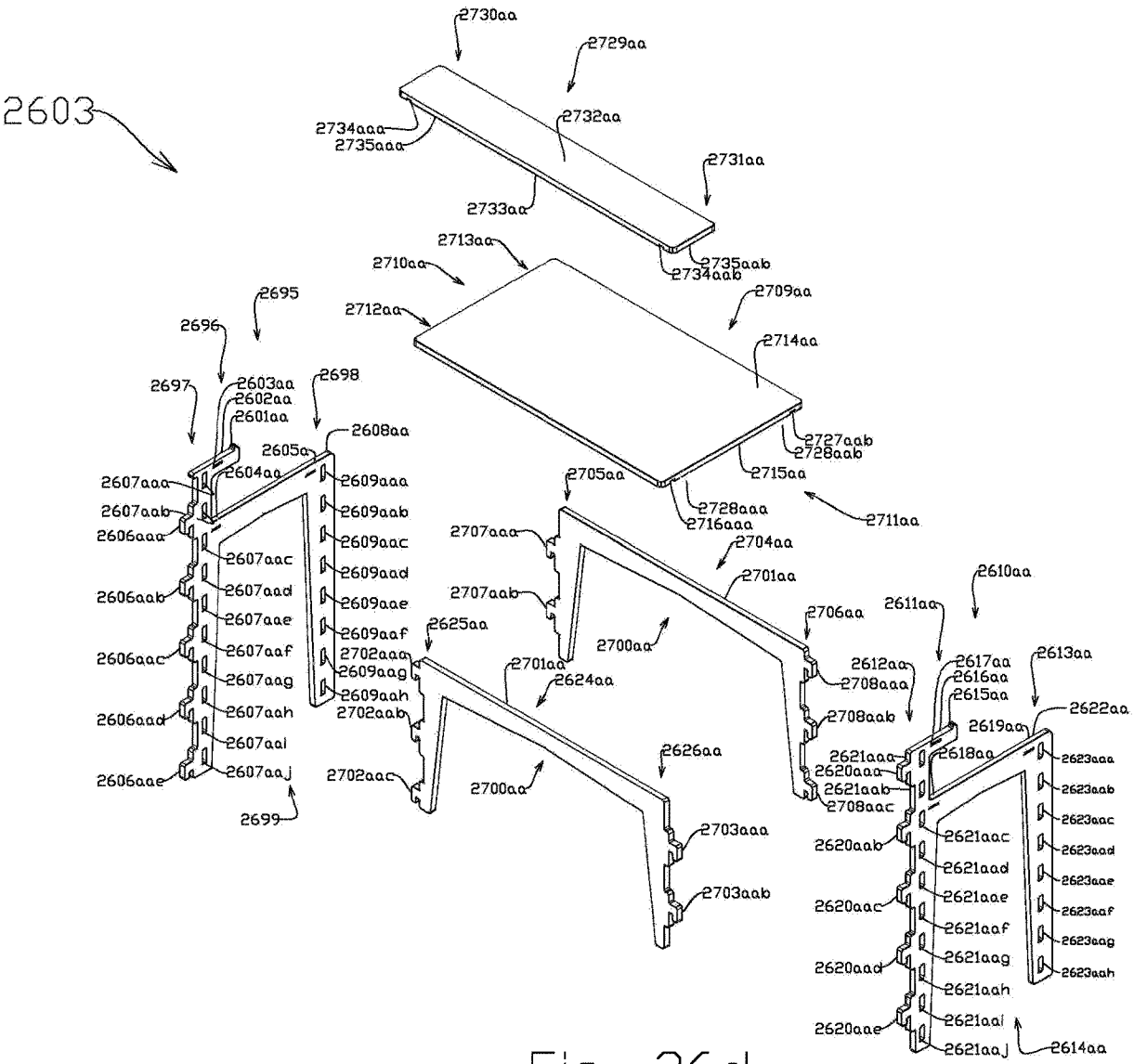
FIG. 26*d* is an exploded view of the 2603 group in FIG. 26*a*.

FIG. 26*d* is an exploded view of the 2603 group in FIG. 26*a*. Two lateral modular components 2695 and 2610*aa* are cooperatively attached to transverse modular components 2624*aa* and 2704*aa*. The cooperative attachment is through the use of L-bend connectors and connecting slots. In regards to modular component 2695, the column 2697 of connecting slots 2607*aaa-aaj* and column 2698 of connecting slots 2609*aaa-aah* cooperatively connect to L-bend connectors 2702*aaa-aac* and 2707*aaa-aab* respectively. In regards to modular component 2610*aa*, the column 2613*aa* of connecting slots 2623*aaa-aah* and column 2612*aa* of connecting slots 2621*aaa-aaj* cooperatively connect to L-bend connectors 2708*aaa-aac* and 2703*aaa-aab* respectively. Modular planar element 2729*aa* which has a top 2732*aa* and a bottom 2733*aa* and has a proximal end 2731*aa* and a distal end 2730*aa* and is configured to cooperatively connect with linear surface 2616*aa* on the proximal 2731*aa* end and with lateral surface 2602*aa* on the 2730*aa* distal end utilizing channel 2735*aab* cooperatively connecting with lateral surface 2616*aa* and channel 2735*aaa* cooperatively connecting with lateral surface 2602*aa* and to be locked in place through an interference fit utilizing locking cam 2734*aaa* and connection slot 2603*aa* and locking cam 2734*aab* and connecting slot 2617*aa*. The modular horizontal planar element 2729*aa* is contained by tab 2601*aa* of modular assembly 2695 and by tab 2615*aa* of modular assembly 2610*aa*. In a continuing explanation of the connection of modular subassembly 2603, modular horizontal planar element 2709*aa* is configured to cooperatively go between 2622*aa* and linear surface 2608*aa* where edge 2710*aa* and edge 2711*aa*, respectively, rest between the linear surfaces and are locked in place utilizing locking cam 2728*aaa* and locking cam 2727*aab* into a connection slots 2618*aa* and 2619*aa* respectively on modular component 2610*aa* and locking cam 2612*aa* and locking cam 2713*aa* cooperatively connect with connection slot 2604*aa* and connection slot 2605*aa* and where channel 2716*aaa* and channel 2727*aab* cooperatively connect with linear surfaces 2701*aa* on transverse sections 2624*aa* and 2704*aa* respectively. The locking cams and the channels are on the bottom side of modular horizontal planar element 2709*aa* designated by 2715*aa* with the top of the modular horizontal planar element designated by 2714*aa*. Transverse sections 2624*aa* and 2704*aa* are also configured to have a transverse section 2700*aa* with columns 2625*aa* and 2626*aa* on either end of the transverse section of modular component 2624*aa* and column 2705*aa* and column 2706*aa* on either end of the transverse section 2700*aa* of modular component 2704*aa*. The modular assembly 2603 may also be configured to be a six sided modular assembly with a top modular component, a bottom or lower modular component, a left side modular component, a right side modular component, a front side modular component and a rear side modular component. The top, front, left, and right modular components may be configured to be operable in an opening and closing action. As an example, the six sided modular assembly may be of footlocker where the top modular component is configured to open and close in a hinged manner.

Figure 27A:
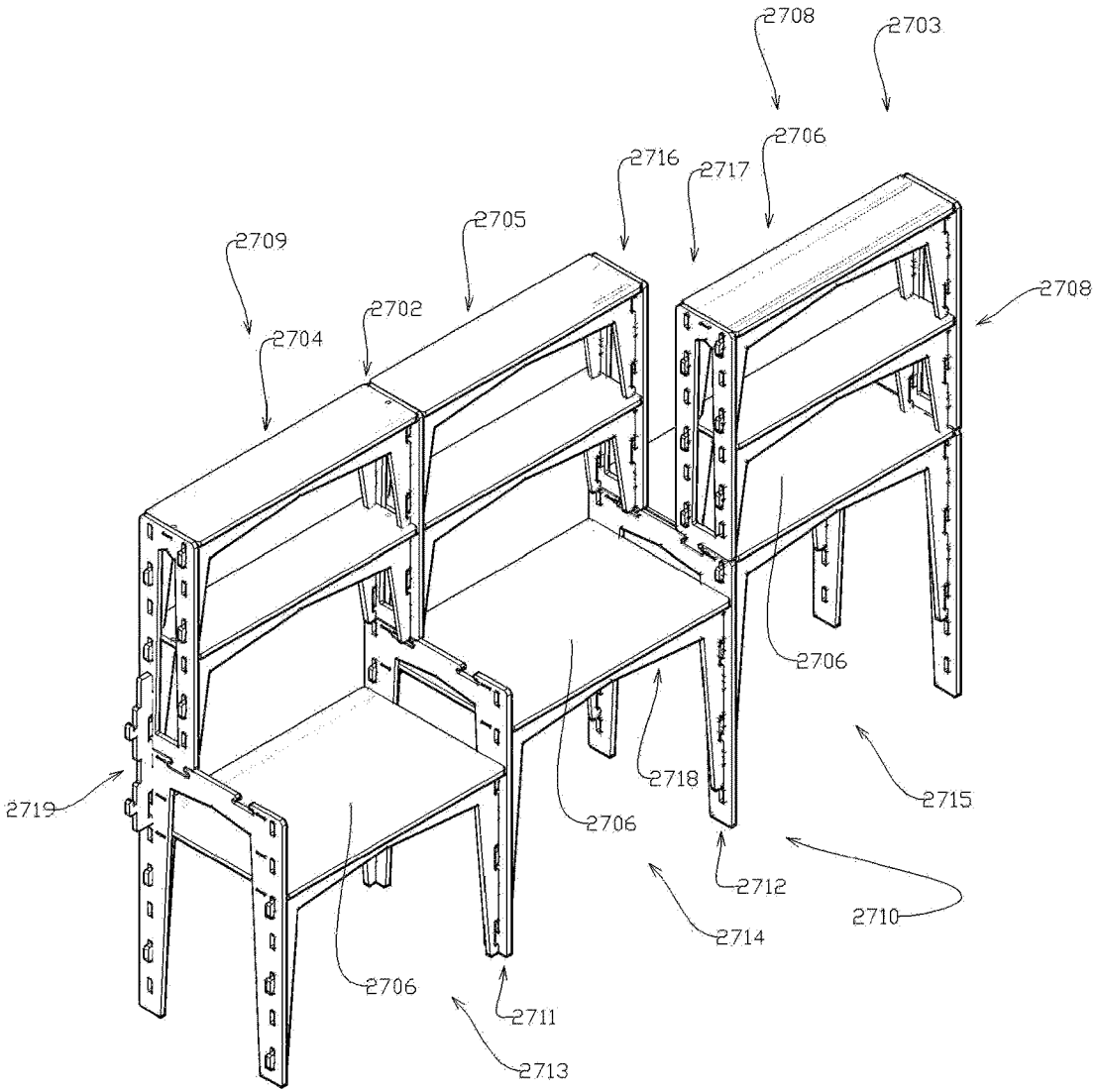
FIG. 27*a* is a perspective assembled view of several modular desk assemblies connected in a serpentine fashion.

FIG. 27*a* is a perspective assembled view of several modular desk assemblies connected in a serpentine fashion. Modular component assembly 2700 utilizes modular component 2719 to align the upper portion of the modular desk assembly 2707 with the lower portion. The first end of the modular desk assembly 2709 and the last end 2708 are connected together using modular components 2702, 2716, 2717. The top planar elements of the serpentine modular desk assembly are designated by 2704, 2705, and 2706. The lower modular horizontal planar element of the serpentine desk assembly is designated by 2706 and may be configured to be at different heights in the different modular desk assemblies that comprise the serpentine desk modular assembly. Spaces available under the modular serpentine desk assembly are designated by 2713, 2714, and 2715. The lower portion of the modular assembly component that cooperatively connects modular desk assembly 2704 and 2705 is designated by 2711 while the modular assembly component that cooperatively connects the lower portion of the modular desk assembly 2705 and 2706 is designated as 2712. The designation 2702 is a modular component assembly that connects the top portion of the 2704 modular desk assembly while 2703 is a similar modular assembly component that connects the upper portion of modular desk assembly 2706.

Figure 27B:
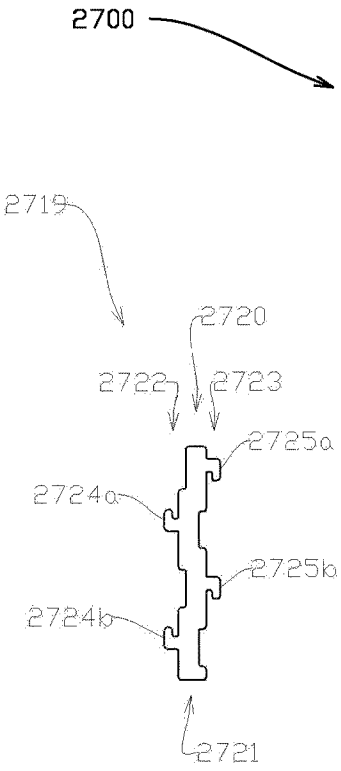
FIG. 27*b* is a side view of modular element 2719 from FIG. 27*a*.

FIG. 27*b* is a side view of modular element 2719 from FIG. 27*a*. This is an important modular assembly component in that the L-bend connectors are configured in both an upward facing and a downward facing directions so as to allow for further modular component connections. As an example, L-bend connectors 2725*a* and 2725*b* are in a downward facing direction while L-bend connectors 2724*a* and 2724*b* are in an upward facing direction. The upper end of modular assembly component 2719 is designated by 2720 while the lower end is designated by 2721. The different connecting sides of modular assembly component 2729, showing both the alternating and directional characteristics of the L-bend connectors is shown by designation 2722 and 2723.

Figure 27C:
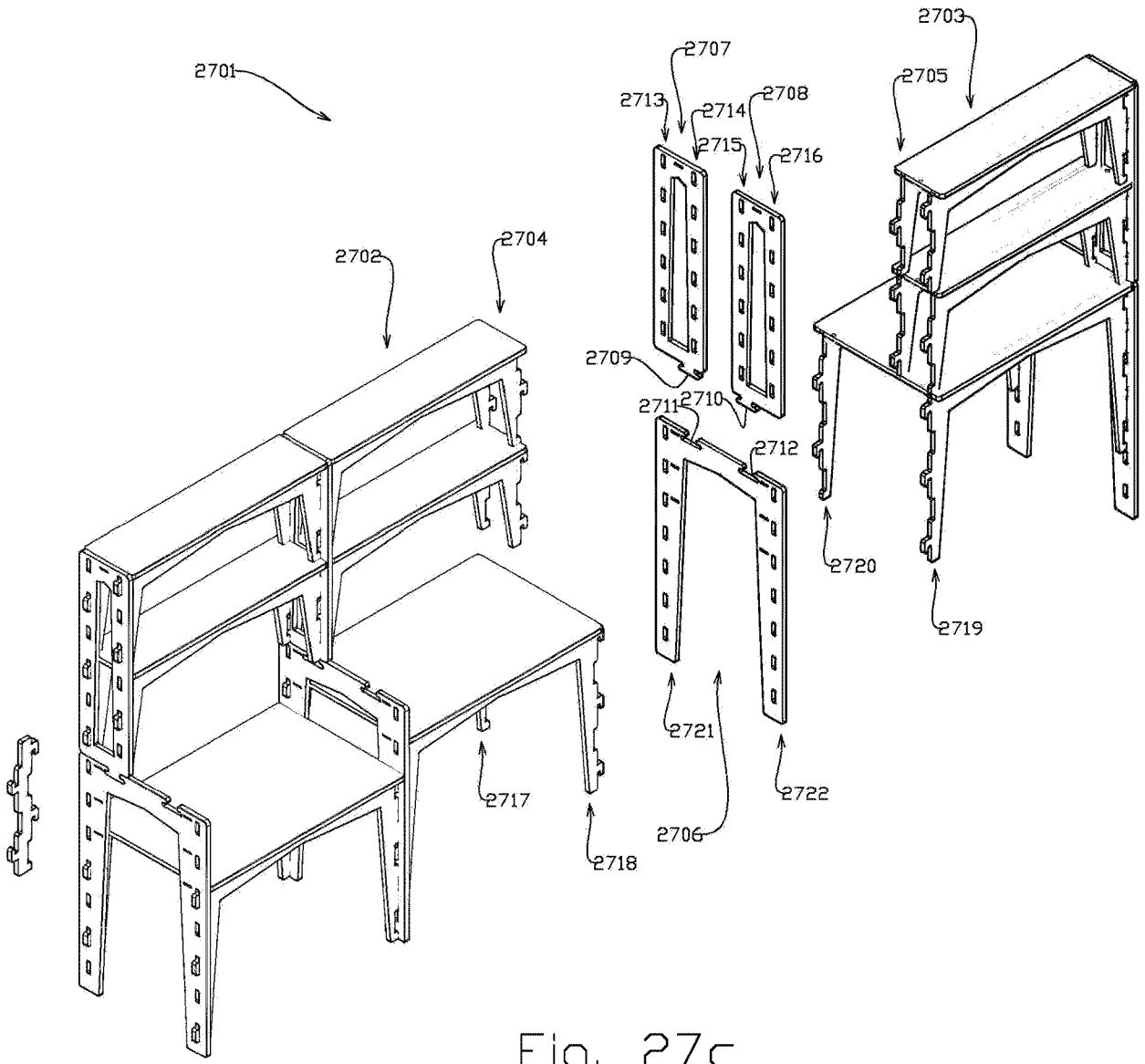
FIG. 27*c* is a semi-exploded perspective view of a group of modular desk assemblies.

FIG. 27*c* is a semi-exploded perspective view of a group of modular desk assemblies in a serpentine configuration. Here, modular assembly component 2706 is configured to cooperatively connect the lower sections of the modular serpentine desk assembly while modular assembly components 2707 and 2708 are configured to cooperatively connect the upper sections of the modular serpentine desk assembly. The lower edge of the desk assemblies and the 2706 modular assembly component are designated by 2717, 2718, 2721, 2722, 2720, and 2719. The T-connectors 2709 and 2710 are cooperatively connected to connection slots 2711 and 2712 respectively, locking the upper modular components with the lower modular components. The columns of connecting slots 2713 and 2714 of modular component 2707 along with the columns of connecting slots 2715 and 2716 of modular component 2708 are configured to cooperatively connect with the L-bend connectors on the upper portion of the modular serpentine desk assembly 2702 and 2703 where columns of L-bend connectors 2704 and 2705 respectively accomplish the cooperative connection with the connecting slots.

Figures 28A, 28B, 28C:
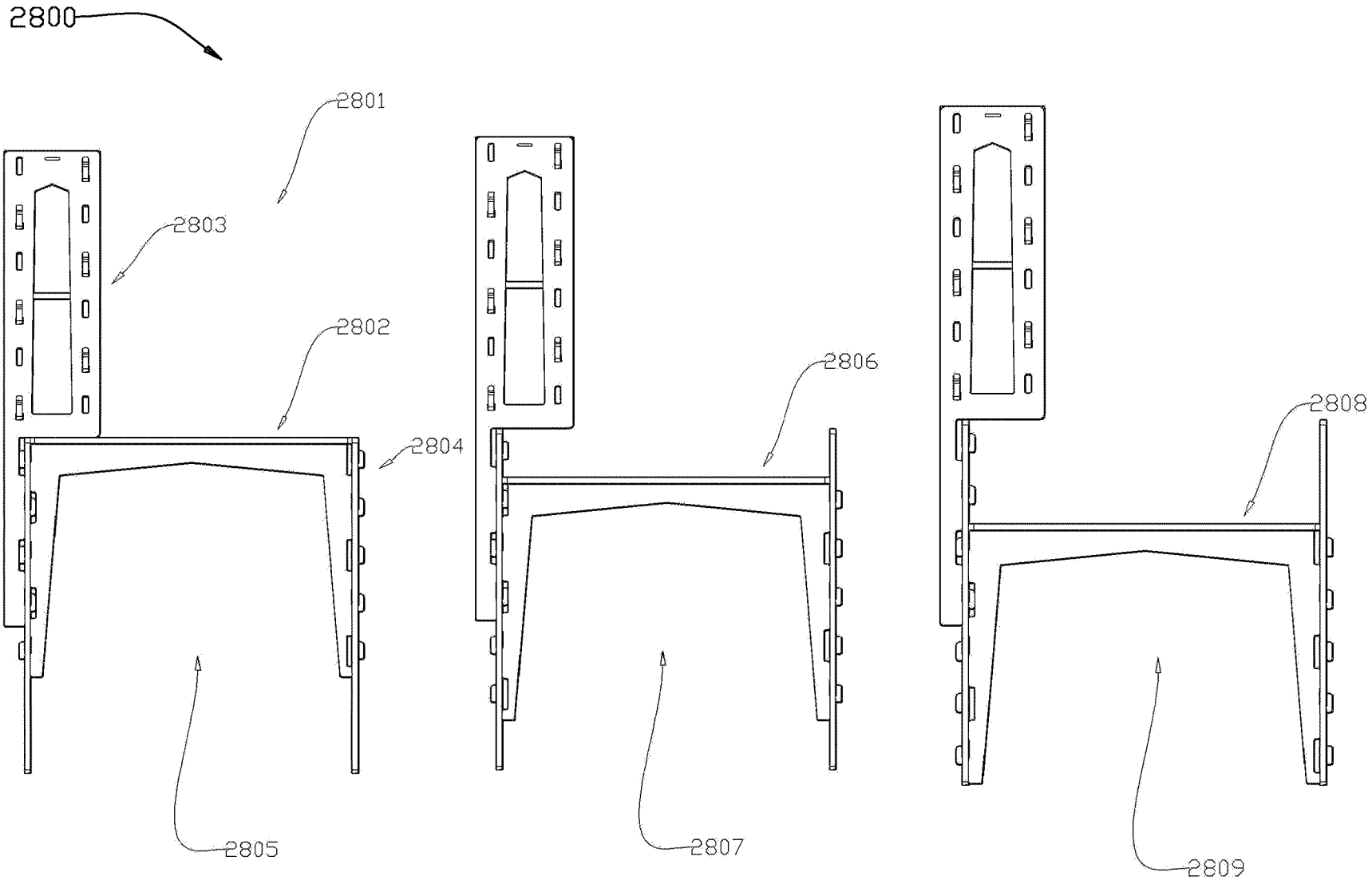
FIG. 28*a* is a side view of a modular desk assembly with a modular planar element at a first elevation.
FIG. 28*b* is a side view of a modular desk assembly with a modular planar element at a second elevation.
FIG. 28*c* is a side view of a modular desk assembly with a modular planar element at a third elevation.

FIG. 28*a* is a side view of a modular desk assembly with a modular horizontal planar element at a first elevation. The modular horizontal planar element 2802 is incorporated into modular assembly 2801 through cooperative connection with modular components 2803 and 2804 utilizing L-bend connectors and connecting slots and is laid on the upper linear edge of the modular transverse component 2805. Modular component 2803, also designated as a side mounted hutch, is configured to cooperatively connect with other modular components regardless of the height where modular horizontal planar element 2802 is set.

FIG. 28*b* is a side view of a modular desk assembly with a modular horizontal planar element at a second elevation. Here modular horizontal planar element 2806 may be adjusted in height by moving modular transverse component 2807 lower by engaging the L-bend connectors in the lower connecting slots. In a similar fashion to FIG. 28*a*, modular component 2803, also designated as a side mounted hutch, is configured to cooperatively connect with other modular components regardless of the height where modular horizontal planar element 2806 is set.

FIG. 28*c* is a side view of a modular desk assembly with a modular horizontal planar element at a third elevation. Here modular horizontal planar element 2808 is moved yet lower in the modular assembly by moving modular transverse component 2809 yet further lower in a cooperative connection of the L-bend connectors and connecting slots. In a similar fashion to FIG. 28*a*, modular component 2803, also designated as a side mounted hutch, is configured to cooperatively connect with other modular components regardless of the height where modular horizontal planar element 2808 is set.

Figure 29:
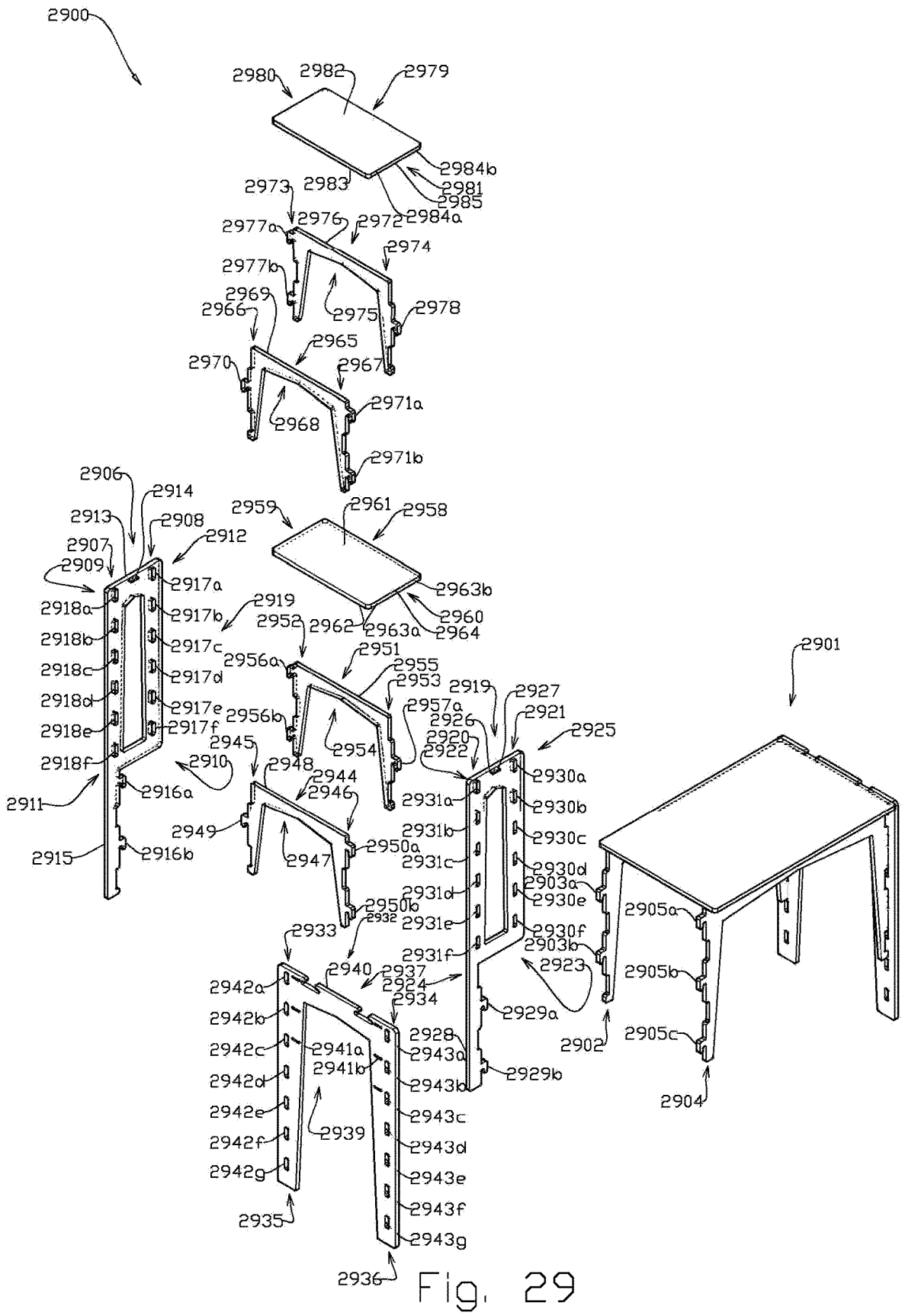
FIG. 29 is an exploded view of a modular desk assembly.

FIG. 29 is an exploded view of a modular desk assembly. The modular desk assembly 2900 connects modular components 2906 and 2919 to modular component 2932 by cooperatively connecting L-bend connectors 2916*a-b* of 2906 and 2929*a-b* of 2919 with connecting slots 2942*a-g* in column 2933 and 2943*a-g* in column 2934 respectively. Connecting slots 2918*a-f* of column 2907 and connecting slots 2917*a-f* of column 2908 in modular component assembly 2906 are configured to cooperatively connect with L-bend connectors so as to extend the modularity of modular component assembly 2900. In a similar fashion, modular component 2932 is configured to cooperatively connect with modular assembly 2901 utilizing L-bend connectors 2903*a-b* and 2905*a-c* to cooperatively connect with connecting slots 2942*a-g* and 2943*a-g* respectively. The column of L bend connectors 2903*a-b* and 2905*a-c* are configured with the lower portion 2902 and 2904. It is a critical aspect of the modular assembly that the L-bend connectors of modular component 2906 and 2919 alternate in the connecting slots 2942*a-g* and 2943*a-g* so that the L-bend connectors 2903*a-b* and 2905*a-c* may connect on the opposite side of modular component 2932. Modular components 2951 and 2944 are configured to cooperatively connect with modular component 2919 and 2906 utilizing L-bend connectors and connecting slots. The L-bend connectors 2957*a* and 2950*a-b* are configured to cooperatively connect with connecting slot column 2921 and 2920 respectively. In a similar fashion L-bend connectors 2949 and 2956*a-b* are configured to cooperatively connect with connecting slot column 2907 and 2908 respectively. These connections are made on the inside of 2906 designated by 2910 and the inside of 2919 designated by 2922. Further, planar element 2958, which is configured with an upper surface 2961 and a lower surface 2962, is configured to cooperatively connect with modular components 2951 and 2944 where the edges of 2951 designated by 2952 and 2953 are separated by transverse section 2954 as modular component 2944 has a transverse section 2947 that separates edges 2946 and 2945. The channels 2963*b* and 2963*a* are configured to cooperatively connect with the linear surfaces 2955 and 2948 of modular components 2951 and 2944 respectively. Modular horizontal planar element 2979 is configured to have an upper surface 2982 and a lower surface 2983 where the lower surface 2983 is configured to cooperatively connect with linear surface 2976 and 2969 of modular components 2972 and 2965 respectively. Locking cam elements 2985 and 2980 are configured to cooperatively connect with available connecting slots utilizing interference fit connections. The transverse section 2968 and 2975 of modular components 2965 and 2972 respectively separate two ends of the modular component 2966 and 2967 for modular component 2965 and ends 2973 and 2974 on modular component 2972. L bend connectors 2977*a-b*, 2970, 2978, and 2971*a-b* are configured to cooperatively connect with connecting slots so as to incorporate the modular components into a modular assembly.

Figures 30A, 30B:
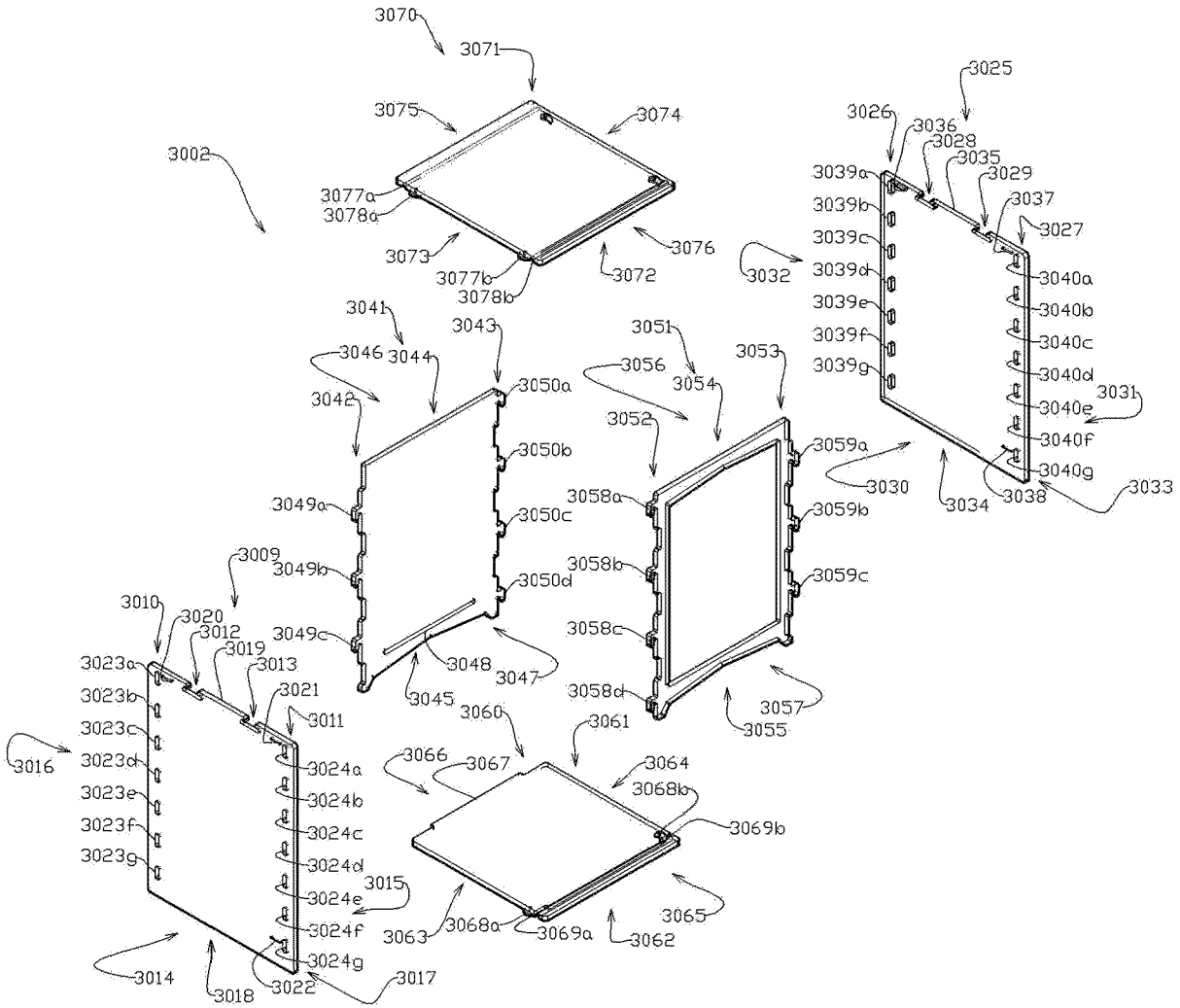
FIG. 30*a* is a perspective view of assembled modular storage assembly.
FIG. 30*b* is an exploded view of a modular storage assembly.

FIG. 30*a* is a perspective view of assembled modular storage assembly. The modular assembly 3001 is configured to have a top 3003, a side 3005 and opposite side 3006, the bottom portion 3008, an underneath space 3004, and a back portion 3007.

FIG. 30*b* is an exploded view of a modular storage assembly. Here, connecting slots 3024*a-g* in column 3011 and connecting slots 3023*a-g* in column 3010 of modular component 3009 are configured to cooperatively connect with L-bend connectors 3049*a-c* in column 3042 of modular component 3041 and L-bend connectors 3058*a-d* of column 3052 of modular component 3051, respectively. In a similar fashion, connecting slots 3039*a-g* in column 3026 of modular component 3025 and connecting slots 3040*a-g* in column 3027 of modular component 3025 are configured to cooperatively connect with L-bend connectors 3050*a-d* in column 3043 of modular component 3041 and L-bend connectors 3059*a-c* of column 3053 in modular component 3051, respectively. Modular component 3060 is configured to cooperatively connect with modular component 3041 utilizing 3067 and connecting slot 3048. Locking cams 3068*a* and 3068*b* are configured to form an interference fit with connecting slots 3038 and 3022. The modular component 3060 is configured to have a back portion 3066, a right side 3064, a front portion 3065 a top portion 3061 and a bottom portion 3062. channel 3069*a* and 3069*b* is configured to engage onto column 3052 and 3053 of component 3051 above the transverse portion 3055. Modular horizontal planar element 3070 is configured to cooperatively connect with the linear surface of modular component 3041 designated as linear surface 3044 and the linear surface of modular component 3051 designated as linear surface 3054. The channels 3077*a* and 3078*b* cooperatively connect with the linear surface 3044 and 3054 respectively. Modular horizontal planar element 3070 is further configured to cooperatively connect with modular elements 3009 and 3025 utilizing connecting slots 3020 and 3021 forming an interference fit with locking cam 3078*a* and locking cam 3077*b* respectively. In a similar fashion, connecting slots 3036 and 3037 form an interference fit with locking cams along the edge 3074 of modular horizontal planar element 3070.

Figure 31A:
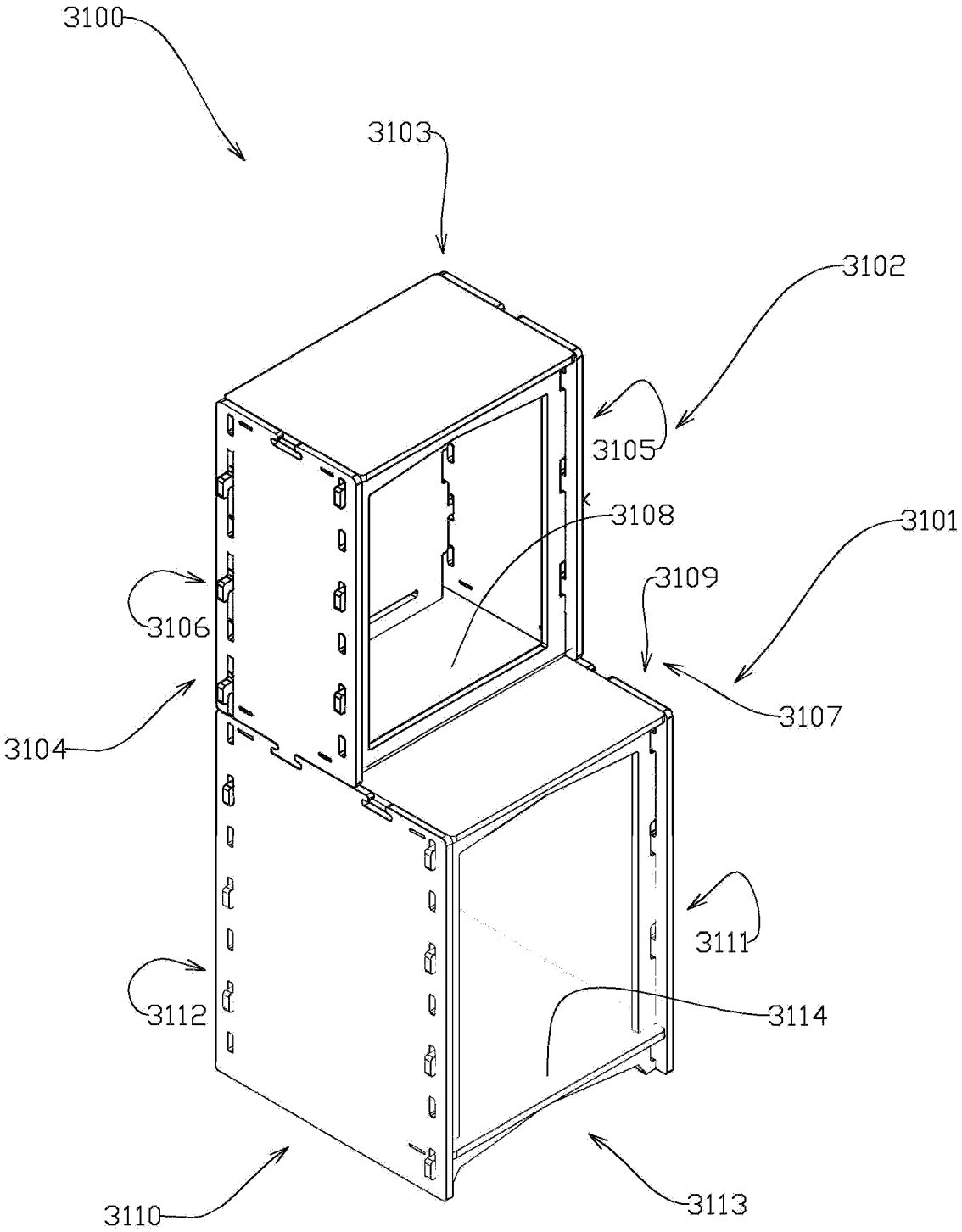
FIG. 31*a* is a perspective view of assembled and stacked modular storage assemblies.

FIG. 31*a* is a perspective view of assembled and stacked modular storage assemblies. The stacked modular storage units 3100 comprised of two major subsystems, the lower modular storage assembly 3101 and the upper modular storage assembly 3102. Modular storage assembly 3101 is configured with a backside modular component 3112, a front side modular component 3113, a left side modular component 3110, and a right side modular component 3111, an upper modular component 3109, and a floor modular component in the lower modular storage assembly designated as 3114. The upper modular storage assembly is configured with backside modular component 3106, left side modular component 3104 right side modular component 3105 an upper modular component 3103 and the lower modular component or floor 3108. All of the modular components for both the upper modular storage assembly 3102 and the lower modular storage assembly 3101 are configured to cooperatively connect with each other utilizing L-bend connectors and connection slots.

Figure 31B:
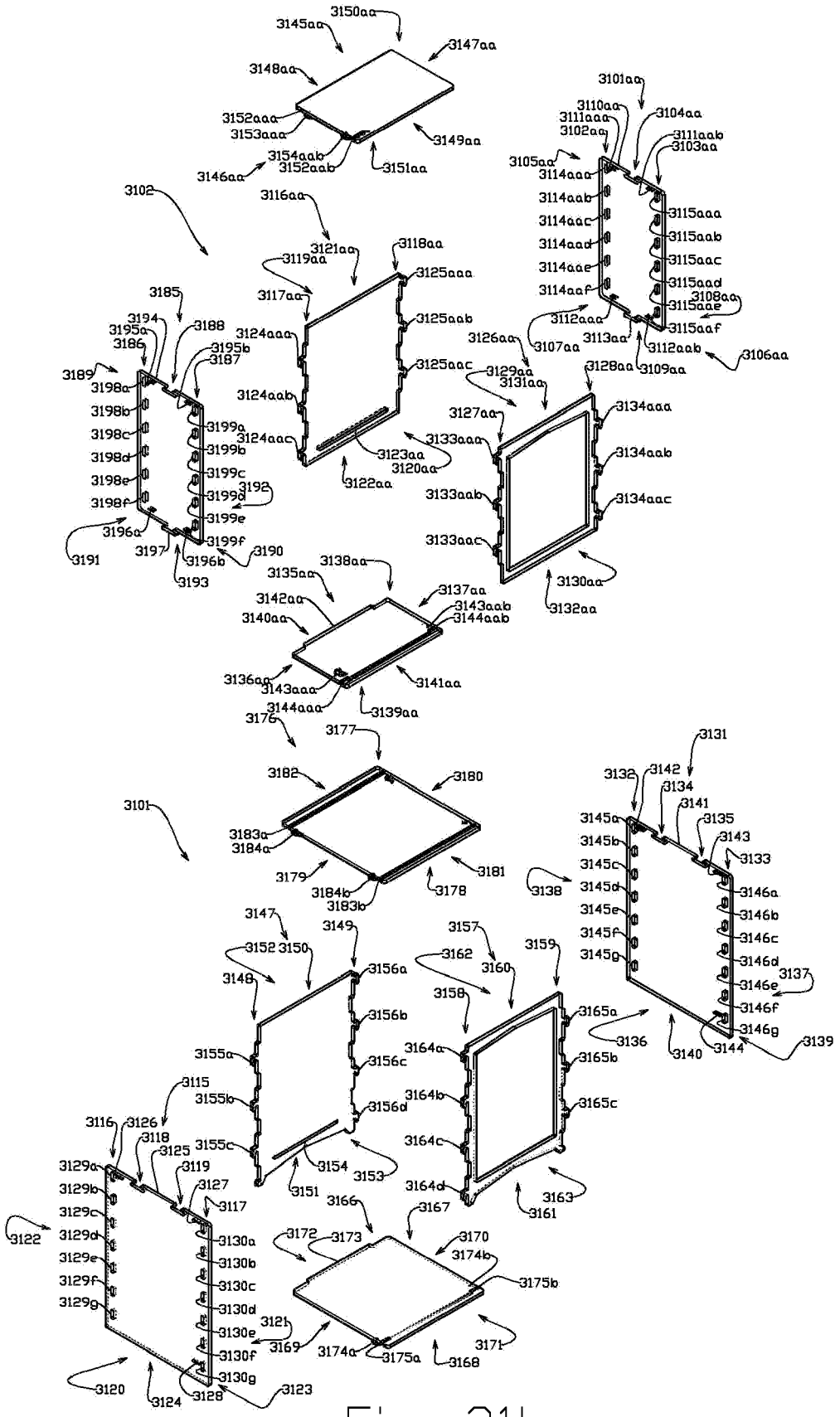
FIG. 31*b* is an exploded view of FIG. 31*a* stacked modular storage assemblies.

FIG. 31*b* is an exploded view of FIG. 31*a* stacked modular storage assemblies. The lower modular storage assembly 3101 is comprised of a left side 3115 and the right side 3131 where connecting slots 3129*a-g* in column 3116 and connecting slots 3130*a-g* in column 3117 of modular component 3115 cooperatively connect with modular component 3147 utilizing L bend connectors 3155*a-c* in column 3148 and L-bend connectors 3164*a-d* in column 3158. In a similar fashion, modular component 3131 is configured with connecting slots 3145*a-g* in column 3132 and connecting slots 3146*a-g* in column 3133 to cooperatively connect with L-bend connectors 3156*a-d* in column 3149 and L-bend connectors 3165*a-c* in column 3159 respectively. The lower modular storage assembly 3101 further has a floor modular component 3166 that cooperatively connects with the lower portions of 3115, 3147, 3131, and 3157. Linear edge 3169 is locked in place utilizing locking cam 3174*a* and connecting slot 3128 to form an interference fit. The front edges of 3115 and 313 are designated by 3123 and 3139 respectively. Modular component 3131 and is locked in place utilizing locking cam 3174*b* and connecting slot 3144 to form an interference fit. The rear linear edge of modular component 3166 is configured with tab 3173 that cooperatively connects with connecting slot 3154. The front edge of modular component 3166 cooperatively connects with the inner edges of columns 3158 and 3159 of modular component 3157 utilizing connecting slots 3175*a* on the left and 3175*b* on the right. The upper portion of lower modular storage assembly 3101 is designated as 3176 which engages with the linear edge 3150 of modular component 3147 and the linear edge 3160 of modular component 3157 utilizing channel 3183*a* and channel 3183*b* respectively. Modular component 3176 is configured to be locked in place utilizing locking cams 3184*a* and 3184*b* and connecting slots 3126 and 3127 respectively. In a similar fashion, edge 3180 of modular component 3176 is configured to be cooperatively connected to the top edge 3141 of modular component 3131 utilizing locking cams and connecting slots to form an interference fit. The upper modular storage assembly 3102 consists of a left side modular component 3185, a right side modular component 3101*aa*, a back modular component 3116*aa*, a front modular component 3126*aa*, a top modular component 3145*aa*, and a lower modular component 3135*aa*. Modular component 3185 is cooperatively connected to modular components 3116*aa* and 3126*aa* utilizing L-bend connectors and connecting slots. Connecting slots 3198*a-f* in column 3186 and connecting slots 3199*a-f* in column 3187 cooperatively connect with L-bend connectors 3124*aaa-aac* in column 3117*aa* and L-bend connectors 3133*aaa-aac* in column 3127*aa* respectively. In a similar fashion, connecting slots 3114*aaa-aaf* in column 3102*aa* and connecting slots 3115*aaa-aaf* in column 3103*aa* cooperatively connect with L-bend connectors 3125*aaa-aac* in column 3118*aa* and L-bend connectors 3134*aaa-aac* in column 3128*aa* respectively. Modular component 3145*aa* cooperatively connects with modular component 3185 utilizing locking cams 3153*aaa* and 3154*aab* cooperatively connecting with connecting slot 3195*a* and 3195*b* respectively. In a similar fashion, linear edge 3147*aa* cooperatively connects with modular component 3101*aa* utilizing locking cams and connecting slots 3111*aaa* and 3111*aab* to form an interference fit. Modular component 3145*aa* is configured with a back linear edge 3148*aaa*, a left linear edge 3146*aa*, a front linear edge 3149*aa* and a right linear edge 3147*aa*. Connecting slot 3188 in modular component 3185 and connecting slot 3104*aa* in modular component 3101*aa* allow for further modular connections to be made to the upper modular storage assembly 3102. The lower modular component or floor or 3135*aa* of modular assembly 3102 is cooperatively connected to 3185 and 3101*aa* utilizing connecting slot 3196*b* and locking cam 3143*aaa* and connecting slot 3112*aab* and locking cam 3143*aab* to form an interference fit. Connecting slots 3144*aaa* and 3144*aab* cooperatively connect with the inner edges of columns 3127*aa* and 3128*aa* of modular component 3126*aa*. The rear edge 3140*aa* of modular component 3135*aa* is configured with a tab 3142*aa* that cooperatively connects with slot 3123*aa* in modular component 3116*aa*. To complete the attachment to the lower modular storage assembly 3101, T connectors 3197 and 3113*aa* cooperatively connect with slots 3118 and 3134 respectively in one configuration or connecting slots 3119 and 3135 respectively in another configuration.

Figure 32B:
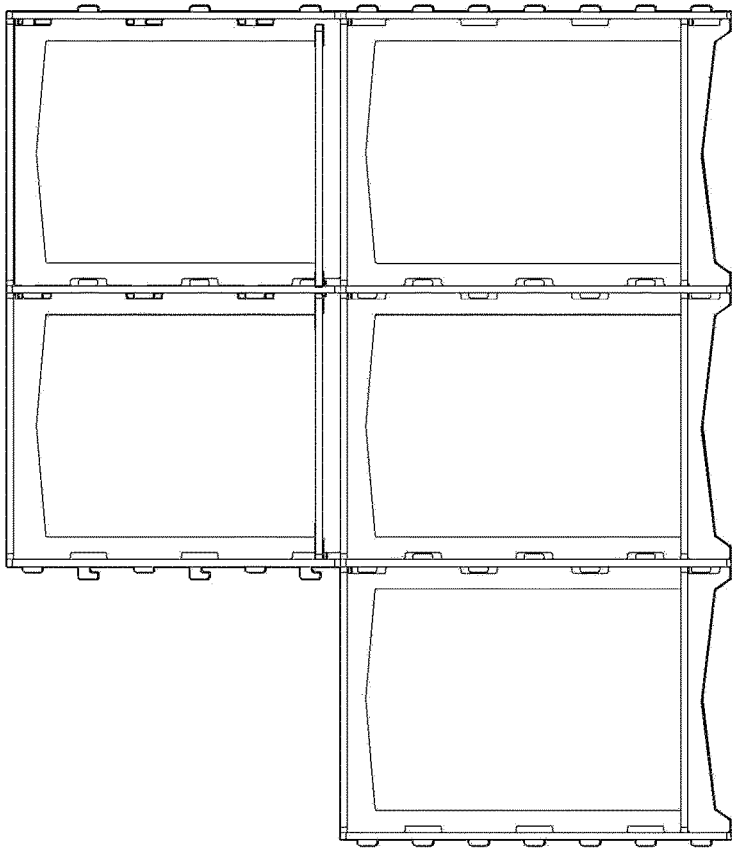
FIG. 32*b* is a front view of multiple stacked and extended modular storage assemblies.
Figure 32A:
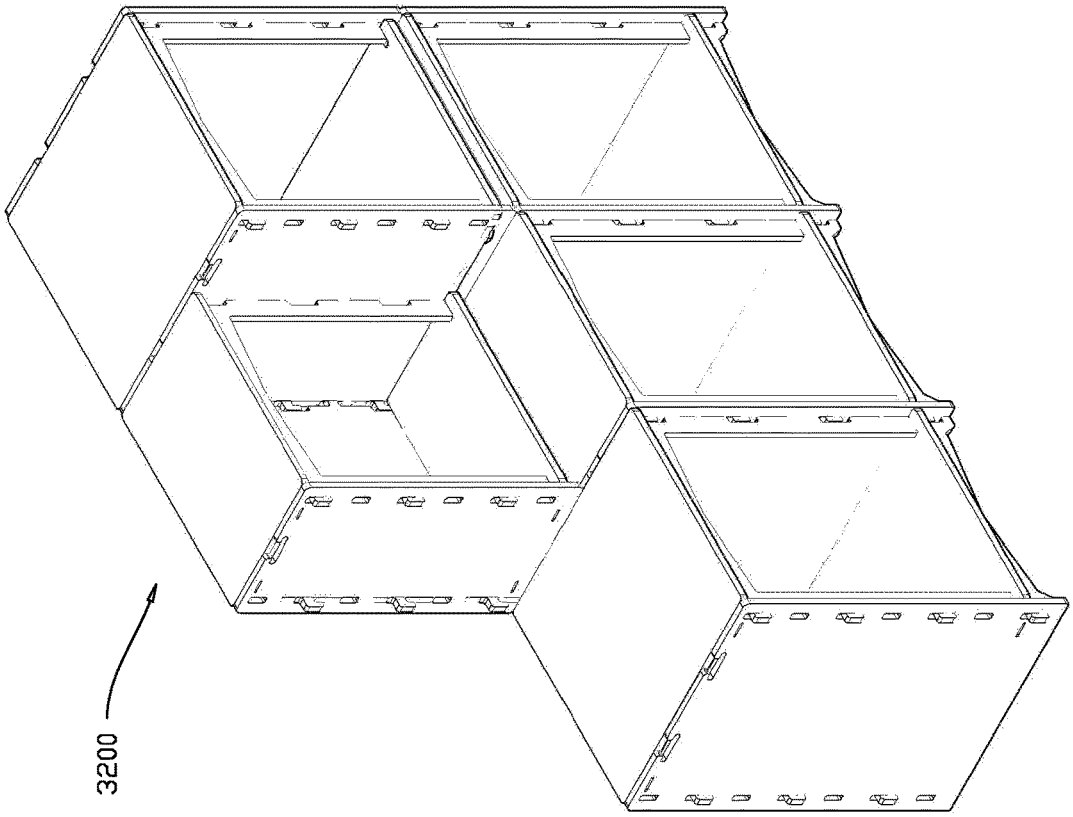
FIG. 32*a* is a perspective view of multiple stacked and extended modular storage assemblies.

FIG. 32*a* is a perspective view of multiple stacked and extended modular storage assemblies represented by modular assembly 3200.

FIG. 32*b* is a front view of multiple stacked and extended modular storage assemblies.

Figure 33B:
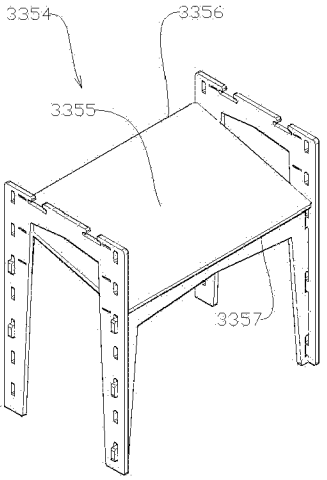
FIG. 33*b* is a perspective view of a modular inclined table assembly.
Figure 33C:
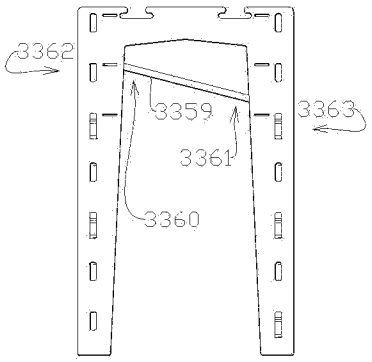
FIG. 33*c* is a side view of a modular inclined table assembly.
Figure 33A:
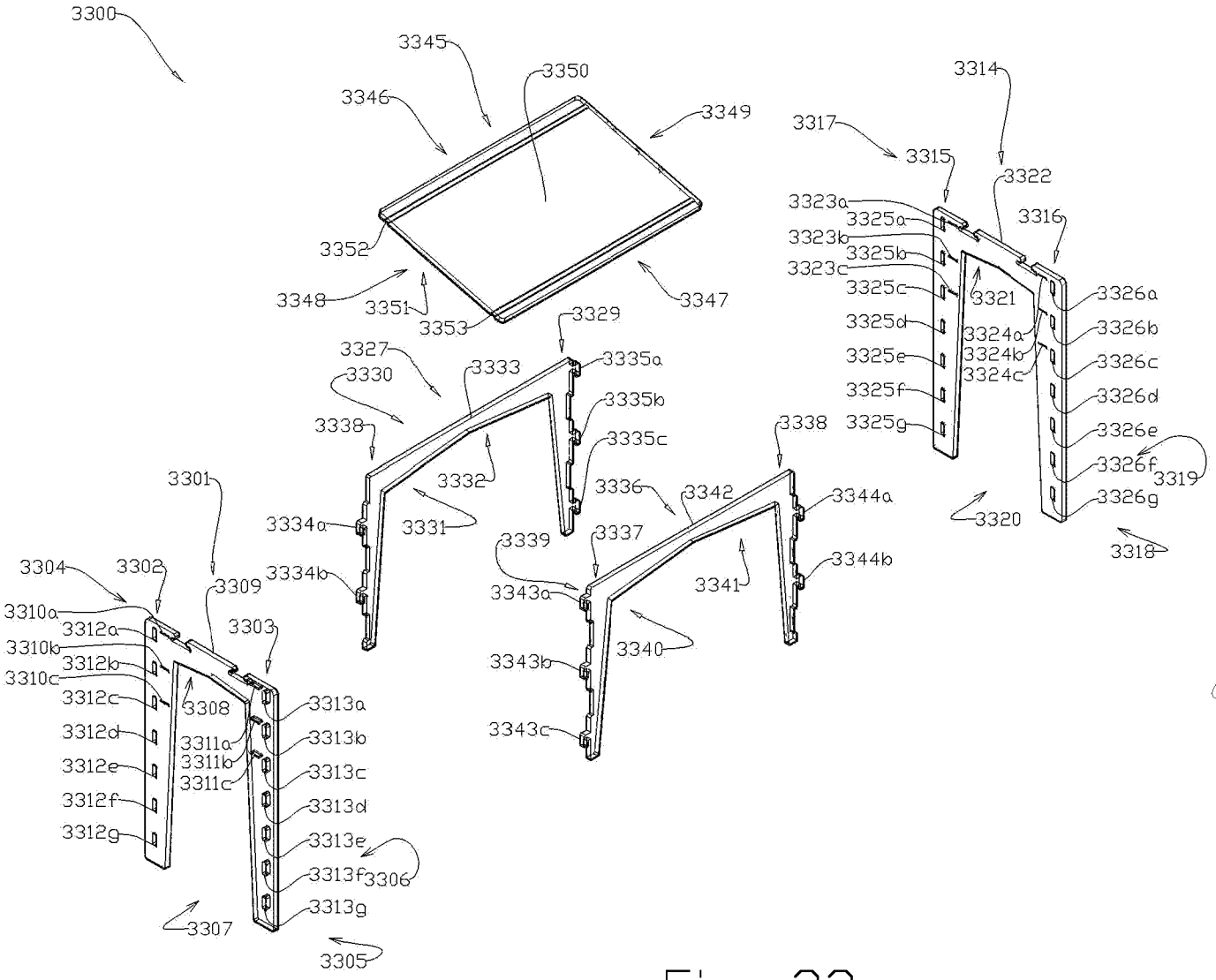
FIG. 33*a* is an exploded view of a modular inclined table assembly.

FIG. 33*a* is an exploded view of a modular inclined table assembly. Here, modular component 3301 is cooperatively connected to transverse modular components 3327 and 3336 through the use of L-bend connectors and connecting slots. Connecting slots 3312*a-g* in column 3302 and connecting slots 3313*a-g* in column 3303 cooperatively connect with L-bend connectors 3334*a-b* in column 3338 and 3343*a-c* in column 3337 respectively. In a similar fashion, connecting slots 3325*a-g* in column 3315 and connecting slots 3326*a-g* in column 3316 cooperatively connect with L-bend connectors 3335*a-c* in column 3329 and L-bend connectors 3344*a-b* in column 3338 respectively. From the perspective of the front edge 3347 of modular horizontal planar element 3345, modular component 3301 has a left side and right side designated by 3307 and 3306 respectively and a back edge 3304 and a front edge 3305. In a similar fashion, modular component 3314 is configured to have a right side 3319 and a left side 3320 and a back edge 3317 and a front edge 3318. Modular component 3301 has a linear top edge 3309 as does modular component 3314 designated by 3322. Connecting slots 3310*a-c* and connecting slots 3311*a-c* in modular component 3301 and connecting slots 3323*a-c* and connecting slots 3324*a-c* in modular component 3314 are configured to cooperatively connect with modular horizontal planar element 3345. Channels 3352 and 3353 are cooperatively connected with linear surface 3333 and 3342 respectively. Modular horizontal planar element 3345 is configured to have parallel planar edges 3348 and 3349 and an upper surface 3350 and a bottom surface 3351. A special aspect of modular assembly 3300 is that linear edge 3346 of modular component 3345 may be at different level than linear edge 3347 thus forming an inclined plane. The inclined plane is configured to be at any angle between positive 90° and −90° where the 0° is defined by the linear edge 3309 of modular component 3301 and the linear component 3322 as defined by modular component 3314.

FIG. 33*b* is a perspective view of a modular inclined table assembly. The modular assembly 3354 is comprised of a modular horizontal planar element 3355 where the front edge 3357 of the modular horizontal planar element 3355 is lower in height than the rear edge 3356 of the modular horizontal planar element 3355 thus forming an inclined plane that is incorporated into a modular assembly.

FIG. 33*c* is a side view of a modular inclined table assembly. Here, modular assembly 3358 is configured to have a back 3362 and a front 3363 where the modular horizontal planar element 3359 is inclined in a downward fashion from the back edge 3360 to the front edge 3361 such that the front edge 3361 of the modular horizontal planar element 3359 is lower than the rear edge 3360.

Figure 34:
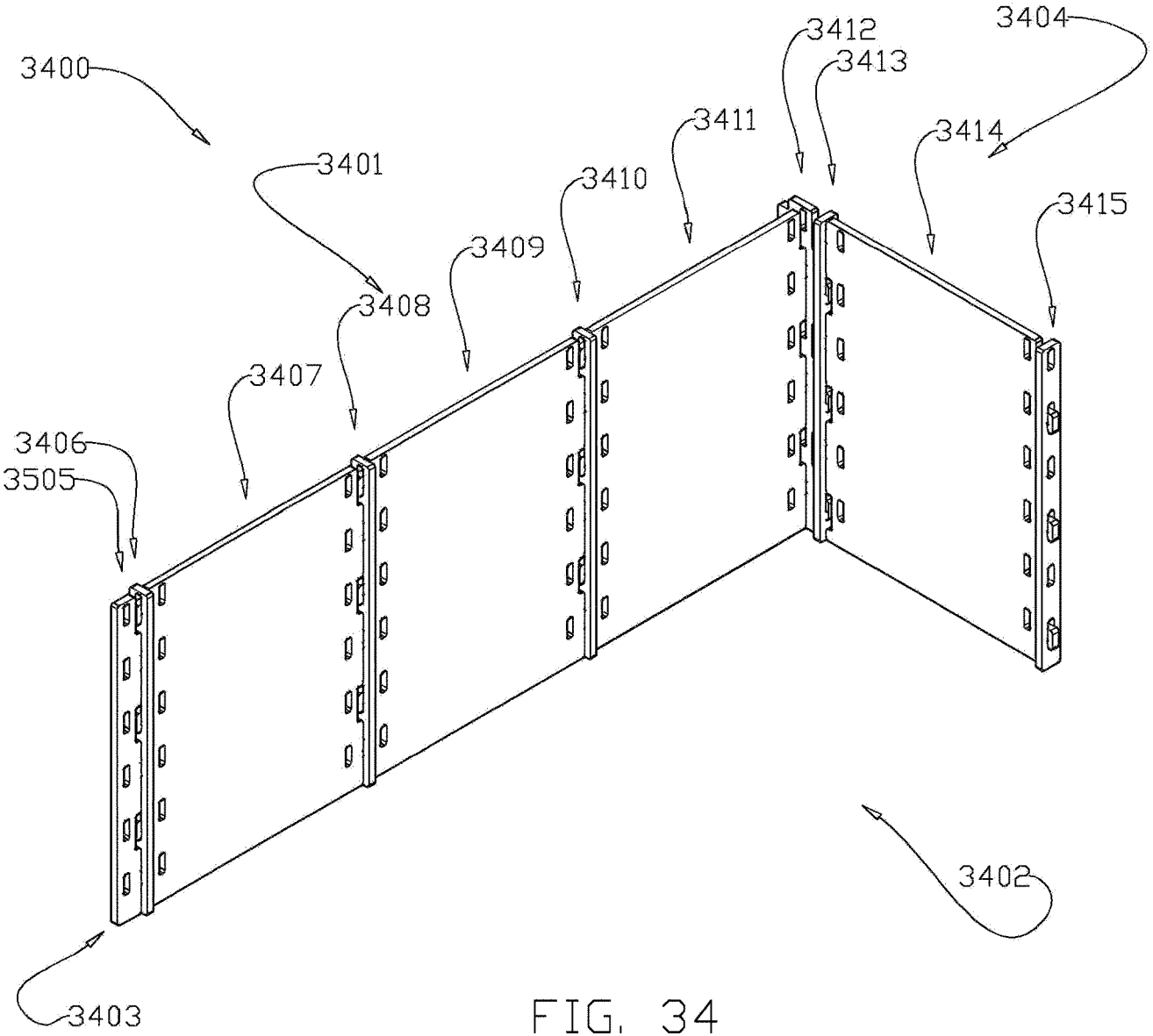
FIG. 34 is a perspective view of an extended modular panel assemblies.

FIG. 34 is a perspective view of an extended modular panel assemblies. Modular assembly 3400 is comprised of three modular panel components 3407, 3409, 3411 that are arranged in a straight linear fashion and are cooperatively connected to each other utilizing modular component 3408, and 3410 utilizing L-bend connectors and connecting slots. Modular component panel 3414 is arranged at an angle to the linear arrangement of modular component panels 3407, 3409, and 3411. Modular component panel 3414 is cooperatively connected to the other three panels through the configuration of L-bend connectors and connecting slots. The modular assembly 3400 is configured to have a backside 3401, a front side, 3402 a left side 3403 and the right side 3404. Thus, panel 3414 is cooperatively attached to modular component 3413 which is subsequently cooperatively connected to modular component 3412 which is subsequently connected to modular component panel 3411 through the use of L-bend connectors and connecting slots. In a similar fashion, modular component 3415 is cooperatively connected to modular component panel 3414 and is configured to allow for further modular component connections through the available connecting slots. Modular component 3505 is cooperatively connected to modular component 3406 which is subsequently cooperatively connected to modular component panel 3407. In a similar fashion to modular component 3415, modular component 3505 allows for further expansion of the modular assembly through the attachment of modular components utilizing the available connecting slots arranged in modular component 3505.

Figure 35:
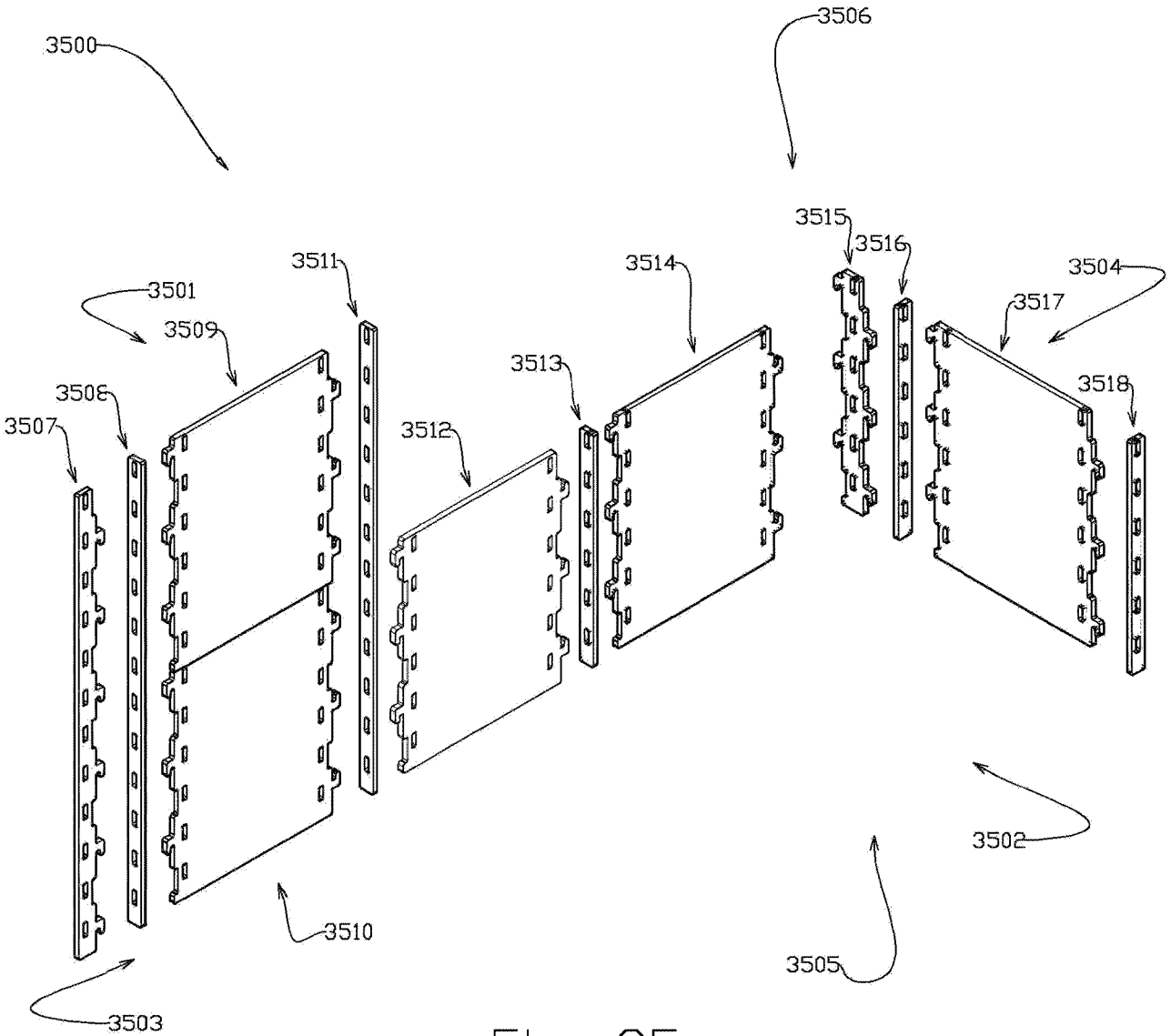
FIG. 35 is a perspective and semi-exploded view of a stacked and extended modular panel assemblies.

FIG. 35 is a perspective and semi-exploded view of a stacked and extended modular panel assemblies. The modular assembly 3500 is comprised of several modular component panels in different orientations. Modular component panel 3509 is stacked on top of modular component panel 3510 and is cooperatively connected to modular component 3508 on the left side 3503 and 3511 on the right side 3504. Modular component 3507 is cooperatively connected to modular component 3508 utilizing L-bend connectors and connecting slots. This cooperative connection scheme allows for modular component panels 3509 and 3510 to be cooperatively connected and stacked in a stable configuration. In a similar fashion, modular component panel 3512 is cooperatively connected to modular component 3511 on the left side 3503 and also configured to be connected to modular component 3513 which is configured to be cooperatively connected to modular component panel 3514 which is configured to be cooperatively connected to modular component 3515 which is configured to be cooperatively connected to modular component 3516. Modular component 3516 is configured to be cooperatively connected to modular component panel 3517 which is configured to be cooperatively connected to modular component 3518. The cooperative connection of the various modular components is accomplished through the use of L-bend connectors and connecting slots where the L-bend connectors are configured in an upward or downward configuration and alternate in an odd and even fashion connection to connecting slots on either side of a connecting slot column. The modular assembly of modular component panels is configured to have a backside 3501, a front side 3502 a left side 3503 and the right side 3504 and a top side 3506 and a bottom side 3505. The bottom edge of the modular component panels 3510 rest on a level surface such as a floor.

Figure 36B:
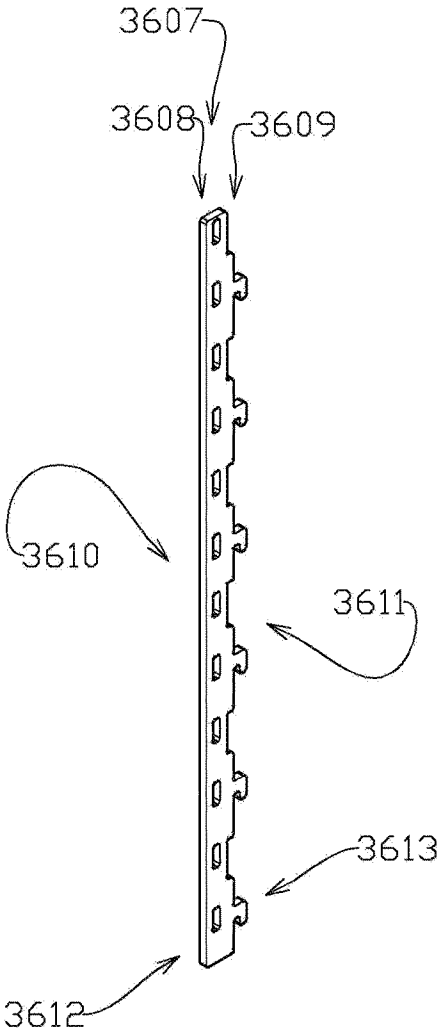
FIG. 36*b* is a modular component with L-bend connectors extending from one lateral edge of the modular component in the column of connecting slots running longitudinally in the central column of the modular component.
Figure 36A:
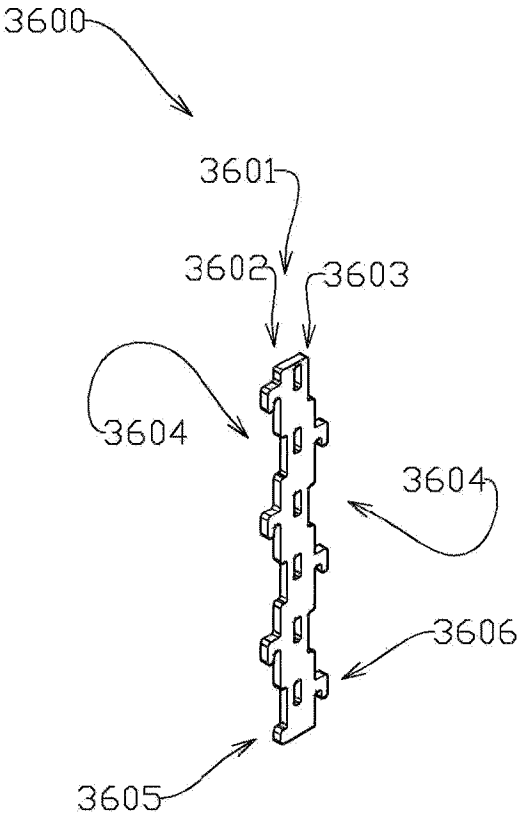
FIG. 36*a* is a modular component with L-bend connectors alternating on opposite sides and connecting slots in the central column in the central column of the modular component.

FIG. 36*a* is a modular component with L-bend connectors alternating on opposite sides and connecting slots in the central column of the modular component. The modular component 3600 is configured to have a central column of connecting slots 3601, a flat side 3604, a left edge 3605 and the right edge 3606. The L-bend connectors in column 3602 are configured to alternate in a height relationship to the L-bend connectors in column 3603 so as to connect with connecting slots at different heights.

FIG. 36*b* is a modular component with L-bend connectors extending from one lateral edge of the modular component in the column of connecting slots running longitudinally in the modular component. The modular component depicted is configured to have a column of connecting slots 3607, a straight column with no connections 3608, and a column of L-bend connectors 3609. The modular component is configured to have backside 3610, front side 3611, a left side 3612, and a right side 3613.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known processes, structures, and techniques have been shown without unnecessary detail to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

Also, configurations may be described as a process that is depicted as a flow diagram or block diagram. Although each may describe the operations as a sequential process, many of the operations can be performed in parallel or concurrently. In addition, the order of the operations may be rearranged. A process may have additional stages or functions not included in the figure.

Having described several example configurations, various modifications, alternative constructions, and equivalents may be used without departing from the spirit of the disclosure. For example, the above elements may be components of a larger system, wherein other structures or processes may take precedence over or otherwise modify the application of the invention. Also, a number of operations may be undertaken before, during, or after the above elements are considered. Accordingly, the above description does not bound the scope of the claims.

A statement that a value exceeds (or is more than) a first threshold value is equivalent to a statement that the value meets or exceeds a second threshold value that is slightly greater than the first threshold value, e.g., the second threshold value being one value higher than the first threshold value in the resolution of a relevant system. A statement that a value is less than (or is within) a first threshold value is equivalent to a statement that the value is less than or equal to a second threshold value that is slightly lower than the first threshold value, e.g., the second threshold value being one value lower than the first threshold value in the resolution of the relevant system.

What is claimed is:

1. A modular frame assembly, comprising:

a first and second lateral frame member each including a transverse portion with an upper edge and a first end and a second end, the first end and the second end of each lateral frame member including a flange portion extending from each end of the longitudinal axis of the first and second lateral frame members; and wherein the flange portion of the first end of the first and second lateral frame members alternate from the flange portion of the second end of the first and second lateral frame members; and a first and second side frame member each comprising a first end, a second end, and a cross panel extending therebetween; the first and second end including one or more receiving members; and wherein the one or more receiving members being sized and aligned to receive the flange portion to cooperatively connect the first end of the first lateral frame member and the first end of the first side frame member together, the second end of the second lateral frame member and the second end of the first side frame member together, the second end of the first lateral frame member and the first end of the second side frame member together, and the first end of the second lateral frame member and the second end of the second side frame member together; and where the flange non-deformably cooperatively connects with the one or more receiving members; and where the receiving members utilized by the first lateral frame member are in a different elevation from the receiving members utilized by the second lateral frame member; and where the non-utilized receiving members of the first and second side frame members are open to receive additional modular frame components; and where the modular frame assembly is configured to accept at least one modular horizontal planar member;

wherein the horizontal planar member has an upper surface and a lower surface, the lower surface of the horizontal planar member including one or a plurality of chambers to receive the upper edge of the transverse portion of the first and second lateral frame member; and where the modular frame assembly and the horizontal planar member are cooperatively connected utilizing at least one locking cam element; and where the at least one locking cam element has a curve configuration on the outer portion of the cam element; and where the at least one locking cam element with a curve configuration on the outer portion of the at least one locking cam element forms an interference fit between the modular frame assembly and the horizontal planar member; and at least two parallel edges of the horizontal planar member are entirely within the confines of the upper edge of the modular frame assembly.

2. The modular frame assembly of claim 1 where a number of frame members may be engaged and cooperatively connected for an expanded group of modular assemblies.

3. The modular frame assembly in claim 1 where plural modular frame assemblies are cooperatively connected in a serpentine configuration.

4. The modular frame assembly in claim 1 where the flange is comprised of at least one L-bend connector.

5. The modular frame assembly in claim 1 where the one or more receiving members are connecting slots that are cut through a modular frame member from one side to another side and are completely enclosed or partially enclosed.

6. The modular frame assembly in claim 1 where the modular frame assembly is configured to form a bed.

7. The modular frame assembly in claim 1 further comprising at least one modular outrigger assembly that is cooperatively connected to a modular component configured to form a modular frame assembly.

8. The modular frame assembly in claim 1 where the modular frame assembly is configured to form a storage unit.

9. The modular frame assembly in claim 1 where the modular frame assembly is configured to form walls, panels or partitions.

10. The modular frame assembly in claim 1 where the modular frame assembly is configured to form a desk.

11. The modular frame assembly in claim 1 further comprising at least two modular outrigger assemblies that are cooperatively connected to a modular component configured to form a modular frame assembly.

12. A modular frame assembly, comprising: a first lateral frame member including a first end and a second end, the first end and second end including a flange portion extending from each end of the longitudinal axis of the first lateral frame member; at least one side frame member including one or more receiving members; and wherein the one or more receiving members being sized and aligned to receive the flange portion to cooperatively connect the first lateral frame member and at least one side frame member together; and where the flange non-deformably cooperatively connects with the one or more receiving members; and where the first lateral frame member and at least one side frame member are cooperatively connected to at least one second lateral frame member through connecting slots in the first side frame member or at least one side frame member where the at least one second lateral frame member is configured to couple to the first lateral frame member or at least one side frame member utilizing connecting slots in the first side frame member or at least one side frame member where the connecting slots utilized by the at least one second lateral frame member are different from the connecting slots utilized by the first lateral frame member; where the modular frame assembly is configured to accept at least one modular horizontal planar element; and where the modular frame assembly and the horizontal planar element are cooperatively connected utilizing at least one locking cam element; and where the at least one locking cam element has a curve configuration on the outer portion of the cam element; and where the at least one locking cam element with a curve configuration on the outer portion of the at least one locking cam element forms an interference fit between the modular frame assembly and the horizontal planar element.

13. The at least one second lateral frame member in claim 12 where the at least one lateral frame member is configured in a different plane other than the first lateral frame member.

14. The at least one second lateral frame member in claim 12 where the at least one second frame member is configured to have a proximal end and a distal end; and where the proximal end is cooperatively coupled to the first lateral frame member utilizing the side frame member and where the distal end of the at least one second lateral frame member is cooperatively coupled to a second side frame member.

15. The horizontal planar element of claim 12 where at least two parallel edges of the horizontal planar surface are entirely within the confines of the upper edge of the modular frame assembly.

16. The horizontal planar element of claim 12 where one edge of the horizontal planar element is at a different elevation than a second horizontal planar element parallel edge.

17. A method of constructing a modular frame assembly, comprising: supplying at least one L-bend connector and at least one connecting slot; and where the at least one L-bend connector is moved first in a horizontal plane through the at least one connecting slot; and where the at least one L-bend connector is subsequently moved in a vertical plane to form a cooperative connection between two modular frame assembly components; where a first modular frame component with at least one L-bend connector is cooperatively connected on one side of a column of connecting slots incorporated into a second modular frame component; and where a third modular frame component with at least one L-bend connector is cooperatively connected to the opposite side of the second modular frame component; and where the first modular frame component is cooperatively connected to the second modular frame component utilizing alternating slots from the third modular frame connector.

* * * * *